US008435142B2

(12) United States Patent
Gibson

(10) Patent No.: US 8,435,142 B2
(45) Date of Patent: May 7, 2013

(54) METHOD FOR PLAYING A GAME AND BALL AND GOAL THEREFORE

(75) Inventor: William G. Gibson, Villanova, PA (US)

(73) Assignee: Kronum, LLC, Villanova, PA (US)

( * ) Notice: Subject to any disclaimer, the term of this patent is extended or adjusted under 35 U.S.C. 154(b) by 771 days.

(21) Appl. No.: 12/378,870

(22) Filed: Feb. 20, 2009

(65) Prior Publication Data

US 2009/0227398 A1 Sep. 10, 2009

Related U.S. Application Data

(60) Provisional application No. 61/066,672, filed on Feb. 21, 2008.

(51) Int. Cl.
*A63B 67/00* (2006.01)

(52) U.S. Cl.
USPC ..... 473/471; 473/478; 273/402

(58) Field of Classification Search ..... 273/398–402; 473/465, 470, 471, 476–478
See application file for complete search history.

(56) References Cited

U.S. PATENT DOCUMENTS

| | | | | |
|---|---|---|---|---|
| 175,172 | A | 3/1876 | Ryan | |
| 574,087 | A | 12/1896 | Frick | |
| 1,356,817 | A | 10/1920 | Gregory | |
| 1,549,848 | A | 8/1925 | Sexton | |
| 1,629,907 | A | 5/1927 | Dwyer | |
| 1,927,741 | A | 9/1933 | Herbert | |
| 2,051,476 | A * | 8/1936 | Grant | 273/342 |
| 2,126,102 | A | 8/1938 | Fowier | |
| 2,805,861 | A | 9/1957 | Lopas | |
| 2,771,294 | A | 11/1965 | Macchesney | |
| 3,415,522 | A * | 12/1968 | Bauer | 473/471 |
| 3,580,578 | A * | 5/1971 | McCarthy | 473/471 |
| 3,746,340 | A * | 7/1973 | Ellis | 473/471 |
| D232,369 | S | 8/1974 | Tolliver | |
| 4,168,066 | A | 9/1979 | Sole et al. | |

(Continued)

FOREIGN PATENT DOCUMENTS

| | | |
|---|---|---|
| DE | 43-31-713 A1 | 3/1995 |
| GB | 3025493 | 8/2006 |
| WO | WO-02-30525 A1 | 4/2002 |
| WO | WO-2005-074567 A2 | 8/2005 |

OTHER PUBLICATIONS

Gaelic Football, "Rules of the Game", Diagram Group, Paddington Press LTD, 1974, pp. 140, 141.*

(Continued)

*Primary Examiner* — Mark Graham
(74) *Attorney, Agent, or Firm* — Dilworth Paxson LLP

(57) ABSTRACT

Methods are provided for at least two teams to play a game with a ball on a playing surface having a plurality of zones and at least two goals. Zones have distinct rules for handling passing, receiving, and shooting of a ball during a game. A goal provides two distinctly defined types of scoring zones through which to score the ball from within a peripheral line of the playing surface. One type of scoring zone is at least one open ring shaped opening, and the other is an arced rectangularly shaped opening. The ball may be scored through either of the scoring zones. Points are awarded differently for scoring in either of the two zones and for throwing or kicking the ball through the two zones. Ball comprises at least two panels having arms attached along a contiguous seam.

18 Claims, 92 Drawing Sheets

U.S. PATENT DOCUMENTS

| | | | | |
|---|---|---|---|---|
| 4,284,277 | A * | 8/1981 | Leonard et al. | 473/471 |
| 4,373,734 | A * | 2/1983 | Frank | 473/471 |
| 4,441,719 | A | 4/1984 | Lohr | |
| 4,453,720 | A | 6/1984 | King | |
| 4,489,941 | A | 12/1984 | Shieh | |
| 4,542,902 | A | 9/1985 | Massino | |
| 4,579,344 | A | 4/1986 | Meggs | |
| 5,000,461 | A | 3/1991 | Borazjani | |
| 5,413,331 | A | 5/1995 | Stillinger | |
| 5,427,381 | A | 6/1995 | Macaluso et al. | |
| 5,599,025 | A * | 2/1997 | Pobee-Mensah | 473/471 |
| 5,624,122 | A * | 4/1997 | Winkelhorn | 473/471 |
| 5,908,360 | A * | 6/1999 | Guillont | 473/416 |
| 6,849,010 | B1 * | 2/2005 | Valdeus, Jr. | 473/469 |
| 6,905,418 | B2 | 6/2005 | Rhee | |
| D520,580 | S | 5/2006 | Takata | |
| D522,596 | S | 6/2006 | Laliberty et al. | |
| D539,858 | S | 4/2007 | Laliberty et al. | |
| D540,408 | S | 4/2007 | Laliberty et al. | |
| D544,931 | S | 6/2007 | Laliberty et al. | |
| D575,364 | S | 8/2008 | Smith | |
| 7,611,427 | B1 * | 11/2009 | Cline | 473/465 |
| 2004/0214666 | A1 * | 10/2004 | Dilling | 473/470 |
| 2004/0242347 | A1 | 12/2004 | Langhorn | |
| 2007/0049433 | A1 | 3/2007 | Laliberty et al. | |
| 2007/0129184 | A1 * | 6/2007 | Anderson | 473/470 |
| 2007/0184920 | A1 | 8/2007 | Mah et al. | |
| 2008/0113833 | A1 * | 5/2008 | Fernandez | 473/471 |
| 2011/0092319 | A1 * | 4/2011 | Gurgul et al. | 473/471 |

OTHER PUBLICATIONS

Ball shown on webpage: http://theassociation.blogs.com/the_association/new%20ball.jpg Display Date: Feb. 26, 2007.

* cited by examiner

METHOD FOR PLAYING A GAME AND BALL AND GOAL THEREFORE

CROSS-REFERENCE TO RELATED APPLICATION

This application claims the priority of U.S. Provisional Patent Application Ser. No. 61/066,672, filed Feb. 21, 2008, entitled "Method of Playing a Game and a Ball and Goal Therefor," the entirety of which is incorporated herein by reference.

FIELD OF THE INVENTION

This invention is directed to a method for playing a game with an inflated ball and at least two goals for playing the game. More particularly, the invention relates to a method for playing a game with a ball on a playing surface having a plurality of zones that govern how players of the game advance, pass, move, shoot, and score a ball within the zones on the playing surface, and at least two goals on the playing surface having at least two distinctly defined spaces for scoring the ball therein.

SUMMARY OF THE INVENTION

A ball is provided for playing a game. The ball comprises a first section attached along a contiguous seam to a second section. The sections may be configured to maintain the ball in a substantially spherical shape. The first section and the second section each have a center portion and arms extending from the center portion.

In an embodiment, the first section of the ball may be substantially symmetrical to the second section and the at least three arms extend at about 120 degree angles from one another. The arms of the sections may be substantially ellipsoidal.

The first section and the second section of the ball may be attached along an edge of the first section and an edge of a second section. The attachment of the section may comprise stitching, bonding, thermal molding, hermetic sealing, or other attachment mechanism.

An inflatable bladder may be provided within the first section attached along the contiguous seam to the second section of the ball. The inflatable bladder may be inflated to an internal pressure to maintain the ball in a substantially spherical shape.

A lining may be provided within the first section attached along the contiguous seam to the second section of the ball. The lining may be configured to be hermetically sealed to maintain air pressure within the ball.

In an embodiment, the substantially spherical shape of the ball may comprise a circumference in a range of about 24 inches to about 26 inches.

In an embodiment, the ball may weight in a range of about 240 grams to about 370 grams.

A field is provided for at least two teams to play a game. The field comprises a substantially flat surface, a center portion on the substantially flat surface, demarcations lines to designate at least three or more areas on the substantially flat surface related to a goal, and at least two goals on the substantially flat surface.

In an embodiment of the field, the substantially flat surface may comprise any geometric shape. The geometric shape may be any one of a square, rectangle, circle, or triangle. In an embodiment, the field is round.

In an embodiment of the field, lines may be provided and comprise at least two concentric circles. In an embodiment, five concentric circles may be provided on playing surface of field. In an alternative embodiment, four concentric circles may be provided on playing surface of field. Two of the concentric circles may define a center ring and a peripheral boundary on the field. In an embodiment, the peripheral boundary comprises a diameter in a range of about 50 yards to about 100 yards.

In an embodiment of the field, the lines are provided and comprise at least two sets of two substantially linear lines extending from a point on the substantially flat surface. The substantially linear lines extend away from the center portion of the field.

In an embodiment of the field, lines comprise at least one substantially arced line. The at least one substantially arced line contacts a peripheral boundary line at two points.

In an embodiment of the field, a plurality of zones are provided on playing surface. In an embodiment, at least three areas comprise a goal zone, a wedge zone, and a flex zone. A cross zone may also be provided centered on the playing surface. The goal zone is adjacent the goal and within the peripheral boundary. The goal zone is partially defined by an arced line substantially below a portion of the goal. The flex zone is adjacent the goal zone and within the peripheral boundary. The wedge zone is adjacent the flex zone and within the peripheral boundary.

Goals are provided with the field. Portions of each of at least two goals extend over portions of the field adjacent a goal zone. The at least two goals each provide at least two distinctly defined scoring zones. The two distinctly defined scoring zones comprise at least one substantially vertically configured open ring and an arced planar opening.

The at least one substantially vertically configured open ring comprises an opening defined by an interior of the open ring. In an embodiment, the goal comprises five substantially vertically configured open rings.

The arced planar opening comprises a rectangular shape and may be substantially directly under a portion of the goal extending over a portion of the field adjacent a goal zone. In an embodiment, the arced planar opening comprises an opening defined by an arced upper portion of the goal, two vertically configured and horizontally separated posts, and a line provided on the substantially flat playing surface, wherein the line is substantially under a portion of the goal.

In an embodiment of the goal, at least two distinctly defined scoring zones, and a support structure for the at least two distinctly defined scoring zones are provided. The two distinctly defined scoring zones comprise at least one open ring and an arced rectangularly-shaped zone. The at least one open ring is substantially vertically configured between an upper arc shaped member positioned above a lower arc shaped member of the goal. The upper arc shape member and the lower arc shaped member extend substantially horizontally in front of support structure of the goal. In an embodiment, at least five open rings are provided with the goal. At least one open ring comprises a planar scoring opening.

The arced rectangularly-shaped opening is substantially below a portion of the goal. The arced rectangularly-shaped opening is defined by an upper portion of the goal, a first substantially vertically configured post, and a second substantially vertically configured post. In an embodiment, the first substantially vertically configured post is horizontally separated from the second substantially vertically configured post.

In an embodiment, the support structure of a goal is provided and comprises at least two vertically configured support posts, at least two horizontally configured support posts, and at least two angularly configured support posts, all interconnected to maintain the at least two distinctly defined scoring zones of the goal substantially vertical.

In an embodiment, a method is provided for at least two teams to play a game with a ball. The method comprises starting the game by placing a ball in play on a playing surface comprising a plurality of zones. Each of the plurality of zones have distinct rules for handling the ball during play. The playing surface has at least two goals each having two distinctly defined scoring zones.

The method also comprises contacting the ball within at least one of the plurality of zones according to the distinct rules of play for handling the ball. Contacting the ball may comprise any one or more of the players passing, receiving, controlling, redirecting, or shooting the ball. Contacting the ball may occur in any one of the plurality of zones related to a goal. The plurality of zones related to a goal may comprise any one or more of a cross zone, a flex zone, a wedge zone, and a goal zone.

In an embodiment, distinct rules of play for handling the ball in the cross zone comprise playing the ball with any body part of a player. In an further embodiment, the rules of play for handling the ball in the cross zone may comprise playing the ball with any body part of a player from the waist up. The distinct rules of play for handling the ball in the flex zone comprise playing the ball with any body part of a player. The distinct rules of play for handling the ball in the wedge zone comprise playing the ball with any body part of a player except arms and hands. The distinct rules of play for handling the ball in the goal zone comprise playing the ball with any body part of a player.

In an embodiment, the method comprises the further step of scoring by passing the ball through at least one of two distinctly defined scoring zones of the goal or optionally by taking possession of the ball immediately after starting the game.

The method further comprises awarding points comprising assigning different points for throwing ball through at least one open ring, kicking the ball through at least one open ring, throwing ball through arc planar rectangularly-shaped opening, and kicking ball through arc planar rectangularly-shaped opening. The awarding of points depends on the location and nature of a shot of a ball in relation to a near goal or a distant goal.

The method comprises a further step of stopping play for a ball traveling outside of a peripheral boundary of the playing surface or for a foul.

The method comprises the further step of restarting play by a throw-in or a kick-in.

The at least two teams for the game comprise a base number of players on the playing surface. The base number of players may be 10.

The method comprises the further step of completing play of the game within at least one timed period. The at least one timed period comprises a range of about 20 minutes to about 30 minutes. Three timed periods may be provided for a game.

The method may comprise the further step of awarding a win to the team having the greatest number of points at the end of a game.

BRIEF DESCRIPTION OF THE DRAWINGS

Understanding of the present invention will be facilitated by consideration of the following detailed description of embodiments of the present invention taken in conjunction with the accompanying drawings, in which like numerals refer to like parts throughout the views thereof, and wherein.

DESCRIPTION OF EMBODIMENTS OF THE INVENTION

Figure 1:
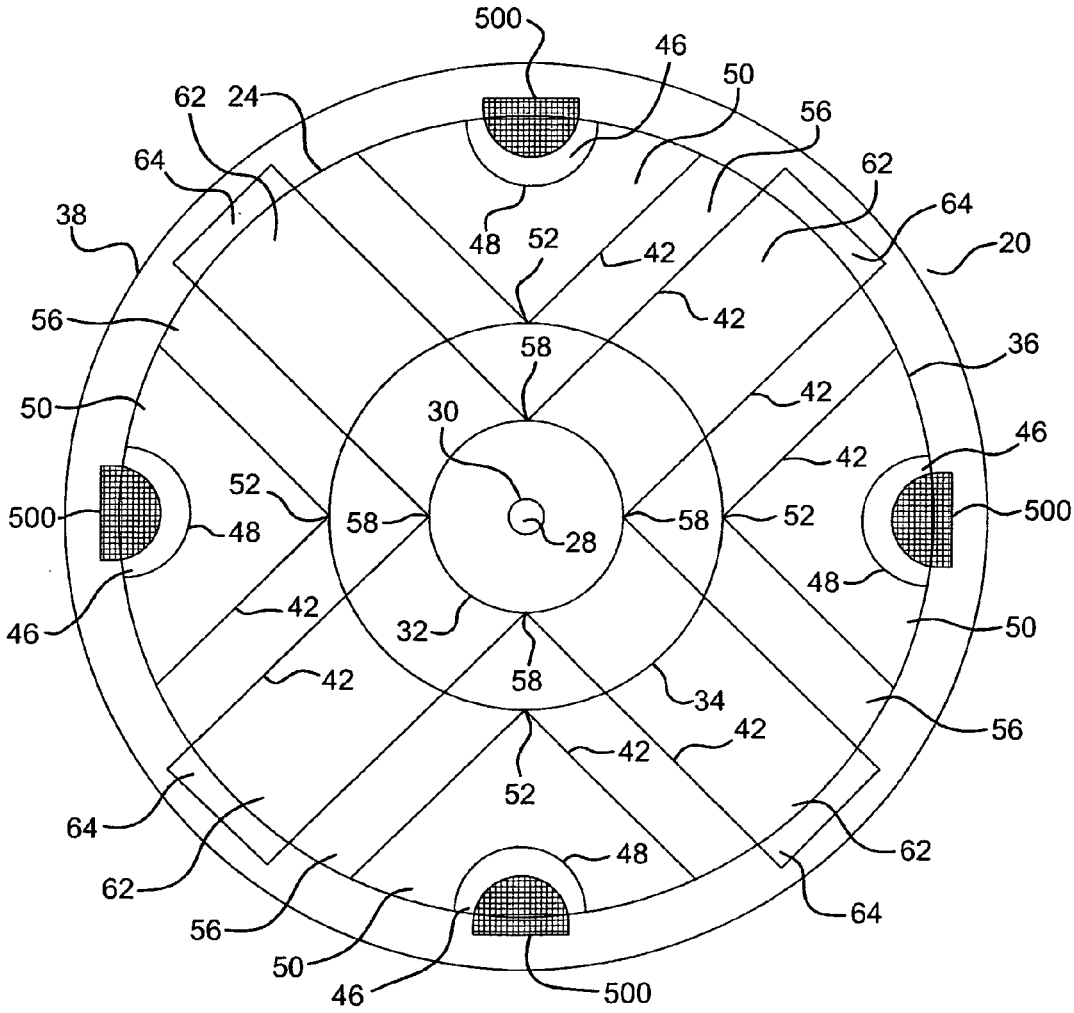
FIG. 1 shows a top plan view of an embodiment of the playing surface of the invention.

It is to be understood that the figures and descriptions of the present invention have been simplified to illustrate elements that are relevant for a clear understanding of the present invention, while eliminating, for the purposes of clarity, many other elements which may be found in the present invention. Those of ordinary skill in the pertinent art will recognize that other elements are desirable and/or required in order to implement the present invention. However, because such elements do not facilitate a better understanding of the present invention, a discussion of such elements is not provided specifically herein.

In an embodiment of the invention, a method of playing a game is provided. The game may be played within at least one timed period between at least two teams comprising at least two individuals each on playing surface 20 having a plurality of zones. Playing surface 20 is substantially flat comprising a plurality of zones and at least two goals 500 as shown generally in FIG. 5. Goals 500 may be placed anywhere on playing surface 20. In the plurality of zones, ball 310 may be advanced, passed, and moved by members of a team. Ball 310 may be advanced, passed, or moved by a player using at least one or more of his/her body parts, such as, for example, hands, head, feet, arms, etc., depending upon the physical location of the player within a particular zone on playing surface 20. A player may score points for his or her team by passing ball 310 completely through one of the at least two distinctly defined spaces provided by goal 500 shown throughout FIGS. 16 through 29 and described below as at least one or more circular open rings 536 and arced rectangularly-shaped opening 512 shown specifically in FIGS. 23*b* and 24*b* or, alternatively, arced rectangularly-shaped opening 513 shown specifically in FIGS. 23*c* and 24*c*.

Playing Surface

Referring now to an non-limiting embodiment shown in FIGS. 1, 2, and 30 through 67 and in another non-limiting embodiment shown in FIGS. 5 and 68 through 101, playing surface 20 comprises a substantially flat surface having dimensions, lines, zones, and at least two goals 500 in an embodiment of the invention. Substantially flat surface of playing surface 20 may be provided by natural turf, artificial turf, a combination thereof, or any other suitable playing surface for competitive sports. The dimensions of playing surface 20 may be defined by peripheral boundary 24.

The dimensions of playing surface 20 may be round as provided in an non-limiting embodiment shown in FIGS. 1, 2, and 30 through 67 and in another non-limiting embodiment shown in FIGS. 5 and 68 through 101, square, or another suitable geometric shape. An exemplary, but non-limiting dimension of a round playing surface 20, may be a diameter in a range of about 50 yards to about 100 yards. Peripheral boundary 24 may be a circle and referred to as a "Boundary ring" shown in an embodiment of FIGS. 1, 2, and 30 through 67 and in an alternative embodiment shown in FIGS. 5 and 68 through 101. In an embodiment, the diameter of boundary ring 36 of round playing surface 20 may be about 70 yards shown specifically in an embodiment of FIG. 2 and in an alternative embodiment of FIG. 69. Goals 500 may be provided along boundary ring 36 of playing surface 20 shown in an embodiment of FIGS. 1, 2, and 30 through 67 and an alternative embodiment of FIGS. 5 and 68 through 101.

Playing surface 20 may be further defined with lines to create additional boundaries and zones based off of center portion 28 and within peripheral boundary 24 shown in an embodiment of FIGS. 1 through 4 and 30 through 67 or alternatively based off of center spot 29 in the embodiment shown in FIGS. 5 and 68 through 101. Lines may provide demarcations at a distance from center portion 28 or alternatively center spot 29 and may also provide V-shaped demarcations 42 extending away from center portion 28. As non-limiting examples, and as shown in an embodiment of FIGS. 1 and 30 through 67 and an alternative embodiment of FIGS. 5 and 68 through 101, the demarcations may be concentric circles that increase in size the further a demarcation is from center of playing surface 20.

A line may be used to define center portion 28 that may be round, shown as circular ring 30 specifically in an embodiment of FIG. 1 and generally throughout FIGS. 30 through 67. Center portion 28 may be another two-dimensional shape defining a centralized space on playing surface 20. In alternative embodiment, a line may be used to define a center area containing center spot 29 that may be round, shown as circular ring 30' specifically in an embodiment of FIGS. 5 and 68 through 101. Center spot 39 may be centrally located on playing surface 20 and about 12 inches in diameter.

Remote demarcations may be provided at a distance from center portion 28 in an embodiment or from center spot 29 in an alternative embodiment. Lines provided on playing surface 20 may be about 4 inches to about 5 inches wide. Other widths may be used for lines. Lines may be provided on playing surface 20 as one color and may be different than the color of the rings discussed in further detail below.

Referring generally now to an embodiment shown in FIG. 1, concentric circles may define a number of areas on playing surface 20. For example, center ring 30, which may also be referred to as a "Prime ring" may be provided to mark the center of playing surface 20 and also to define a scoring region. Ball 310 may be placed into play in an area of playing surface 20 defined by center ring 30 during a Prime rush described below as an embodiment to start play of the game. Further concentric rings, such as, for example, second ring 32, third ring 34, and boundary ring 36, may be provided on playing surface 20 as shown specifically in FIG. 1. A scoring region may also be defined by playing surface 20 within second ring 32 or within third ring 34.

Second ring 32 shown specifically in FIG. 1 and generally throughout FIGS. 30 through 67 defines an area on playing surface 20 into which an offensive team may be required to clear ball 310 after an opponent has scored ball 310 in any one of goals 500.

Third ring 34 shown specifically in an embodiment in FIG. 1 and generally throughout FIGS. 30 through 67 defines an area on playing surface 20 that an offensive team may be required to clear ball 310 after a turnover or change of possession. Players may be required to stay outside of an area of playing surface 20 defined within third ring 34 before a Prime rush as described in the disclosure.

Boundary ring 36 shown specifically in FIG. 1 and generally throughout FIGS. 30 through 67 defines an outer limit of playing surface 20. Ball 310 present inside of boundary ring 36 is considered "in-bounds" or "in-play" during play of the game. Ball 310 outside of boundary ring 36 is considered "out-of-bounds" or "out-of-play" during the game.

Figure 5:
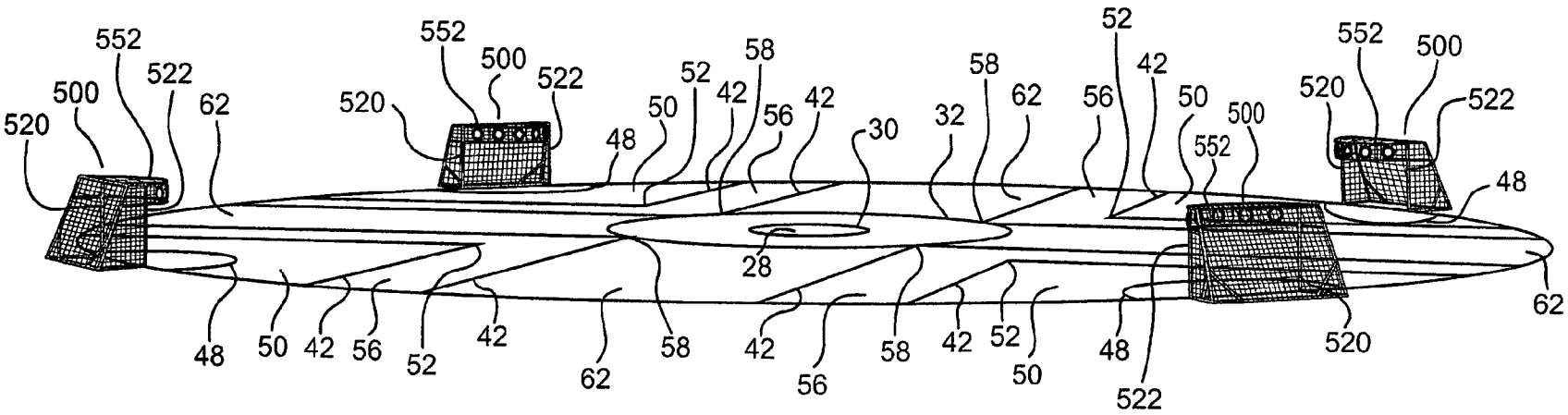
FIG. 5 shows a perspective view of an embodiment of a playing surface of the invention.
Figure 6:
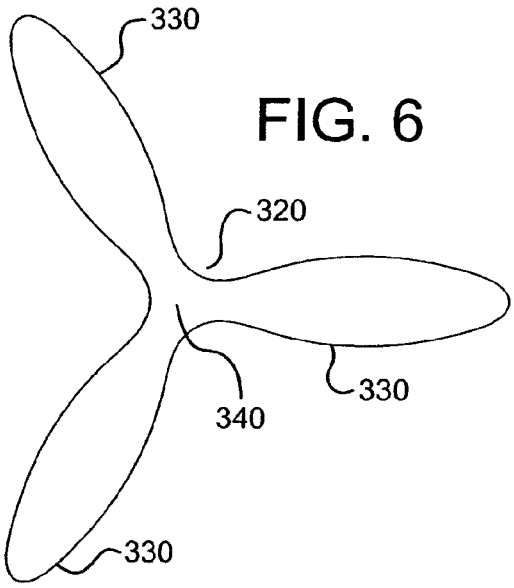
FIG. 6 shows a plan view of an embodiment of a first panel of a ball of the invention.
Figure 7:
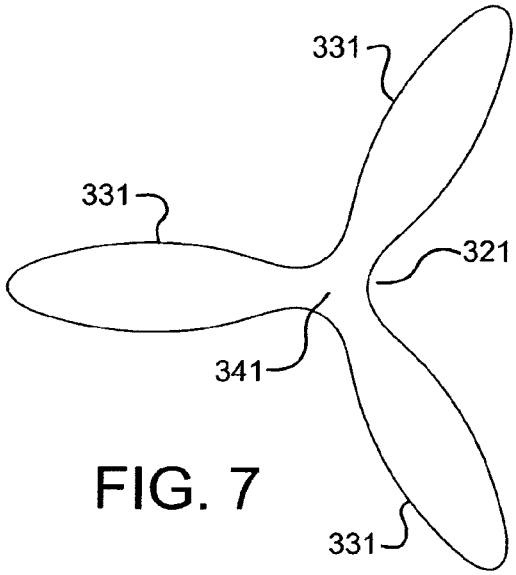
FIG. 7 shows a plan view of a corresponding second panel of a ball of the invention.
Figure 8:
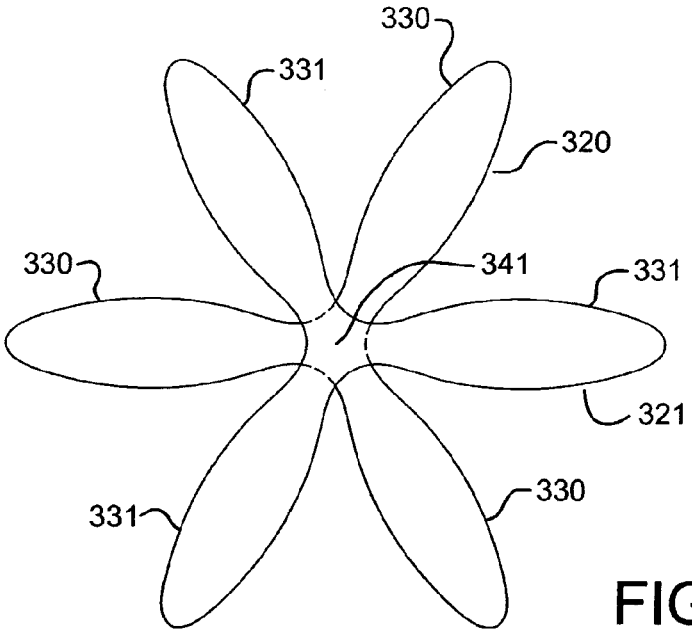
FIG. 8 shows a plan view of the first panel of FIG. 6 overlapping the second panel of FIG. 7.
Figure 9:
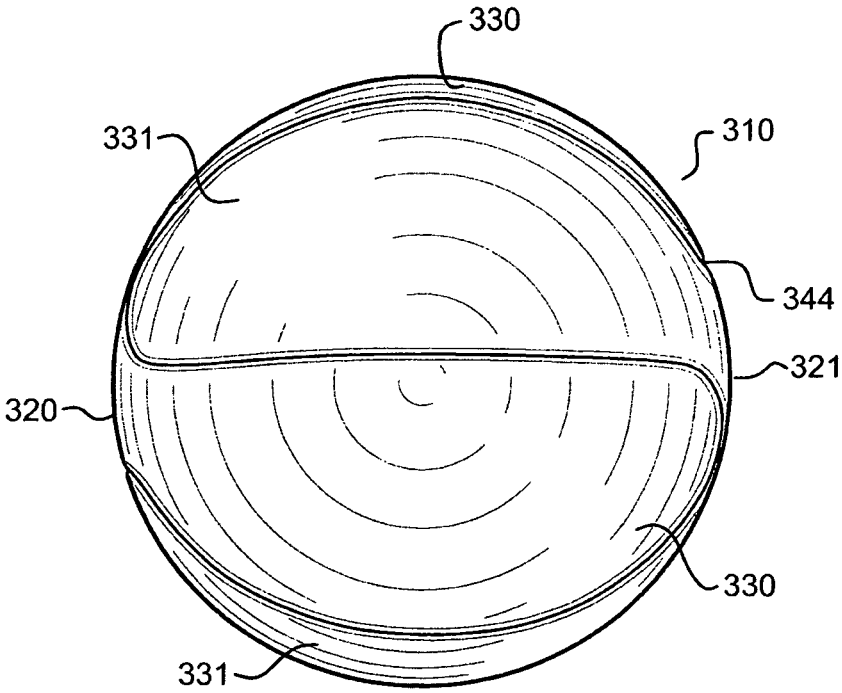
FIG. 9 shows a front elevation view of a ball of the invention.
Figure 10:
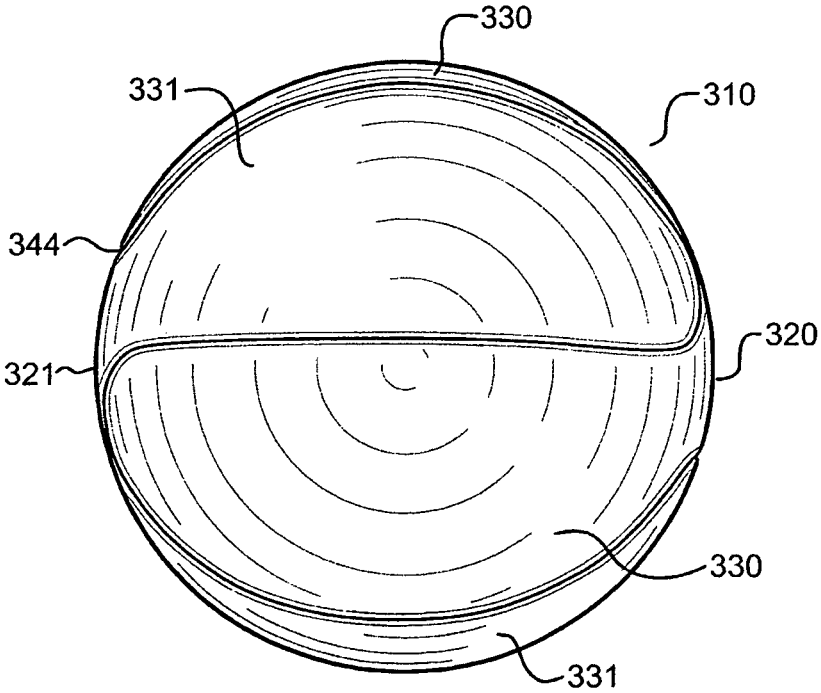
FIG. 10 shows a rear elevation view of the ball shown in FIG. 9.
Figure 11:
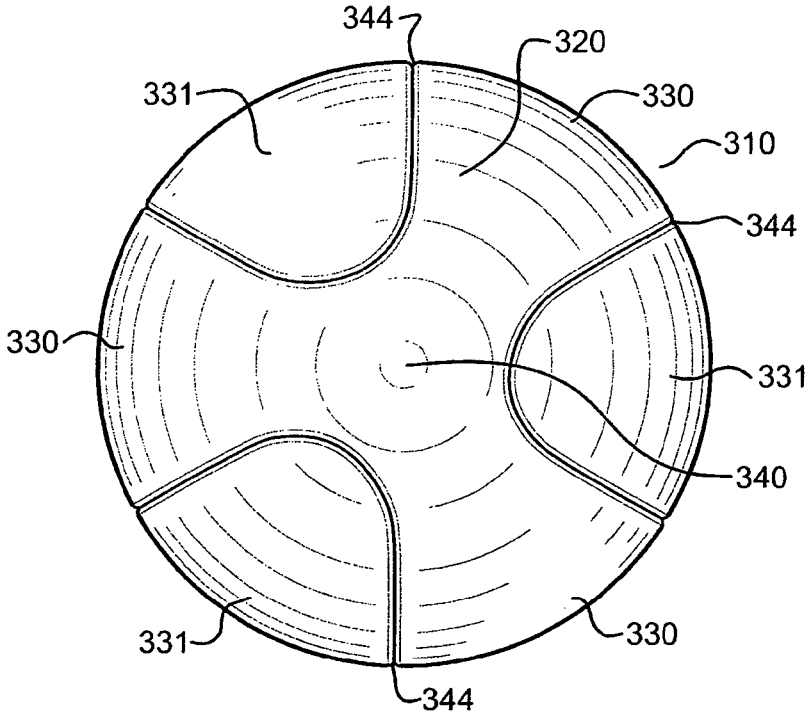
FIG. 11 shows a first side elevation view of the ball shown in FIG. 9.
Figure 12:
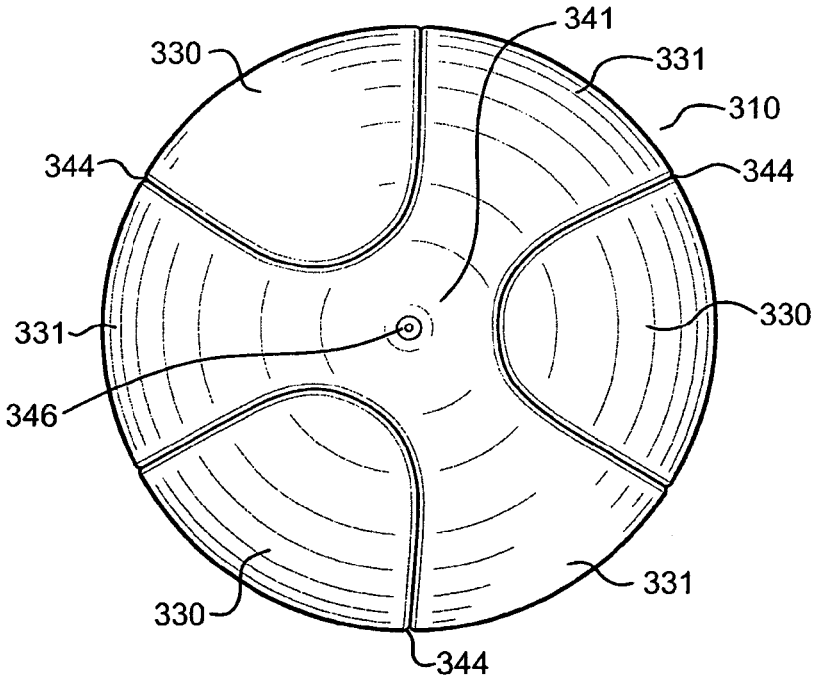
FIG. 12 shows a second side elevation view of the ball shown in FIG. 9.
Figure 13:
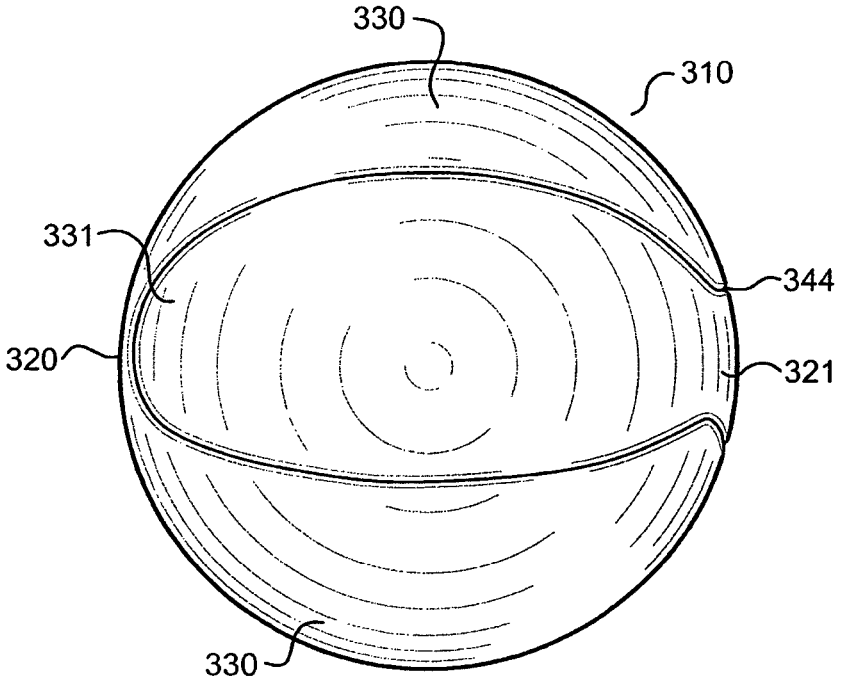
FIG. 13 shows a top plan view of the ball shown in FIG. 9.
Figure 14:
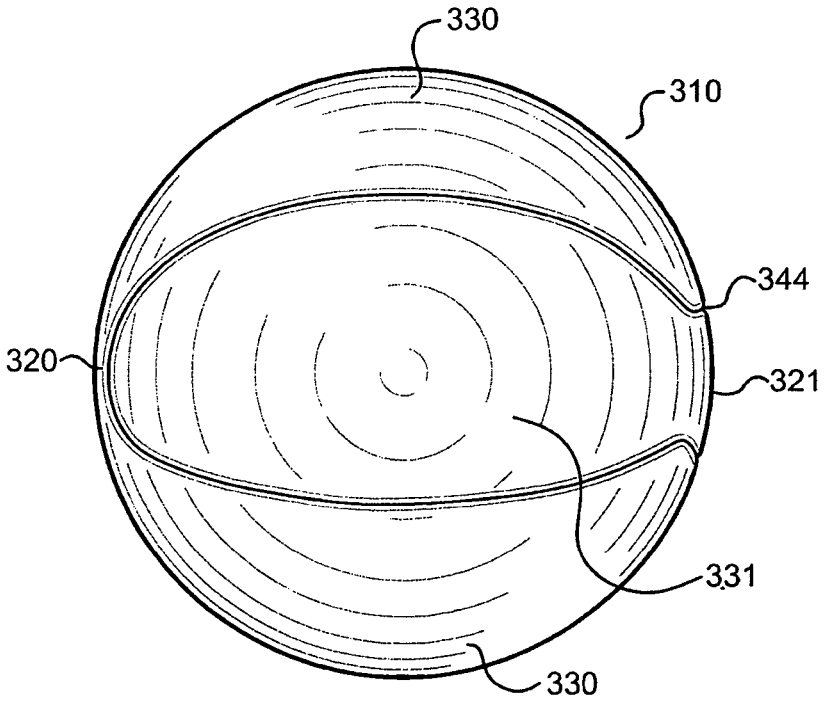
FIG. 14 shows a bottom plan view of the ball shown in FIG. 9.
Figure 15:
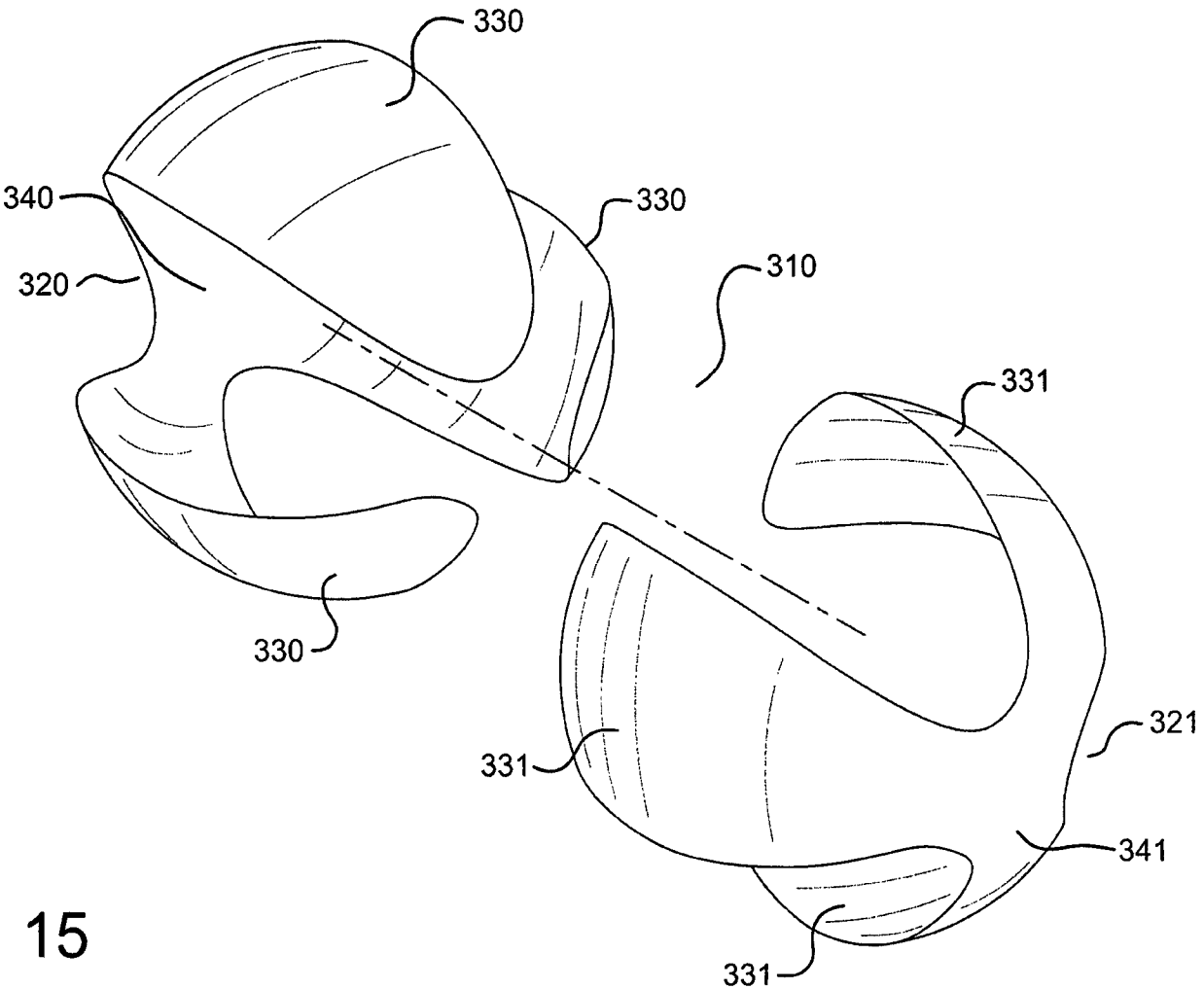
FIG. 15 shows an exploded view of the ball shown in FIG. 9.
Figure 16:
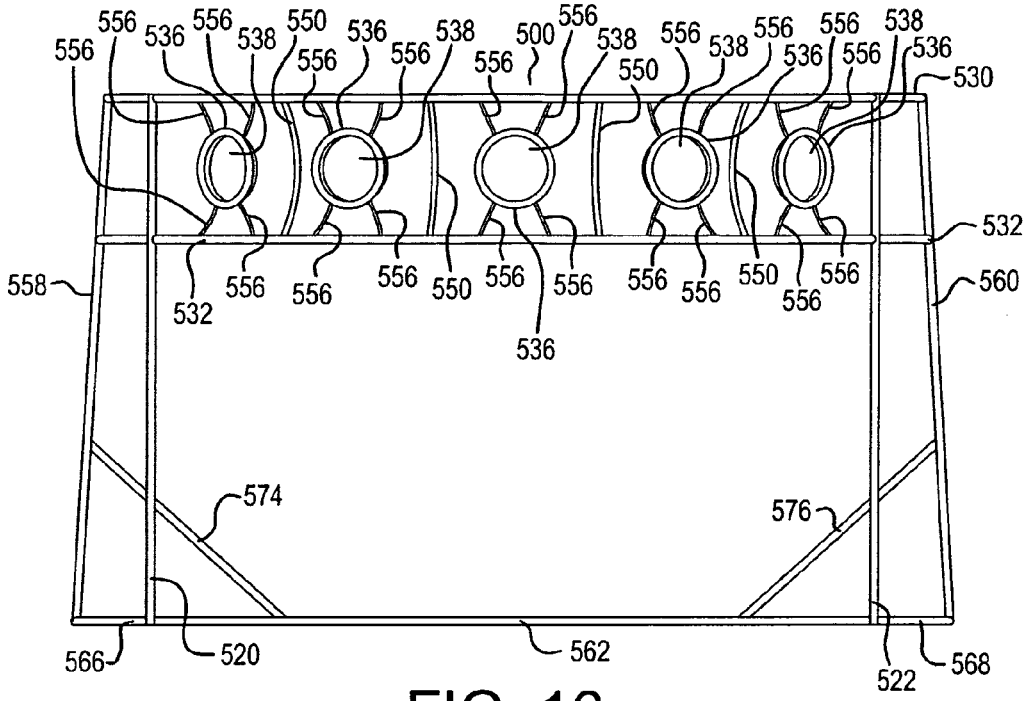
FIG. 16 shows a front elevation view of an embodiment of a goal of the invention without a net attached thereto.
Figure 17:
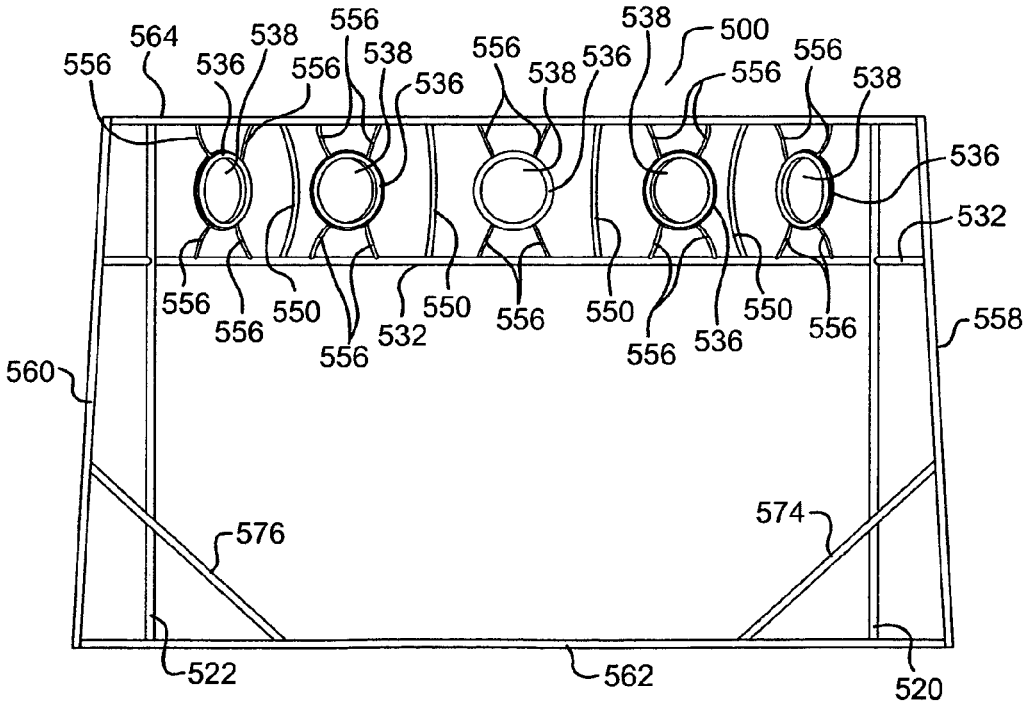
FIG. 17 shows a rear elevation view of the goal shown in FIG. 16.
Figure 18:
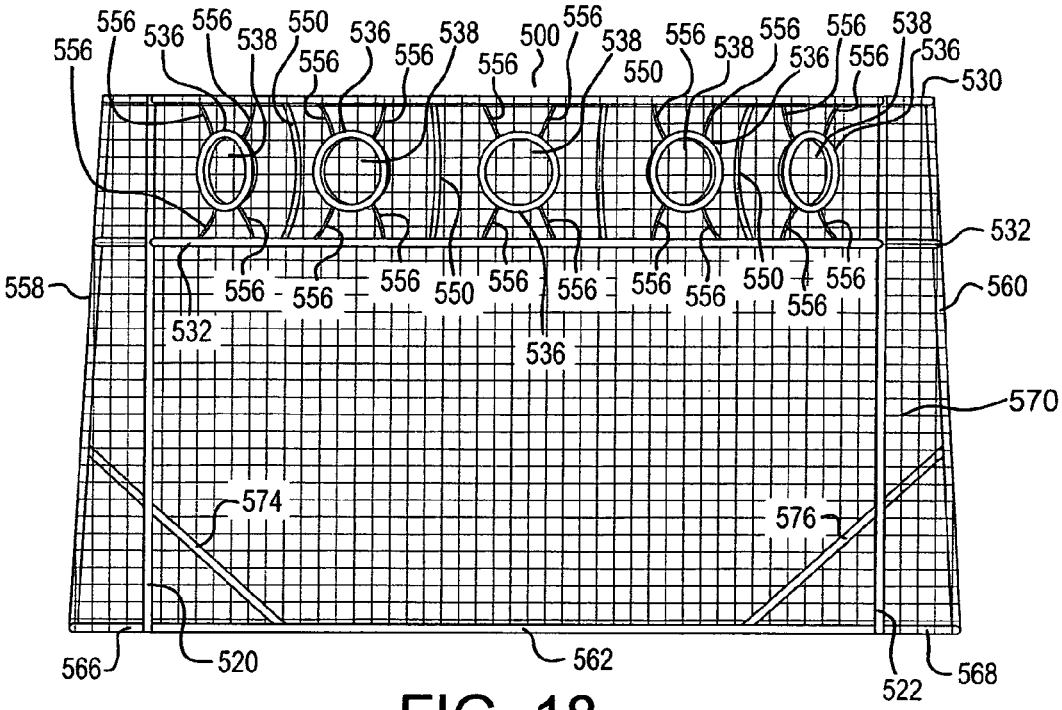
FIG. 18 shows a front elevation view of an embodiment of a goal of the invention having a net attached thereto.
Figure 19:
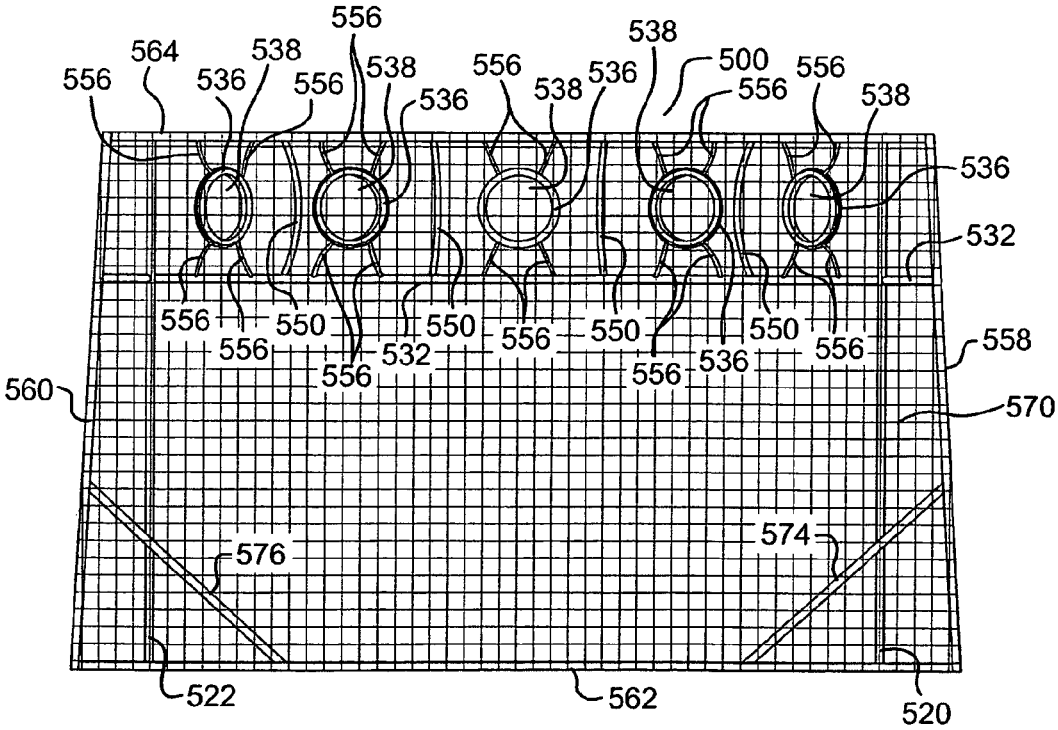
FIG. 19 shows a rear elevation view of the goal shown in FIG. 18.
Figure 20:
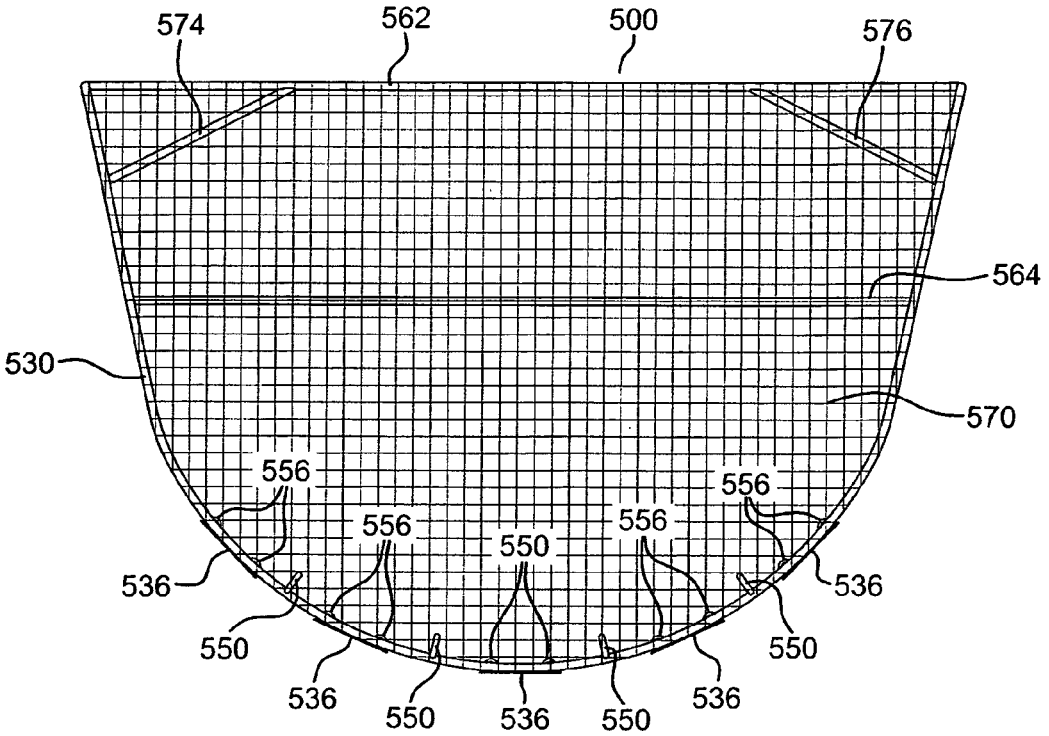
FIG. 20 shows a top plan view of the goal shown in FIG. 18.
Figure 21:
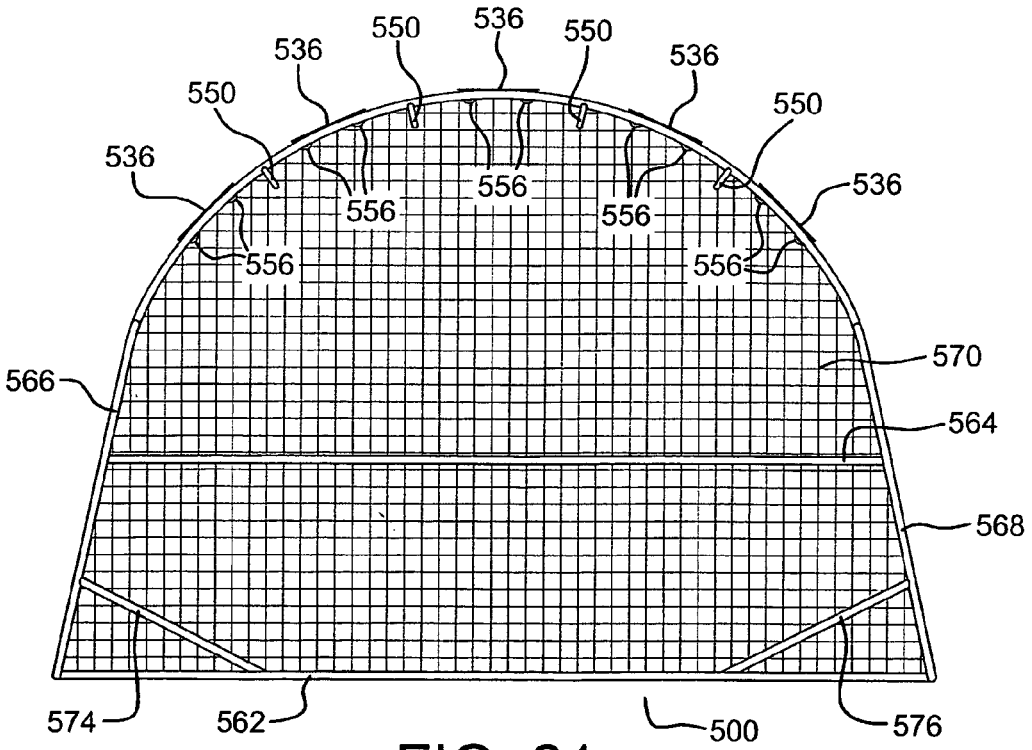
FIG. 21 shows a bottom plan view of the goal shown in FIG. 18.
Figure 22:
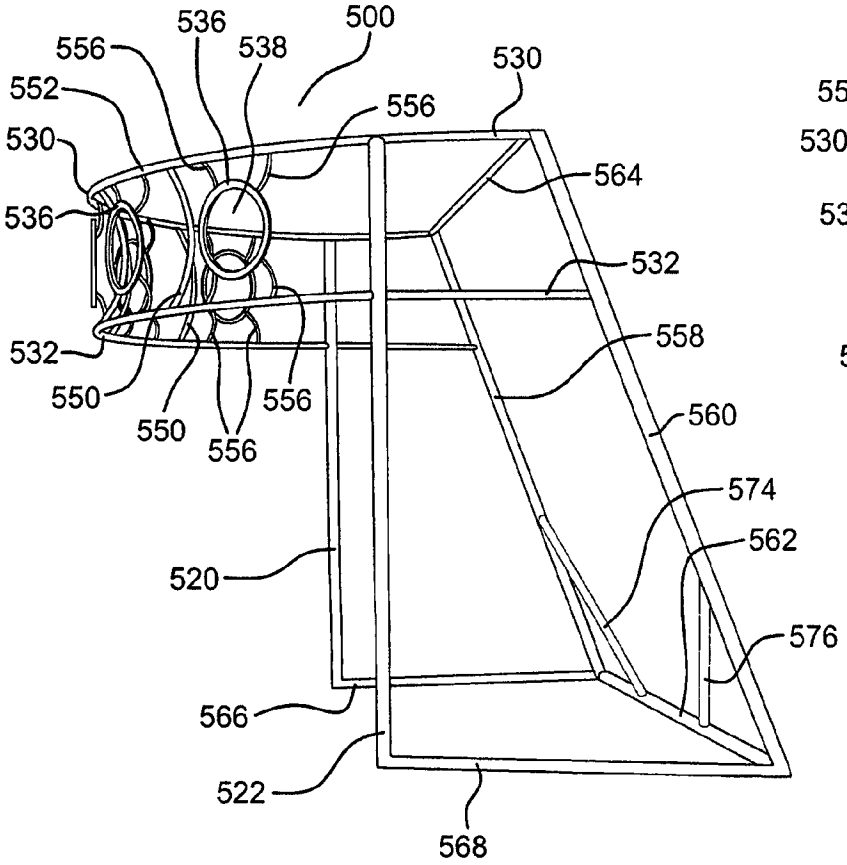
FIG. 22 shows a side perspective view of the goal shown in FIG. 16.
Figure 68:
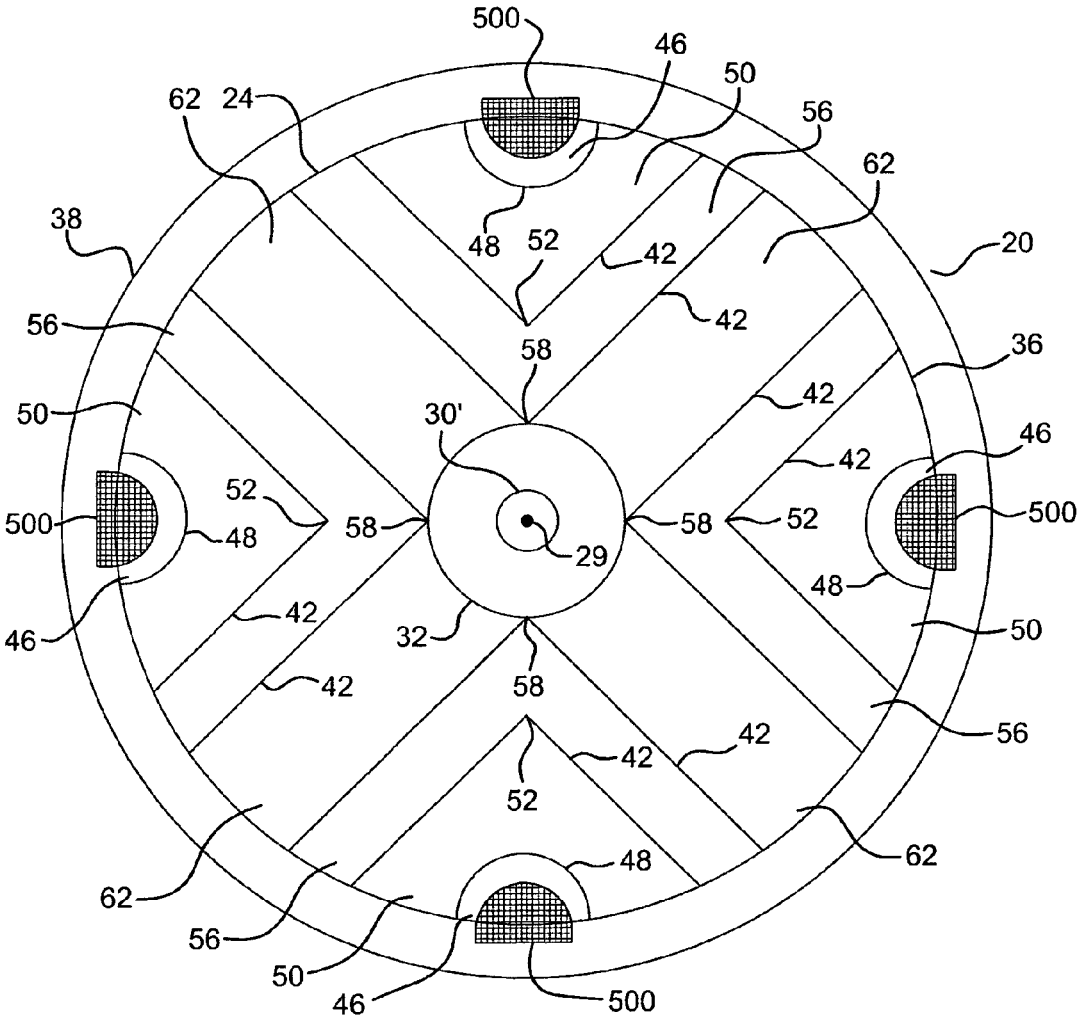
FIG. 68 shows a top plan view of an alternative embodiment of the playing surface of the invention.

Referring generally now to an alternative embodiment shown in FIGS. 5 and 68, concentric circles may define a number of areas on playing surface 20. For example, center ring 30, also referred to as a Prime ring, may be provided to mark the center of playing surface 20 and also to define an area having center spot 29. Ball 310 may be placed into play on center spot 29 during a Prime rush described below in an alternative embodiment of the start play of the game. Further concentric rings, such as, for example, second ring 32 and boundary ring 36, may be provided on playing surface 20 as shown specifically in FIGS. 5 and 68 and generally through FIGS. 69 through 101. A scoring region may also be defined by playing surface 20 within second ring 32.

Second ring 32 shown specifically in FIGS. 5 and 68 and generally throughout FIGS. 69 through 101 defines an area on playing surface 20 into which an offensive team may be required to clear ball 310 after an opponent has scored ball 310 in any one of goals 500.

Boundary ring 36 shown specifically in FIG. 68 and generally throughout FIGS. 69 through 101 defines an outer limit of playing surface 20. Ball 310 present inside of boundary ring 36 is considered "in-bounds" or "in-play" during play of the game. Ball 310 outside of boundary ring 36 is considered "out-of-bounds" or "out-of-play" during the game.

An additional ring 38 shown specifically in an embodiment shown in FIG. 1 and generally throughout FIGS. 30 through 67 and in an alternative embodiment shown in FIGS. 5 and 68 through 101 may be provided that encircles center ring 30, second ring 32, third ring 34 if optionally provided, and boundary ring 36. Additional ring 38 may be referred to as the "Welcome ring." Additional ring 38 may be positioned a distance E and equidistant from boundary ring 36 shown specifically in an embodiment in FIG. 2 and an alternative embodiment shown in FIG. 68. In alternative embodiments shown in FIGS. 2 and 69, distance E may be about 15 feet to about 30 feet. Additional ring 38 may be used to define a neutral zone, but for team bench zones 64 or alternatives team bench areas if provided, between boundary ring 36 and additional ring 38.

Figure 2:
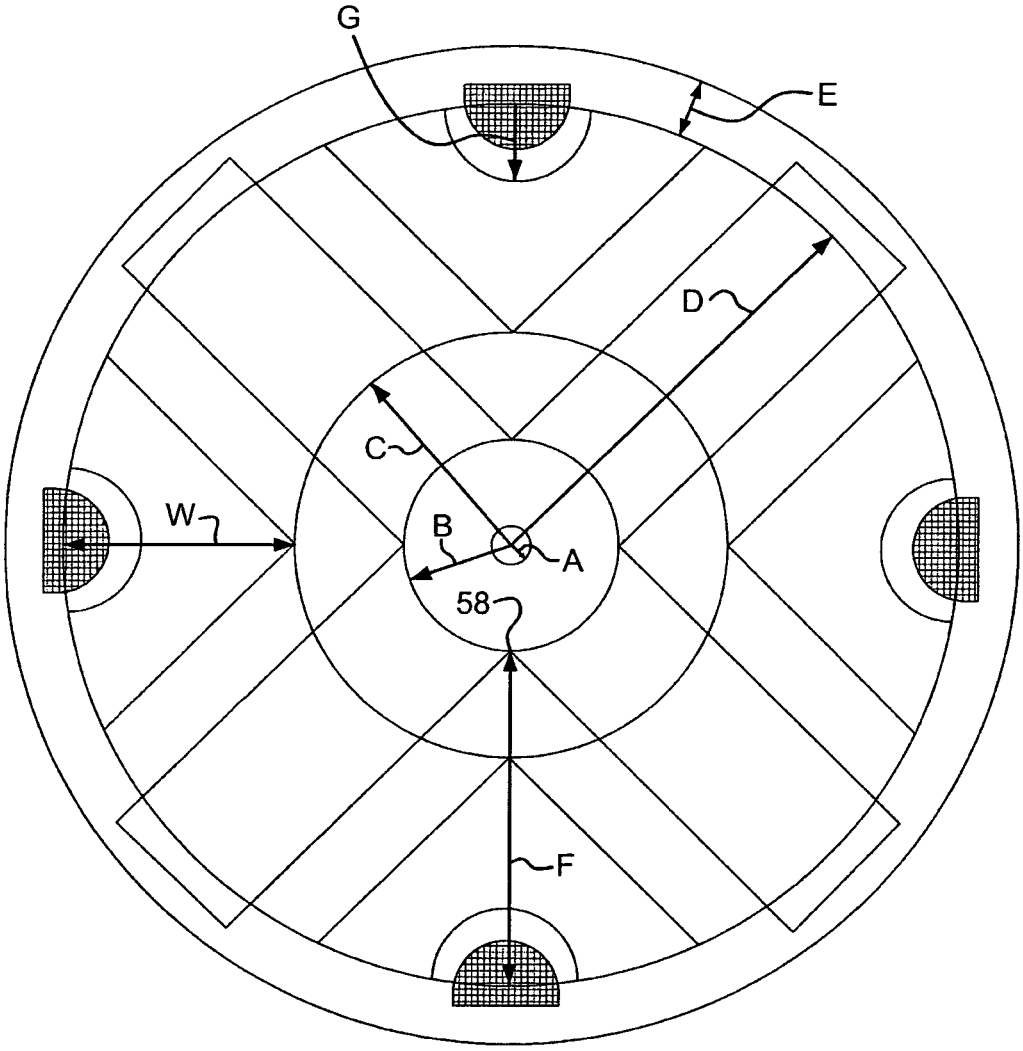
FIG. 2 shows another top plan view of the embodiment of the playing surface shown in FIG. 1.

Referring specifically to an embodiment shown in FIG. 2, and for an embodiment of playing surface 20 having a diameter of about 70 yards, center ring 30 may have radius A of about 9 feet. Second ring 32, which is shown centered around center ring 30, may have radius B. In this embodiment, radius B may be about 30 feet. Third ring 34, which is centered around center ring 30 and second ring 32, may have radius C. In this embodiment, radius C may be about 54 feet. Boundary ring 36, which is centered around center ring 30, second ring 32, and boundary ring 36, may have radius D. In an embodiment, radius D may be about 105 feet.

Figure 69:
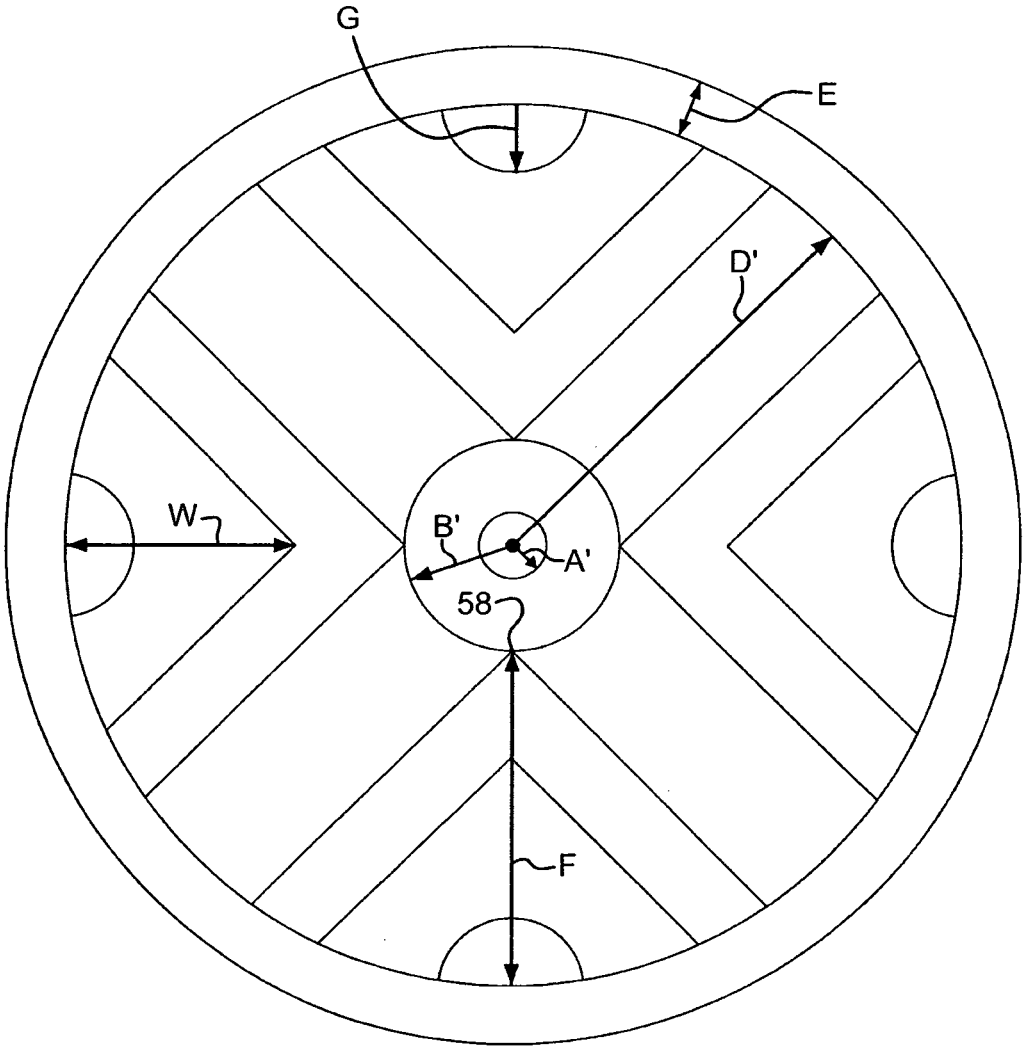
FIG. 69 shows another top plan view of an alternative embodiment of the playing surface of the invention.

Referring specifically to an embodiment of FIG. 69, and for an embodiment of playing surface 20 having a diameter of about 70 yards, center ring 30 may have radius A' of about 9 feet. Second ring 32, which is shown centered around center ring 30, may have radius B'. In this embodiment, radius B' may be greater than or equal to about 30 feet. Boundary ring 36, which is centered around center ring 30, second ring 32, and boundary ring 36, may have radius D'. In an embodiment, radius D' may be about 105 feet.

Referring now generally to embodiments shown in FIGS. 1 and 30 through 67 and alternative embodiments shown in FIGS. 5 and 68 through 101, V-shaped demarcations 42 may also be provided by lines on playing surface 20. Any V-shaped demarcation 42 provided on playing surface 20 may or may not contact center portion 28. V-shaped demarcations 42 may be configured on playing surface 20 as two lines extending outwardly away from the central portion of playing surface 20 as well as any point on playing surface 20. There may be numerous V-shaped demarcations 42 provided on playing surface 20 to define zones in which specific types of ball handling may be used by a player and his/her team to advance, pass, and move ball 310 on playing surface 20 and shoot ball 310 at one or more goals 500 on playing surface 20.

Figure 3:
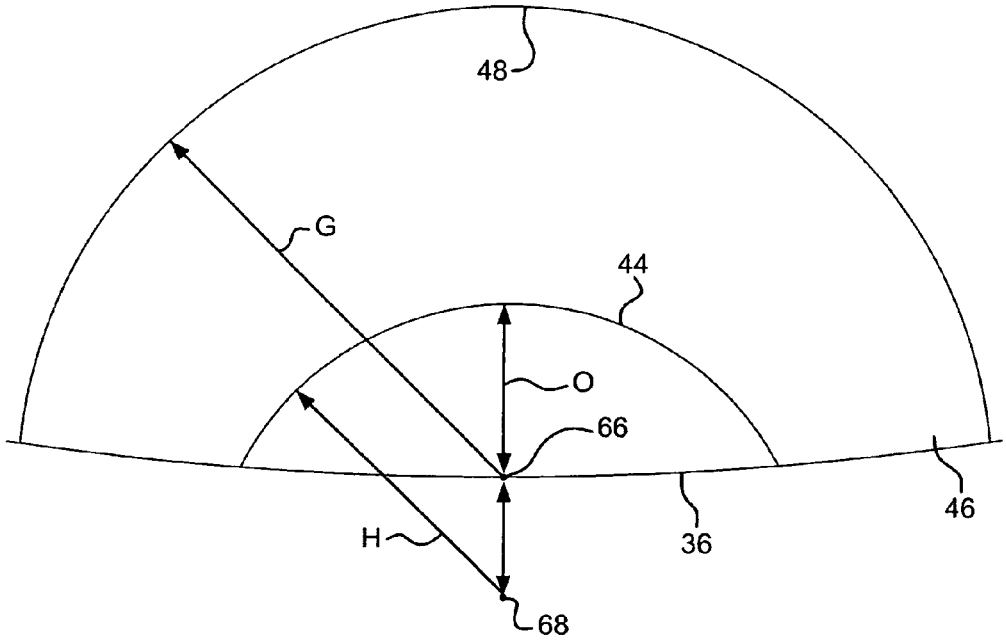
FIG. 3 shows a top plan view of an embodiment of a goal zone of the invention.
Figure 4:
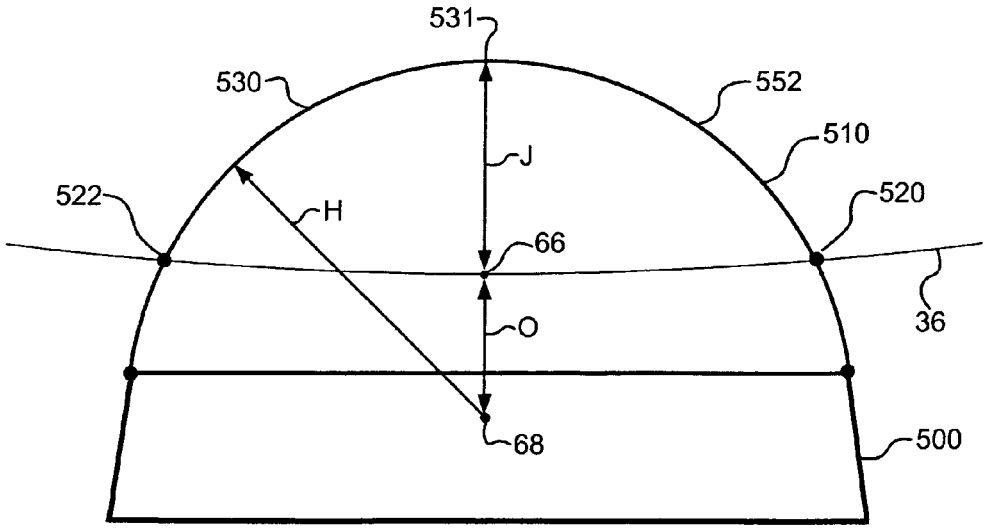
FIG. 4 shows a top plan view of the embodiment of the goal zone of the invention shown in FIG. 3 with a goal.

Referring now to FIGS. 3, 23*a*, 23*b*, 24*a*, and 24*b*, goal lines 44 may be provided on playing surface 20 in near proximity to goal 500 that may be positioned on the periphery of playing surface 20. Goal line 44 may be provided that defines a lower side of a scoring plane of goal 500. In an embodiment, goal line 44 may be provided as an arc-shaped line that contacts boundary ring 36 at two points. Referring specifically to FIGS. 3 and 4, goal line 44 may comprise about a half-circle with radius H originating from goal origin point 68. In an embodiment, radius H may be about 9 feet. Goal origin point 68 may be positioned distance O from goal hash intersect 66 provided on boundary ring 36. In an embodiment, distance O may be about 3 feet and 8½ inches from goal hash intersect 66 and outside boundary ring 36 shown specifically in FIGS. 3 and 4. The number of goal lines 44 corresponds directly with the number of goals 500 provided on playing surface 20.

Referring now to FIGS. 1 and 3, goal zones 46 may be provided on playing surface 20. Goal zone 46 may be defined by goal zone line 48 and corresponding goal line 44. Goal zone line 48 may be provided as about a half-circle line having radius G originating from goal hash intersect 66 shown specifically in FIGS. 2 and 3. Radius G may be about 15 feet. In an exemplary embodiment, goal zone 46 may be defined on playing surface 20 between goal zone line 48 and goal line 44 shown specifically in FIG. 1. Goal hash intersect 66 may be provided as evenly-spaced, one foot lines perpendicular to, and centered on, boundary ring 36 on playing surface 20. Goal hash intersect 66 denotes the center of goal zone 46.

In alternative embodiments shown specifically in FIGS. 5, 68, 23*c*, and 24*c*, goal line 44 may be absent from playing surface 20. In the alternative embodiments, the portion of boundary ring 36 between first vertically configured post 520 and second vertically configured post 522 may be considered a "goal line" for purposes of defining goal zone 46 along with goal zone line 48 shown specifically in FIGS. 5, 68, 23*c*, and 24*c*. Goal zone line 48 may be provided as about a half-circle line having radius G originating from goal hash intersect 66 shown specifically in FIG. 68. Radius G may be about 15 feet. In an exemplary embodiment, goal zone 46 may be defined on playing surface 20 between goal zone line 48 and goal line comprising that portion of boundary ring 36 between first vertically configured post 520 and second vertically configured post 522 shown specifically in FIGS. 23*c*, 24*c*, and 68. Goal hash intersect 66, which may also be called a goal spot, may be provided as evenly-spaced, one foot lines perpendicular to, and centered on, boundary ring 36 on playing surface 20. Goal hash intersect 66 or goal spot, denotes the center of goal zone 46.

Referring generally now to embodiments shown in FIG. 1 and alternative embodiments of FIGS. 5 and 68, a plurality of wedge zones 50 may be provided on playing surface 20. Wedge zone 50 may be defined on playing surface 20 between goal zone 46 and flex zone 56. Wedge zone 50 may be a zone defined as the portion of playing surface 20 between goal zone 46 and flex zone 56 described below. Wedge zone 50 may be defined, in part, by V-shaped demarcations 42 extending from wedge zone point 52 to peripheral boundary 24 excluding goal zone 46.

In an exemplary embodiment shown in FIG. 1, wedge zone 50 may be defined in part by lines that extend from wedge zone point 52 provided on one of concentric rings, such as, for example, third ring 34 to peripheral boundary 24. In an alternative exemplary embodiment shown in FIGS. 5 and 68, wedge zone 50 may be defined by lines that extend from wedge zone point 52 on playing surface. In embodiments shown generally in FIG. 1 and alternative embodiments shown in FIGS. 5 and 68, the lines defining wedge zone 50 may extend from wedge zone point 52 at about a 90 degree angle, and wedge zone point 52 may be a distance W from goal hash intersect 66 as shown in FIG. 2, where wedge zone point 52 may comprise optional third ring 34. In an embodiment, distance W may be about 51 feet.

Referring generally now to embodiments shown in FIG. 1 and alternative embodiments of FIGS. 5 and 68, a plurality of flex zones 56 may be provided on playing surface 20. Flex zone 56 may be defined on playing surface 20 between wedge zone 50 and cross zone 62. Flex zone 56 may be defined in part by V-shaped demarcation 42 extending from flex zone point 58 to peripheral boundary 24. In an exemplary embodiment, flex zone 56 may be defined by lines that extend from flex zone point 58 on one of concentric rings on playing surface 20, such as, for example, second ring 32, to peripheral boundary 24 and excluding goal zone 46 and wedge zone 50. In this embodiment, the lines defining flex zone 56 may extend from flex zone point 58 at about a 90 degree angle, and flex zone point 58 may be distance F from goal hash intersect 66, shown in FIGS. 2 and 69, where flex zone point 58 connects with second ring 32. In an embodiment, distance F may be about 75 feet.

Referring generally now to an embodiment shown in FIG. 1 and alternative embodiments of FIGS. 5 and 68, cross zone 62 may be provided on playing surface 20. Cross zone 62 may be defined as a zone positioned generally centrally on playing surface 20 between any two or more flex zones 56 and that, in an embodiment, may be x-shaped with portions extending to boundary ring 36. In an exemplary embodiment, cross zone 62 may be defined in part by at least four flex zones 56 as shown in an embodiment of FIG. 1 and an alternative embodiment of FIGS. 5 and 68.

Referring now to FIG. 1, optional team bench zones 64 may be provided on playing surface 20 and located outside boundary ring 36 and where cross zone 62 intersects boundary ring 36. Team bench zones 64 may be about the width of cross zone 62 and about 6 feet deep and within Welcome ring 38. Team bench zones 64 may be outlined with lines on playing surface 20. In alternative embodiments, two team bench areas may be provided inside or outside of Welcome ring 38.

In an alternative embodiment, administrative box may be provided between two team bench areas and in Welcome ring 38. The administrative box may be outlined with lines and may have an administrative table, administrative box, and penalty box.

It is understood that the plurality of zones, lines, and demarcations of playing surface 20 of the invention may be provided in alternative numbers and configurations and are not limited to the written description and embodiments provided herein. Any measurement provided with any embodiment of the invention may be scaled up or down, proportionally or otherwise, with the size of playing surface 20.

In an embodiment, a backstop may be placed behind each goal 500 on playing surface 20 to stop ball 310 out-of-bounds behind or near goals 500. In another embodiment, a border wall may be provided outside of Welcome ring 38.

Playing surface 20 may be provided indoor or outdoor.

Ball

Referring now to FIGS. 6 through 15, ball 310 for playing the game is provided and is substantially spherical in shape. In an embodiment, ball 310 may comprise at least two sections 320 and 321 shown separately in FIGS. 6 and 7 and shown overlaid in FIG. 8. Each section 320 and 321 may comprise an even or odd number of arms 330 and 331 extending from center portions 340 and 341 shown specifically in FIGS. 6 through 8 and in the exploded view of ball 310 in FIG. 15. In the embodiment shown in FIGS. 6 through 15, two sections 320 and 321 are provided, each with three evenly-spaced arms 330 and 331 extending from center portions 340 and 341 at about 120 degree angles from one another. Sections 320 and 321 may comprise natural leather, synthetic leather, polyurethane, or other synthetic material.

The at least two sections 320 and 321 may be attached to one another by stitching either by hand or machine, bonding, thermal molding, or other suitable means for attaching sections 320 and 321 along one contiguous seam 344 to create substantially spherical ball 310.

A lining and/or an inflatable bladder may be provided within ball 310 between the attached symmetrical sections 320 and 321. The lining may comprise multiply or multilayer material or combinations of materials, such as, for example, a limited cotton/polyester blend, or similar material. The lining may be hermetically sealed to maintain an internal air pressure within lining of ball 310. A valve may be provided with the lining to add or to remove air from within the lining of ball 310 to maintain a desire pressure within ball 310. An inflatable bladder may be provided within substantially spherical ball 310 to maintain a desired air pressure within ball 310. The inflatable bladder may comprise valve 346 to add or remove air from within inflatable bladder to reach a desired internal air pressure within inflatable bladder. The inflatable bladder may comprise latex, butyl, or other suitable material or combinations of materials capable of maintaining a suitable amount of air pressure within ball 310 to play the game.

Ball 310 may have any circumference. In a non-limiting embodiment, the circumference of ball 310 may be in a range of about 24 inches to about 26 inches. Ball 310 may have any weight attributable to the materials it comprises. In a non-limiting embodiment, the weight of ball 310 may be in a range of about 240 grams to about 370 grams.

Goal

Referring now to FIGS. 16 through 29, goal 500 is provided as an apparatus on playing surface 20 for scoring ball 310 while playing the game. Goal 500 may provide at least two distinctly defined spaces, zones, or openings for scoring ball 310 during play of the game. In an embodiment, goal 500 may define multiple scoring zones.

Figure 23A:
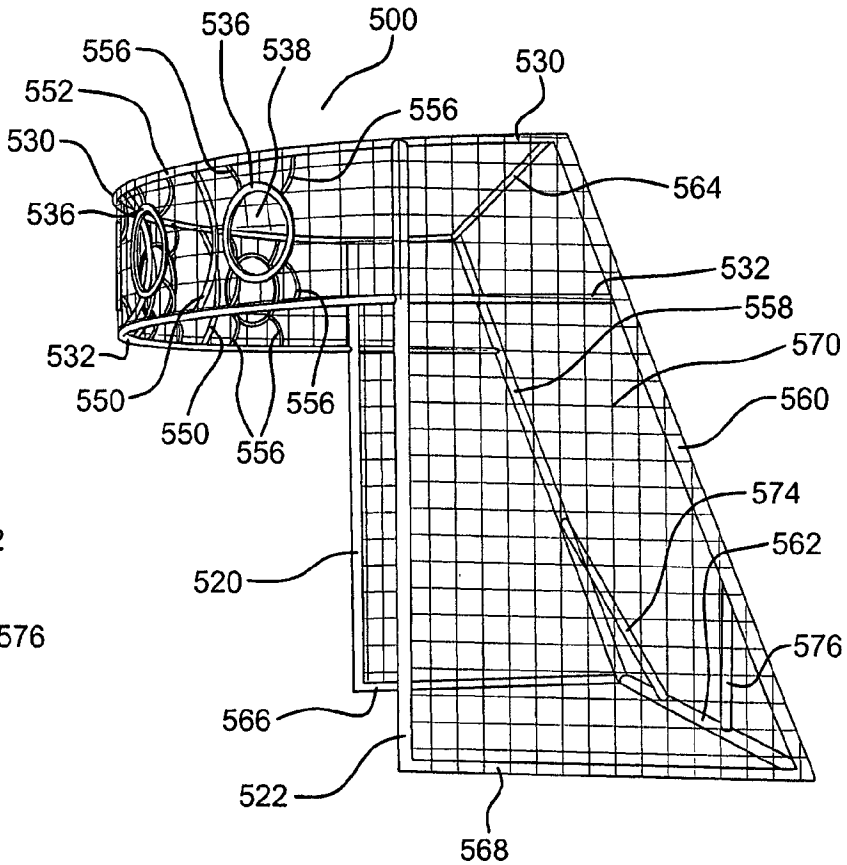
FIG. 23*a* shows a side perspective view of the goal shown in FIG. 18.
Figure 23B:
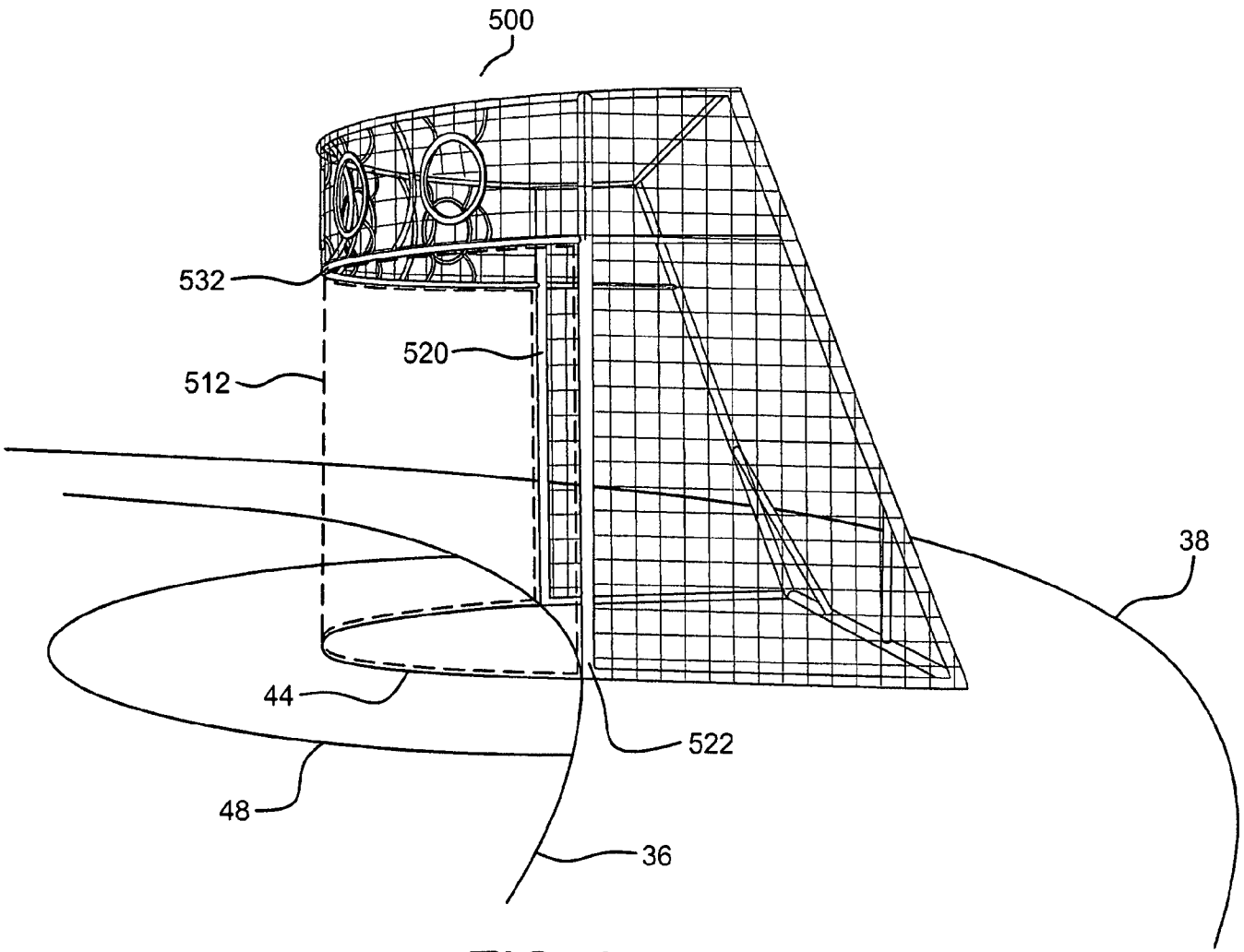
FIG. 23*b* shows a side perspective view of the goal shown in FIG. 18 delineating an arced rectangularly-shaped opening.
Figure 23C:
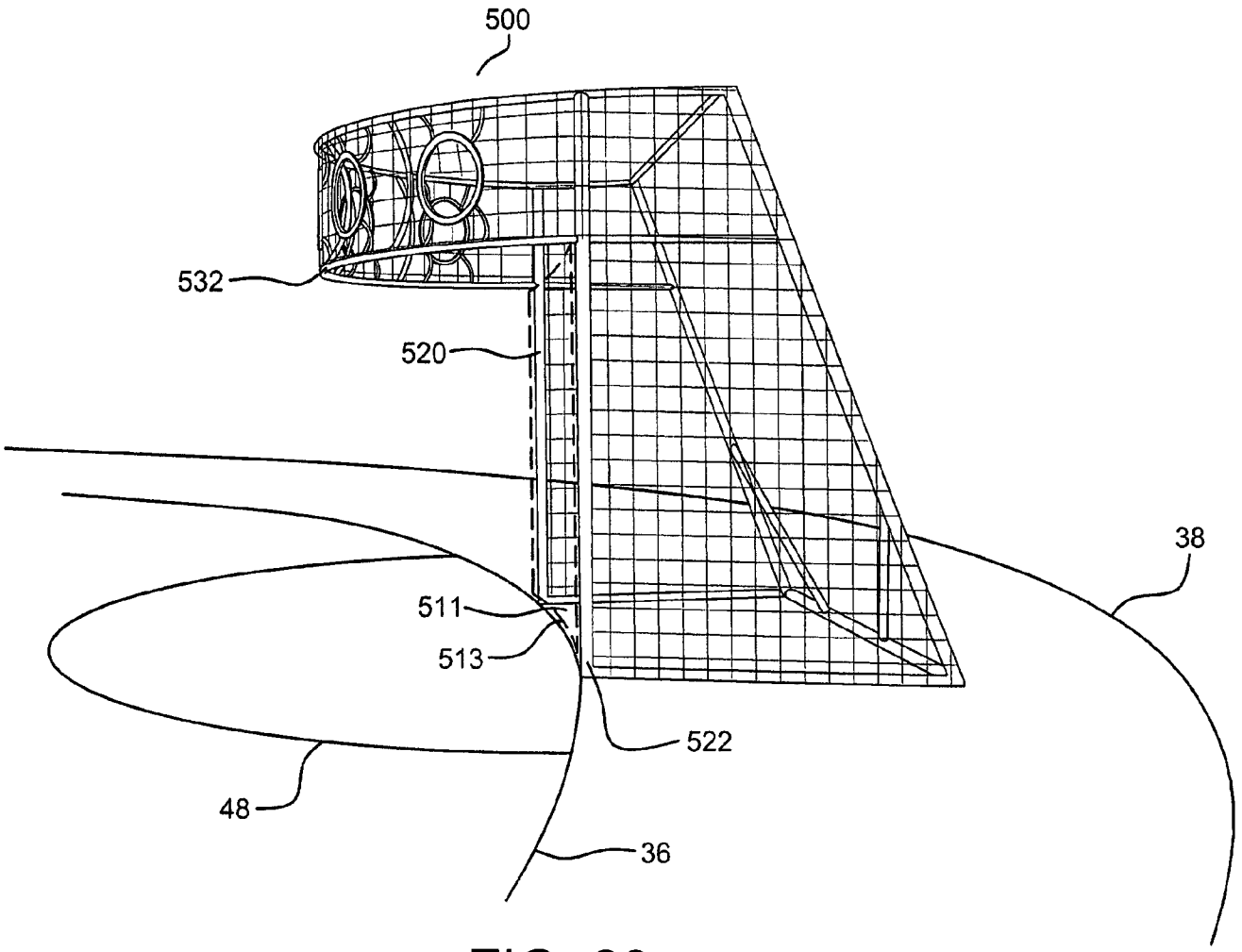
FIG. 23*c* shows a side perspective view of the goal shown in FIG. 18 delineating an alternative embodiment of an arced rectangularly-shaped opening.
Figure 24A:
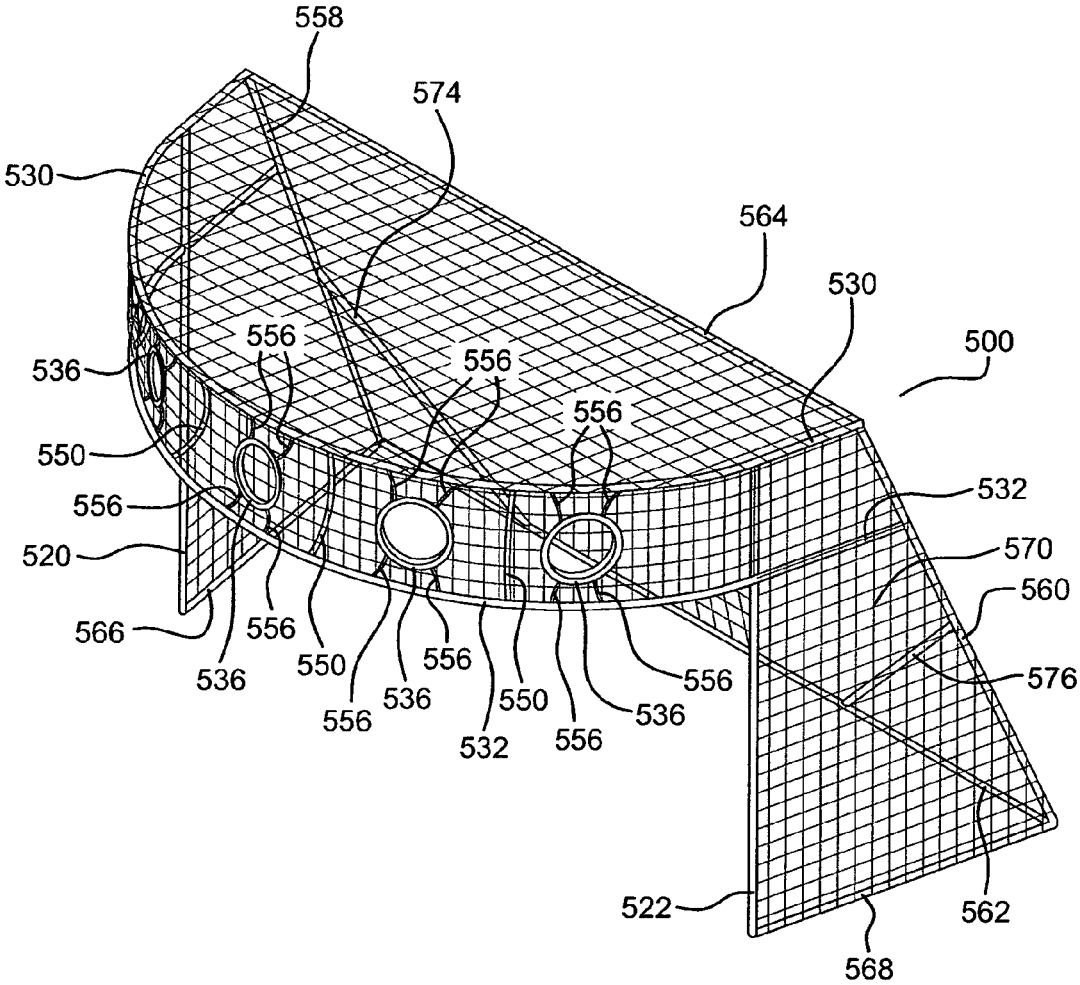
FIG. 24*a* shows a front perspective view of the goal shown in FIG. 18.
Figure 24B:
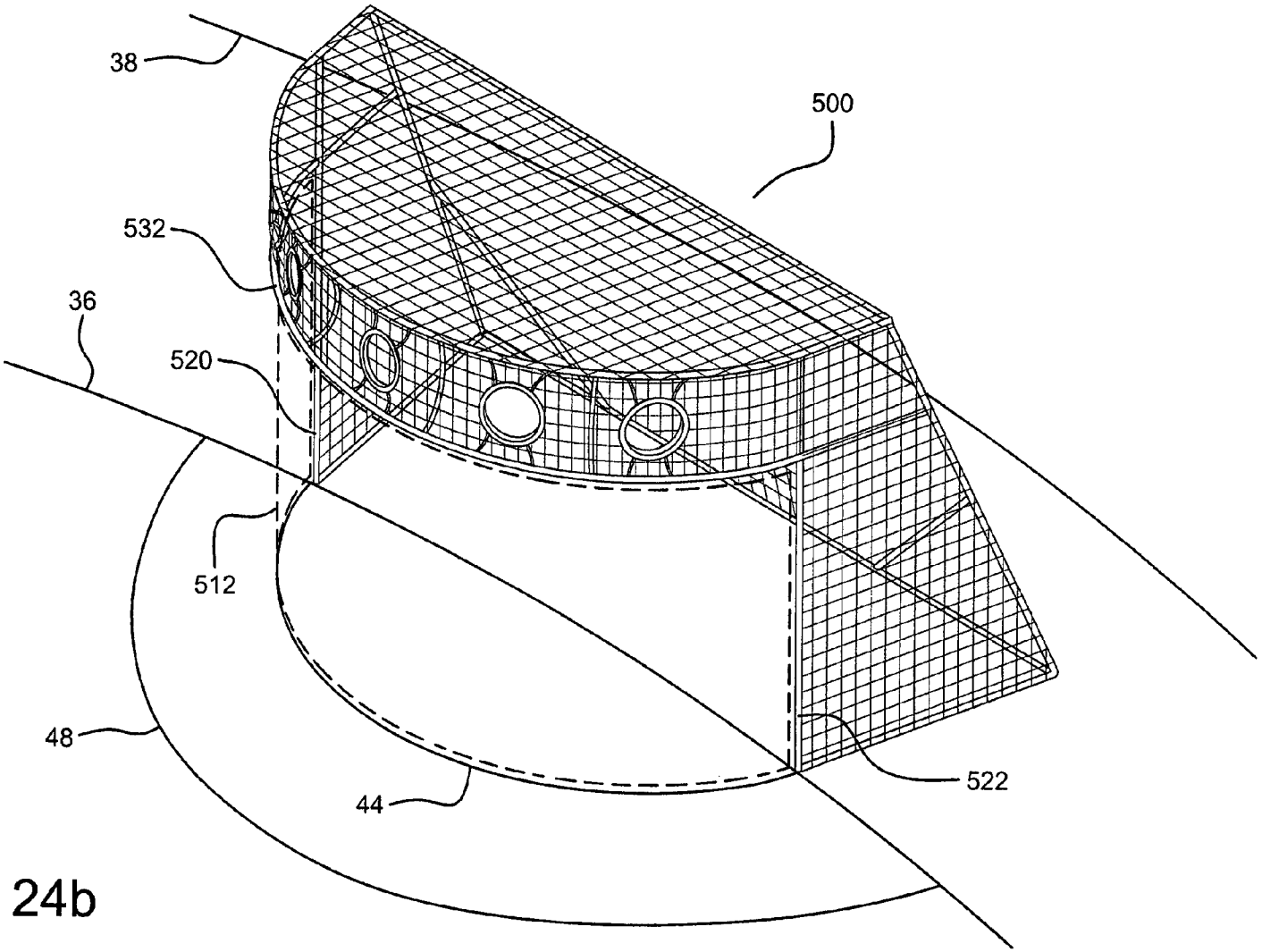
FIG. 24*b* shows a front perspective view of the goal shown in FIG. 18 delineating an arced rectangularly-shaped opening.

One type of scoring zone of goal 500 shown in FIGS. 16 through 29 may be arced rectangularly-shaped opening 512 shown specifically in FIGS. 23*b* and 24*b*. Arced rectangularly-shaped opening 512 may be three dimensional and defined by goal line 44 of playing surface 20 or a line on the surface upon which goal 500 is positioned substantially upright, first vertically configured post 520 and second vertically configured post 522, and lower horizontal and parallel convex arc bar 532 positioned substantially directly above goal line 44.

Figure 24C:
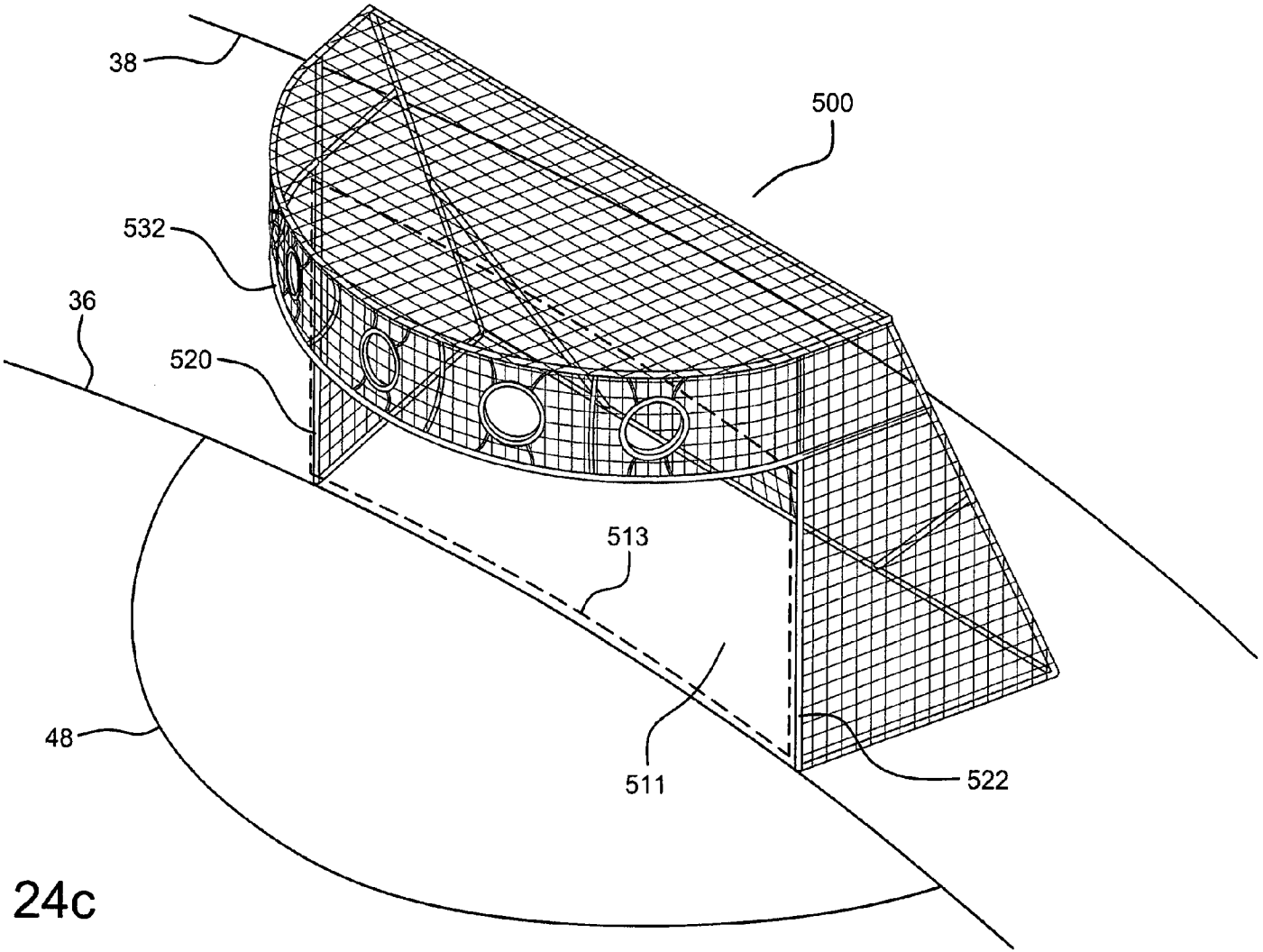
FIG. 24*c* shows a front perspective view of the goal shown in FIG. 18 delineating an alternative embodiment of an arced rectangularly shaped opening.
Figure 25:
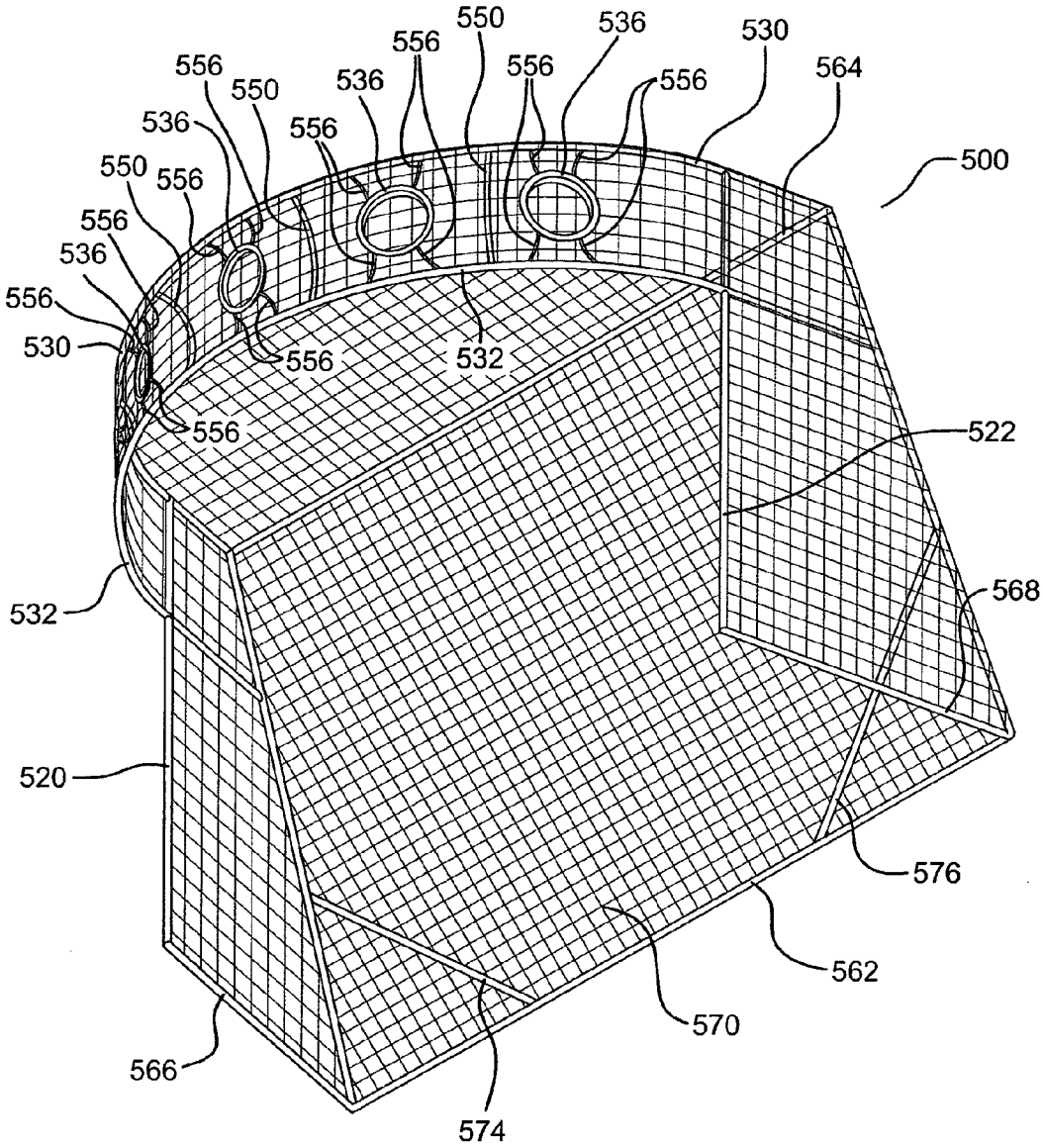
FIG. 25 shows a bottom perspective view of the goal shown in FIG. 18.
Figure 26:
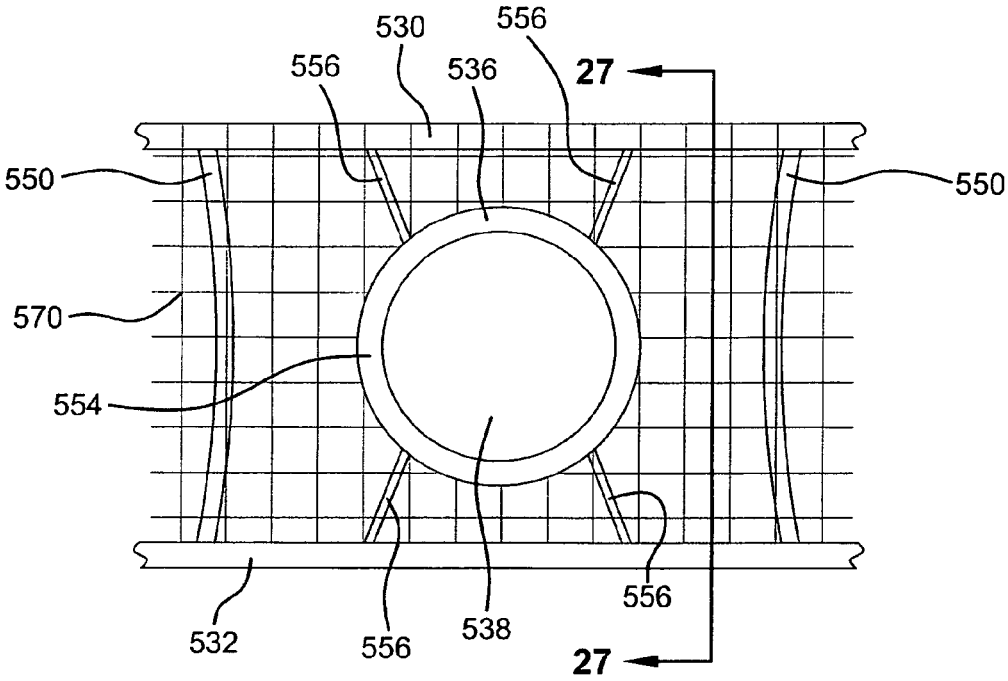
FIG. 26 shows a partial view of an embodiment of a Crown along Line 27 of the goal shown in FIG. 18.
Figure 27:
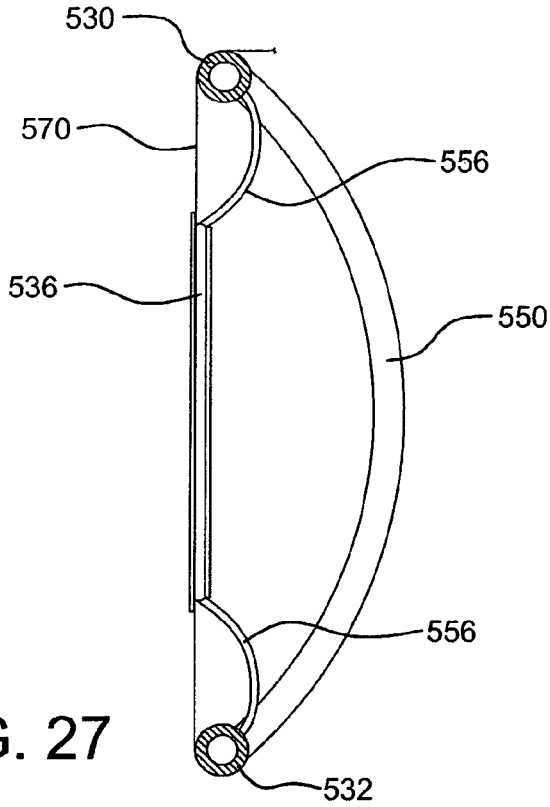
FIG. 27 shows a sectional view of the Crown shown in FIG. 26.
Figure 28:
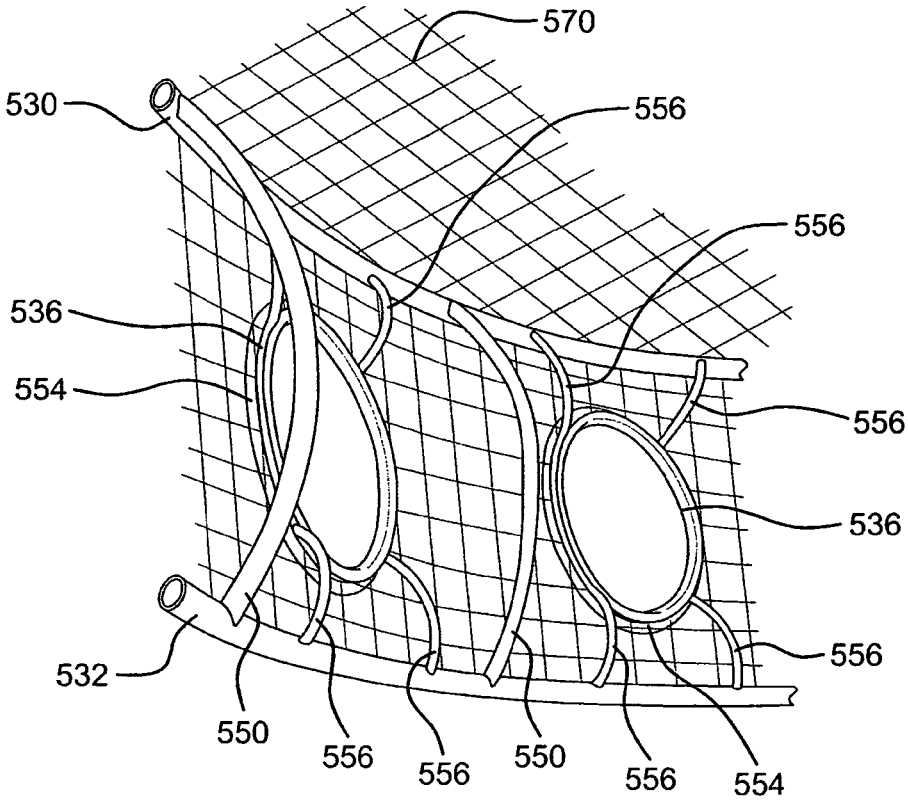
FIG. 28 shows a rear partial view of the Crown shown in FIG. 26.
Figure 29:
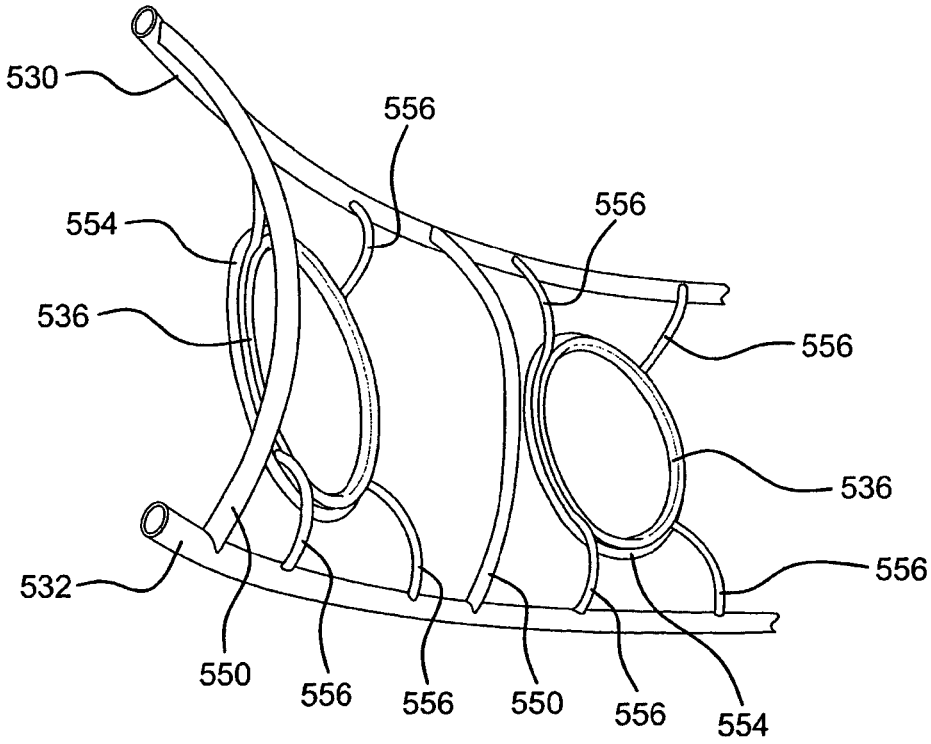
FIG. 29 shows a rear partial view of the Crown shown in FIG. 28 without a net attached thereto.

An alternative type of scoring zone of goal 500 shown in FIGS. 16 through 29 may be arced rectangularly-shaped opening 513 shown specifically in FIGS. 23*c* and 24*c*. Arced rectangularly-shaped opening 513 may be three dimensional and defined by the portion of boundary ring 36 of playing surface 20 or line on the surface upon which goal 500 is positioned substantially upright, first vertically configured post 520 and second vertically configured post 522, and up to net 570 along top of goal 500 or alternatively up to where lower horizontal and parallel convex arc bar 532 connects to first vertically configured post 520 and second vertically configured post 522.

In either embodiment of arced rectangularly-shaped opening 512 or 513, a goal chamber 511, as shown, for example, in FIGS. 23*c* and 24*c*, is defined from opening 512 or 513 into the interior of goal 500 defined by net 570.

In embodiments of goal 500, at least one circular open ring 536 may be provided substantially vertically configured between upper horizontal and parallel convex arc bar 530 and lower horizontal and parallel convex arc bar 532 of goal 500. Circular open rings 536 may be configured vertically along rectangular-shaped plane comprising a generally planar shape. Arc bar support posts 550 may be provided to maintain a uniform distance between upper horizontal and parallel convex arc bar 530 and lower horizontal and parallel convex arc bar 532 and support goal 500. Upper portion 552 of goal 500 comprising upper horizontal and parallel convex bar 530 and lower horizontal and parallel convex bar 532 with at least one circular open ring 536 may be referred to as "Crown" 552. The face of Crown 552 may be flat, concave, or convex.

Referring now to FIGS. 16 through 29, circular open ring 536 may comprise flat annular face 554 extending away from circular open ring 536. Circular open ring 536 may be attached by ring support connections 556, shown in FIGS. 16 and 29, to upper horizontal and parallel convex arc bar 530 and lower horizontal and parallel convex arc bar 532 of goal 500. Cylindrical open rings 536 may comprise plastic, fiberglass, graphite, composite material, or a combination of any of the foregoing or other rigid material suitable to maintain cylindrical open rings 536 substantially circular and open.

In an alternative embodiment, circular open rings 536 may be provided as circularly-shaped holes provided in a piece of substantially rectangularly-shaped Plexiglas, plastic, fiberglass, graphite, composite material, or a combination of any of the foregoing or other rigid material suitable to maintain circularly-shaped holes. Cylindrical open ring 536, having flat annular face 554, may be inserted into and attached to a corresponding circularly-shaped hole at any point along the periphery of circularly-shaped holes provided in the substantially rectangularly-shaped Plexiglas or an alternative. The substantially rectangularly-shaped Plexiglas or an alternative may be attached by any fastening or attachment means between upper horizontal and parallel convex arc bar 530 and lower horizontal and parallel convex arc bar 532 of goal 500.

In a further embodiment, at least one circular open ring 536 may be provided along net 570 stretched between upper horizontal and parallel convex arc bar 530 and lower horizontal and parallel convex arc bar 532 of goal 500. Circular open ring 536 may comprise an opening in the net 570 that is reinforced with any rigid material suitable to maintain circular open ring 536 in a substantially open and round configuration.

In any embodiment, circular open ring 536 must be large enough for a player to pass ball 310 completely through opening 538 defined by interior surface of circular open ring 536.

Referring now to FIGS. 16 through 25, goal 500 may also comprise support devices to maintain goal 500 in a substantially upright configuration on playing surface 20, generally facing toward the center of playing surface 20. In an embodiment, first rear support post 558 and second rear support post 560 may be provided to support goal 500. First rear support post 558 may be attached along its upper portion to the rear of first sides of both upper horizontal and parallel convex arc bar 530 and lower horizontal and parallel convex arc bar 532. Likewise, second rear support post 560 may be attached along its upper portion to the rear of second sides of both upper horizontal and parallel convex arc bar 530 and lower horizontal and parallel convex arc bar 532.

In an embodiment, first vertically configured post 520 and second vertically configured post 522 may be provided to support goal 500. First vertically configured post 520 may be attached near its upper portion near the rear of first sides of both upper horizontal and parallel convex arc bar 530 and lower horizontal and parallel convex arc bar 532. Likewise, second vertically configured post 522 may be attached near its upper portion near to the rear of second sides of both upper horizontal and parallel convex arc bar 530 and lower horizontal and parallel convex arc bar 532.

Referring now to FIGS. 16 through 25, the bottom end of first rear support post 558 may be attached to the bottom end of second rear support post 560 by lower horizontal support post 562. The top end of first rear support post 558 may be attached to the top end of second rear support post 560 by way of upper horizontal support post 564.

Referring now to FIGS. 16 through 25, the bottom end of first rear support post 558 may be attached by way of first lower support post 566 to first vertically configured post 520. Likewise, the bottom end of second rear support post 560 may be attached by way of second lower support post 568 to second vertically configured post 522.

Referring now to FIGS. 16 through 25, first angular support 574 and second angular support 576 may be provided to lend stability for lateral movement of goal 500. First angular support 574 may be used to connect first rear support post 558 to lower horizontal support post 562. Second angular support 576 may be used to connect second rear support post 560 to lower horizontal support post 562.

It is understood that various forms and configurations of support devices may be used so long as goal 500 provides at least one cylindrical open ring 536 providing opening 538 and arced rectangularly-shaped opening 512 or alternatively arced rectangularly-shaped opening 513 and is maintained in a substantially upright configuration, generally facing toward the center of playing surface 20.

All of the posts, crossbars, and support devices of goal 500 may be comprised of metal, metal alloy, plastic, or other suitable material or combination of materials capable of maintaining rigidity of goal 500. Posts, crossbars, and support devices may be round, as shown, for example, like pipe in FIGS. 27 through 29. Posts, crossbars, and support devices of goal 500 may be attached by welding, fasteners, bolts, pins with cotter keys, or other suitable fasteners or combination of fasteners capable of maintaining rigidity of goal 500.

One or more counterweights may be provided to maintain goal 500 in a substantially upright configuration. Fasteners may also be provided with goal 500 to removeably affix goals to corresponding fasteners on playing surface 20.

Referring now to FIGS. 18 through 21, 23*a* through 26, and 28, net 570 may be attached securely to goal 500 with fasteners. Net 570 provides openings for any number of circular open rings 536 provided with goal 500. Net 570 also provides an opening for arced rectangularly-shaped opening 512 and for alternative arced rectangularly-shaped opening 513. Net 570 may comprise any density of solid, mesh, interwoven, braided, or twisted natural or composite material including, but not limited to, heavy density materials that may be weatherproof and/or waterproof.

In an exemplary embodiment shown in FIGS. 16 through 25, five circular open rings 536 are provided substantially equally and symmetrically spaced between upper horizontal and parallel convex arc bar 530 and lower horizontal and parallel convex arc bar 532 attached to at least first vertically configured post 520 and second vertically configured post 522 and other support components of goal 500. In this embodiment, each circular open ring 536 has an internal diameter of about 18 inches defining opening 538. Alternative internal diameters of circular open ring 536 may be provided with goal 500. For example, the internal diameter of circular open ring 536 may be in a range of about 18 to about 24 inches.

In an embodiment, first vertically configured post 520 and second vertically configured post 522 of goal 500 may be spaced about 16 feet apart and joined by upper horizontal and parallel convex arc bar 530, which may be provided at a height of about 10½ feet substantially vertically from playing surface 20 in an embodiment, and lower horizontal and parallel convex arc bar 532, which may be provided at a height of about 8 feet substantially vertically from playing surface 20. Alternative space configurations may be provided.

Upper horizontal and parallel convex arc bar 530 and lower horizontal and parallel convex arc bar 532 shown in FIGS. 16 through 25 comprising Crown 552, may be positioned substantially directly and vertically above goal line 44 when goal is in position on playing surface 20 shown specifically in FIGS. 3 and 4. Crown 552 and optional goal line 44 may each comprise a substantially half-circle configuration with radius H originating at goal origin point 68 as illustrated specifically in the plan views of FIGS. 3 and 4. In an embodiment, radius H may be about 9 feet.

Referring now specifically to FIG. 4, midpoint 531 of upper horizontal and parallel convex arc bar 530 and lower horizontal and parallel convex arc bar 532 may protrude distance J from goal hash intersect 66 over playing surface 20 when goal is positioned on playing surface 20. In an embodiment, distance J may be about 63½ inches.

General Aspects of the Game

The method of playing the game on playing surface 20 with ball 310 and goals 500 involve the practice and display of a full range of human athleticism including, but not limited to, speed, agility, flexibility, three-dimensional mobility, strength, aerobic fitness, and dexterity of hands, feet, and mind. The game is designed for fast moving, free-flowing, and non-stop action, involving shots, scores, passes, and ball handling through an array of strategies and tactics to win the game.

The game may be played between at least two teams on any embodiment of playing surface 20. The base number of players for each team may be 10 players on playing surface 20, excluding players within team bench zones 64 or alternative team bench areas during a game. A team may have a total number of 20 players on a roster. The number of players may change to more than 10 or less than 10 depending on the strategy employed by any team and as described below. Teams must start each period with a base number of players unless a player has been ejected from a game according to game rules. A team may add or subtract a player from playing surface 20 during play to achieve tradeoffs, described below.

The team's base number of players may be reduced by the number of players ejected from the game according to penalty rules. In such instances, a team that has lost players due to ejection may still opt for a tradeoff, described below. A team that has a player ejected is not eligible for a Krone for good sportsmanship, described below, in the game that the player(s) was ejected.

A team may substitute players during a game. In an embodiment, a player leaving a game may be required to remove his/her active player arm band, if optionally in use, and hold it above his/her head upon leaving playing surface 20 and entering team bench zone 64. A player entering a game may be required to put on his/her active arm band and raise his/her arm while entering the game. An entering player may be required to enter the game from the same team bench zone 64 or alternative team bench area that the exiting player is entering as he/she is leaving the game. A substitution may be allowed for a player coming from Welcome ring 38 into his/her team bench zone 64 or alternative team bench upon conclusion of a penalty.

A team may be allowed any number of substitutions during play of a game. In another embodiment, substitutions may be made in a free-flowing manner according to alternative substitution procedures for the game. In an embodiment, players awaiting a substitution may leave a team bench area and proceed to a substitution box in an administration box area within Welcome ring 38. A exiting player leaving playing surface 20 on a substitution must completely exit playing surface 20 into a substitution box and touch a player entering the game on playing surface 20 in exiting player's place and before the player replacing him may enter playing surface 20. The exiting player may return to his team bench area or team bench zone 64. A substitution may be allowed for a player coming from a penalty box in administration box at the conclusion of a penalty.

Substitutes and substitutions may be subject to the authority of Referee R and assistant referees.

Players may be required to wear equipment to play the game. The equipment may comprise a jersey, shorts, socks, and shin guards. The equipment may correspond with a designated team uniform configuration. A player may opt to wear additional sports gear so long as such gear is approved by Referee R and is safe for play. A player may not wear any equipment or gear that is dangerous to himself/herself or other players. Referee R may instruct a player to exit playing surface 20 to remove dangerous equipment or gear or to correct equipment or gear. The player may reenter playing surface 20 once removal or correction is made. An active player band may be worn by players in a visible fashion to show that they are on playing surface 20 and playing in a game.

Ball Handling Rules

Team members may advance, pass, and move ball 310 amongst one another subject to ball handling rules within the zones on playing surface 20, described below, in exemplary embodiments of the game described in relation to FIGS. 30 through 101.

Rules are provided for handling ball 310 in cross zone 62. In an embodiment, a player may play ball 310 from his/her waist up in cross zone 62 shown generally in FIG. 1. In other words, a player may dribble, roll, hold, deflect, pass, catch, or shoot ball 310 with his/her arms, hands, torsos, or head. A player may not kick ball 310 in cross zone 62 or walk or run while holding ball 310. The player may advance, pass, or move ball 310 individually or with a team member according to the rules of play in cross zone 62.

Rules are provided for handling ball 310 in flex zone 56. In an embodiment, a player may play ball 310 with any part of his/her body in flex zone 56 shown generally in FIG. 1. In other words, a player may dribble, roll, hold, deflect, pass, catch, trap, deflect, kick, or shoot ball 310 with arms, hands, torsos, legs, feet, or head. A limitation of the nature of play in flex zone 56 may be that a player transition from playing ball 310 with his hands to his feet and vice versa so long as two-handed possession of ball 310 is not taken. The player may advance, pass, or move ball 310 individually or with a team member according to the rules of play in flex zone 56. The player may not walk or run while holding ball 310.

Rules are provided for handling ball 310 in wedge zone 50. In an embodiment, a player may play ball 310 with any part with his/her body except arms or hands in wedge zone 50 shown generally in FIG. 1. In other words, a player may dribble, trap, deflect, pass, kick, or shoot ball 310 with legs, feet, torso, or head. The player may advance, pass, or move ball 310 individually or with a team member according to the rules of play in flex zone 56. A player may not play ball 310 with his/her arms or hands in wedge zone 50.

Rules are provided for handling ball 310 in goal zone 46 shown generally in FIG. 1. In an embodiment, a player may be limited to the ball handling rules previously described for flex zone 56. A limitation on the nature of play in goal zone 46 may be that an offensive player may not have one-handed or two-handed possession while any part of player is in contact with playing surface 20. Additionally, only one offensive player may be present in goal zone 46 at a time for a limited time period. For example, such time period may be about four seconds. An offensive player in goal zone 46 may not interfere with any defensive member in goal zone 46. There may not be a limitation on the number of defensive players allowed in goal zone 46 or the duration of time any defensive player spends in goal zone 46. Defensive players may play ball 310 according to ball handling rules for flex zone 56. Furthermore, and when a defensive player takes two-handed control of ball 310 in goal zone 46, a change of possession between teams occurs.

An alternative embodiment of ball handling rules is provided. In this embodiment, and for cross zone 62, flex zone 56, and goal zone 46, players may dribble, roll, hold, pass, catch, trap, deflect, kick, or shoot ball 310 with their arms, hands, torsos, legs, feet, or head. In these zones, the players may play ball 310 with any part of their bodies; however, players may not walk or run while holding ball 310. A player may transition from playing ball 310 with his hands to his feet and vice-versa. In this same embodiment, and for wedge zone 50, players may dribble, trap, deflect, pass, kick, or shoot ball 310 with their legs, feet, torsos, or head. Players may not play ball 310 with their arms or hands.

Zone presence of a player may be determined by several different rules. A player is considered to be present in a zone if both of a player's feet are on playing surface 20 in the zone. A player is considered to be present in a zone if the player has only one foot on playing surface 20 in the zone. If a player has jumped into the air and neither of his feet are on playing surface 20, the player is considered present in the zone where his feet last left playing surface 20 and while the player is in the air. A player having a foot or any part of his body on playing surface 20 wedge zone 50 is considered to be in wedge zone 50. The player must handle ball 310 according to various embodiments of ball handling rules in use during a game based upon the player's presence in any particular zone.

Modified Ball Handling Rules—Bonuses, Tradeoffs, and Advantages

Bonuses, tradeoffs, and advantages may be available for teams playing the game. As previously disclosed, the base number of players per side is 10 players unless a player has been ejected for a foul. A team may add a player to the base number to play the game with 11 players or subtract a player from the base number to play the game with 9 players to receive tradeoffs. Teams may be required to communicate changes to the number of players on the field to Referee R. Referee R may be required to approve the change. Teams may be required to display the number of players in the game.

Ball handling rules may change as a result of adding or removing a player from the game. In a previously disclosed embodiment, both teams may play with 10 players each on playing surface 20 during a game. In this instance, normal ball handling rules for the various zones of the playing surface 20 may apply.

Figure 64:
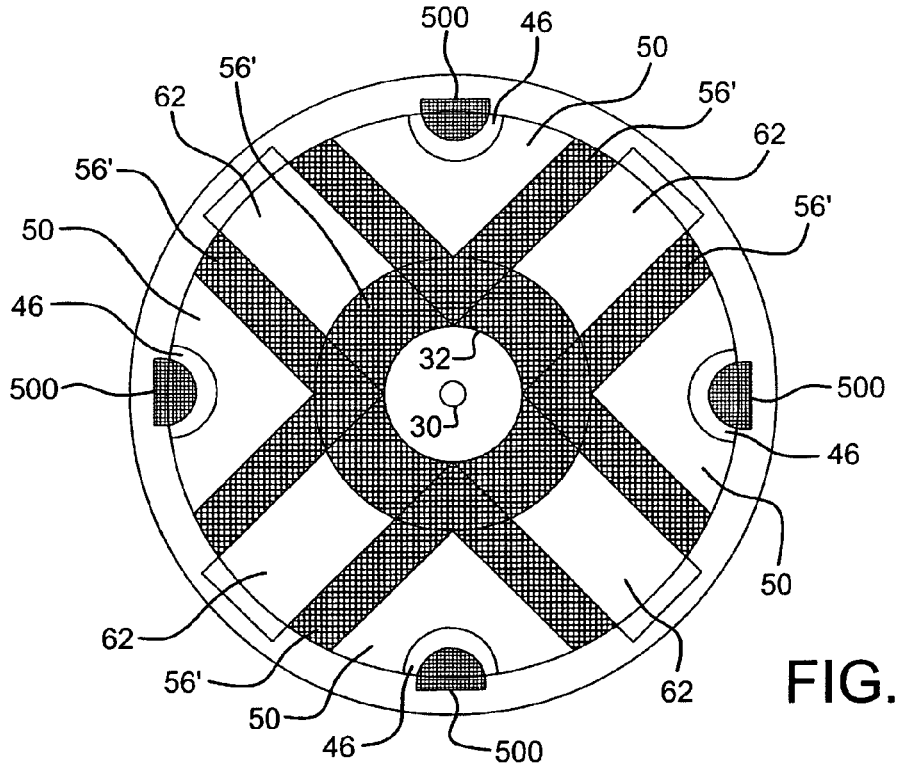
FIG. 64 shows an embodiment of a modified flex zone for a 9 player versus 9 player game.
Figure 65:
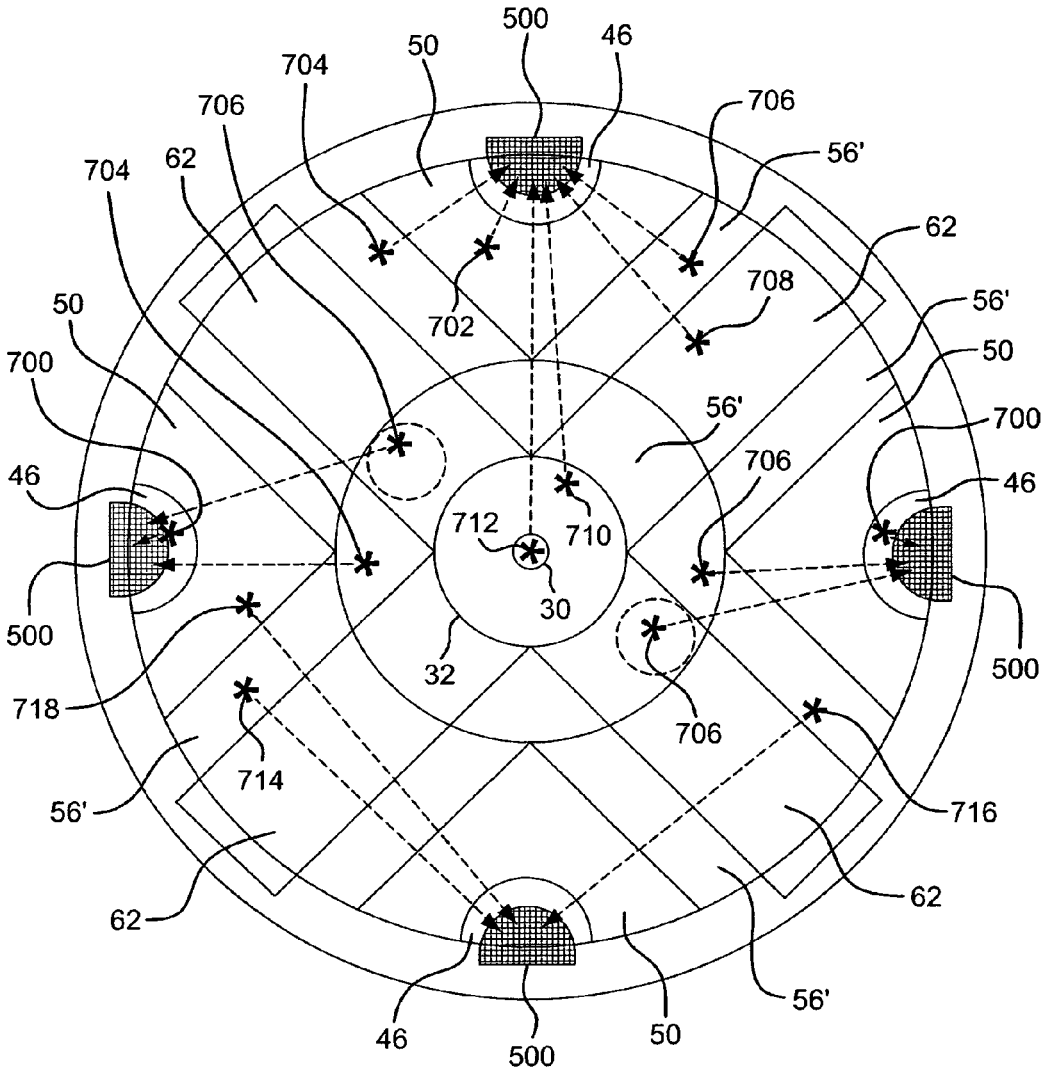
FIG. 65 shows an embodiment of a modified shot scoring system for a 9 player versus 9 player game.

In an alternative embodiment, both teams may play with 9 players each on playing surface 20 during a game. In this instance, ball handling rules for flex zones 56 extend to cross zones 62 outside second ring 32 and within third ring 34 as shown in FIG. 64. All other ball handling rules for the other zones on playing surface 20 would apply.

In another embodiment, both teams may play with 11 players each on playing surface 20 during a game. In this instance, flex zone 56 ball handling rules may extend to cross zone 62 outside of third ring 34, as shown, for example, in FIG. 66. All other ball handling rules for the other zones on playing surface 20 would apply.

In yet another embodiment, Team A may play with 9 players and team B may play with 10 players. In this instance, Team A may be allowed to re-advance ball 310 after a 2-handed possession on offense. All other ball handling rules for the zones on playing surface 20 would apply.

In an even further embodiment, Team A may play with 10 players and Team B may play with 11 players. In this instance, Team B may not be allowed into goal zone 46 on offense. All other ball handling rules for the zones on playing surface 20 would apply.

In yet an even further embodiment, Team A may play with 9 players and Team B may play with 11 players. In this instance, Team A may be allowed to re-advance ball 310 after 2-handed possession on offense. Team B may not be allowed into goal zone 46 on offense. All other ball handling rules for zones on playing surface 20 would apply.

Timed Period—Start, Stop, and Restart of Play

The game may be played within at least one timed period. In an embodiment, the game may be played within three timed periods, each referred to as a "Triad." Alternative numbers of timed periods may be used in playing the game. Timed periods may last about 20 minutes to about 30 minutes. In an embodiment, each timed period may be about 20 minutes. Alternative durations may be used for timed periods while playing the game.

Rest intervals may be provided between timed periods. Rest intervals may be in a range of about 3 minutes to about 5 minutes. Other durations of time for rest intervals may be used. Timed periods may be extended by Referee R for interrupted play of the game, time outs, fouls, penalties, and lost time, such as, for example, for player injury and treatment.

Team captains may greet one another and Referee R before the start of a game in prime ring 30. A team may be designated "Home team" and the other "Guest team." Referee R may flip a coin, and the Guest team may call a side for the coin-toss. The team that wins the coin-toss may elect one or more team bench zone 64 to occupy for the game.

Figure 70:
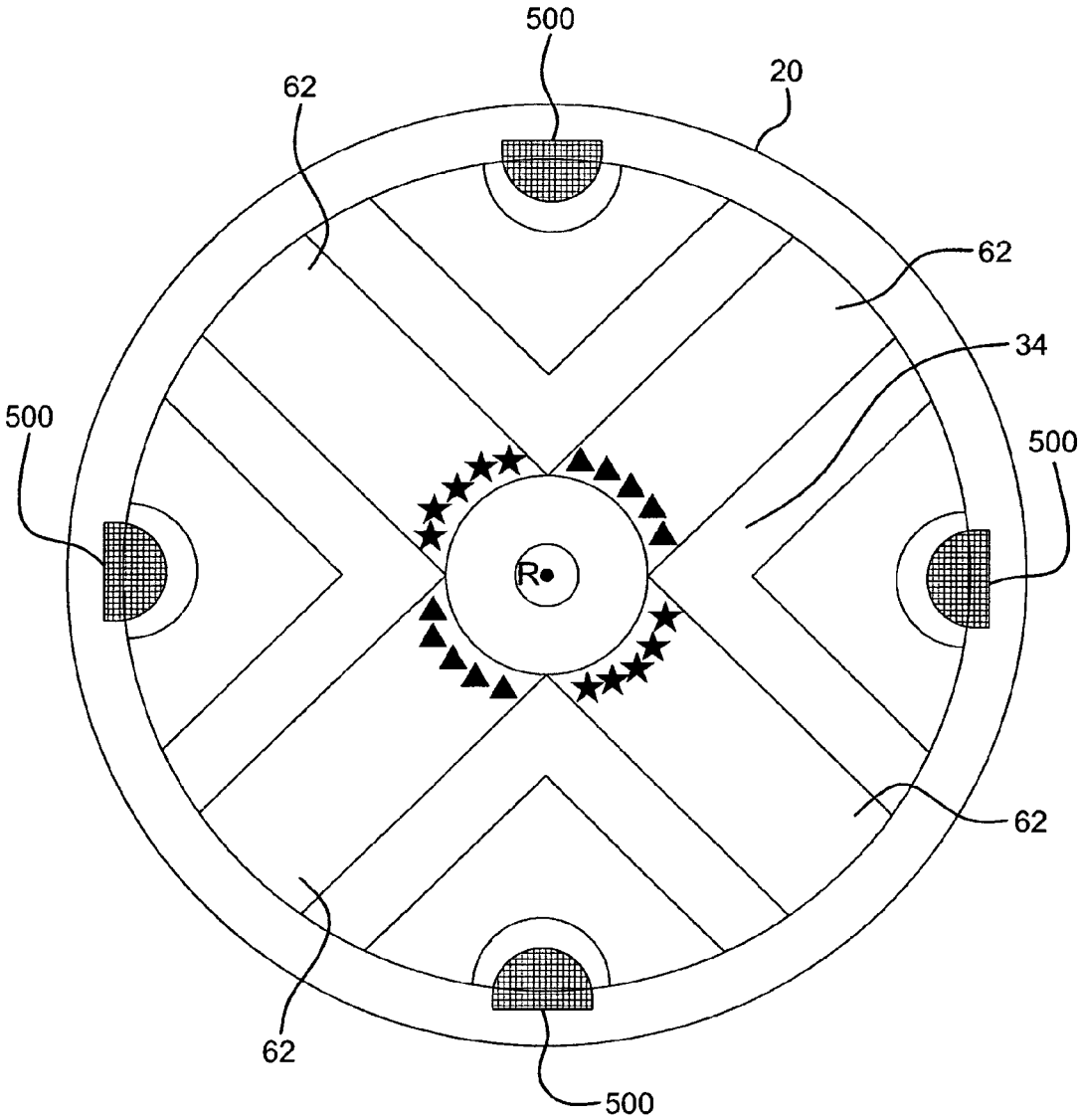
FIG. 70 shows an alternative embodiment of a team alignment for a prime rush.

The start of play for each timed period may be initiated by Referee R either bouncing ball 310 or throwing ball 310 vertically in center portion 28 of playing surface 20. In an alternative embodiment, Referee R may spike ball 310 on center spot 29 so that ball 310 bounces in Prime ring 30'. Referee R may also blow a whistle to provide an audible indication of the start of the game. The start of play of any timed period may be referred to as a "Prime rush." Prior to the Prime rush, players may be required to stand outside second ring 32, as shown in FIG. 70, or alternatively third ring 34, as shown in FIG. 30, on playing surface 20. Players may also be required to stand in cross zone 62 as shown in FIGS. 30 and 70. At the prime rush, players may rush from positions outside of second ring 32 or alternatively third ring 34 on playing surface 20 in an attempt to gain possession of ball 310.

In an embodiment, and at the start of a game with a Prime rush, players may be required to be outside of third ring 34 and optionally also inside cross zone 62. Teams may be required to start with 5 players in cross zone 62 and outside third ring 34 or second ring 32 depending upon the embodiment of playing surface 20 in use. Once Referee R blows a whistle, players may rush prime ring 30 to attempt to gain possession of ball 310. The team having possession of ball 310 is considered on offense, and the other team without possession of ball 310 is considered on defense.

Referee R or timekeeper may start a clock used to time each timed period after a Prime rush and while ball 310 is in-play. Referee R or timekeeper may stop the clock when ball 310 goes out-of-bounds. The clock may be started again when play is restarted with a kick-in or throw-in.

Ball 310 may be considered in-play when ball 310 is on the ground or in the air within boundary ring 36 of playing surface 20. Ball 310 is considered in-play when ball 310 is not out of play and at all times during the game, such as, for example, when ball 310 rebounds from goal 500 or Referee R within boundary ring 36 of playing surface 20.

Ball 310 may be considered out-of-play when ball 310 has crossed entirely outside boundary ring 36, whether on the ground or in the air and touches the ground outside of boundary ring 36. Ball 310 that is out-of-play may be an out-of-bounds violation, and ball 310 may then be turned over to the opposing team that was not the last to have a player contact ball 310 before ball 310 went out-of-play. Ball 310 may also be considered out-of-play once ball 310 entirely crosses goal line 44 for a score. In this case, ball 310 may be turned over to the non-scoring team and put back in play when ball 310 is cleared into second ring 32. Ball 310 may be considered out-of-play if ball 310 strikes a player outside of Boundary ring 36 with one or both feet on playing surface 20. Ball 310 may also be considered out-of-play when Referee R stops or suspends the game for a violation, foul, held ball, injury, time out, period end, or other such matter.

Play of the game stops if ball 310 goes out of play outside peripheral boundary 24. Play of the game may be restarted by either a kick-in or throw-in.

A kick-in may be used to resume play of the game if ball 310 goes out-of-bounds. In an embodiment, a kick-in may be used to restart play if ball 310 goes out of bounds in cross zone 62. A kick-in may be awarded to team opposing a player that last touched ball 310 before ball 310 entirely crossed boundary ring 36. A player may not score ball 310 directly on a throw-in.

Figure 60:
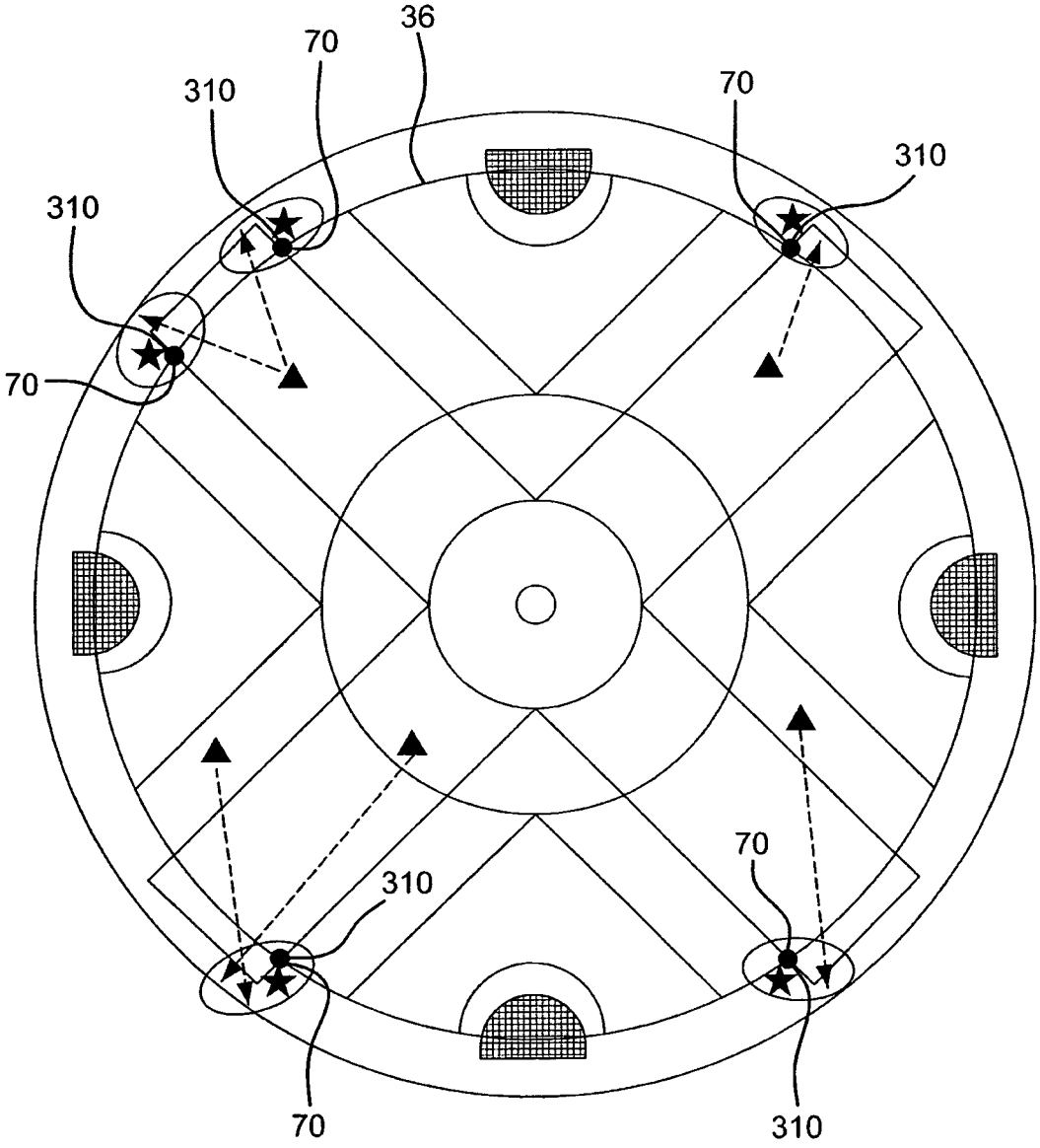
FIG. 60 shows alternative embodiments of a kick-in of a ball.

Referring now to FIG. 60, ball 310 crossing out-of-bounds at boundary ring 36 in cross zone 62 may be placed at the nearest cross zone/flex zone corner point 70 for a kick-in to restart play. A kick-in may occur by a kicker placing ball 310 at the nearest cross zone/flex zone corner point 70 where ball 310 went out-of-bounds. Kicker's opponents may be required to remain about 3 or more yards from the point where the kick-in is to be taken. The kicker may be required to remain outside boundary ring 36 and take no more than two steps before kicking ball 310 into play on playing surface 20. The kicker may only touch ball 310 after ball 310 has touched another player.

Play of the game may also be restarted by a throw-in if ball 310 goes out-of-bounds. A throw-in may be used to restart play if ball 310 goes out-of-bounds in wedge zone 50 or flex zone 56. A throw-in may be awarded to the team opposing a player that last touched ball 310 before ball 310 entirely crossed out-of-bounds over boundary ring 36. A player may not score directly from a throw-in.

Figure 61:
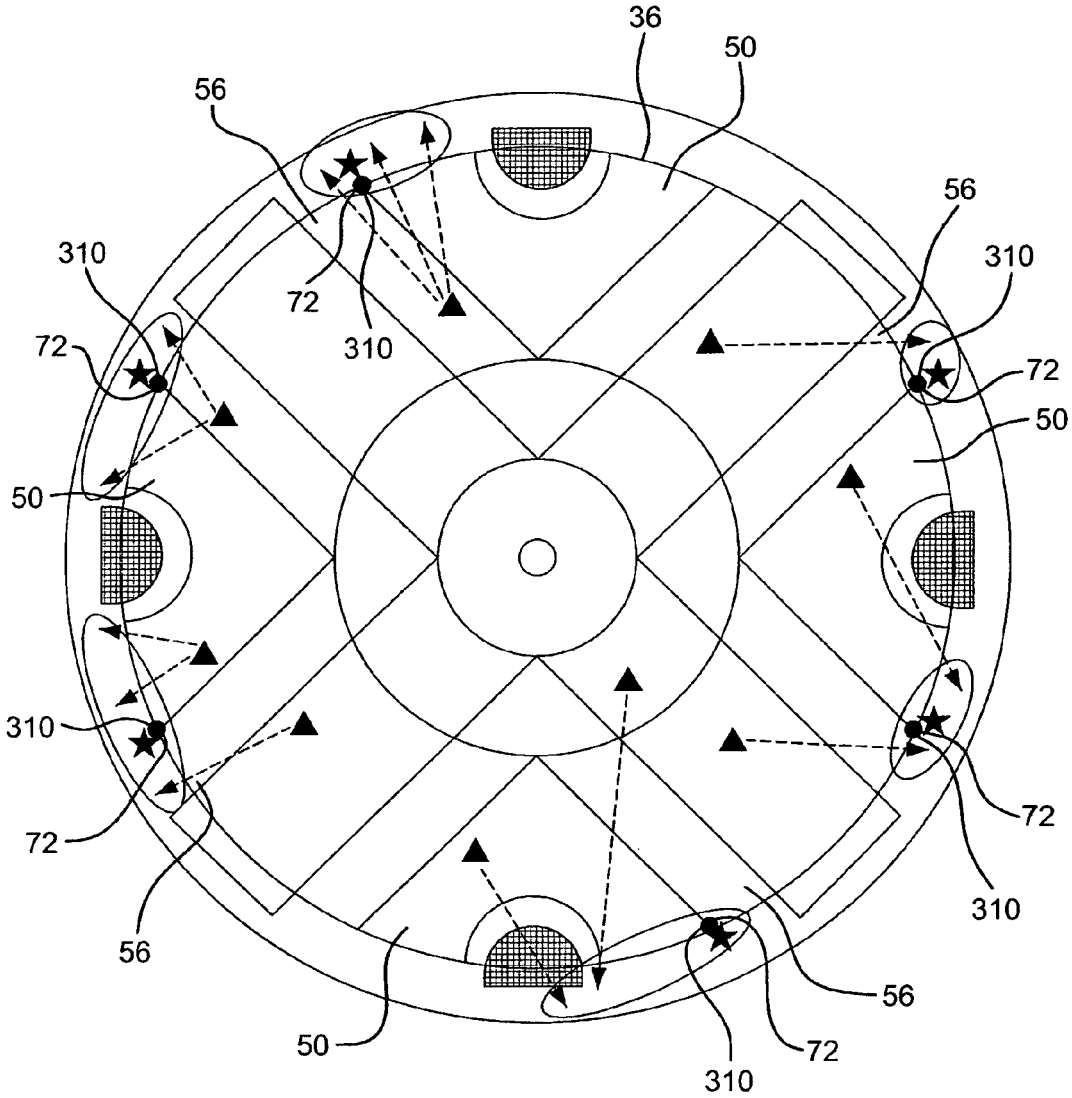
FIG. 61 shows alternative embodiments of a throw-in of a ball.

Referring now to FIG. 61, ball 310 crossing out-of-bounds at boundary ring 36 in wedge zone 50 or flex zone 56 may be placed at the nearest wedge zone/flex zone corner point 72 for a throw-in to restart play. A throw-in may occur by a thrower holding ball 310 with one or two hands while standing on boundary ring 36 as shown in FIG. 61. The thrower may start the throw outside boundary ring 36 so long as thrower is standing on boundary ring 36 upon release of ball 310. Opponents may be required to remain two or more yards from the point at which the throw-in is taken. The thrower may take no more than two steps before releasing ball 310. Ball 310 is in-play once ball 310 crosses over boundary ring 36 in bounds. The thrower may touch ball 310 after ball 310 has touched another player on playing surface 20.

Figure 81:
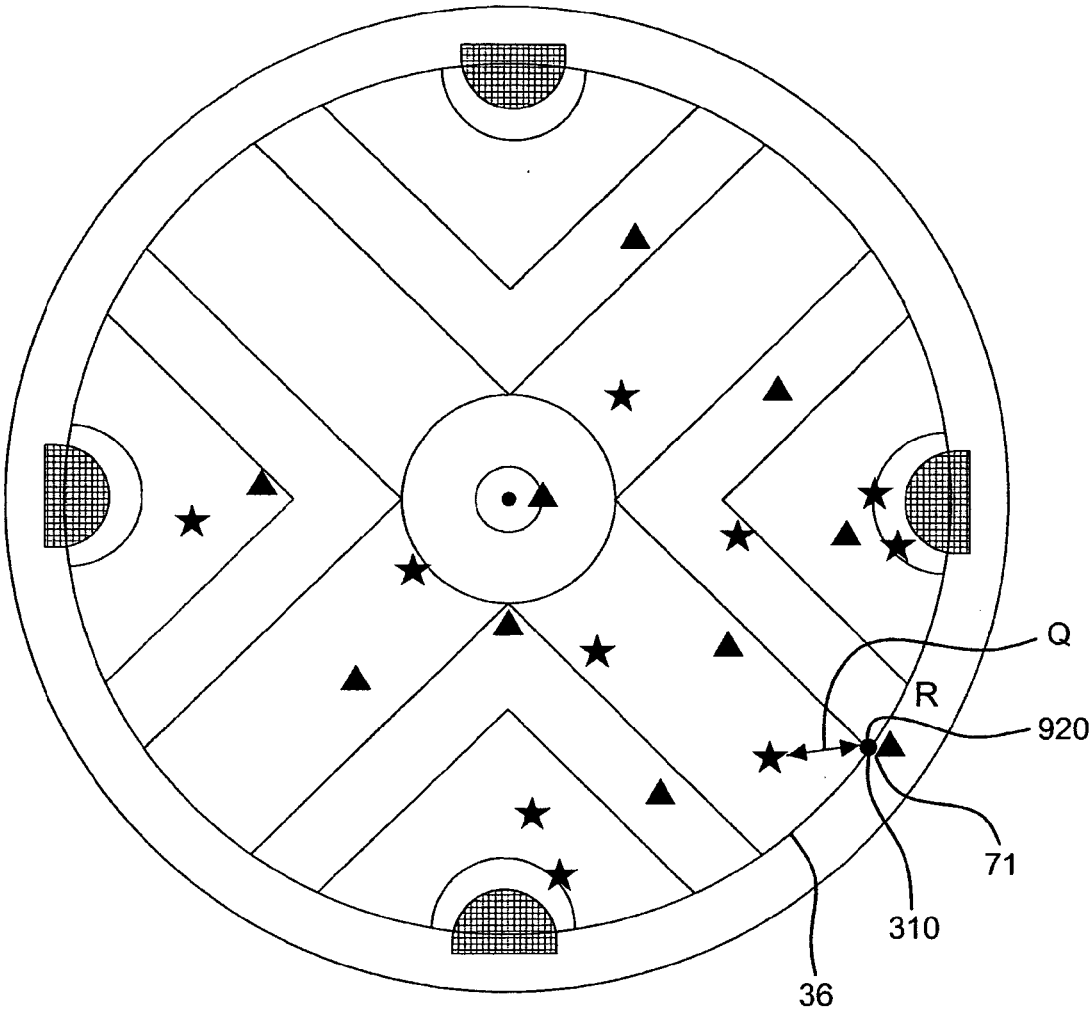
FIG. 81 shows an alternative embodiment of a throw-in alignment.
Figure 82:
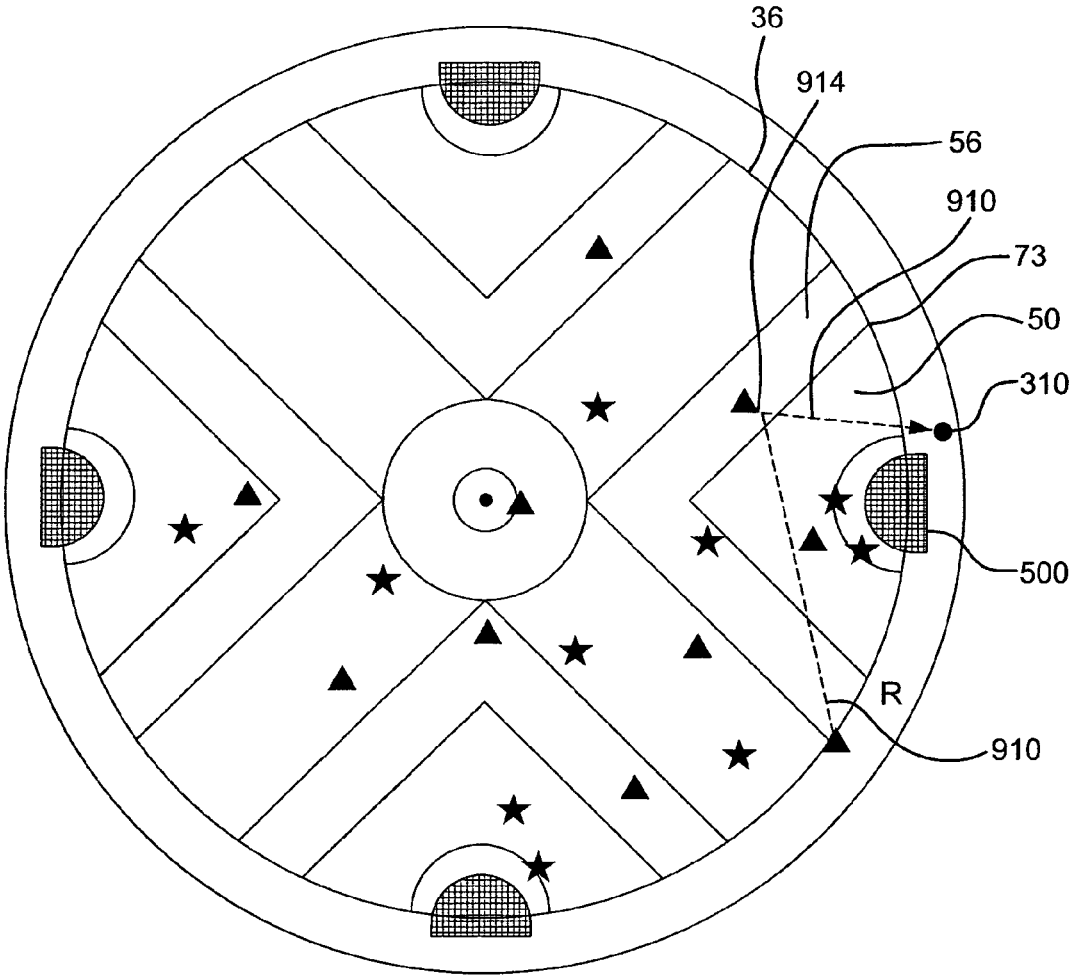
FIG. 82 shows an alternative embodiment of a throw-in and a shot resulting in an out-of-bounds.
Figure 98:
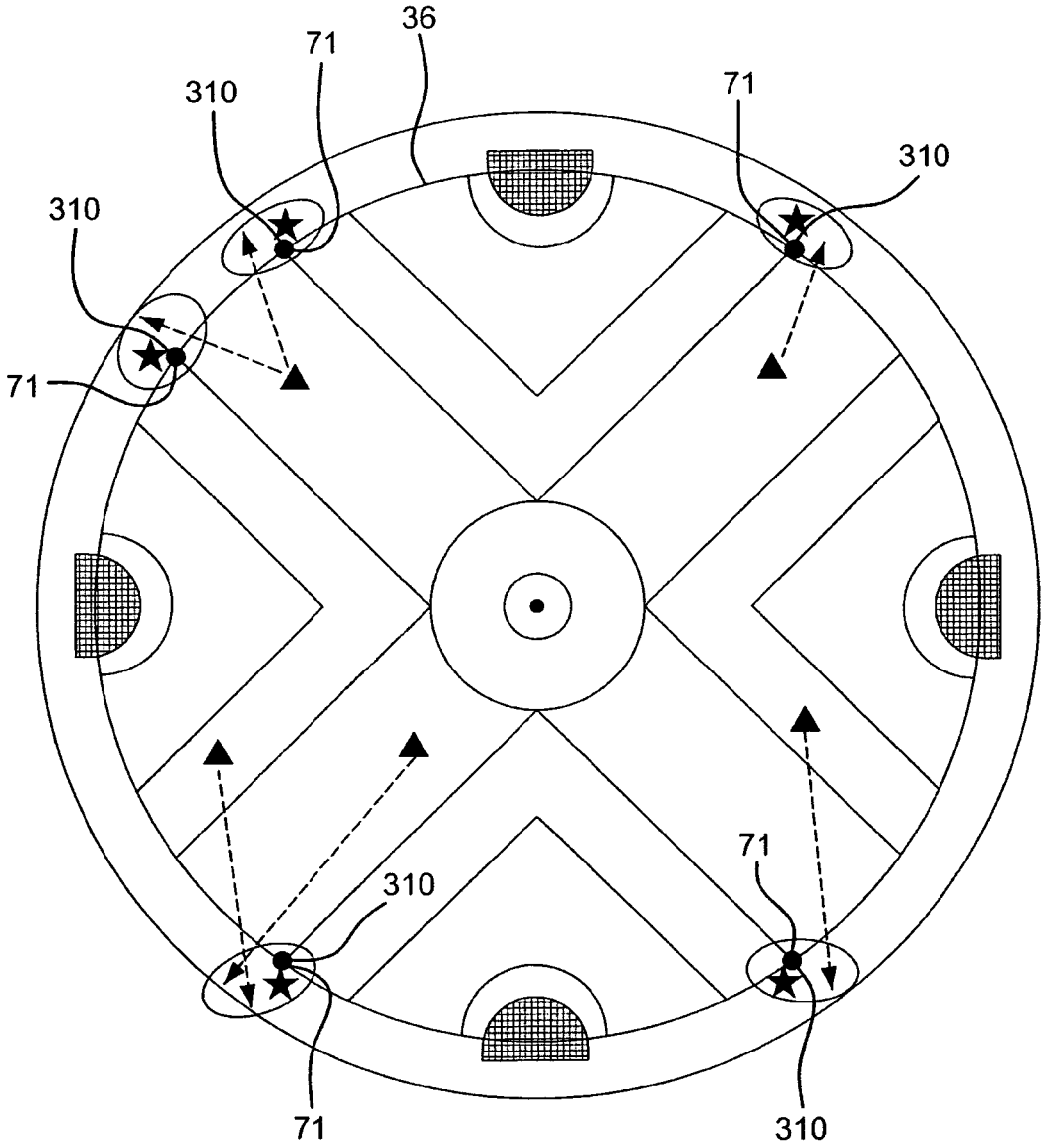
FIG. 98 shows alternative embodiments of throw-in configurations.

An alternative embodiment of throw-ins are provided and may be used in place of a kick-in procedure. If ball 310 passes over boundary ring 36 in cross zone 62 and out-of-bounds, a throw-in may take place at the nearest flex zone corner point 71 as shown in FIG. 98. The team throwing ball 310 into play is on offense and does not need to clear ball 310 as shown in FIGS. 81 and 82. The team throwing ball 310 into play may not score directly from the throw-in. The team defending the throw-in must remain distance Q away from flex zone corner point 71 until ball 310 is released.

Figure 83:
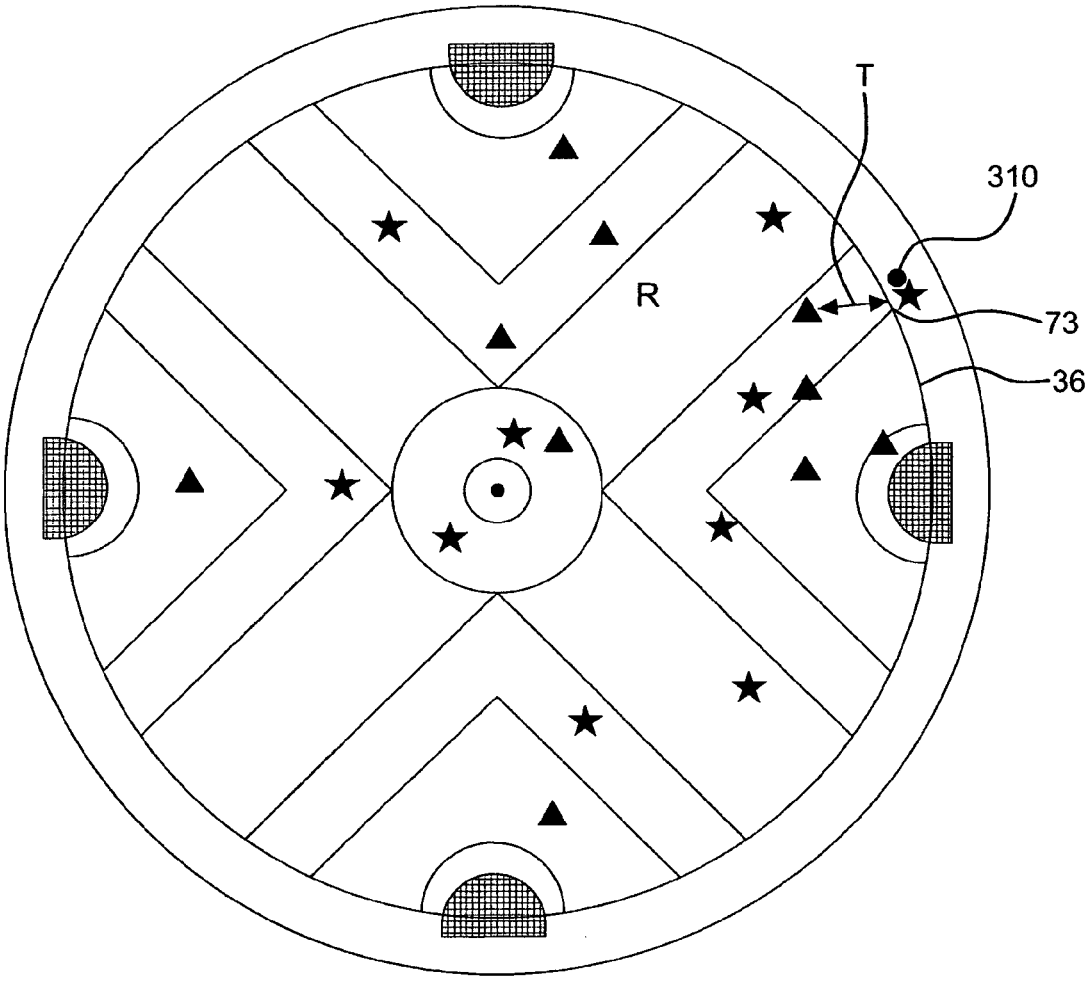
FIG. 83 shows an alternative embodiment of another throw-in alignment.
Figure 84:
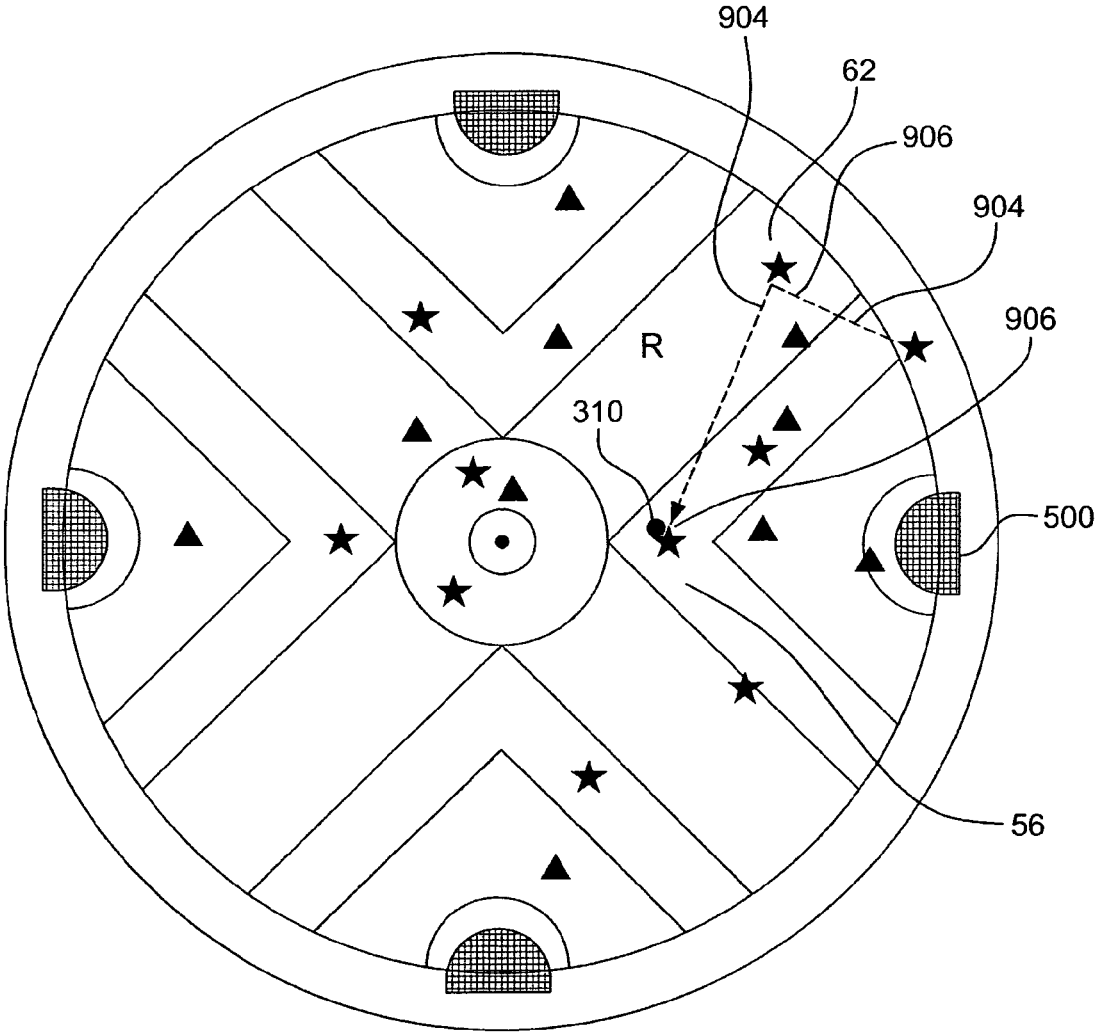
FIG. 84 shows an alternative embodiment of a throw-in and a pass of a ball.
Figure 99:
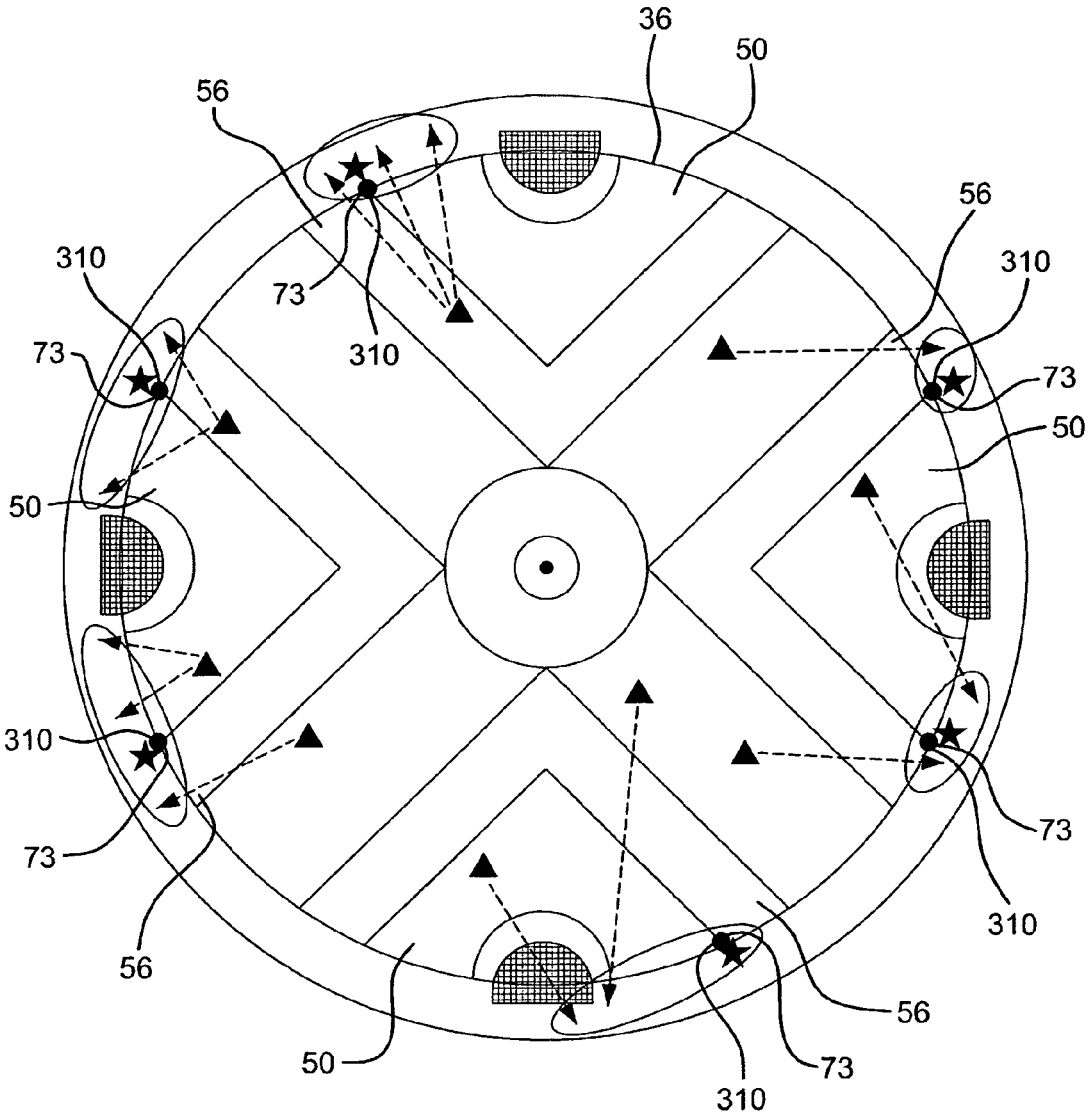
FIG. 99 shows further alternative embodiments of throw-in configurations.

A further alternative embodiment of throw-ins are provided and may be used in place of a kick-in procedure. If ball 310 passes over boundary ring 36 from flex zone 56, wedge zone 50, or goal zone 46 and out-of-bounds, a throw-in may take place at the nearest wedge zone corner point 73 as shown in FIG. 99. The team A throwing in ball 310 does not need to clear ball 310 since the turn over occurred on an out-of-bounds as shown in FIGS. 83 and 84. The team A throwing in ball 310 may not score directly from the throw-in. The team defending the throw-in must remain a minimum distance T from the point at which the throw-in is taken until ball 310 is released.

Each team may be provided with a set number of time-outs per game. In an embodiment, three time-outs are provided to each team. The number of time-outs may be more or less than three per game. A time-out lasts a set duration of time. In an embodiment, a time-out may last about 30 seconds or other duration of time. In a further embodiment, two 30 second time outs and one 60 time out may be provided for each team.

An overtime period may be provided if the game is tied at the end of the timed periods. The overtime period may be about 5 minutes or other duration of time. Additional overtime periods may be used if the score is tied at the end of an overtime period.

Offense

Teams may advance ball 310 while on offense according to the rules of play in plurality of zones on playing surface 20. A player may advance ball 310 within the plurality of zones on playing surface 20, so long as he/she obeys ball handling rules pertaining to the respective zones, as well as the general ball handling and other rules of the game. Upon a player taking two-handed possession of ball 310—other than after a catch in cross zone 62 or flex zone 56—the player may not be allowed to dribble or kick ball 310. The player may roll or throw ball 310 to a teammate; roll or throw ball 310 at goal 500; or roll or throw ball 310 into an open space on playing surface 20. In any of those cases, the player who initiates the roll or throw may not reclaim possession of ball 310 until ball 310 has touched a teammate or goal 500, or until ball 310 has been possessed by an opponent.

Upon taking either one-handed or two-handed possession of ball 310, a player may establish an anchor foot and a free foot. The anchor foot is the foot to first touch playing surface 20 when the player takes possession. The free foot is the foot to last touch playing surface 20 after the player takes possession. If both feet are touching playing surface 20 when the player takes possession, then the player may elect to designate either foot as his anchor foot by moving or lifting his/her free foot. A player may use his anchor foot as a pivot and take a legal step—or a series of legal steps—with his free foot, so long as his anchor foot does not leave playing surface 20. A player may use his free foot to play ball 310 from a one-handed possession.

In an alternative embodiment, upon taking one-handed or two-handed control of ball 310, a player may take up to, but not more than, two complete steps in sequence with opposite feet before releasing ball 310 in the act of dribbling, passing, or shooting. Upon taking two complete steps in sequence with opposite feet, a player may not lift a foot before dribbling or passing, unless that player takes a shot on goal 500 before completing a third step. Upon taking one-handed or two-handed possession of ball 310, a player may take an unlimited number of pivot steps with a single free foot, so long as his anchor foot does not leave playing surface 20. The anchor foot is the foot to first touch playing surface 20 when the player takes possession. The free foot is the foot to last touch playing surface 20 after the player takes possession. If both feet are touching playing surface 20 when the player takes possession, then the player may elect to designate either foot as his anchor foot by moving or lifting his free foot. Upon taking two pivot steps with his free foot, a player loses the right to lift his anchor foot.

In alternative embodiments, in cross zone 62, flex zone 56, and goal zone 46, players may possess and advance ball 310 by dribbling, rolling, holding, passing, catching, trapping, deflect, kicking, or shooting ball 310 with their arms, hands, torsos, legs, feet, or head. In these zones, the players may play ball 310 with any part of their bodies; however, players may not walk or run while holding ball 310. A player may transition from playing ball 310 with his hands to his feet and vice-versa.

Only one offensive player is allowed in goal zone 46 at a time. The offensive player has a 4-second limitation to remain within goal zone 46 before he must vacate the area to reset the 4-second count. Once goal zone 46 is cleared of offensive players, the same player or a new offensive player may move into goal zone 46 for a maximum of four seconds. An offensive player may not interfere with a defensive player in goal zone 46.

In wedge zone 50, players may possess and advance ball 310 by dribbling, trapping, deflecting, passing, kicking, or shooting ball 310 with their legs, feet, torsos, or head. Players may not play the ball with their arms or hands. A player with a foot or any part of his body on playing surface 20 in wedge zone 50 is considered in wedge zone 50, and he may not play ball 310 with his arms or hands.

Players may possess and advance ball 310 between zones on playing surface 20, so long as ball handling rules pertaining to the respective zones are obeyed.

An offensive player may not be allowed to hold ball 310 for greater than 5 seconds when being closely guarded by one or more defensive players. If this occurs, the offensive player may be considered trapped by the defensive team, and Referee R may signal a change of possession or may signal a Held ball as described hereinafter.

Defense

Defensive players may challenge an offensive player for space on playing surface 20 and for control of ball 310 during play of the game. Defensive players may be required to play by the rules for player conduct and avoid fouls.

Defensive players may block or stop any pass or shot of ball 310 by an offensive player so long as the defensive player does not violate ball handling and other game rules. A defensive player performs a save when the defensive player in goal zone 46 stops, deflects, or catches an offensive player's shot of ball 310 toward goal 500.

In cross zone 62, flex zone 56, and wedge zone 50, players may play ball 310 with their arms, hands, torsos, legs, feet, or head. In these zones, the players may play the ball with any part of their bodies. Players may not walk or run while holding ball 310.

There is no limit on the number of defense players allowed in goal zone 46 at a time, nor is there a limit on the duration of time a defensive player may remain in goal zone 46. The defensive team may move as many players as they like into goal zone 46 to defend goal 500.

In wedge zone 50, players may play ball 310 with their legs, feet, torsos, or head. Players may not play ball 310 with their arms or hands. A player with a foot or any part of his body on the ground in wedge zone 50 is considered to be in wedge zone 50, and he may not play ball 310 with his arms or hands.

A defensive player may challenge an offensive player for space in playing surface 20 and for control of ball 310, so long as he does not commit an act of misconduct or a foul Once a defensive player has established presence at a location on playing surface 20, he has the right to that space. If an offensive player runs into or through that established defensive player and creates an unfair offensive advantage, it is considered an offensive charge violation.

A defensive player may score by making a shot save when defensive player catches ball 310 shot by an offensive player in goal zone 46 triggering a change of possession. A point may be awarded to the defensive team for a shot save.

Clearance and Possession of Ball

Ball 310 may be required to be cleared after a score, turnover, or change-of-possession.

Generally, the last team to clear ball 310 into second ring 32 or take a throw-in is considered to be in-possession of ball 310 and on offense. That team may attack any goal 500 while they control ball 310 until they score, or until the opposing team takes control of a live (in play) ball 310 and completes a clearance to second ring 32 or takes possession on an out-of-bounds violation.

In an embodiment, ball 310 may be cleared after a score, a live-ball turn over, an out-of-bounds, and rules infraction.

For example, and after an offensive team, Team A, scores, the team that was in a defensive position, Team B, gains control of ball 310. Team B must collect ball 310 from goal 500 and clear ball 310 to a teammate inside second ring 32 by a throw or a kick from within goal zone 46, before Team B is considered to be in possession to advance on offense. Team A may not challenge or interfere with this clear. This may be referred to as a "Free clear." The Free Clear may be required to be completed within 10 seconds. Team A must vacate second ring 32 until the Free clear is complete and a Team B player has touched ball 310 inside second ring 32. The new defensive team, Team A, may rush into second ring 32 and challenge the new offensive Team B player in possession of ball 310 as soon as that possession is established. If a Team A player gets caught inside second ring 32 on a Free clear, that Team A player may not challenge a Team B player inside second ring 32 before that Team A player vacates second ring 32. In other words, Team A players who are outside second ring 32 on the Free clear may rush in and defend, but Team A players stuck in second ring 32 on the Free Clear must vacate before coming back in to defend. If a clearing throw or kick misses second ring 32 or passes through second ring 32 without being touched by the clearing team, Referee R may signal a stray clear. At that point, ball 310 is considered a loose ball which may be captured by either team. Either team capturing ball 310 after a Stray clear must clear ball 310 into second ring 32 before advancing on offense. If the team that captures the Stray clear scores without clearing, no points are awarded and it results in a change of possession.

If an offensive team, Team A, loses control of ball 310 to their defensive opponents, Team B, anywhere on playing surface 20, i.e., Team B makes a save, collects a rebound, steals ball, etc., then the team capturing ball 310, Team B, must clear ball 310 to a teammate inside second ring 32 to complete the change of possession and become the offensive team. Team A remains the offensive team until Team B clears. Team A may challenge Team B's attempt to clear ball 310. If Team A recaptures ball 310 before Team B completes the clearance, Team A may proceed to attack any goal 500 without re-clearing, since the change of possession was not completed. If the turnover occurs inside of second ring 32, the clear is considered complete immediately.

An out-of-bounds violation results in a change of possession. The team awarded ball 310 is considered to be in possession and on offense. The team awarded ball 310 does not have to clear ball 310 to second ring 32 before attacking any goal 500.

Subsequent to a rules infraction which results in a change of possession, Referee R may award ball 310 at center spot 29 in Prime ring 30' or at the nearest wedge zone corner point 73 or flex zone corner point 71 closest to where the infraction occurred. The team awarded ball 310 is considered to be in possession and on offense. The team awarded ball 310 does not have to clear ball 310 to second ring 32 before attacking any goal 500.

In an embodiment, and after Team A scores, Team B must clear ball 310 from goal to a teammate inside second ring 32 in order to complete a free clear of ball 310. If Referee R determines that an individual or team is unduly stalling, wasting time, or acting in an unsportsmanlike manner that inhibits the flow of the game, such as, concluding Free clear in 10 seconds, Referee R may issue a delay of game violation to that player and/or team. In such a case, and prior to issuing the delay of game violation, Referee R may elect to issue a ten second warning, indicating that ball 310 should be played into wedge zone 50 and/or shot at goal 500 in order to avoid the delay of game infraction.

In an embodiment, for example, if an offensive team, Team A, loses possession of ball 310 to its defensive opponent, Team B, anywhere on playing surface 20, then the new offensive team, Team B, may be required to clear ball 310 to a player inside third ring 34. If a change-of-possession occurs inside of third ring 34 or due to an out-of-bounds violation, then there is no need to clear ball 310. The new defensive team, Team A, may challenge attempt to clear ball 310 by new offensive team, Team B.

In an embodiment, for example, and after an offensive team, Team A, scores, the team that was in a defensive position, Team B, gains possession of ball 310. The new offensive team, Team B, may be required to clear ball 310 to a player inside second ring 32. The new defensive team, Team A, may be required to vacate second ring 32 and may not interfere with clearance of ball 310 by new offensive team, Team B. The new defensive team, Team A, may rush into second ring 32 and challenge the new offensive player for possession of ball 310 as soon as possession is established.

In a situation when players of both teams have simultaneous possession of ball 310, which is referred to as a "Held ball," the teams shall take alternating possession of ball 310 at the point on boundary ring 36 closest to where the Held ball occurred. In alternative embodiments, Referee R may place, or direct a player to place, ball 310 at any one of the nearest wedge zone corner point 73 or flex zone corner point 71 closest to where the infraction occurred, or within any embodiment of prime ring on playing surface 20. The first team that may take alternating possession on a Held ball may be the designated Guest team.

Shooting

An objective of each team is to advance ball 310 in play within peripheral boundary 24 and score by shooting ball 310 entirely across any one of at least two distinctly defined spaces provided by goal 500. In an embodiment, and as described further below, ball 310 may be scored by passing it through either arced rectangularly-shaped opening 512 or alternative arced rectangularly-shaped opening 513 of goal 500 or opening 538 provided by any one or more circular open rings 536 of goal 500 using whatever body part is allowed when player is within a respective zone of playing surface 20.

Team members may shoot ball 310 subject to their location within the plurality of zones of playing surface 20, as previously described and further described in exemplary embodiments of play of the game in FIGS. 34, 37*a* and 37*b*, 45*a* and 45*b*, 48*a* and 48*b*, 52*a* and 52*b*, 54*a* and 54*b*, and 56.

The origin of a shot is determined by the last ground placement of the front foot of the shooter before ball 310 was struck or released. If a shooter only has one foot on playing surface 20 when the shot is taken, that foot determines the shot origin point for the purposes of determining scoring.

Team members of the offensive team may have a shot time to shoot ball 310 on goal 500 and score or strike goal 500 with ball 310. The shot time may be about 30 seconds from taking possession of ball 310. The duration of shot time may be more or less than 30 seconds. If a shot time is part of a game, the shot time is reset any time a team takes possession of ball 310, such as, for example, when a team takes possession of ball 310 at the start of a timed period, after an opponents score, after an opponent's missed shot, or upon turnover/change-of-possession, out-of-bounds violation or other penalty, rebound of ball 310 off goal 500, or save by defensive player.

Scoring

There are several ways to score in the game. A player may score by throwing, passing, kicking, or otherwise advancing ball 310 completely across or through one of at least two distinctly defined spaces of goal 500. In an embodiment, a player may score by throwing, passing, kicking, or otherwise advancing ball 310 completely across or through arced rectangularly-shaped opening 512 or alternatively arced rectangularly-shaped opening 513 of goal 500 or any opening 538 defined by any one or more circular open ring 536 provided with Crown 552 of goal 500. A team may also score points for having good sportsmanship during a game or for specific plays on defense.

Further descriptions of how to score and methods for calculating points are shown and described in Tables A through H and FIGS. 62, 65, 67, and 100. The team having the most points at the end of play wins the game.

A player on offense may score ball 310 in a near-goal manner or a distant-goal manner. A near goal score results when a player on offense shoots ball from goal zone 46, wedge zone 50, flex zone 56, cross zone 62, or any ring area closest to goal 500 where the player shoots ball 310. A distant-goal score results when an offensive player shoots ball 310 at goal 500 from a wedge zone 50, flex zone 56, or other zone that may not be part of the quarter of playing surface 20 that goal 500 is positioned.

Various point calculations may be awarded to a team when ball 310 passes completely, on the ground or in the air, through arced rectangularly-shaped opening 512 or alternative arced rectangularly-shaped opening 513 of goal 500 or through any one of opening 538 defined by any circular open ring 536 provided with Crown 552 of goal 500. A foul by the team that scores may negate a score.

Figure 62:
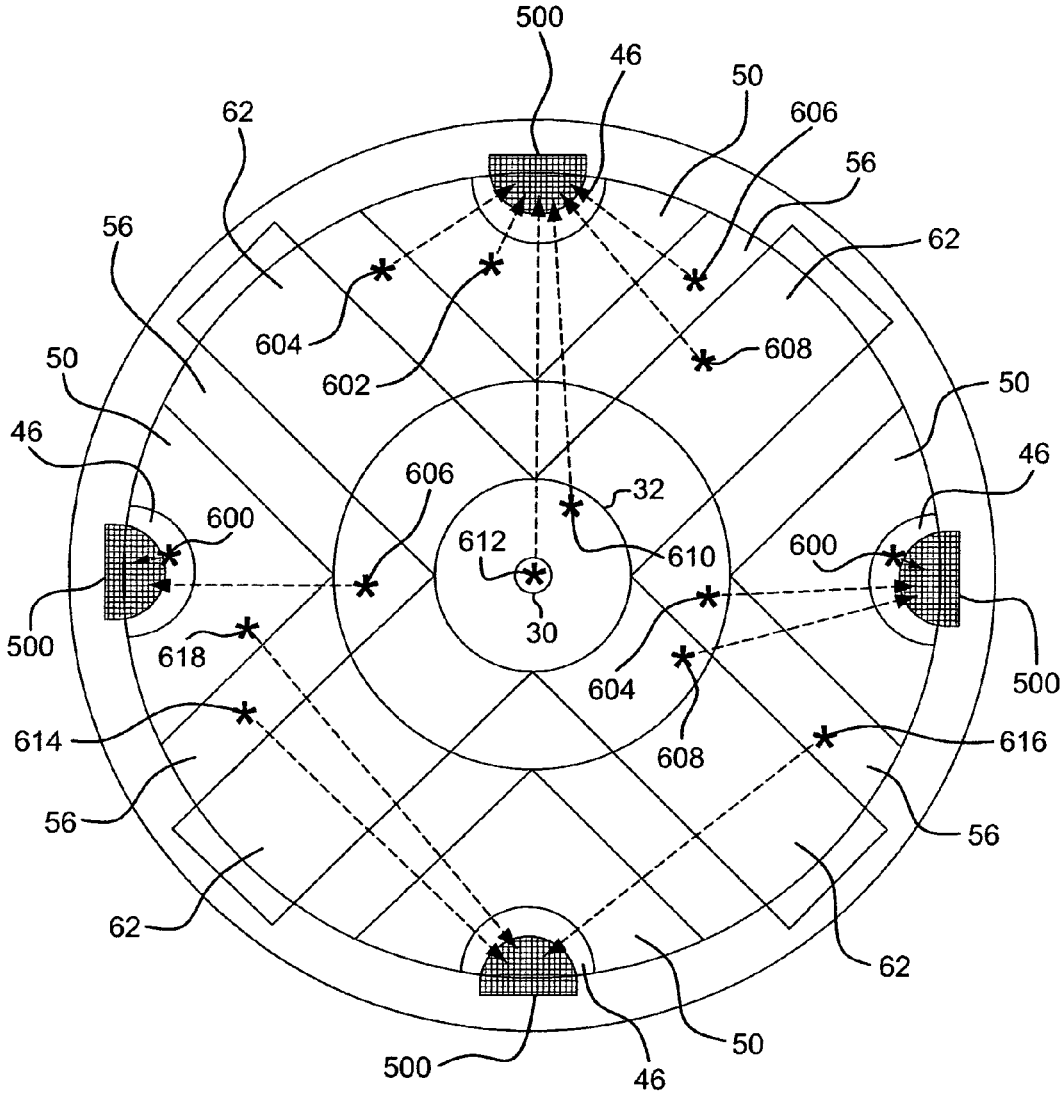
FIG. 62 shows an embodiment of a shot scoring system of the invention.

Points may be scored for 10 player versus 10 player game configuration in a near goal manner according to Table A and a distant goal manner according to Table B and as shown in a non-limiting embodiment in FIG. 62.

TABLE A

Near-Goal Scores for a 10 player versus 10 player game.

| | | Points Awarded | |
|---|---|---|---|
| Manner of Score | Zone/Ring | Ring | Net |
| Kick/Throw 600 | Goal Zone 46 | 2 | 1 |
| Kick 602 | Wedge Zone 50 | 3 | 2 |
| Kick 604 | Flex Zone 56 | 4 | 3 |
| Throw 606 | Flex Zone 56 | 3 | 2 |
| Throw 608 | Cross Zone 62 | 4 | 3 |
| Throw 610 | Second Ring 32 | 5 | 4 |
| Throw 612 | Center Ring 30 | 7 | 6 |

TABLE B

Distant-Goal Scores in a 10 player versus 10 player game.

| | | Points Awarded | |
|---|---|---|---|
| Manner of Score | Zone/Ring | Ring | Net |
| Kick 614 | Flex Zone 56 | 6 | 5 |
| Throw 616 | Flex Zone 56 | 5 | 4 |
| Kick 618 | Wedge Zone 50 | 5 | 4 |

Figure 63:
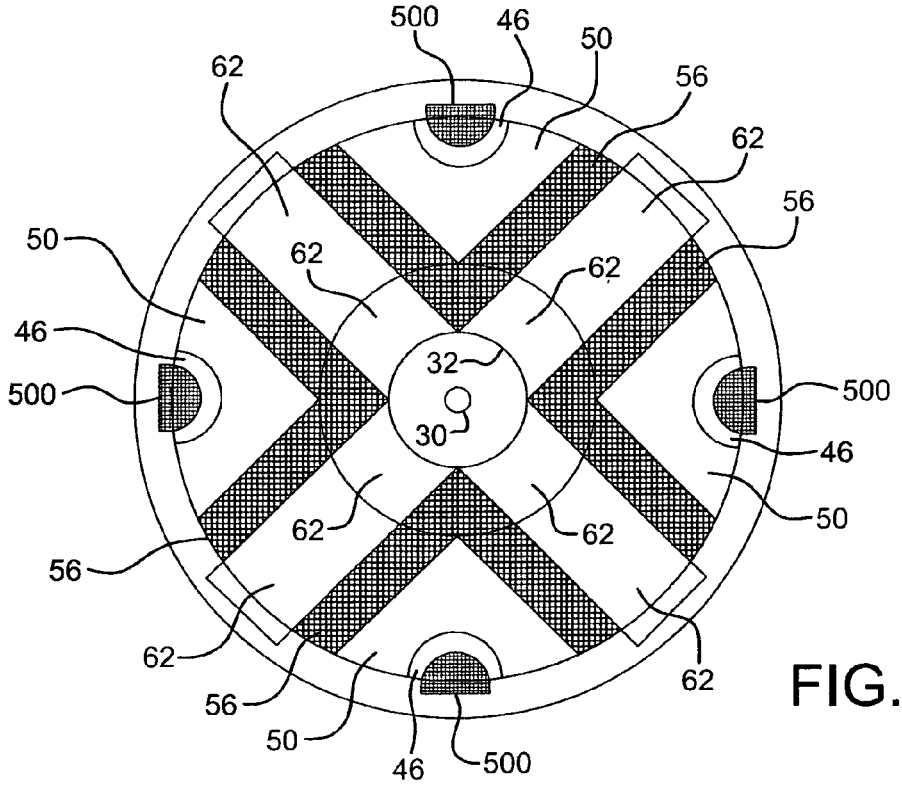
FIG. 63 shows an embodiment of a regular flex zone for a 10 player versus 10 player game.

In an embodiment, flex zone 56 may be changed from a regular flex zone 56 for a 10 player versus 10 player configuration shown in FIG. 63 to modified flex zone 56' for a 9 player versus 9 player configuration shown in FIG. 64. In such a case, modified flex zone 56' may be considered to be a near-goal flex zone for the purpose of point calculations. Points may be scored for 9 player versus 9 player game configuration in a near goal manner according to Table C and a distant goal manner according to Table D and as shown in a non-limiting embodiment in FIG. 65.

TABLE C

Near Goal Scores 9 player versus 9 player game.

| | | Points Awarded | |
|---|---|---|---|
| Manner of Score | Zone/Ring | Ring | Net |
| Kick/Throw 700 | Goal Zone 46 | 2 | 1 |
| Kick 702 | Wedge Zone 50 | 3 | 2 |
| Kick 704 | Modified Flex Zone 56' | 4 | 3 |
| Throw 706 | Modified Flex Zone 56' | 3 | 2 |
| Throw 708 | Cross Zone 62 | 4 | 3 |
| Throw 710 | Second Ring 32 | 5 | 4 |
| Throw 712 | Center Ring 30 | 7 | 6 |

TABLE D

Distant Goal Scores 9 player versus 9 player game.

| | | Points Awarded | |
|---|---|---|---|
| Manner of Score | Zone/Ring | Ring | Net |
| Kick 714 | Modified Flex Zone 56' | 6 | 5 |
| Throw 716 | Modified Flex Zone 56' | 5 | 4 |
| Kick 718 | Wedge Zone 50 | 6 | 5 |

Figure 66:
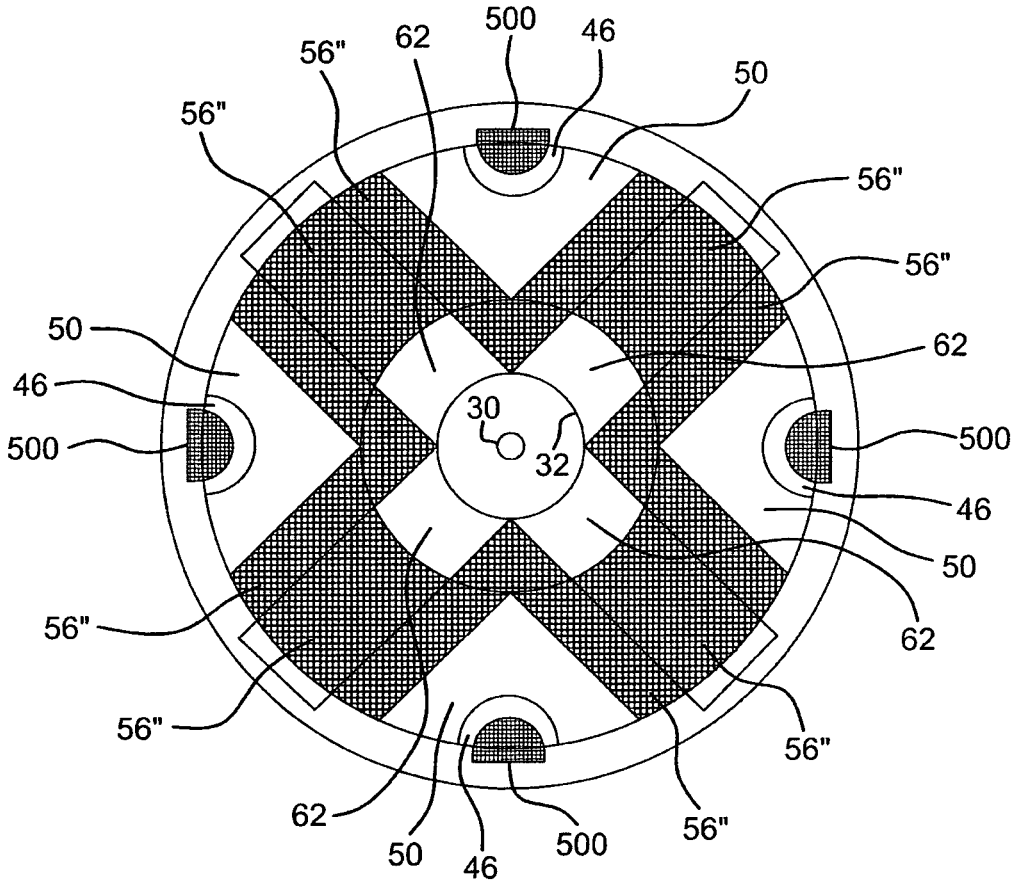
FIG. 66 shows an alternative embodiment of a modified flex zone for an 11 player versus 11 player game.
Figure 67:
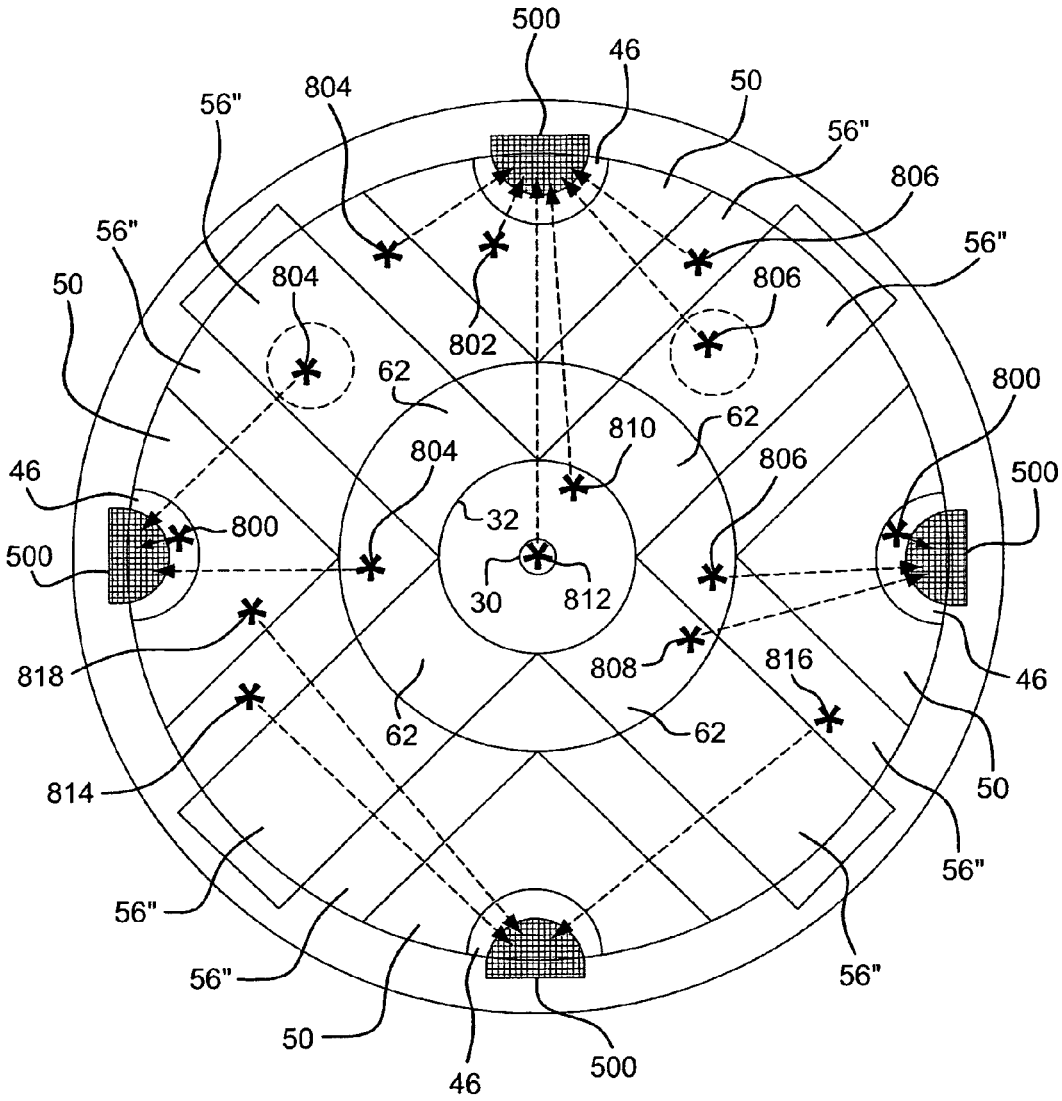
FIG. 67 shows an embodiment of modified shot scoring system for an 11 player versus 11 player game.

In another embodiment, flex zone 56 may be changed from a regular flex zone 56 for a, 10 player versus 10 player configuration shown in FIG. 63 to a modified flex zone 56" for an 11 player versus 11 player configuration shown in FIG. 66. Points may be scored for 11 player versus 11 player game configuration in a near goal manner according to according to Table E and a distant goal manner according to Table F and as shown in a non-limiting embodiment in FIG. 67.

TABLE E

Near Goal Scores for 11 player versus 11 player game.

| | | Points Awarded | |
|---|---|---|---|
| Manner of Score | Zone/Ring | Ring | Net |
| Kick/Throw 800 | Goal Zone 46 | 2 | 1 |
| Kick 802 | Wedge Zone 50 | 3 | 2 |
| Kick 804 | Modified Flex Zone 56" | 4 | 3 |
| Throw 806 | Modified Flex Zone 56" | 3 | 2 |
| Throw 808 | Cross Zone 62 | 4 | 3 |
| Throw 810 | Second Ring 32 | 5 | 4 |
| Throw 812 | Prime Ring 30 | 7 | 6 |

TABLE F

Distant Goal Scores 11 player versus 11 player game.

| | | Points Awarded | |
|---|---|---|---|
| Manner of Score | Zone/Ring | Ring | Net |
| Kick 814 | Modified Flex Zone 56" | 6 | 5 |
| Throw 816 | Modified Flex Zone 56" | 5 | 4 |
| Kick 818 | Wedge Zone 50 | 6 | 5 |

Figure 100:
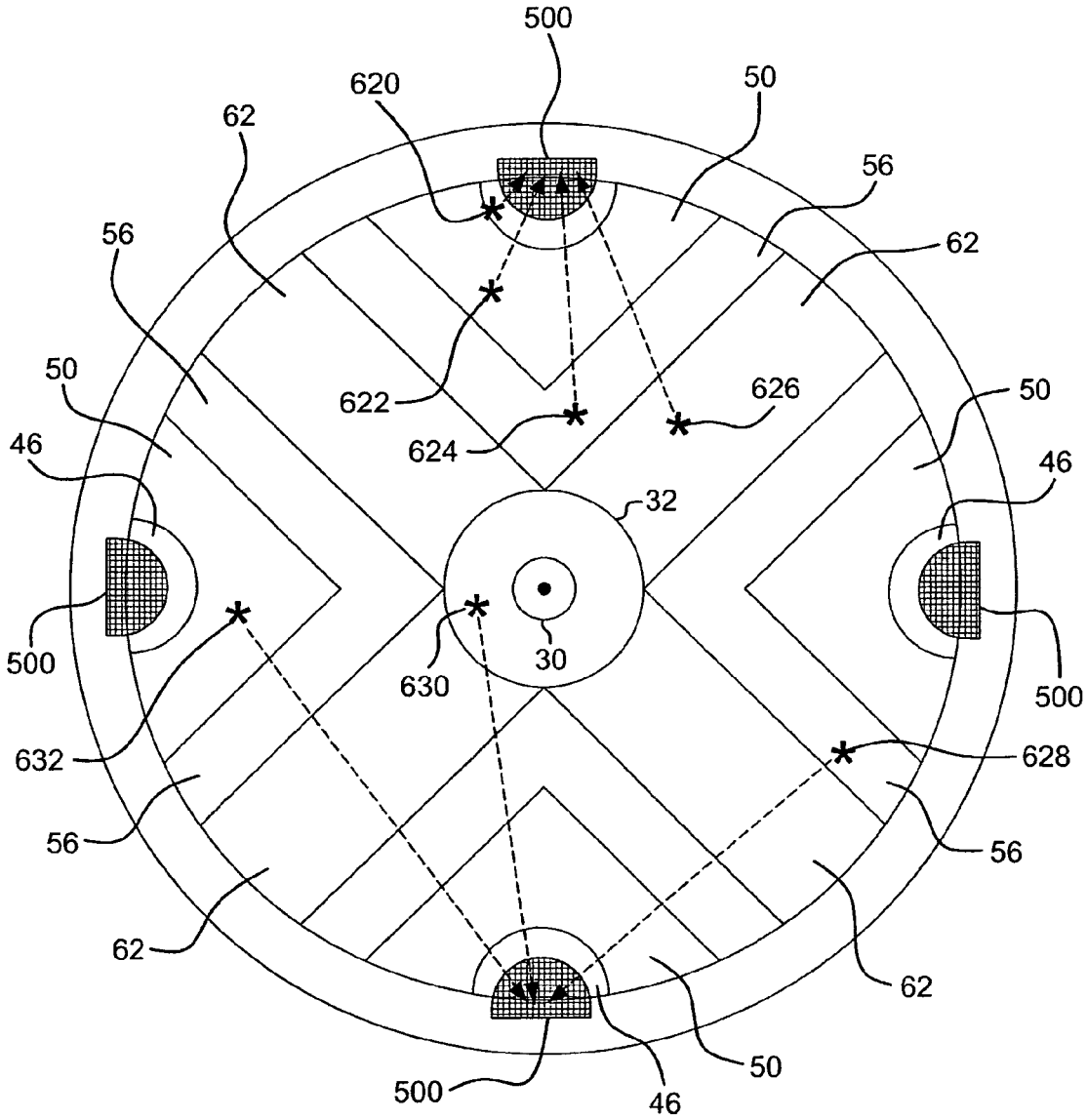
FIG. 100 shows an alternative embodiment of a shot scoring system of the invention.

Points may also be scored for 10 player versus 10 player game configuration in a near goal manner according to an alternative embodiment shown Table G and a distant goal manner according to Table H and as shown in a non-limiting embodiment in FIG. 100.

TABLE G

Near-Goal Scores for a 10 player versus 10 player game.

| Manner of Score | Zone/Ring | Points Awarded Ring | Points Awarded Net |
|---|---|---|---|
| Kick/Throw 620 | Goal Zone 46 | 2 | 1 |
| Kick 622 | Wedge Zone 50 | 4 | 2 |
| Kick/Throw 624 | Flex Zone 56 | 6 | 3 |
| Kick/Throw 626 | Cross Zone 62 | 8 | 4 |
| Kick/Throw 630 | Second Ring 32 | 8 | 4 |

TABLE G

Distant-Goal Scores in a 10 player versus 10 player game.

| Manner of Score | Zone/Ring | Points Awarded Ring | Points Awarded Net |
|---|---|---|---|
| Kick 632 | Wedge Zone 50 | 8 | 4 |
| Kick/Throw 628 | Flex Zone 56 | 8 | 4 |

In an embodiment, a team may optionally be awarded 4 points for winning a prime rush by obtaining possession of ball 310.

Good Sportsmanship Awards, Fouls, and Penalties

The team may be awarded for good play at the end of a game. In an embodiment, the team with both fewer penalties for violations or fouls and less than 15 total penalties in the game may receive an award. The award may be referred to as a "Krone." Krones may be recorded with a team's wins and loss record for a season. At the end of a season, a team may be awarded additional wins based on the number of Krones awarded during the season. In an embodiment, an additional win may be calculated for each Krone awarded to a team. Krones may be tabulated in the determination of final standings for a season.

A player may be penalized for a number of reasons, such as, for example, failing to play by the rules of the game and poor sportsmanship. The game is a competitive sport and physical contact between players may be an aspect of the game. The game may be governed by rules based on principles of fair play and sportsmanship. Players must play within the rules promulgated for the game.

Team members should remain in their respective team bench zones 64 unless they are in play and should conduct themselves in a polite and sportsmanlike manner.

Violation of the rules of the game may result in penalties for a player or his/her team. In embodiments of the game, violations also referred to as "fouls" may result in penalties set forth in Table I.

TABLE I

Fouls and Penalties

| Fouls | Penalty |
|---|---|
| Illegally offensive handling ball | change of possession |
| Illegal defensive handling ball 310 outside of wedge zone 50 | offense retains ball 310 as they would on a Change of Possession |
| Illegal defensive handling ball 310 in wedge zone 50 | penalty shot |
| 4-Second goal zone 46 violation | change of possession |
| 2+ offensive players goal zone 46 violation | change of possession |
| 5-Second trapped player violation | change of possession |

TABLE I-continued

Fouls and Penalties

| Fouls | Penalty |
|---|---|
| 10-Second Free clear violation | change of possession |
| Delay of game | change of possession |
| Unintentional/Incidental interference on Free clear | offense retains ball 310 as they would on a change of possession |
| Illegal second ring 32 challenge or intentional interference on Free clear | penalty box minor and player warning |
| Illegal substitution or too many players | penalty box minor |
| Illegal attire | caution warning and dismissal from playing surface 20 until attire fixed |
| Reaching/Hacking/Grabbing/ Inappropriate slide tackle | offense retains ball 310 as they would on a change of possession |
| Over-aggressive slide tackle | penalty box minor and player warning. offense retains ball 310 as they would on a change of possession |
| False "dive" | no call or change of possession |
| Offensive charging | change of possession |
| Holding/rough play | penalty box minor |
| Taunting/un-sportsmanlike conduct | penalty box major |
| Excessive physical force | penalty box major |
| Interference on shot attempt | penalty shot, plus points count if shot is successful |
| Interference with defender's attempt to block shot | no points if shot is successful and change of possession |
| Brute force (e.g. Kicking, tripping, shoving, holding, tackling, striking an opponent or attempting to do the same) | ejection from game |
| Vile action (e.g. Spitting at an opponent) | ejection from game |

Referee R may effect a change of possession after a foul by placing ball 310 on playing surface 20 at the spot of the foul or other location on playing surface 20 after signaling and announcing a foul that results in a change of possession penalty. In an embodiment, Referee R may signal a foul and ball 310 may be played from center spot 29 within center ring 30, or flex zone corner point 73 or wedge zone corner point 71 closest to foul. The team awarded possession may play ball 310 according to ball handling rules of the game, clearing ball 310 if necessary, and as previously described.

Referee R may effect a lap penalty by directing the penalized player to his nearest team bench zone 64, where the player may exit playing surface 20 and perform a lap penalty within welcome ring 38 after signaling and announcing a foul that results in a lap penalty. The penalized player may run or walk around welcome ring 38 as prescribed by Referee R. The player may reenter playing surface 20 from team bench zone 64 after completing the lap penalty.

In an embodiment, after signaling and announcing a foul, which results in a Penalty box punishment, Referee R may direct the penalized player to the administration box area, where the player must exit the game and remain in the penalty box for a prescribed portion of game time. For example, penalized player may remain in the penalty box for two minutes for a minor penalty or five minutes for a major penalty. The player may reenter the game after completion of the penalty, which should be signaled by an Official.

Referee R may escort an ejected player from playing surface 20 to his/her team bench zone 64, where the player must remain until the match is over after signaling and announcing a foul that results in a player ejection.

A clear shot is an unobstructed throw-shot or kick-shot awarded to a team after certain fouls. After signaling and announcing a foul that results in a clear shot penalty, Referee R may determine the location of the clear shot, which is the point of the foul, and place ball 310 on playing surface 20 at the spot from which the clear shot must be taken. The offensive player awarded the clear shot may elect to kick ball 310, as placed by Referee R, or to stand at the clear shot location and throw ball 310. The player must play ball 310 according to handling rules pertaining to the location of ball 310 in the respective zone of playing surface 20. All other players must remain three or more yards behind the shooting player and/or outside of the zone from which the shot is being taken. If the shot is successful, then the player and his team may be awarded the normal amount of points for a score from that point on playing surface 20.

In an embodiment, Referee R may signal a foul and award a penalty shot. After signaling and announcing a foul which results in a penalty shot, Referee R may place ball 310 at the appropriate wedge zone point 52 from which the penalty shot must be taken, which is wedge zone point 52 nearest to the spot of the foul. If the penalty shot is awarded due to a foul on a shot attempt, the player who was fouled in the act of shooting must take the penalty shot.

Additionally, the player taking the penalty shot may be required to play ball 310 according to the ball handling rules pertaining to zone in which he was fouled. In other words, if the player is fouled in the wedge zone 50, he must kick the penalty shot from a ground placement. In an embodiment, the player may play ball 310 with his hands and/or feet as he chooses.

If the Penalty Shot is awarded due to a violation, such as the illegal use of hands in wedge zone 50 by the defense, then the team awarded the penalty shot may elect any player from the team to take the shot.

At the signal of Referee R, the player taking the penalty shot must make a continuous approach, taking no more than two full steps and release or strike ball 310 toward the nearest goal 500. In an embodiment, the player taking the penalty shot may take a third step if the player dribbles ball 310 once with his hands in the approach. The player may not fake a shot, nor make a pass. The player's feet must remain behind wedge zone point 52 on his approach and shot.

The team which was penalized may designate one player to defend the penalty shot attempt. The player defending the penalty shot must remain on boundary ring 36 at goal hash intersect 66 or alternatively goal spot until the player taking the penalty shot begins his shot approach. All other players must remain outside of flex zone 56 adjacent to wedge zone 50 from which the penalty shot is being taken, until ball 310 is struck or released, at which time it is a live ball.

The team taking the penalty shot is considered to be in possession of ball 310 and on offense in the case that a save is made by the defending player and the ball remains in-bounds and in-play.

A successful penalty shot is worth 3 points if scored into the chamber 511 of goal 500 and 6 points if scored through circular open ring 536.

Officiating—Referee and Assistant Referees

The game may be regulated by Referee R with full authority to enforce the rules of the game that he/she may be officiating. Referee R may have jurisdiction of a game at least 15 minutes before the start of play and at least 15 minutes after the end of the game. One or more assistant referees may also provide officiating support to Referee R in officiating a game.

Referee R may have multiple duties in officiating a game. For example, Referee R may enforce the rules of the game and decide disputed points. A decision by Referee R may be considered final as it relates to the result of the game. Referee R may change an incorrect officiating call or upon advice of an assistant referee. Referee R may only change a call if play has not restarted or the game is over. Referee R may regulate the game with support from assistant referees.

Referee R may inspect playing surface 20, ball 310, goal 500, equipment, uniforms, and other game-related equipment to ensure compliance with the rules of the game. Referee R may obtain team rosters before a game starts. Referee R may act as a timekeeper and keep record of the game. Referee R may stop, suspend, or terminate a game, at his/her discretion, for violation of the rules of the game, outside interference, injury, or for disciplinary action for players or team officials. Referee R may eject players of team officials for violation of the rules of the game.

Referee R may act on advice of any assistant referee regarding incidents that Referee R has not seen directly. Referee R may ensure that no unauthorized persons enter playing surface 20. Referee R may stop and restart play as necessary including terminating the game at the end of play. Referee R may provide appropriate game authorities with a report on a game that Referee R officiated. The report may include roster information, recorded fouls, the final score, and any disciplinary action taken during the game.

Assistant referees may be charged with enforcing rules of the game in support of Referee R. Any call made by any assistant referee may be subject to the authority of Referee R. An assistant referee may indicate when ball 310 has gone out of play. An assistant referee may indicate a throw-in and a kick-in. An assistant referee may supervise team substitutions and indicate a violation of substitution rules. An assistance referee may indicate a foul that Referee R did not see.

Referee R and assistant referees may dress in a uniform. The uniform may comprise neutral color shoes, such as, for example, black shoes, shirts of the same color and style and contrasting with team players, and a cap.

Referee R may have the following equipment to officiate the game: stop watch timer, two-way radio, notepad, and whistle. Any assistant referee may have the following equipment to support Referee R in officiating a game: flag and whistle.

Scorekeeping and Timekeeping

A scorekeeper and/or timekeeper may be assigned to a game. The scorekeeper and/or timekeeper may record information about a game, including, but not limited to, team lineups, player substitutions and names, and Referee R and assistant referee names that may be assigned to officiate the game. The scorekeeper and/or timekeeper may record team scores, shots, defensive saves, fouls, assists, date, playing conditions, attendance, and team names and records, and may manage scoreboard equipment and shot and game clock equipment. An official scorekeeper and/or timekeeper may obtain a signature of Referee R on an official box score form upon the completion of a game. The official box score form may be recognized as the official record of a game.

Referee R may uses various signals to indicate events for a game. Referee R may indicate start of play by blowing a whistle and rotating his/her arm in a clockwise motion. Referee R may stop play by blowing a whistle and making a "T" sign with his/her hands. Referee R may indicate a foul or violation by blowing a whistle and raising his/her right arm and making a fist or alternatively crossing both arms of his/her head at the wrists.

Exemplary Embodiments of Play of the Game

Figure 30:
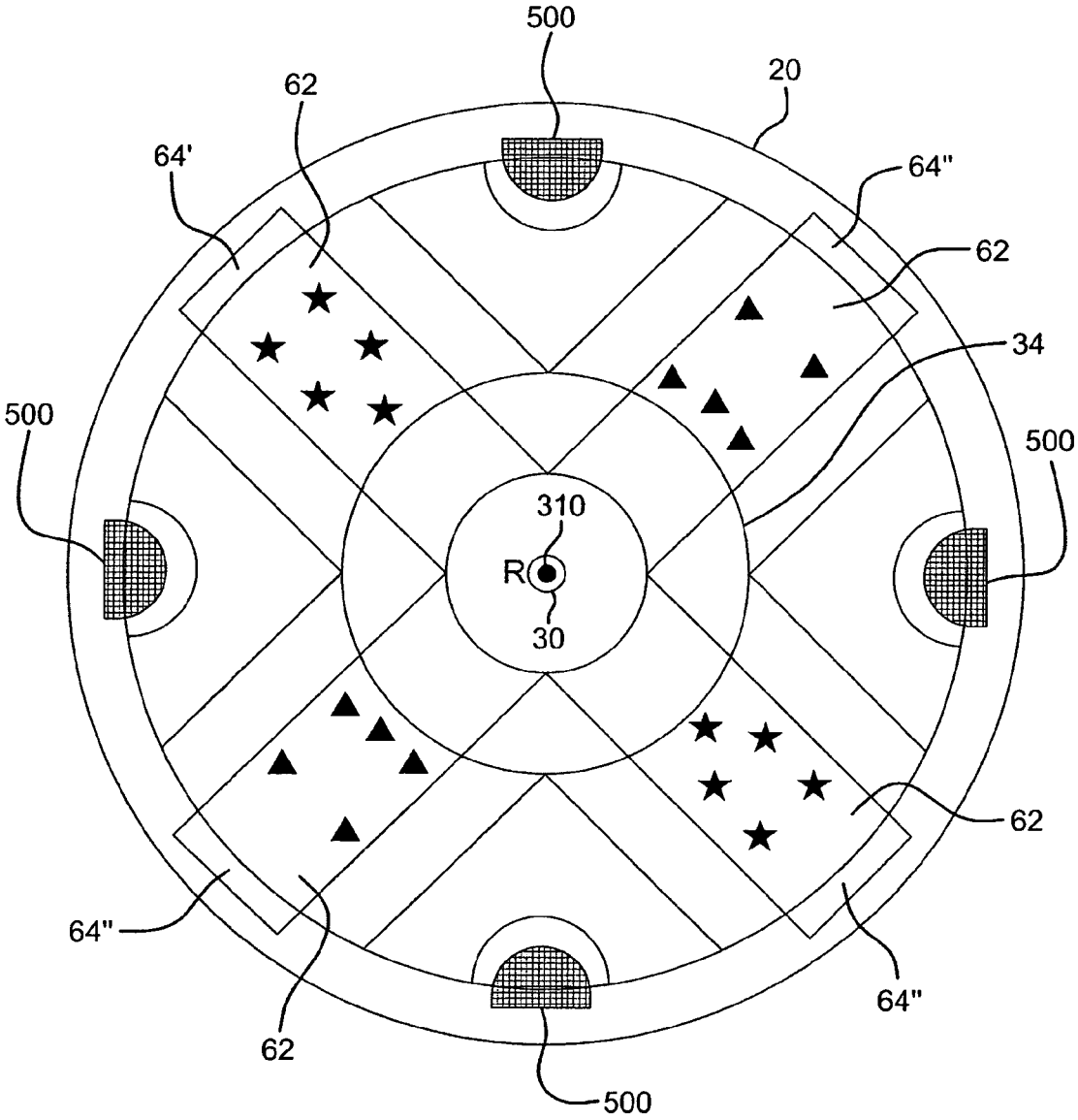
FIG. 30 shows an embodiment of a team alignment for a prime rush.

Referring now to FIG. 30, prior to start of a first timed period of a game with a prime rush, Referee R is shown standing in center ring 30 of playing surface 20 with ball 310. Players from Team A, each designated with a star in FIGS. 30 through 101, are shown aligned adjacent to Team A's team bench zones 64' inside cross zone 62, but outside third ring 34. Players from Team B, each designated with a triangle in FIGS. 30 through 101, are shown aligned adjacent to Team B's team bench zones 64" inside cross zone 62, but outside third ring 34. Players of Team A and Team B are prepared to rush for ball 310 or move to attack/protect any one of goals 500.

Figure 31:
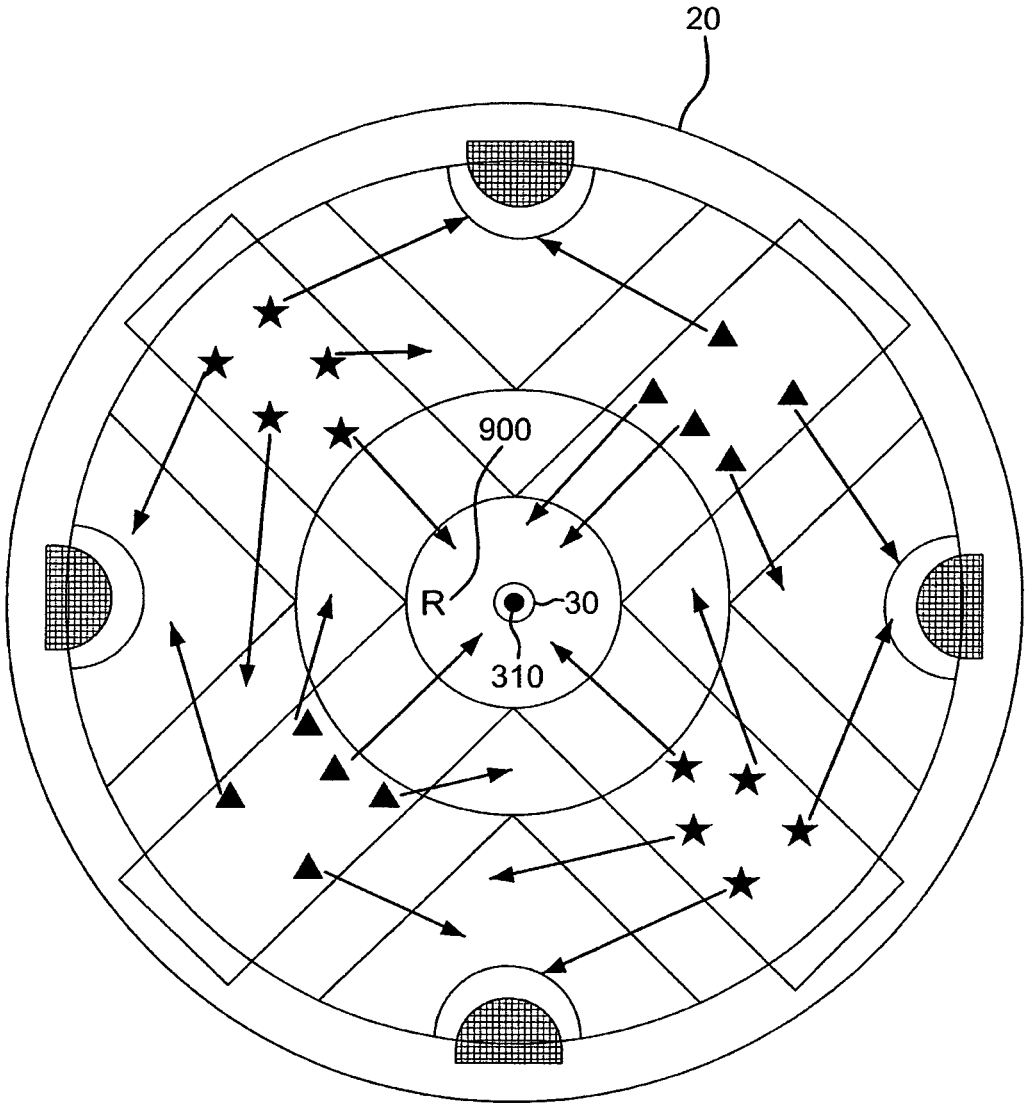
FIG. 31 shows an embodiment of placing the ball in play for a prime rush.

Referring now to FIG. 31, the prime rush is started by Referee R blowing a whistle and spiking 900 ball 310 in the center of center ring 30 in order to bounce ball 310 into the air. After the whistle and the bounce of ball 310, players from Team A and Team B run to capture ball 310 and to win the prime rush. Additional players from Team A and Team B move into attacking and defending positions on playing surface 20.

Figure 32:
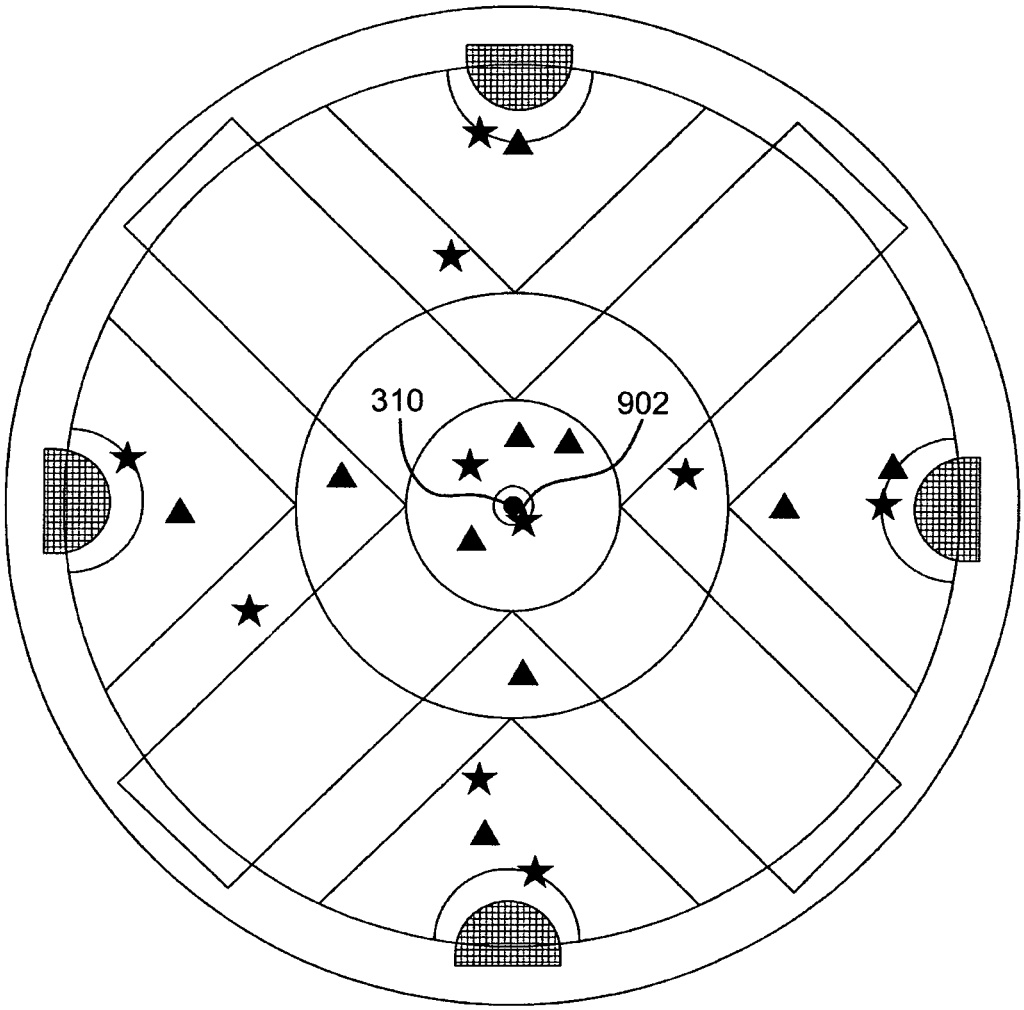
FIG. 32 shows an embodiment of a team player taking two-handed possession.

Referring now to FIG. 32, a player from Team A captures ball 310 by taking two-handed possession 902. The two-handed possession results in a score of 4 points for Team A for winning the prime rush. Referee R signals the score. A 30-second shot clock then starts for Team A, now on offense.

Figure 33:
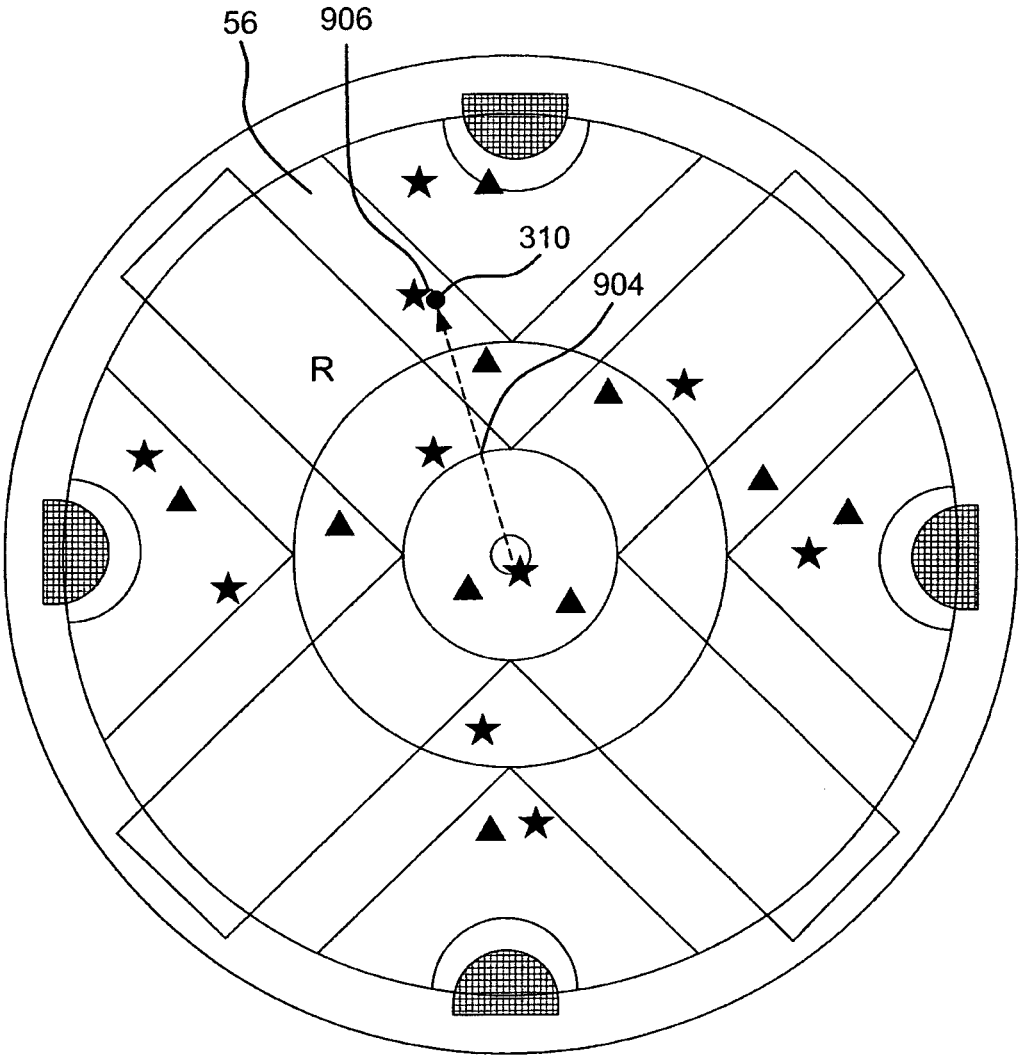
FIG. 33 shows an embodiment of a team player passing a ball from within the prime ring to another team member in a flex zone.

Referring now to FIG. 33, an offensive player from Team A who captured ball 310 on the prime rush throws 904 ball 310 from within center ring 30 to a teammate located in flex zone 56. The player from Team A receiving the pass in flex zone 56 has the option to receive ball 310 by hand or foot and play ball 310 accordingly. The player opts to catch 906 ball 310.

Figure 34:
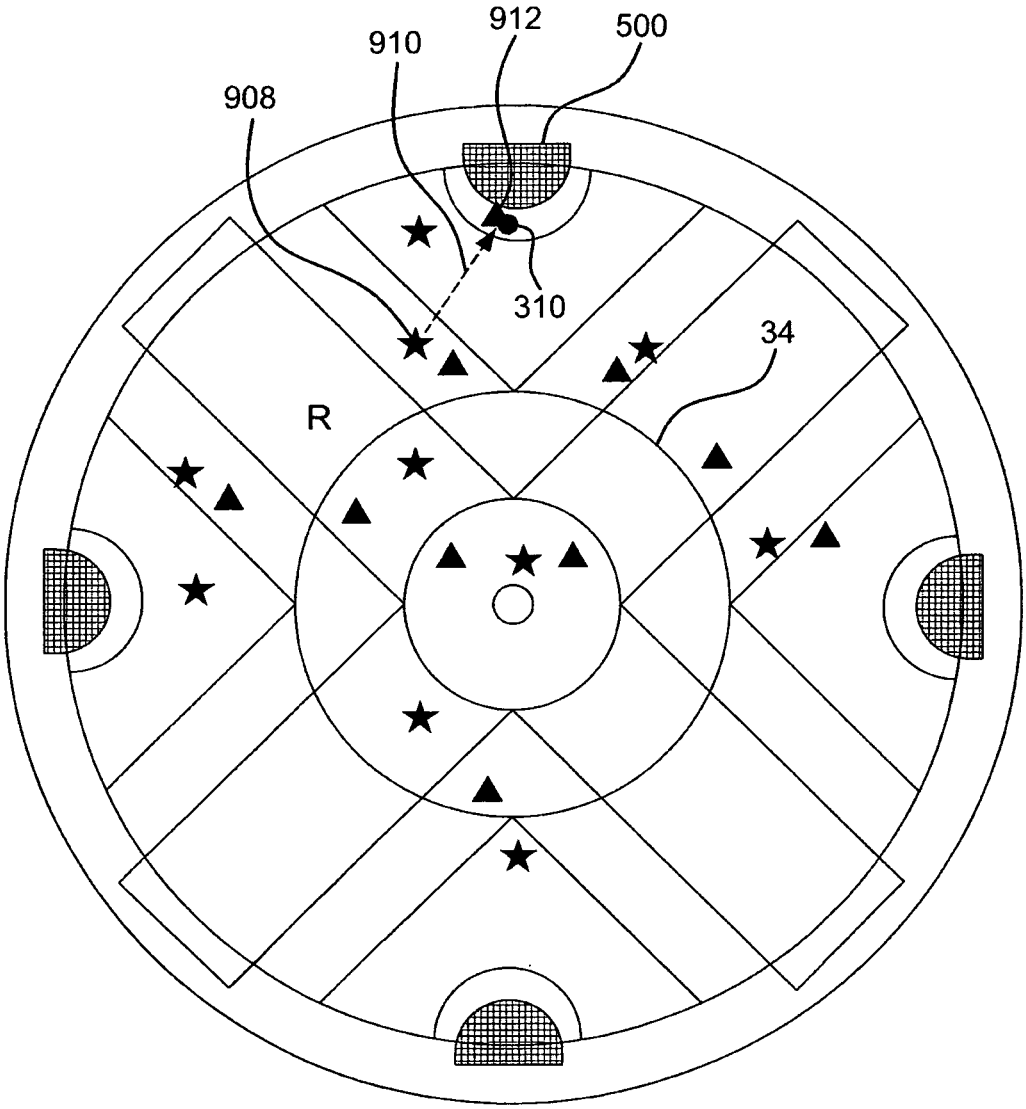
FIG. 34 shows an embodiment of an offensive shot and a defensive catch save.

Referring now to FIG. 34, an offensive player from Team A dribbles 908 ball 310 once and, realizing a defensive player from Team B is closing on him, kicks 910 ball 310 at near goal 500 attempting to score. A defensive player from Team B in goal zone 46 makes a clean two-handed catch-save 912 and scores 1 point for Team B. Referee R signals the score. The save 912 triggers a change of possession. Team B goes on offense, and Team A is now on defense. The 30-second shot clock is reset for Team B. Team B must clear ball 310 inside third ring 34 before scoring. Team A may play normal defense and challenge Team B's attempt to clear ball 310.

Figure 35:
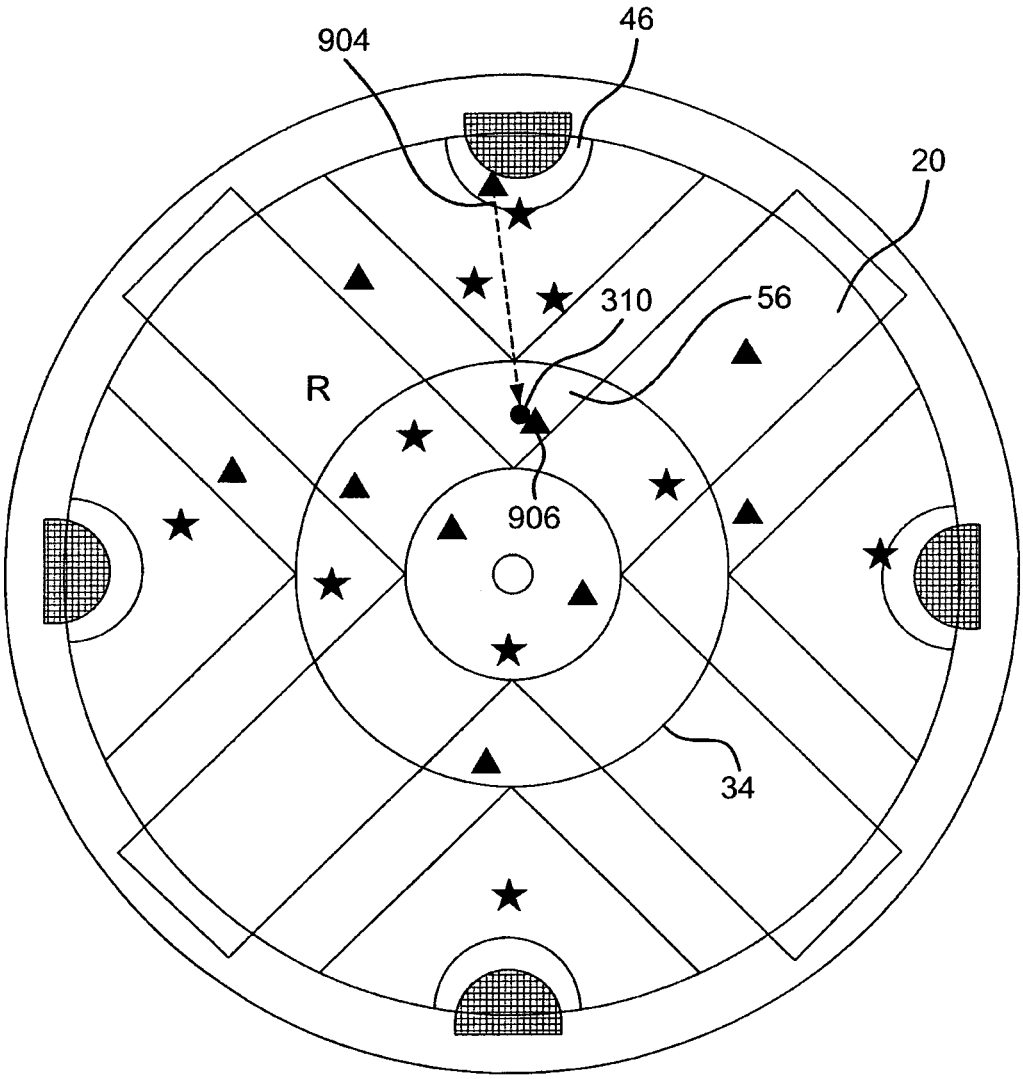
FIG. 35 shows an embodiment of a team clearing a ball in the third ring area.

Referring now to FIG. 35, an offensive player from Team B in goal zone 46 throws 904 ball 310 to teammate inside third ring 34 to complete clearance of ball 310. The Team B player receiving 914 ball 310 is within flex zone 56 and has an option to receive ball 310 by hand or foot and play ball 310 accordingly. The player opts to catch 906 ball 310, and he surveys playing surface 20 for options to advance ball 310.

Figure 36:
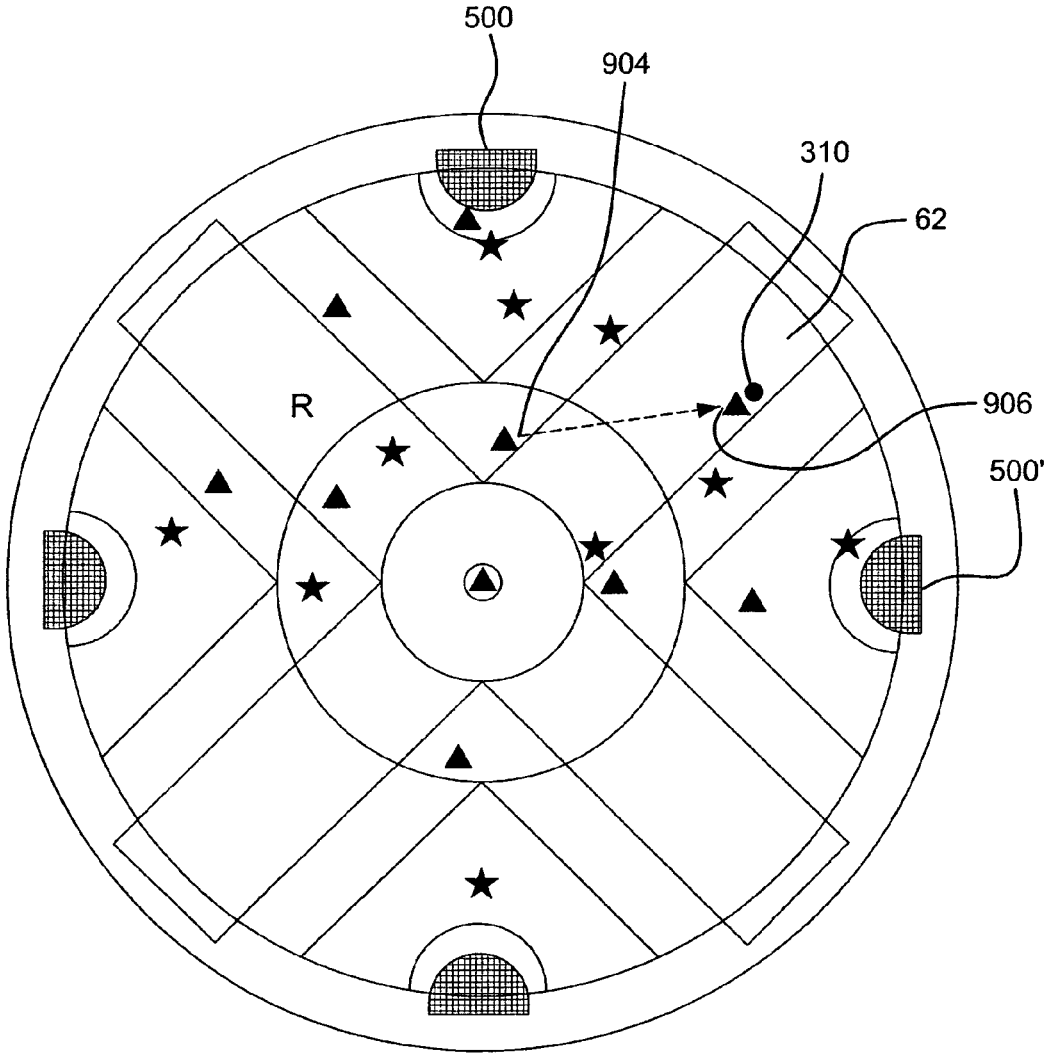
FIG. 36 shows an embodiment of a team player passing a ball to another team player.

Referring now to FIG. 36, an offensive player from Team B decides there are too many defensive players from Team A defending near goal 500, so he turns for other options. The offensive player from Team B notices an open teammate cutting through cross zone 62 towards goal 500, and throws 904 ball 310 to him. The Team B player receiving ball 310 is within cross zone 62, so he must receive ball 310 with his hands. He catches 906 ball 310 and turns toward goal 500 to determine whether to shoot or pass.

Figure 37A:
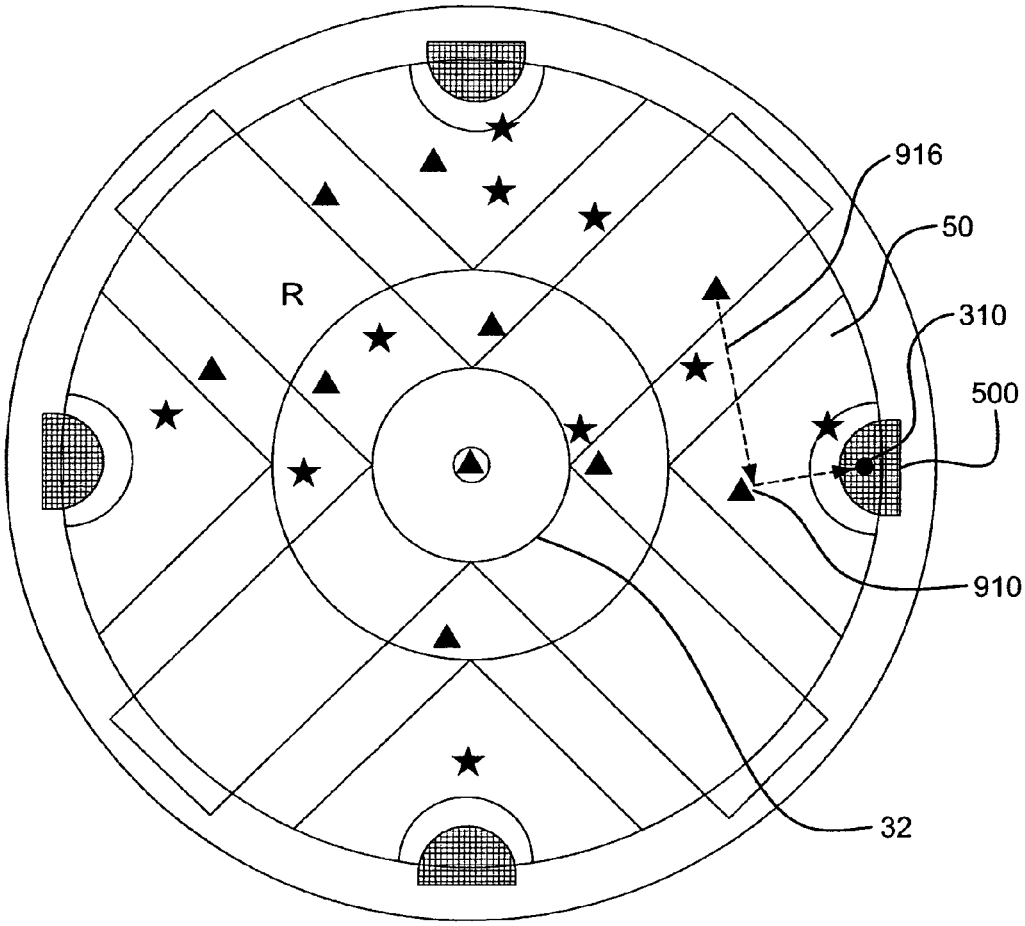
FIGS. 37*a* and 37*b* show an embodiment of a team's pass, shot, and score of a ball in a goal.
Figure 37B:
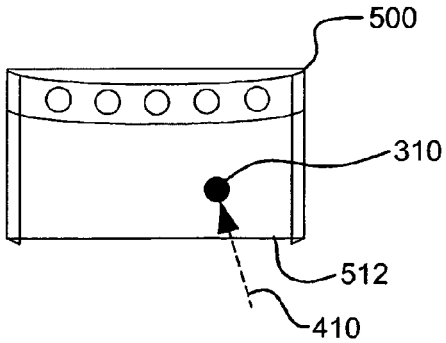

Referring now to FIGS. 37*a* and *b*, an offensive player from Team B sees a teammate cutting through wedge zone 50 toward near goal 500 and determines his teammate may have an opportunity to score, so he passes 916 ball 310 to the open teammate. The passing player is aware that the receiving player may not play ball 310 with his hands, so he throws 904 ball 310 low, making it easier for the receiving player to play ball 310 with his feet. Ball 310 hits the ground, and the Team B player kicks 910 ball 310 immediately with his foot, directing ball 310 through arced rectangularly-shaped opening 512 of goal 500, as shown in FIG. 37*b*, for 2 points. Referee R signals the score. The score triggers a change of possession. Team B is now on defense, and Team A is now on offense. Team A must clear ball 310 inside second ring 32 before scoring. Team B may not challenge the clear attempt following a score. Team B must also evacuate second ring 32.

Figure 38:
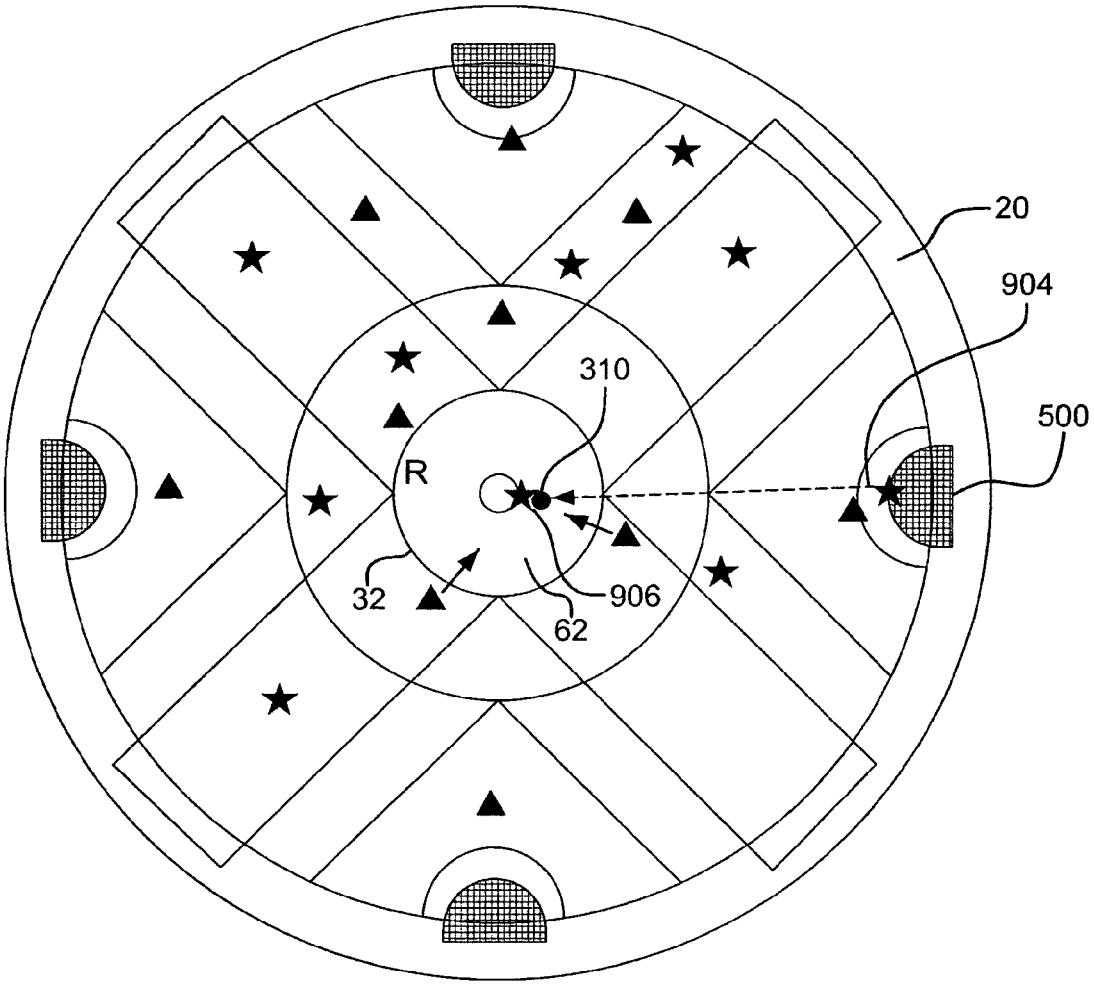
FIG. 38 shows an embodiment of a clearance of a ball to another team player in the second ring.

Referring now to FIG. 38, a player from Team A collects ball 310 from goal 500. The 30-second shot clock resets for Team A, now on offense. Players from both teams tactically reposition themselves on playing surface 20. The player throws 904 ball 310 to a Team A teammate, who catches 906 ball 310, inside second ring 32 in cross zone 62. Team B immediately presses him on defense.

Figure 39:
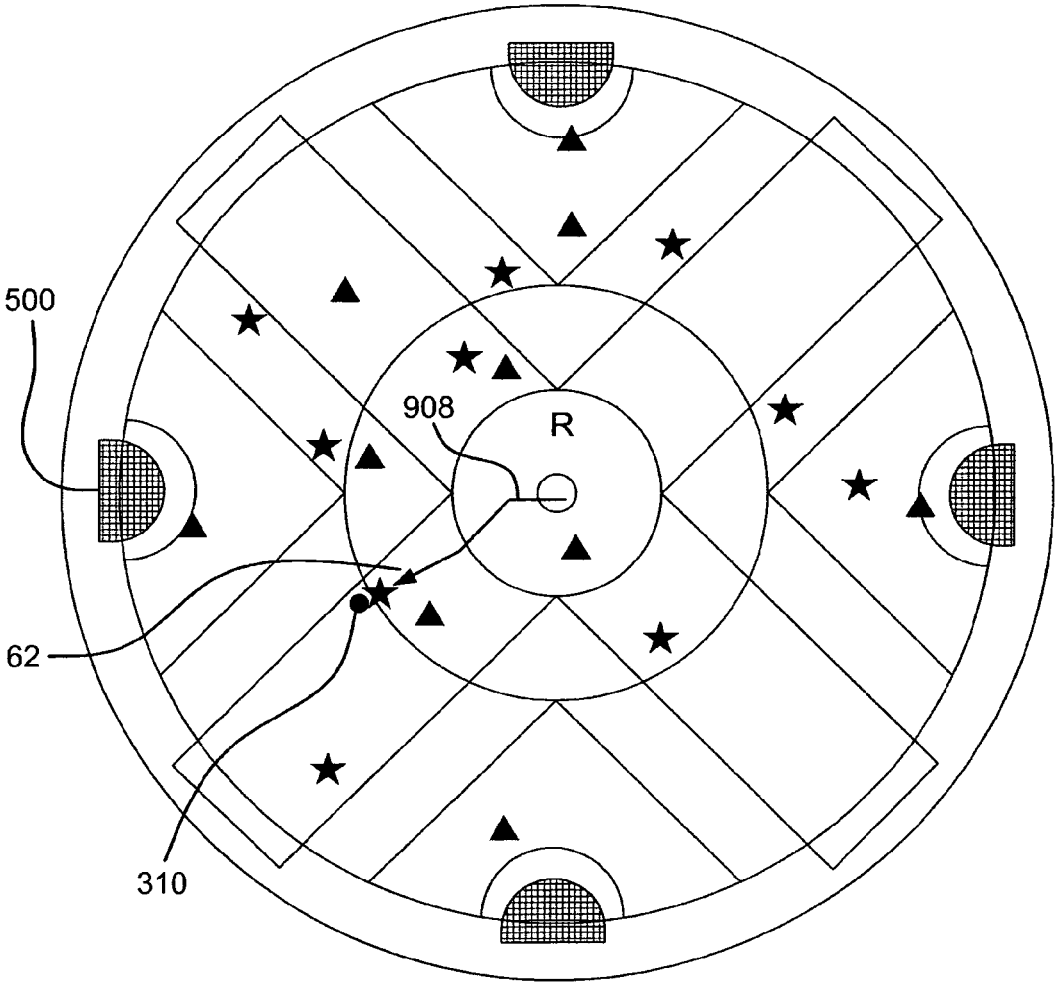
FIG. 39 shows an embodiment of advancing a ball by dribbling.

Referring now to FIG. 39, a player from Team A dribbles ball 310 while moving quickly away from the Team B defensive pressure and into an open area in cross zone 62. Other Team A players move into attacking positions for near goal 500. Team B hurries to cover and defend.

Figure 40:
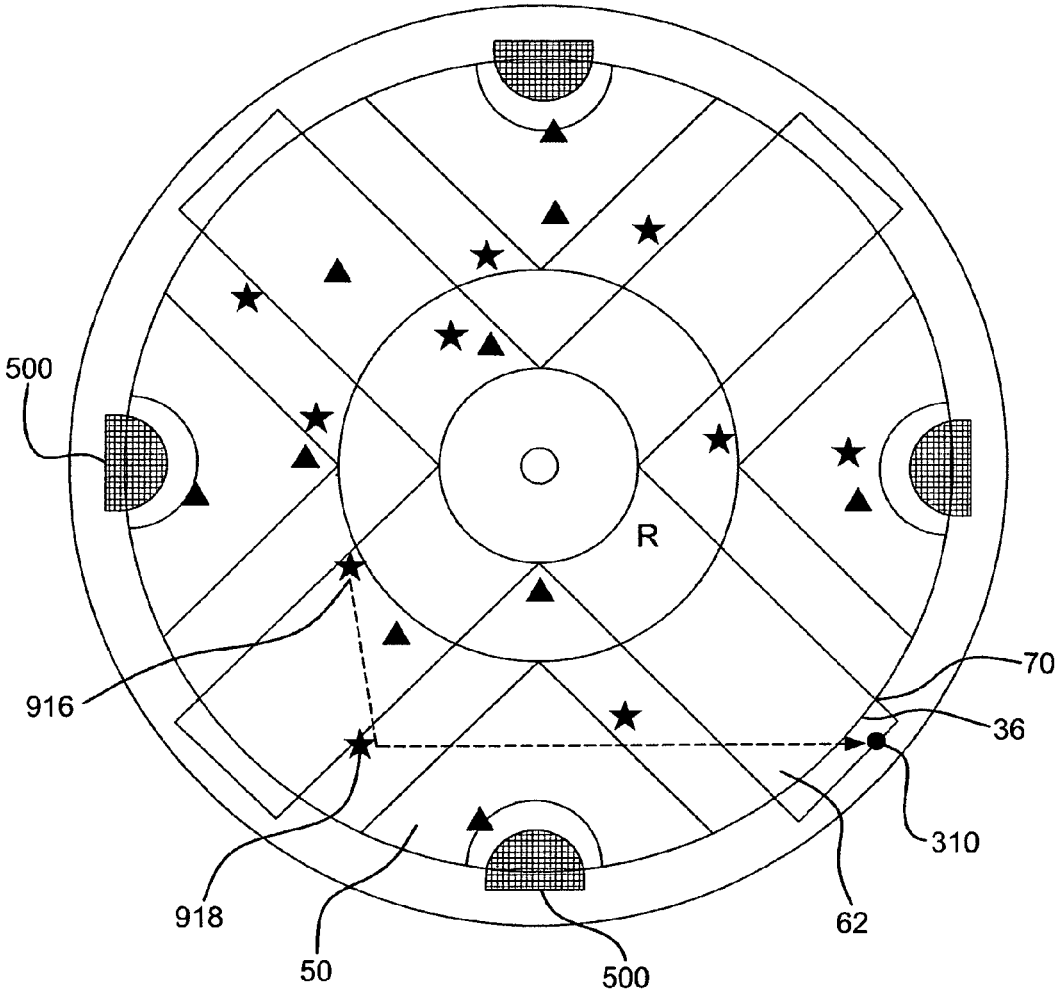
FIG. 40 shows an embodiment of two passes between players of the same team that results in an out-of-bounds.

Referring now to FIG. 40, a player from Team A decides to shift the attack direction and passes 916 ball 310 to a teammate closer to another goal 500. The pass is low and too far ahead of the receiving teammate for him to catch or trap ball 310 cleanly in flex zone 56, but he gets a foot on ball 310 and attempts to kick-deflect 918 ball 310 to another teammate cutting toward wedge zone 50. The pass misses its mark and rolls out-of-bounds at cross zone 62. Referee R signals the out-of-bounds. This triggers a change of possession, and Team B is awarded a kick-in by Referee R. The kick-in should be spotted at the nearest cross zone/flex zone corner point 70 to where ball 310 passed over boundary ring 36.

Figure 41:
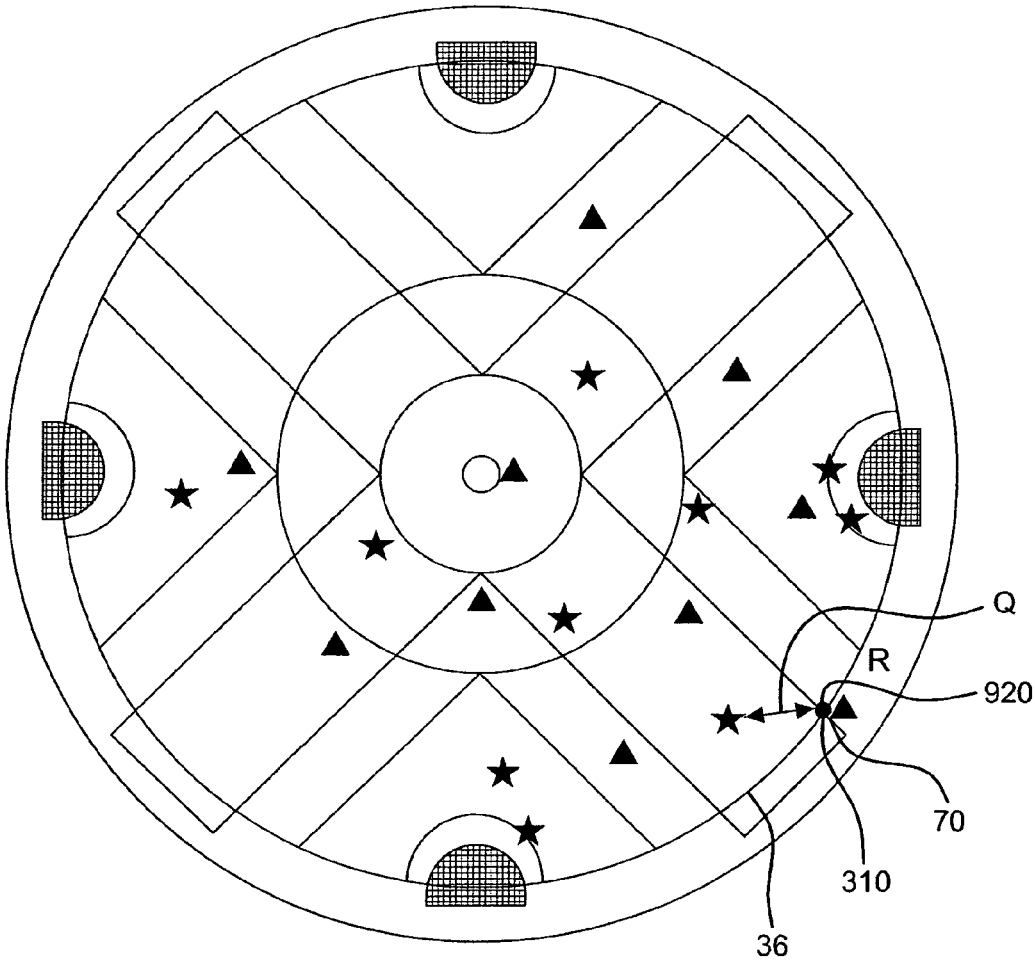
FIG. 41 shows an embodiment of a kick-in alignment.

Referring now to FIG. 41, a player from Team B places 920 ball 310 on nearest cross zone/flex zone corner point 70 to where ball 310 passed over boundary ring 36, and sets himself up to take a kick-in. The 30-second shot clock resets for Team B, now on offense. Team B does not need to clear ball 310, since the turnover occurred on an out-of-bounds. Team B may not, however, score directly from the kick-in. Team A players must remain a minimum distance Q, which may be 3 yards in an embodiment, from the point at which ball 310 is placed for the kick-in.

Figure 42:
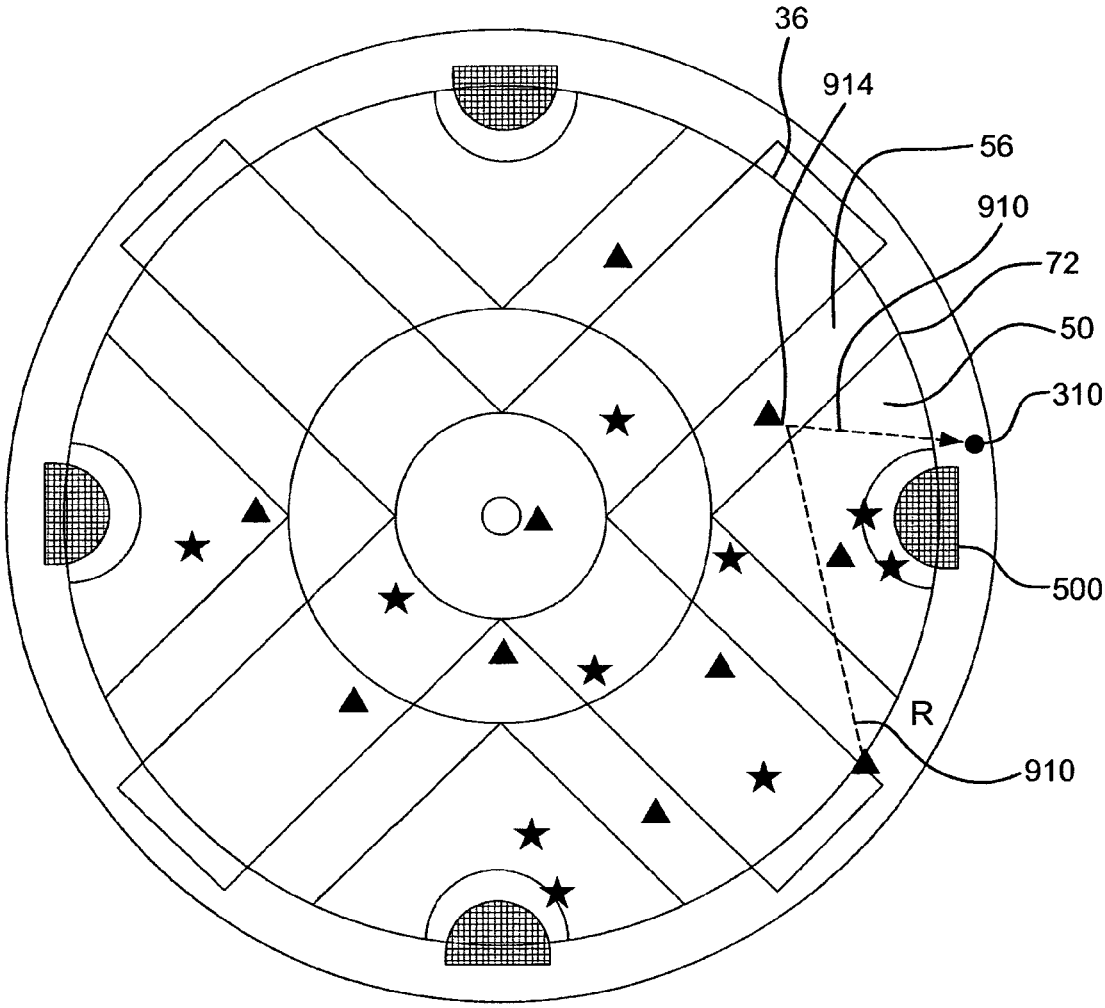
FIG. 42 shows an embodiment of a kick-in and a shot resulting in an out-of-bounds.

Referring now to FIG. 42, a player from Team B takes the kick-in and kicks 910 ball 310 to a teammate in flex zone 56 on the far side of goal 500. The player receiving 914 ball 310 traps ball 310 with his foot, then kicks 910 ball 310 high, aiming for opening 538 of circular open ring 536 of goal 500. The shot misses its mark high and wide, and ball 310 passes out of bounds at wedge zone 50. Referee R signals ball 310 out-of-bounds. This triggers a change of possession, and Team A is awarded a throw-in by Referee R. The throw-in should be spotted at the nearest wedge zone/flex zone corner point 72 to where ball 310 passed over boundary ring 36.

Figure 43:
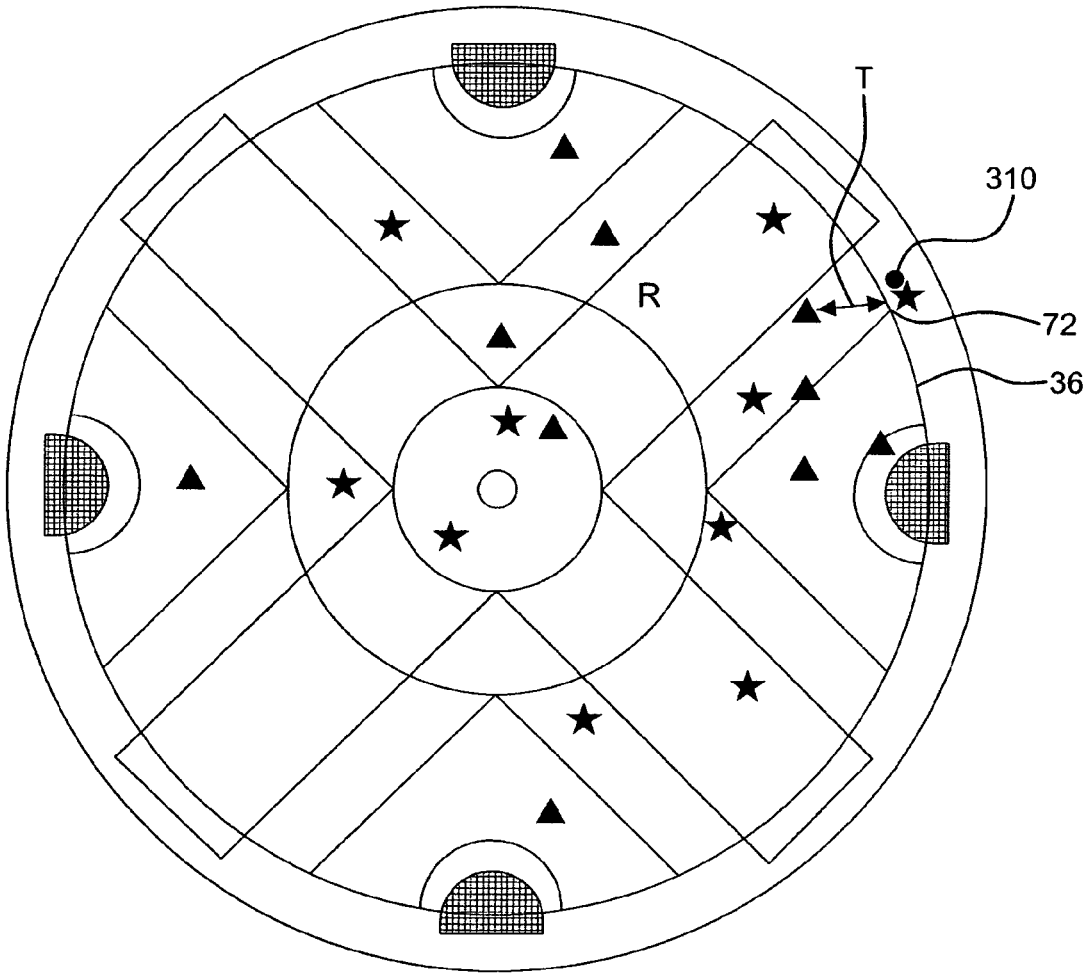
FIG. 43 shows an embodiment of a thrown-in alignment.

Referring now to FIG. 43, a player from Team A holds ball 310 on the nearest wedge zone/flex zone corner 72 point where ball 310 passed over boundary ring 36, and sets himself up to take a throw-in. The 30-second shot clock resets for Team A, now on offense. Team A does not need to clear ball 310, since the turnover occurred on an out-of-bounds. Team A may not, however, score directly from the throw-in. Team B players must remain a minimum distance T, which may be 2 yards in an embodiment, from the point at which the throw-in is taken.

Figure 44:
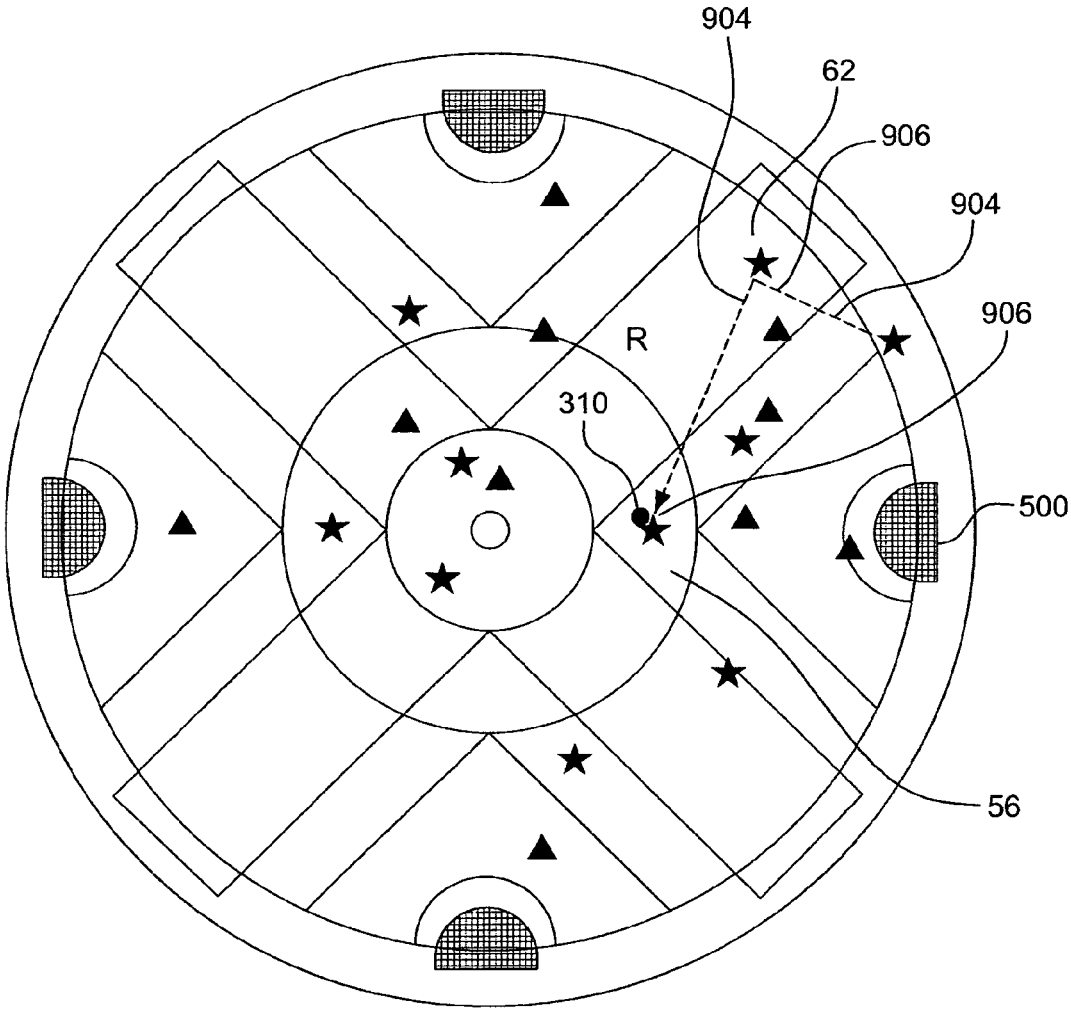
FIG. 44 shows an embodiment of a throw-in and a pass of a ball.

Referring now to FIG. 44, a player from Team A takes the throw-in, throwing 904 ball 310 to a nearby teammate in cross zone 62. The Team A player receiving the throw-in catches 906 ball 310 and throws 904 ball 310 to another teammate in flex zone 56 by near goal 500. The Team A player in flex zone 56 catches 906 ball 310. Team B players move to challenge and defend.

Figure 45A:
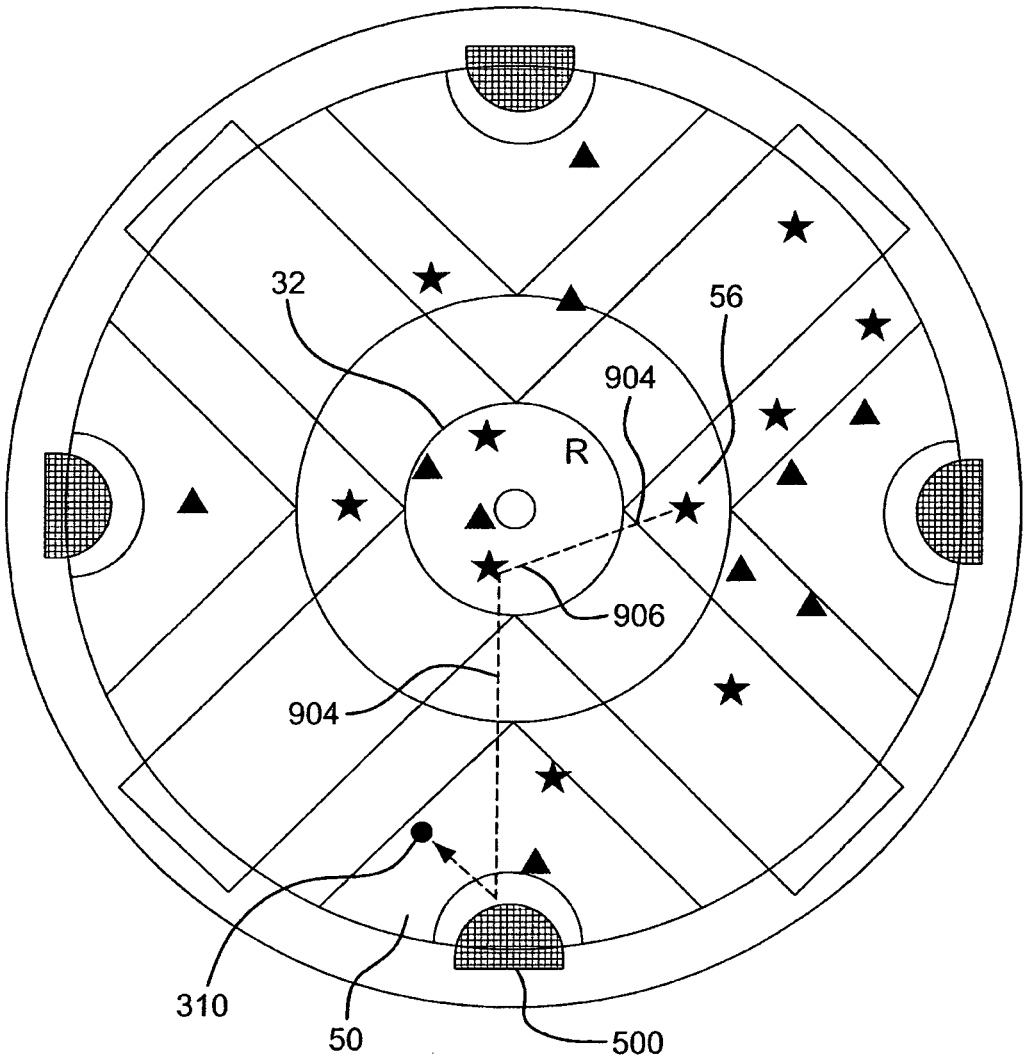
FIGS. 45*a* and 45*b* show an embodiment of a pass, shot, and rebound of a ball off of a Crown of a goal.
Figure 45B:
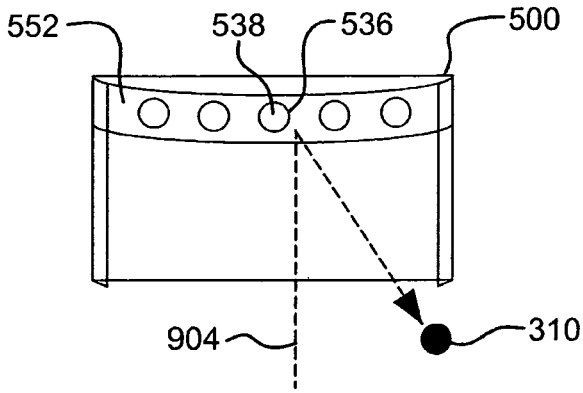

Referring now to FIGS. 45*a* and *b*, a Team A player with ball 310 in flex zone 56, throws 904 ball 310 to an open teammate in second ring 32, who appears to have an option for a long shot or to drive toward another goal 500. The Team A player catches 906 ball 310, takes one dribble, and throws 904 ball 310 at goal 500, attempting to score on a long shot through opening 538 of circular open ring 536 shown in FIG. 45*b*. A Team B player moves to block the shot, but cannot reach it. The shot is off target, and ball 310 rebounds off Crown 552 of goal 500 and rolls away from goal 500 into wedge zone 50. Nearby Team A and Team B players race to retrieve free ball 310.

Figure 46:
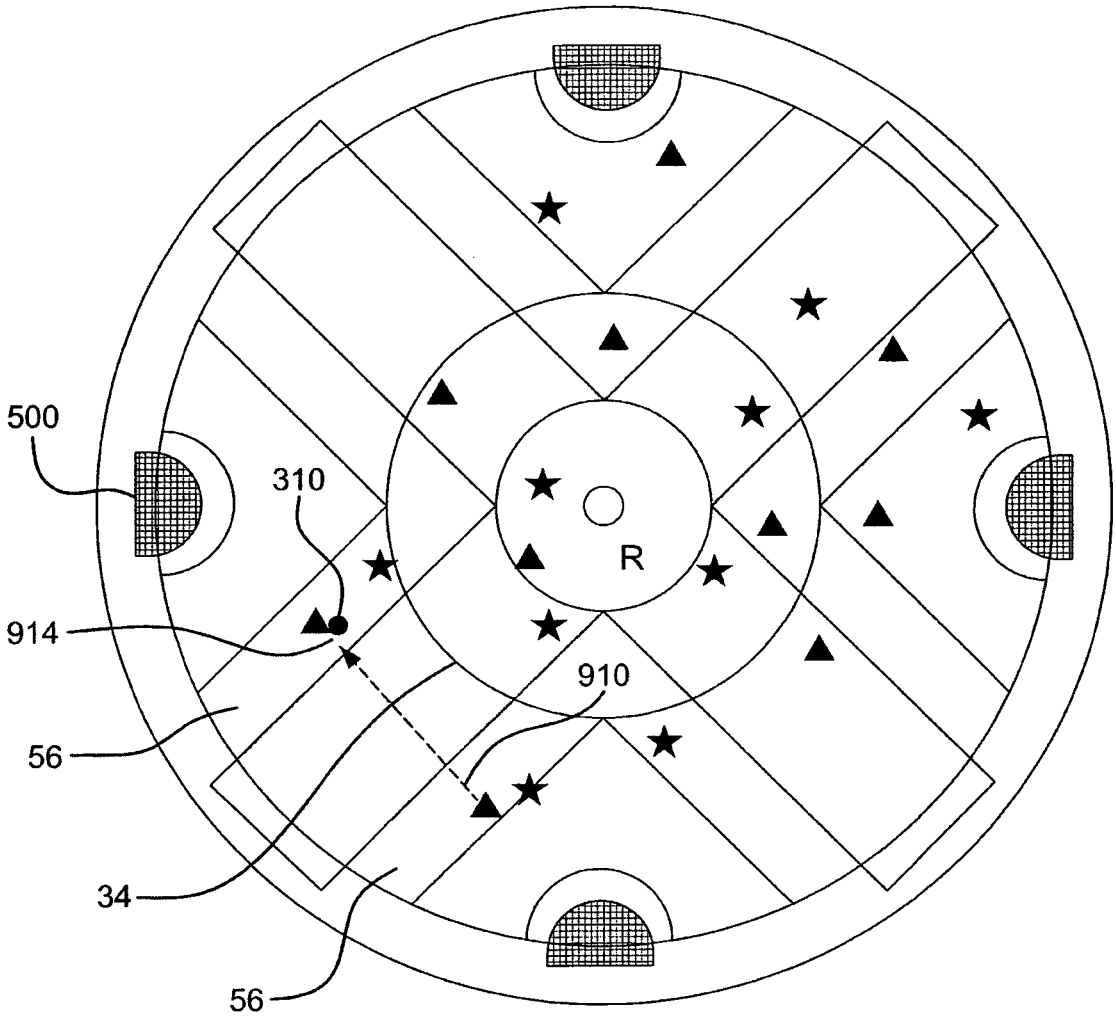
FIG. 46 shows an embodiment of a recovery and a pass of a ball.

Referring now to FIG. 46, a Team B player reaches free ball 310 just ahead of a Team A player and plays ball 310 with his foot, since ball 310 is in flex zone 56. The 30-second shot clock resets for Team B, now on offense. Team B must clear ball 310 to a player inside third ring 34 before scoring. The Team B player with ball 310 is being pressed by a defensive Team A player, who attempts to steal ball 310. The Team B player kicks 910 ball 310 to a teammate inside an adjacent flex zone 56. The near goal 500 is wide open, but Team B must clear before scoring, so the Team B player receiving 914 ball 310 in flex zone 56 traps ball 310 with his foot and looks for a teammate inside third ring 34.

Figure 47:
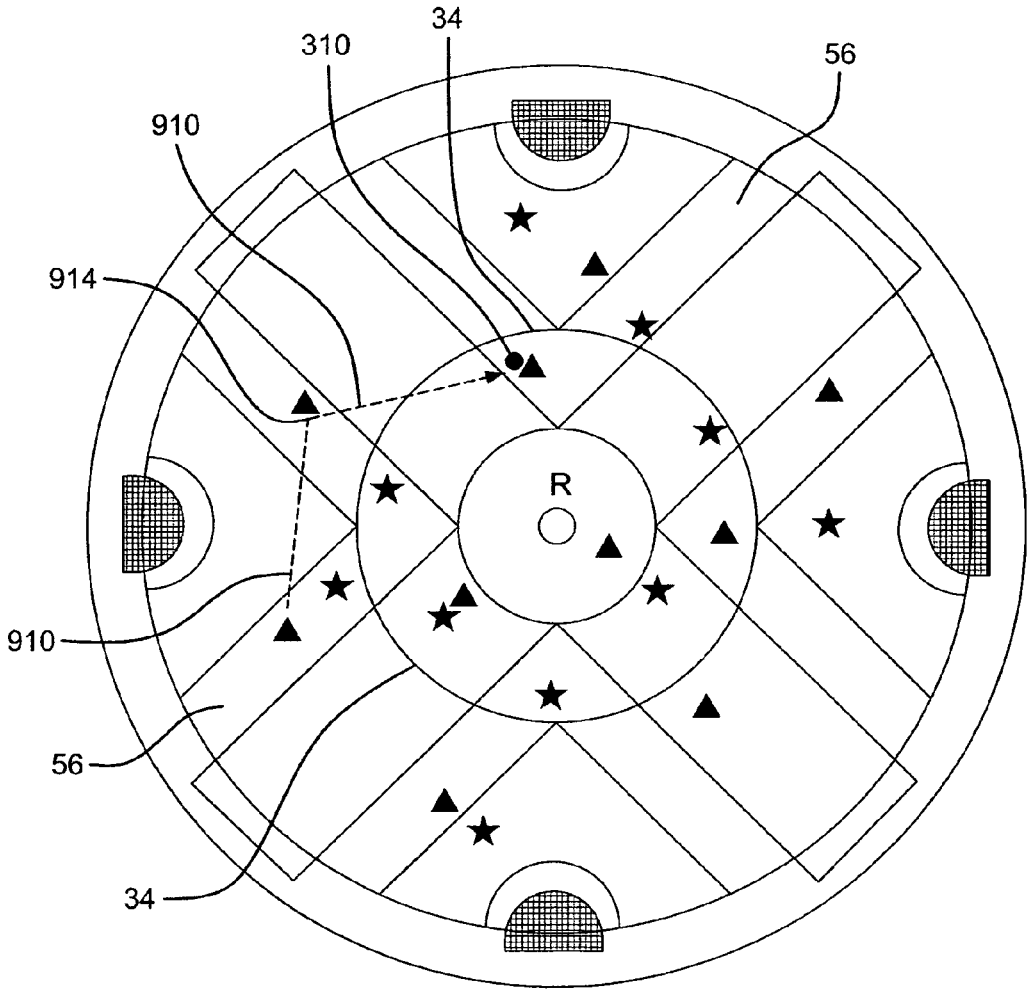
FIG. 47 shows an embodiment of a pass and a third ring clearance of a ball.

Referring now to FIG. 47, a Team B player with ball 310 in flex zone 56 does not see an open teammate available for a pass inside third ring 34, and he is facing defensive pressure from a Team A player, so he kicks 910 ball 310 to an open teammate across from him who is also in flex zone 56. The Team B player receiving 914 ball 310 traps and kicks 910 ball 310 quickly to an open teammate inside third ring 34 in an adjacent flex zone 56.

Figure 48A:
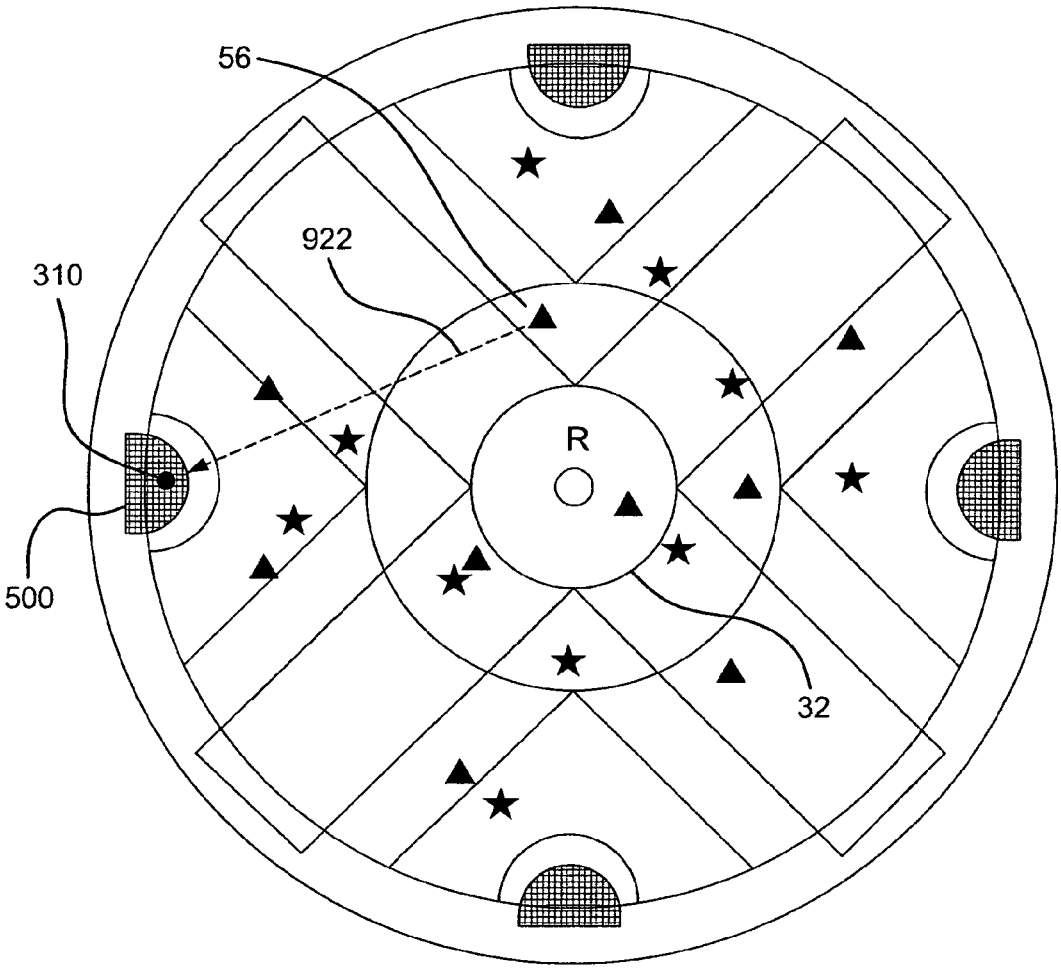
FIGS. 48*a* and 48*b* show an embodiment of a distant shot and a score of a ball in a goal.
Figure 48B:
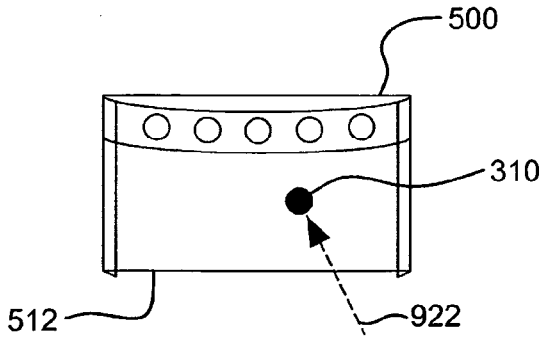

Referring now to FIGS. 48*a* and *b*, a Team B player who receives ball 310 in flex zone 56 realizes that distant goal 500 is still undefended, so he immediately takes a kick shot 922 (from approximately 25 yards away) hoping to score in distant goal 500. His shot is struck on target into arced rectangularly-shaped opening 512 of distant goal 500 for 5 points. Referee R signals the score. The score triggers a change of possession. Team B is now on defense, and Team A is now on offense. Team A must clear ball 310 inside second ring 32 before scoring. Team B may not challenge the clear attempt following a score. Team B must also evacuate second ring 32.

Figure 49:
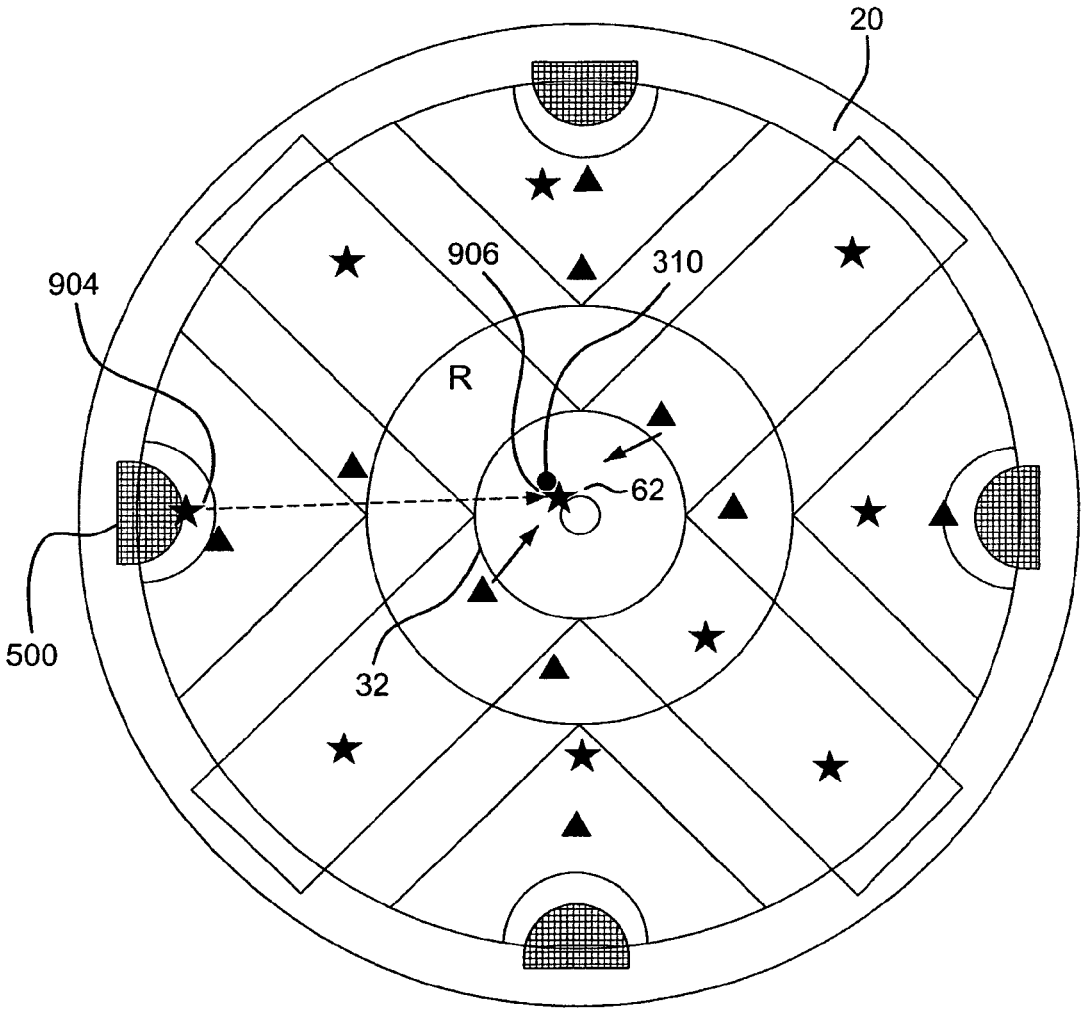
FIG. 49 shows an embodiment of a second ring clearance of a ball.

Referring now to FIG. 49, a player from Team A collects ball 310 from goal 500. The 30-second shot clock resets for Team A, now on offense. Players from both teams tactically reposition themselves on playing surface 20. The player throws 904 ball 310 to a Team A teammate, who catches 906 ball 310 inside second ring 32 in cross zone 62. Team B immediately presses him on defense.

Figure 50:
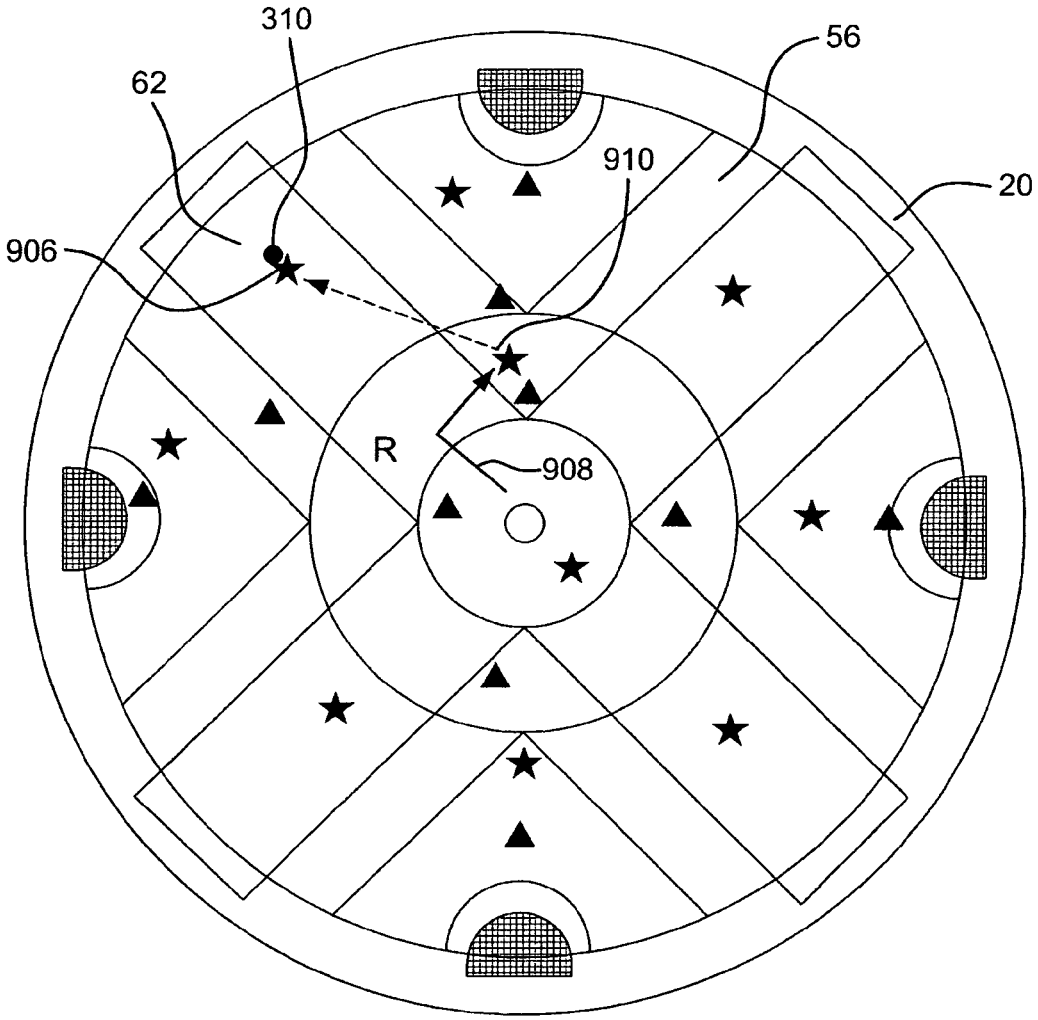
FIG. 50 shows an embodiment of a dribble and a pass of a ball.

Referring now to FIG. 50, a player from Team A with ball 310 dribbles 908 away from the defensive pressure from Team B and into flex zone 56, where he transitions ball 310 to his feet and kicks 910 ball 310 to a teammate in cross zone 62. The Team A player in cross zone 62 catches 906 ball 310 and has time to survey the positions of the players on playing surface 20, all of whom are repositioning themselves tactically to defend or attack.

Figure 51:
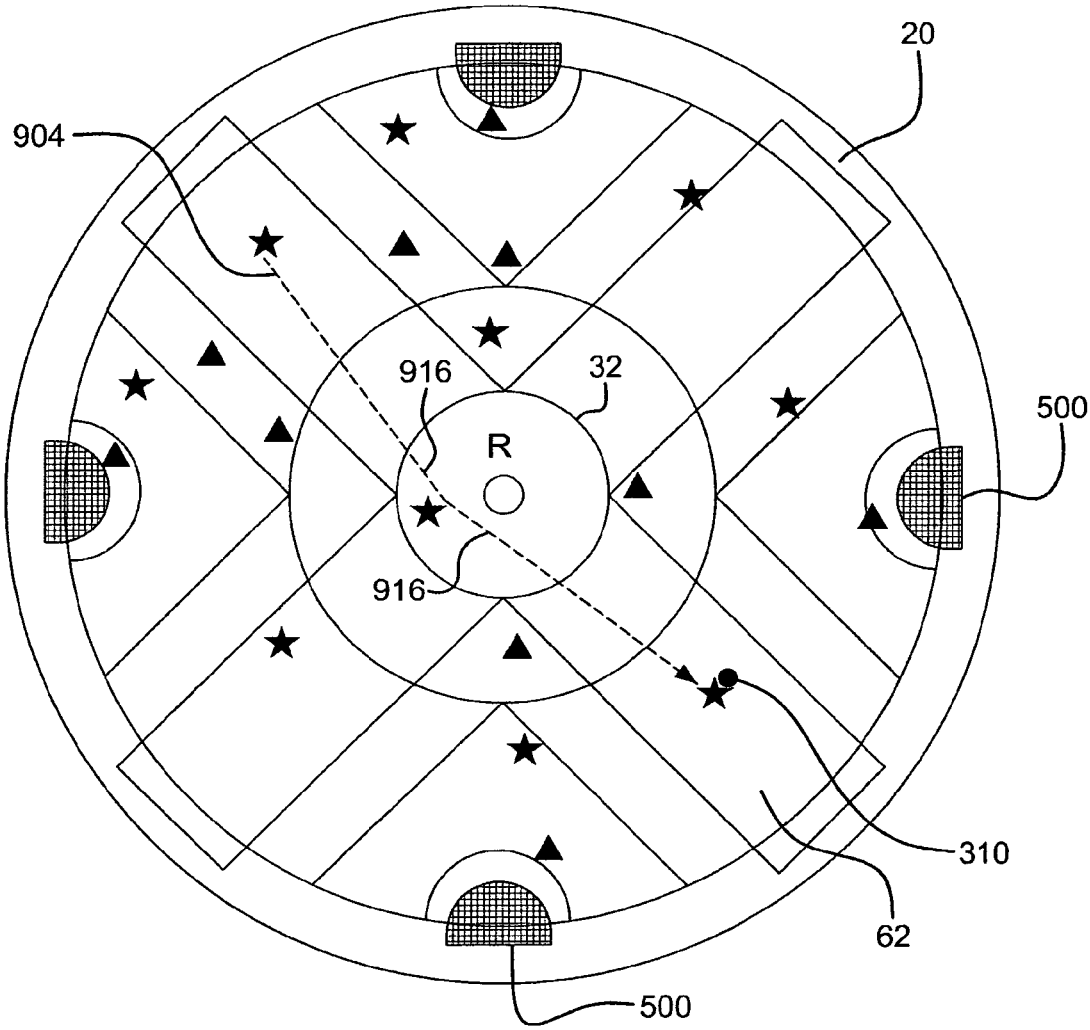
FIG. 51 shows an embodiment of two sequential passes of a ball between team members.

Referring now to FIG. 51, a player from Team A with ball 310 throws 904 ball 310 to a teammate in second ring 32, who passes 916 ball 310 quickly to the opposite side of playing surface 20, where a Team A player is set in cross zone 62 and has an option to attack either of two goals 500.

Figure 52A:
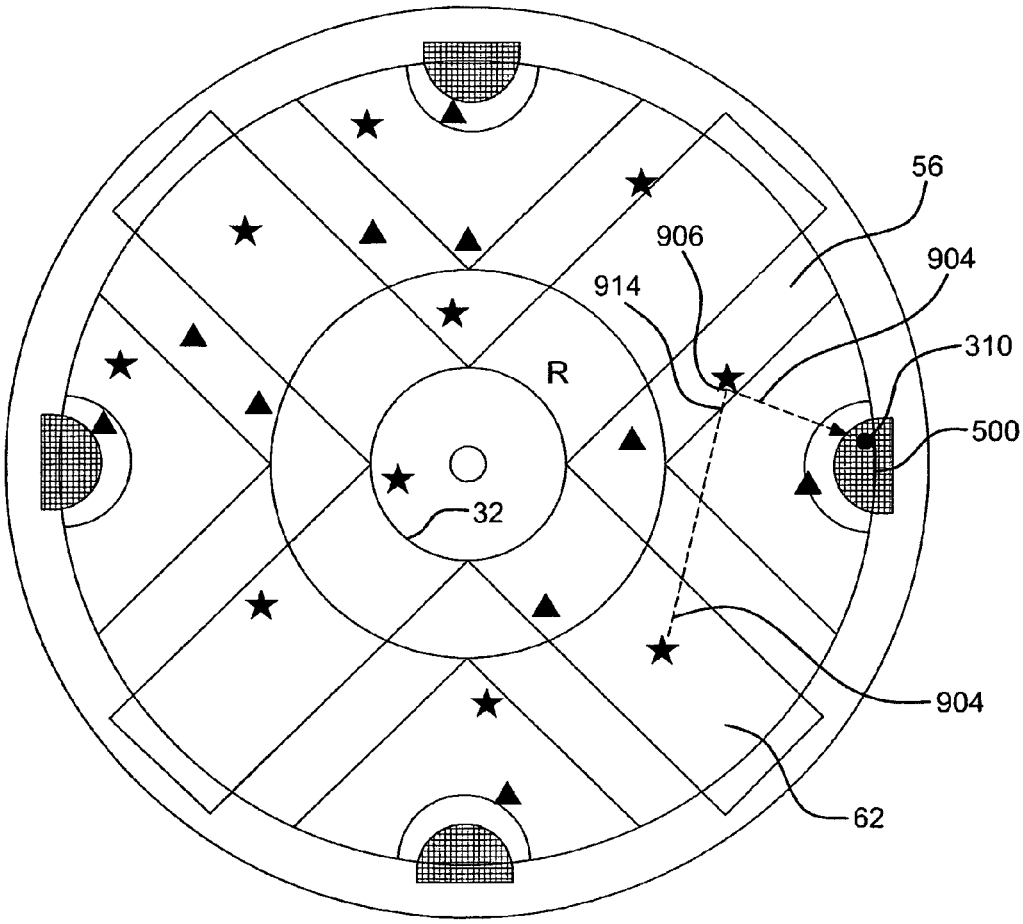
FIGS. 52*a* and 52*b* show an embodiment of a pass, a shot, and a score with a ball through an opening of an open ring structure of a goal.
Figure 52B:
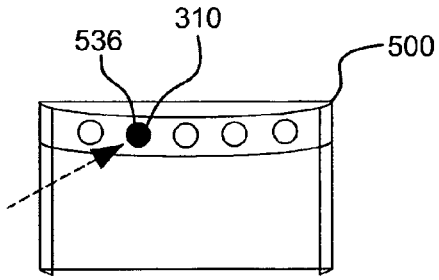

Referring now to FIGS. 52*a* and *b*, an player from Team A with ball 310 in cross zone 62 throws 904 ball 310 to an open teammate on the opposite side of nearby flex zone 56. The Team A player receiving 914 the pass in flex zone 56 decides to catch 906 ball 310 and throws 904 ball 310 immediately at near goal 500, aiming for circular open ring 536 of goal 500. The Team B defender does not have time to move and block the shot. The Team A player's shot is on target into circular open ring 536 of goal 500 for 3 points. Referee R signals the score. The score triggers a change of possession. Team A is now on defense, and Team B is now on offense. Team B must clear ball 310 inside second ring 32 before scoring. Team A may not challenge the clear attempt following a score. Team A must also evacuate second ring 32.

Figure 53:
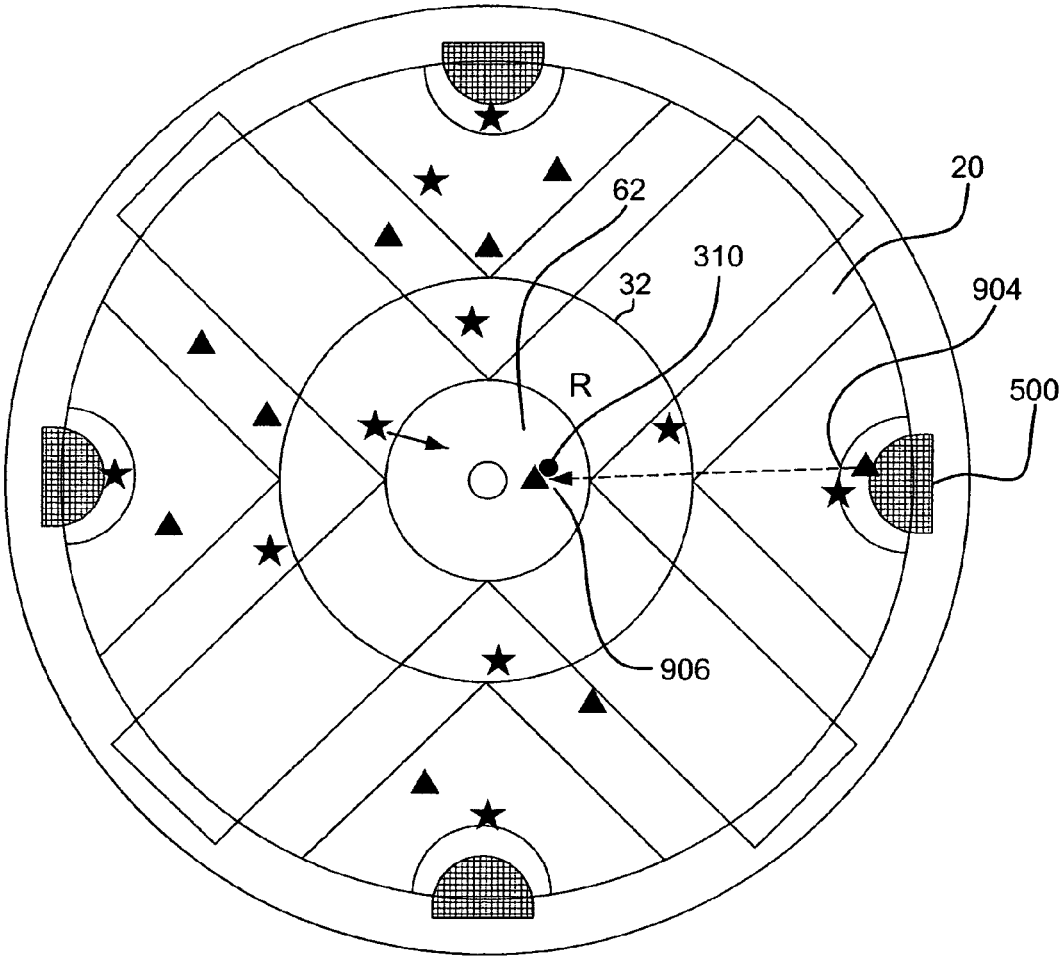
FIG. 53 shows an embodiment of a second ring clearance of a ball.

Referring now to FIG. 53, a player from Team B collects ball 310 from goal 500. The 30-second shot clock resets for Team B, now on offense. Players from both teams tactically reposition themselves on playing surface 20. The player throws 904 ball 310 to a Team B teammate, who catches 906 ball 310 inside second ring 32 in cross zone 62. Team A immediately presses him on defense.

Figure 54A:
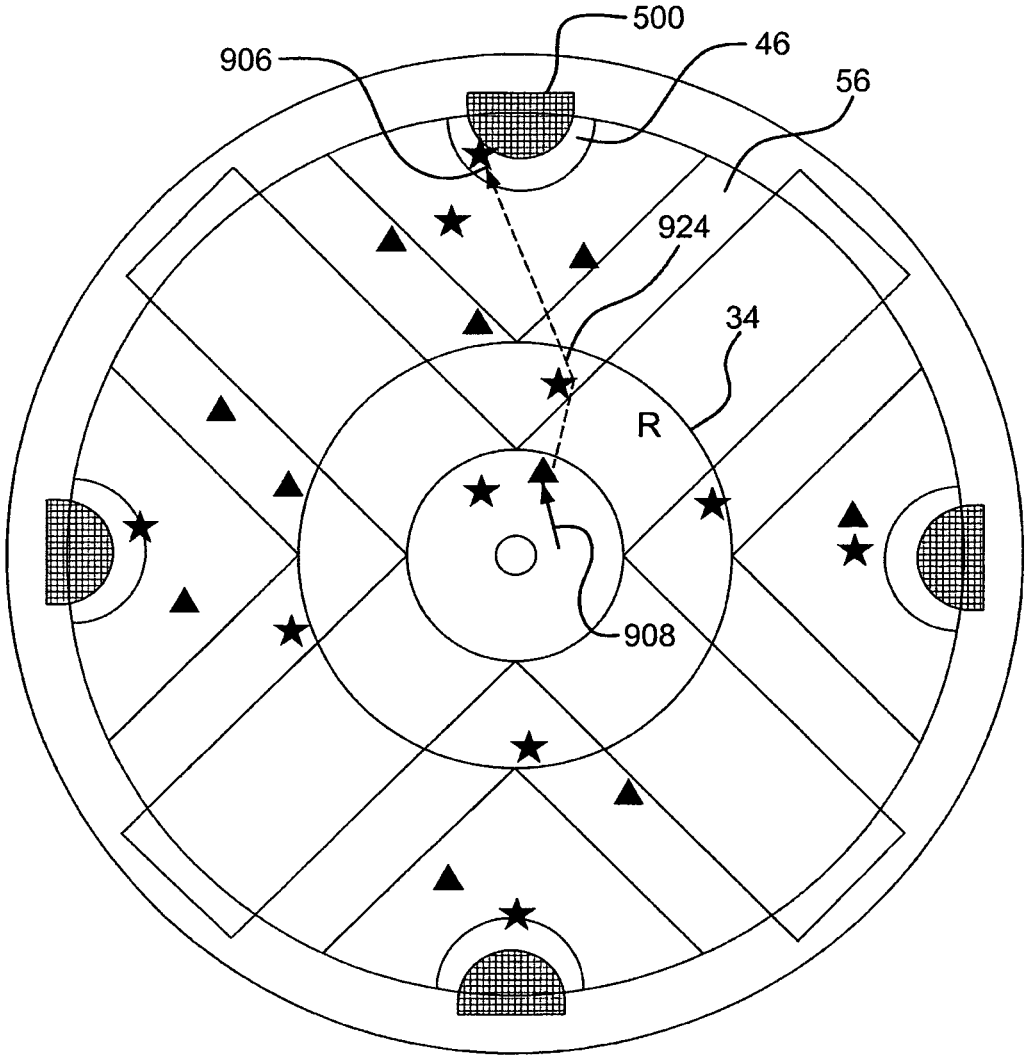
FIGS. 54*a* and 54*b* show an embodiment of a dribble, a turnover, a kick, a dunk, and a score with a ball through an opening of an open ring structure of a goal.
Figure 54B:
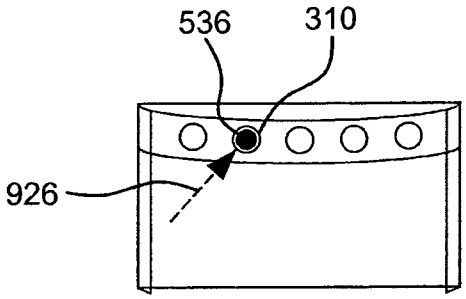

Referring now to FIGS. 54*a* and *b*, a Team B player with ball 310 dribbles 908 in the direction of goal 500 and three teammates. The player mishandles ball 310 and ball 310 bounces away from him and toward a defending Team A player. The Team A player realizes he will get to ball 310 first in flex zone 56 and have a chance to play ball 310 with his foot. This will be a turnover inside third ring 34, which does not require clearance of ball 310. The Team A player turns to recover loose ball 310 and simultaneously shoots 924 at open goal 500. The 30-second shot clock resets for Team A, now on offense. The shot is wide left and high. Another Team A player, who had been in goal zone 46 jumps, catches 906 ball 310 with one hand, and dunks 926 ball 310 through opening 538 of circular open ring 536 shown in FIG. 54*b* in one motion for a 2 point score. Referee R signals the score.

Figure 55:
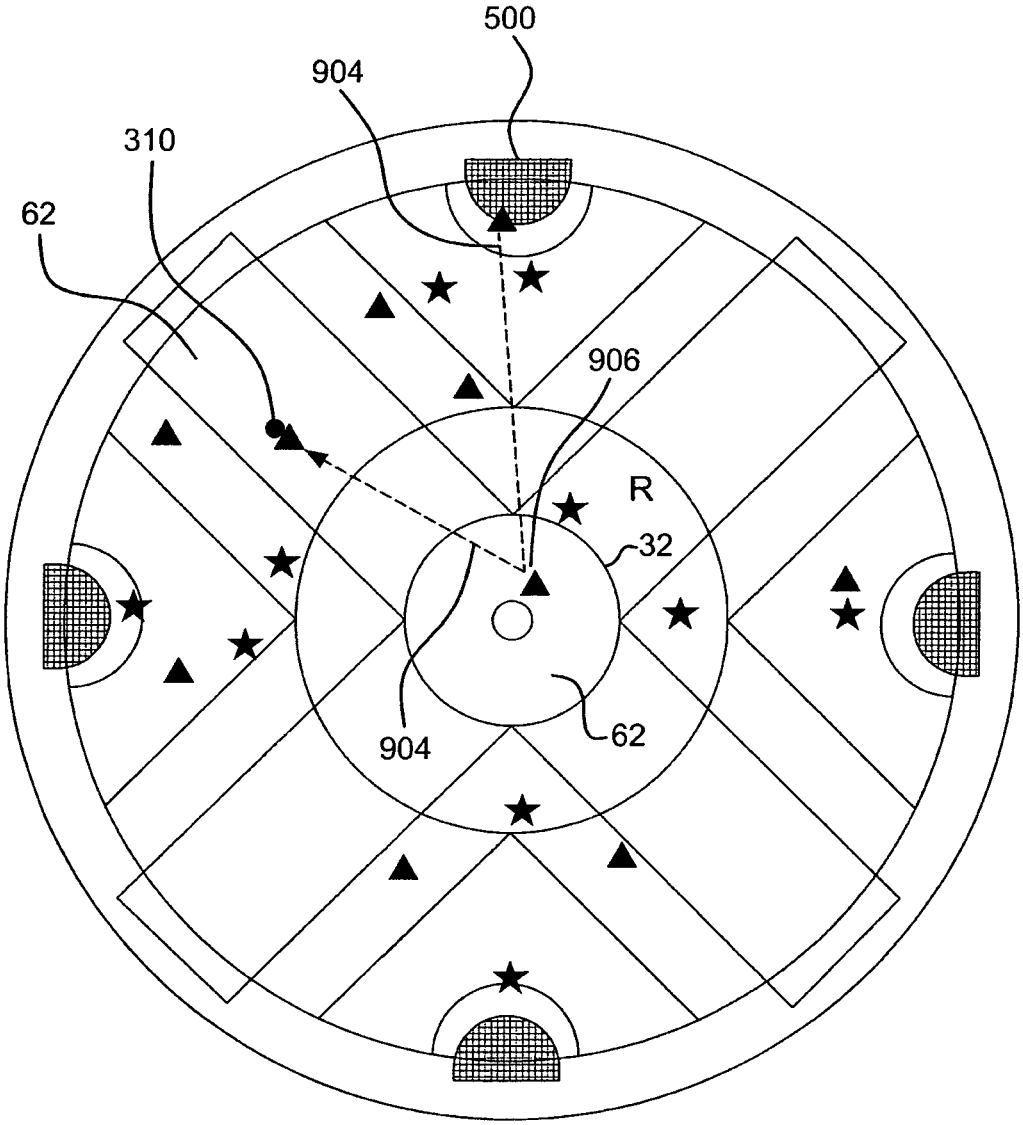
FIG. 55 shows an embodiment of a second ring clearance and a pass of a ball.

Referring now to FIG. 55, a player from Team B collects ball 310 from goal 500. The 30-second shot clock resets for Team B, now on offense. Players from both teams tactically reposition themselves on playing surface 20. The Team B player throws 904 ball 310 to a teammate, who catches 906 ball 310 inside second ring 32 in cross zone 62. The Team B player catching the clearing pass throws 904 ball 310 to another teammate open in cross zone 62. The teammate makes the catch.

Figure 56:
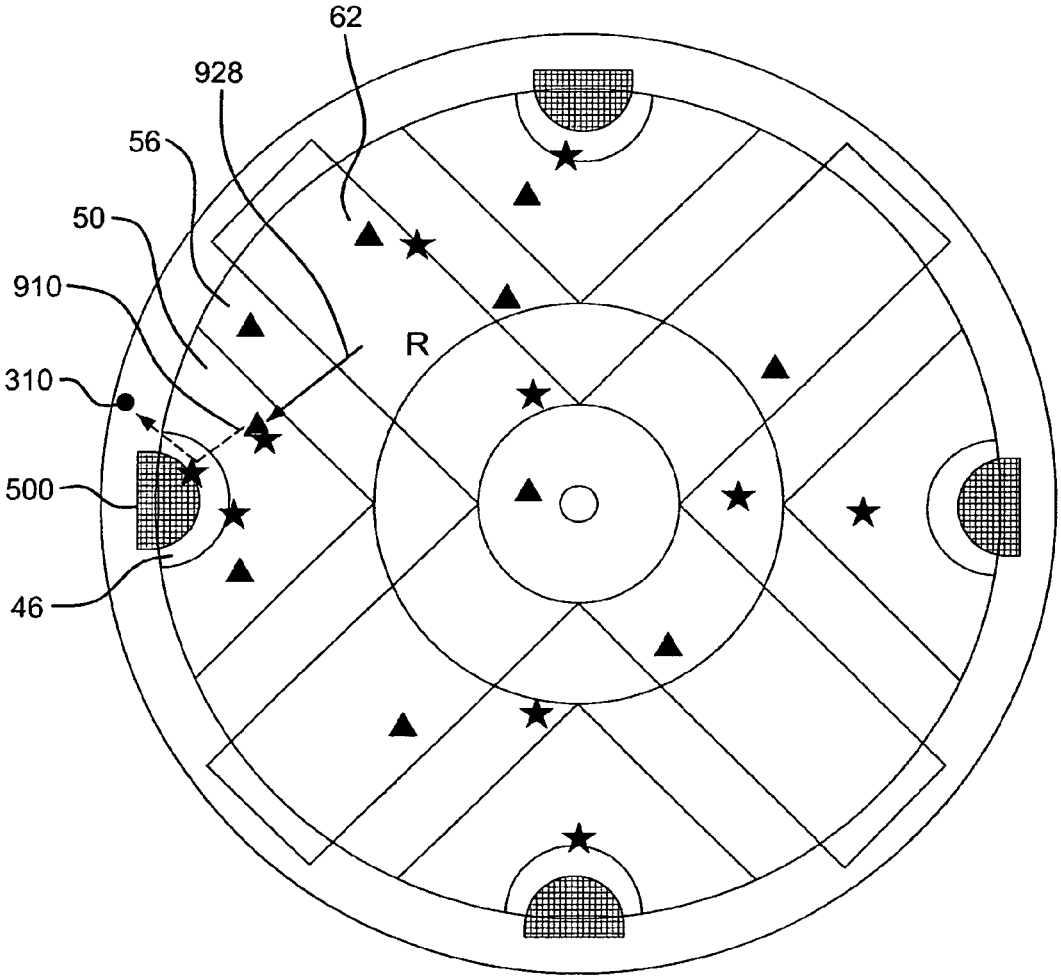
FIG. 56 shows an embodiment of a dribble, a transition, a shot, and a foul.

Referring now to FIG. 56, a Team B player flips 928 ball 310 from cross zone 62 into flex zone 56, where ball 310 lands and begins to roll toward wedge zone 50. The Team B player follows ball 310 and plays ball 310 with his feet driving into wedge zone 50. Team A players react, one taking a defensive position in goal zone 46 to defend a shot, a second providing backup in float arc, and a third directly challenging the driving offensive player. The challenge is too direct, and the Team A player runs into the Team B player, knocking him down to the ground on playing field 20 as he kicks 910 ball 310 at goal 500. Referee R signals a foul on the Team A player. The Team B player in goal zone 46 deflects the shot wide and ball 310 goes out of bounds.

Figure 57A:
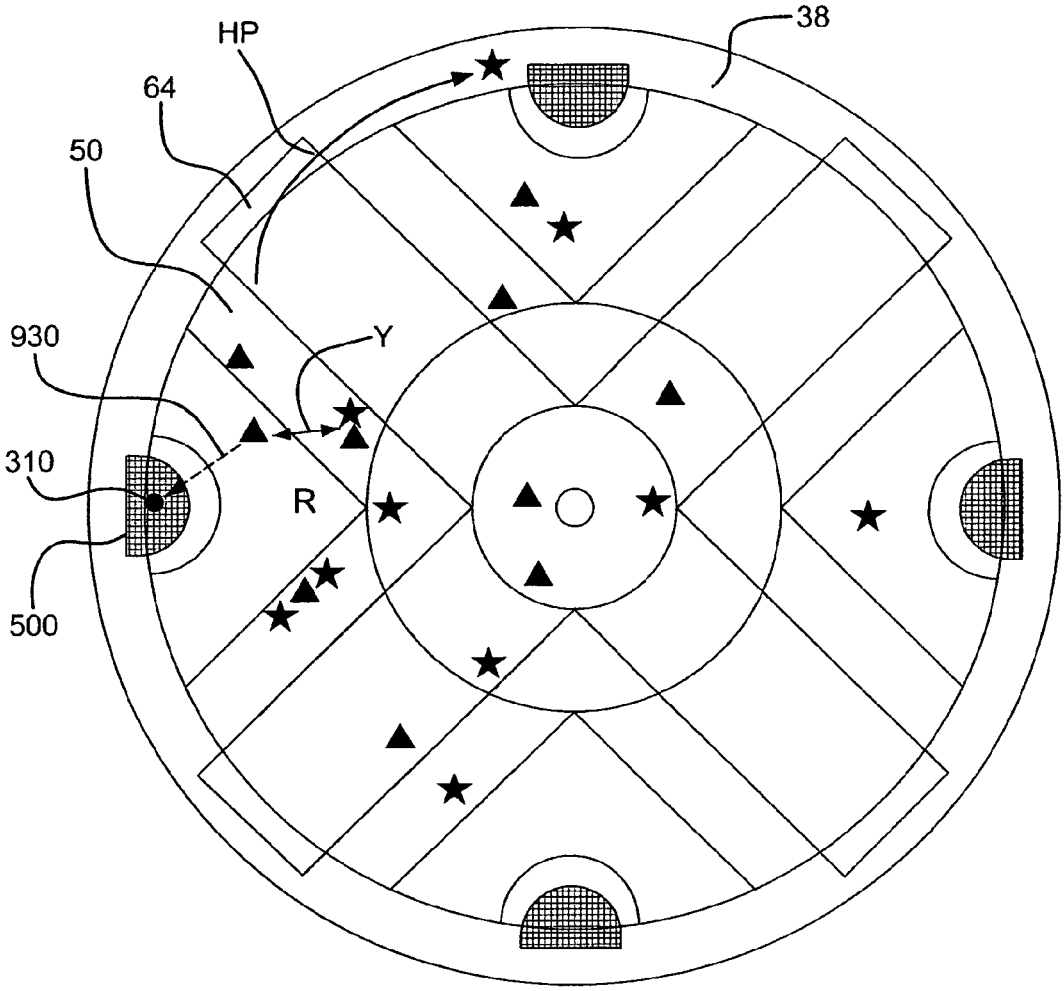
FIGS. 57*a* and 57*b* show an embodiment of a clear shot as a result of a penalty.
Figure 57B:
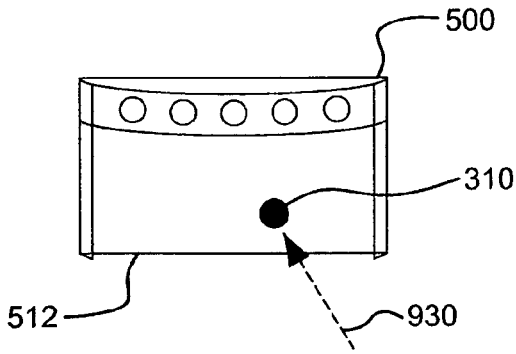

Referring now to FIGS. 57*a* and *b*, Referee R awards the fouled Team B player a clear shot from the spot of the foul and assigns the penalized Team A player a half-lap penalty HP in welcome ring 38. Referee R directs the Team A player toward his closest team bench zone 64 and then places ball 310 on the ground at the spot of the foul in wedge zone 50, and players take appropriate clear shot positions at distance Y from the spot of the foul. Distance Y may be 3 or more yards. The Team A player exits playing surface 20 at his closest team bench zone 64 and begins his half-lap penalty HP in welcome ring 38. The Team B player takes the clear shot kick 930 and scores into arced rectangularly-shaped opening 512 of goal 500 for 2 points shown in FIG. 57*a*. Referee R signals the score.

Figure 58:
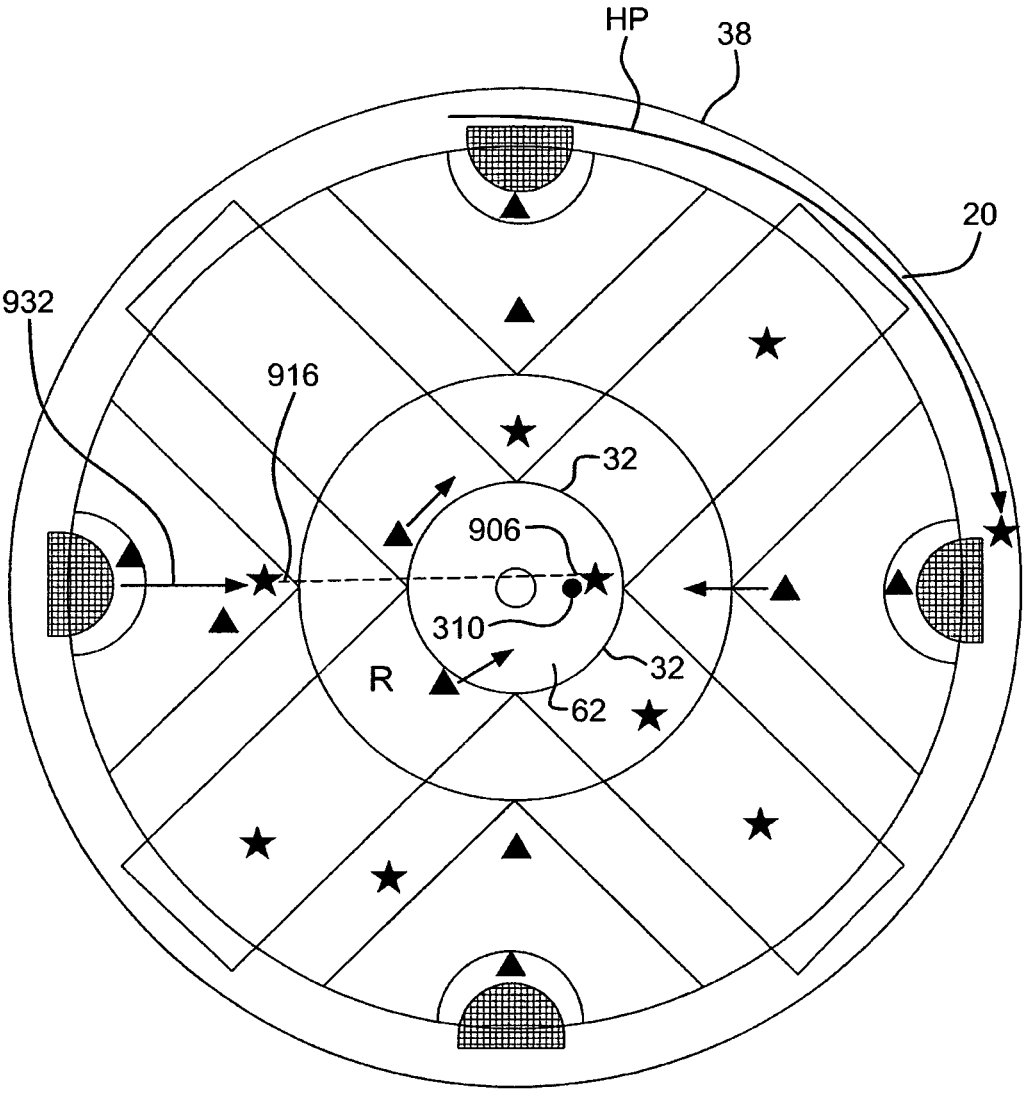
FIG. 58 shows an embodiment of a second ring clearance and a sequence of passes of a ball.

Referring now to FIG. 58, a score triggers a change of possession. Team B is now on defense, and Team A is now on offense. Team A must clear ball 310 inside second ring 32 before scoring. Team B may not challenge the clear attempt following a score. Team B must also evacuate second ring 32. A player from Team A collects ball 310 from goal 500 and begins moving 932 with ball 310 toward second ring 32. The 30-second shot clock resets for Team A. Players from both teams tactically reposition themselves on playing surface 20. The Team A player passes 916 ball 310 to a teammate, who catches 906 ball 310 inside second ring 32 in cross zone 62. Team B immediately presses him on defense. Team A is under time pressure from the 30-second shot clock, but would like to stall until their penalized teammate completes his half-lap penalty HP and the team is back to full strength with 10 players on playing surface 20.

Figure 59:
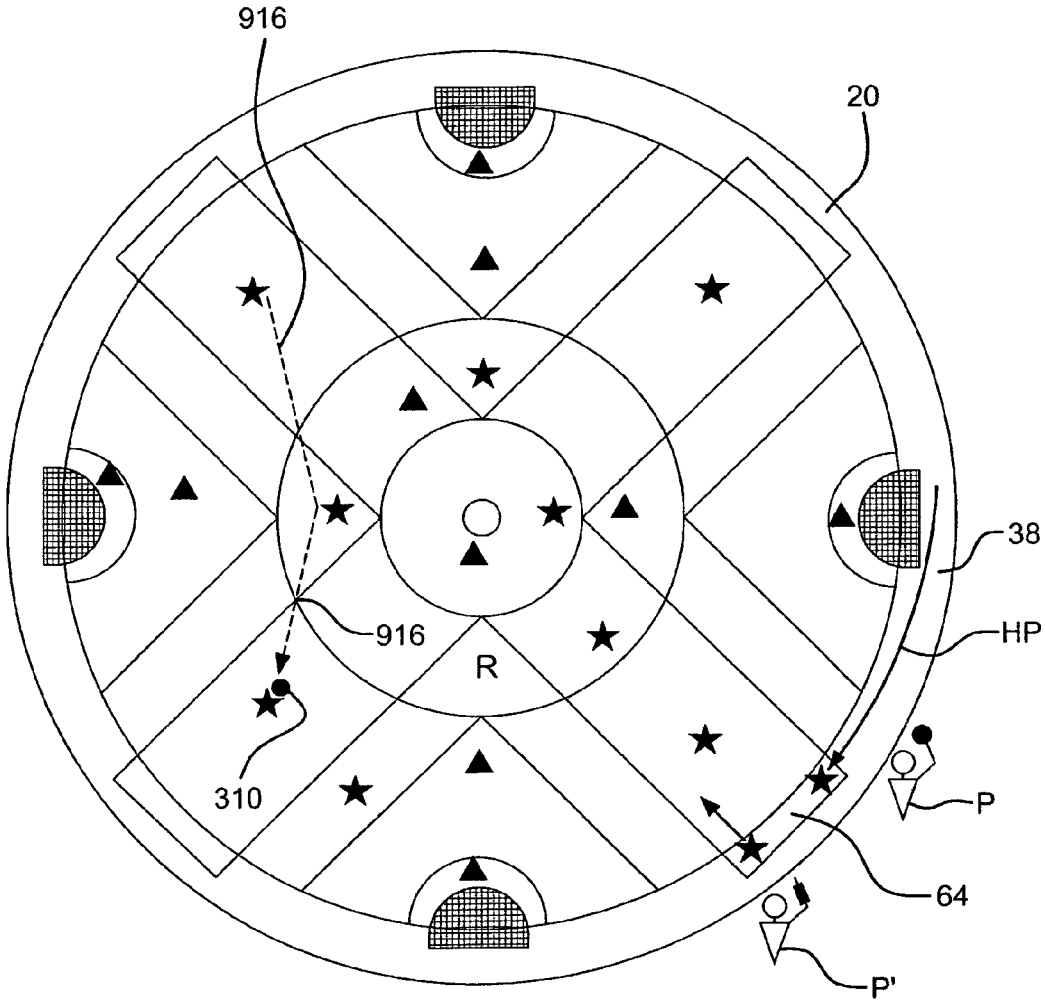
FIG. 59 shows an embodiment of a lap completion and a player substitution.

Referring now to FIG. 59, a penalized Team A player completes his half-lap penalty HP at Team A's team bench zone 64. The player is tired from the run, and so Team A decides to make a player substitution. The player P departing the game removes his active player arm band as he enters team bench zone 64 and holds active player arm band in his raised hand over his head, to signal that he is now inactive. Simultaneously, the new player P' entering the game puts on his active player arm band and raises his arm as he runs onto playing surface 20. Referee R watches the substitution to ensure it is conducted properly. If there is no substitution violation, there is no need for any signals. Team A players continue to pass 916 ball 310 and now prepare to attack offensively though only 18 seconds remain on the shot clock.

Referring now to FIG. 70, Referee R stands in the center of Prime ring 30' with ball 310. Team A players and Team B players are aligned along second ring 32 inside cross zone 62 and prepare for the Prime rush.

Figure 71:
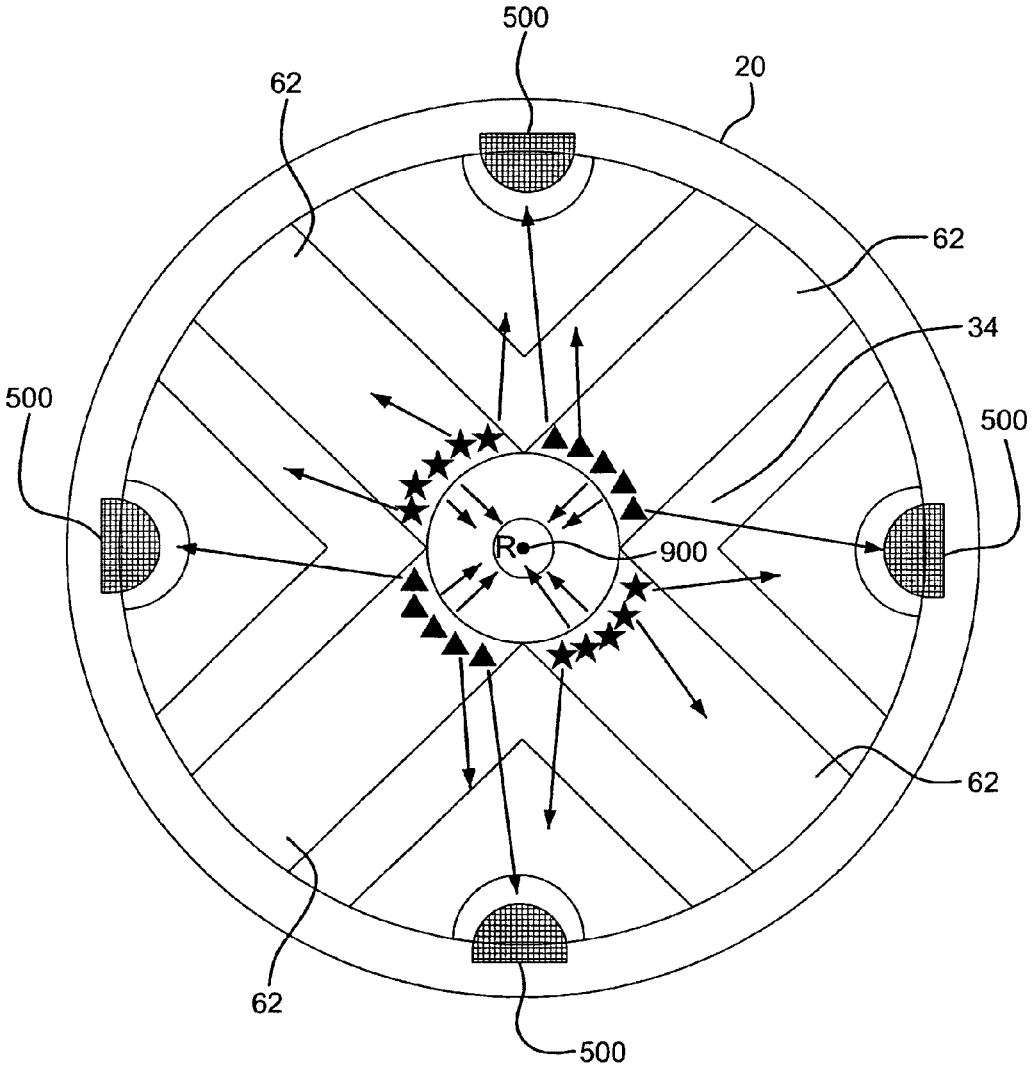
FIG. 71 shows an alternative embodiment of placing the ball in play for a prime rush.

Referring now to FIG. 71, Referee R blows the whistle and spikes 900 ball 310 on center spot 29 within prime ring 30', bouncing ball 310 into the air. Team A players and Team B players attempt to capture ball 310 and win the Prime rush. Other players from Team A and Team B move into attacking and defending positions on playing surface 20.

Figure 72:
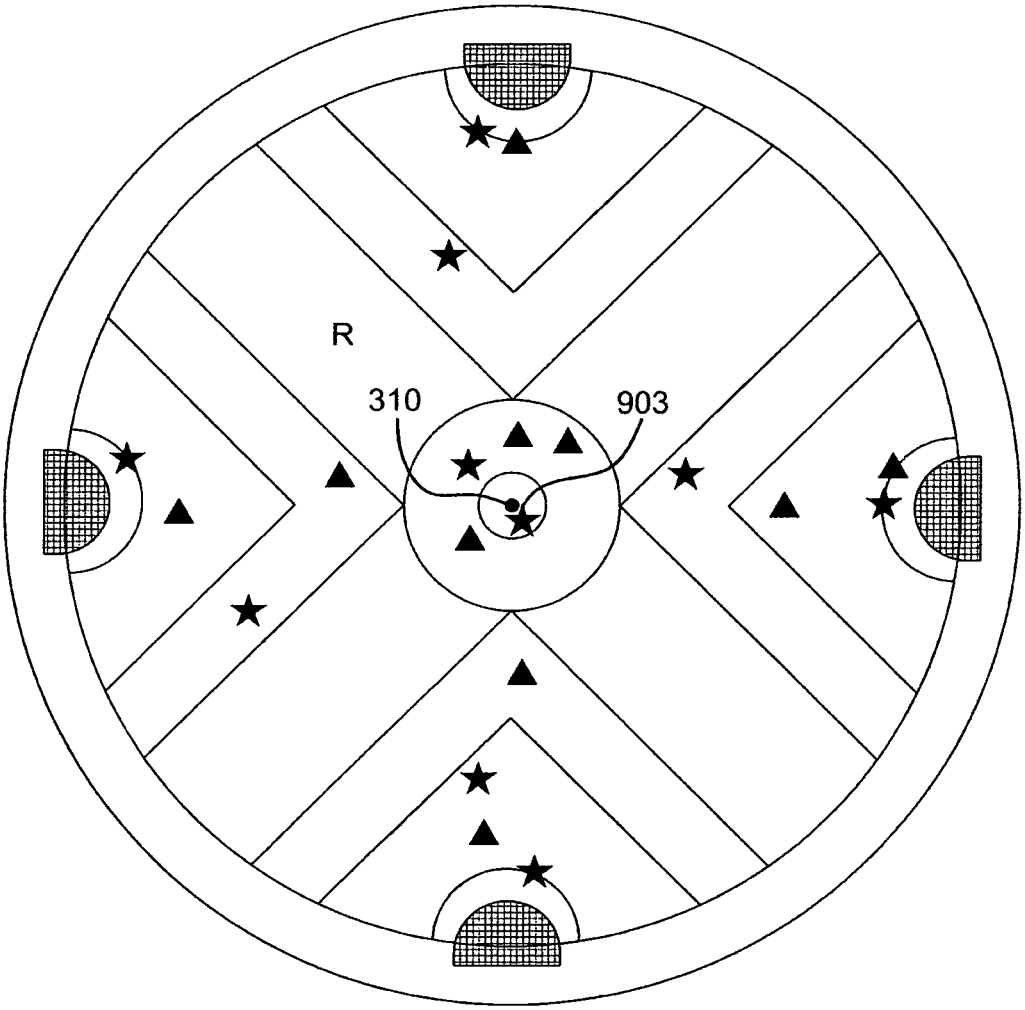
FIG. 72 shows an alternative embodiment of a team player taking possession of a ball.

Referring now to FIG. 72, a player from Team A captures 903 ball 310 and establishes possession for Team A. Referee R signals that Team A is on offense. Team A may attack any goal and attempt to score ball 310 in goal.

Figure 73:
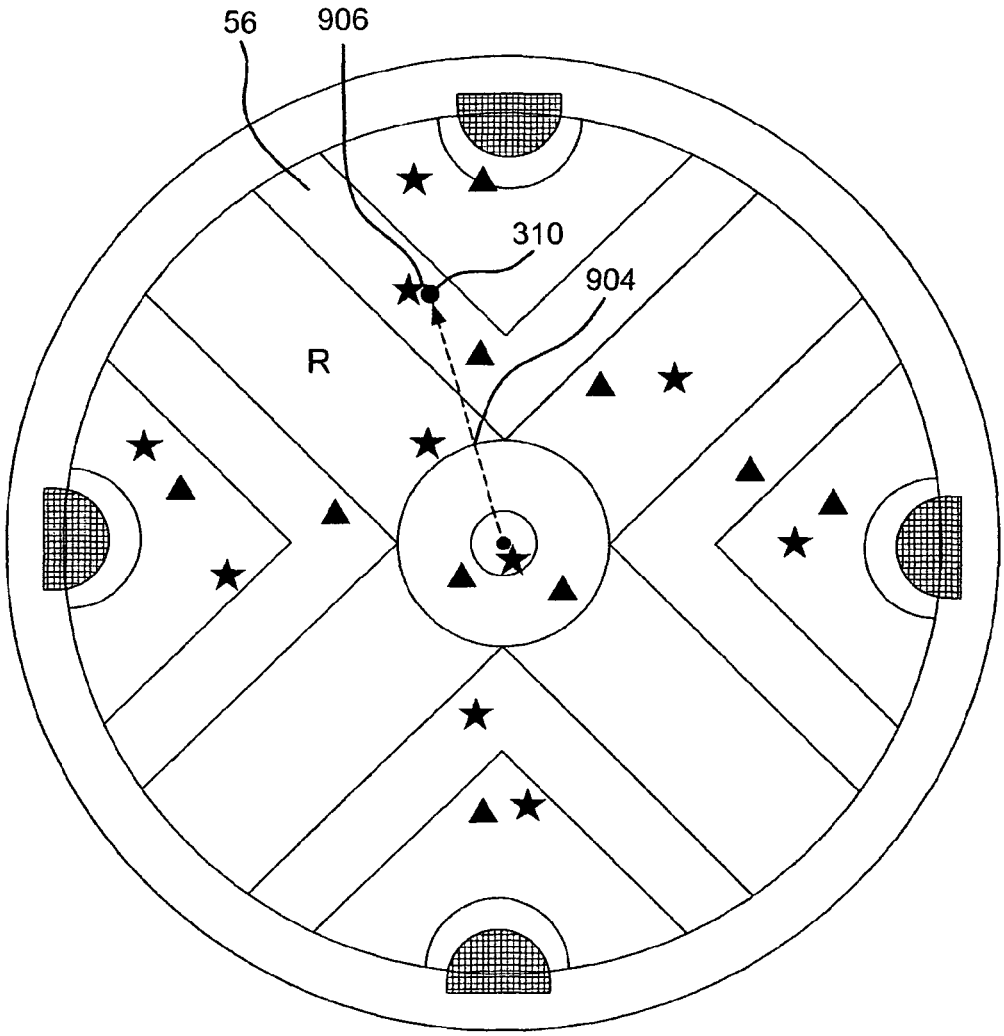
FIG. 73 shows an alternative embodiment of a team player passing a ball from within prime ring to another team member in a flex zone.

Referring now to FIG. 73, a player from Team A throws 904 ball 310 to a teammate located in flex zone 56. The teammate may receive ball 310 by hand or foot, and opts to catch 906 ball 310.

Figure 74:
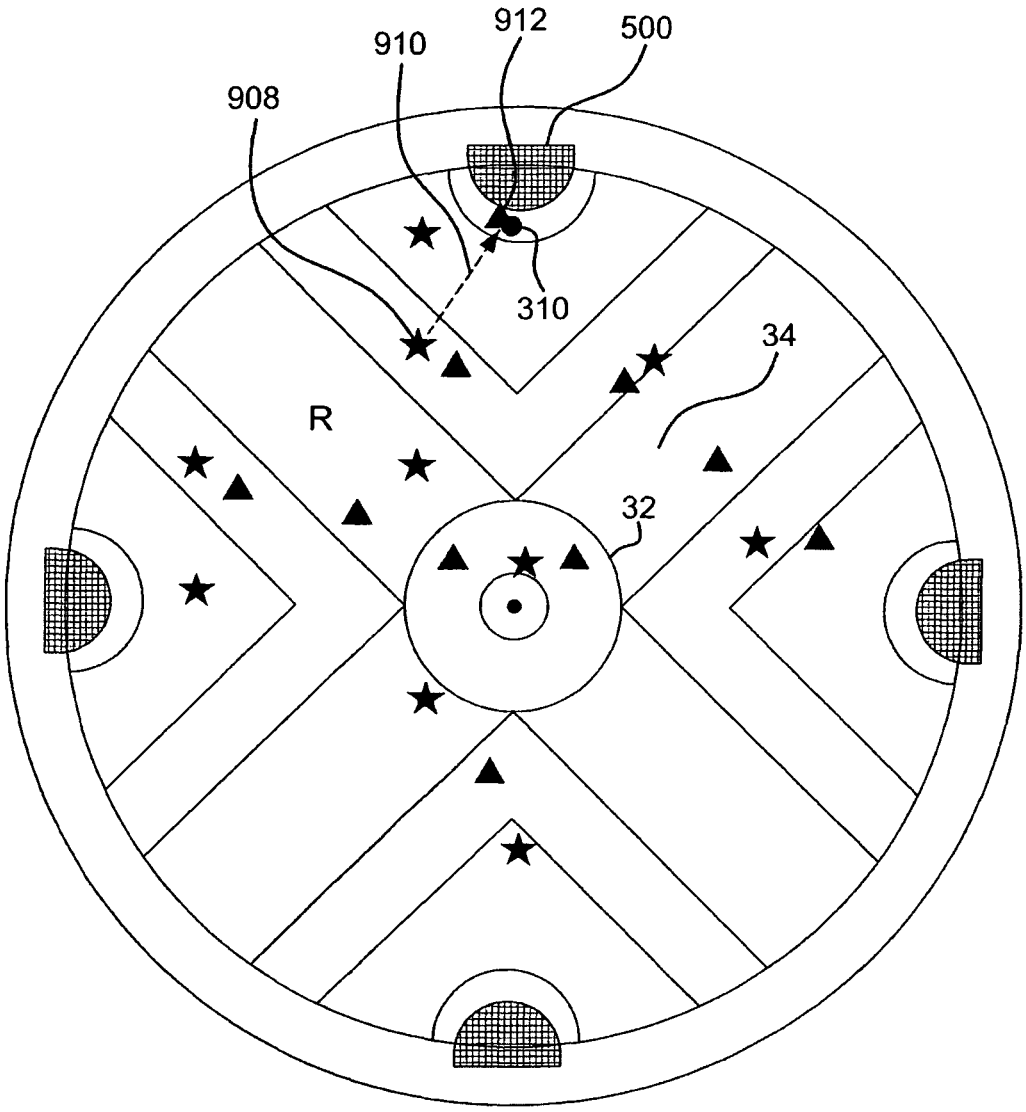
FIG. 74 shows an alternative embodiment of an offensive shot and a defensive catch save.

Referring now to FIG. 74, a player from Team A dribbles 908 ball 310 and then kicks 910 ball 310 at goal 500 attempting to score by passing ball 310 across arced rectangular opening and into chamber of goal 500. A defensive player makes a clean two-handed save 912 of ball 310. Team B controls ball 310, but must clear ball 310 to second ring 32 to complete a change of possession before attempting to score. Team A may play normal defense and challenge the clear attempt.

Figure 75:
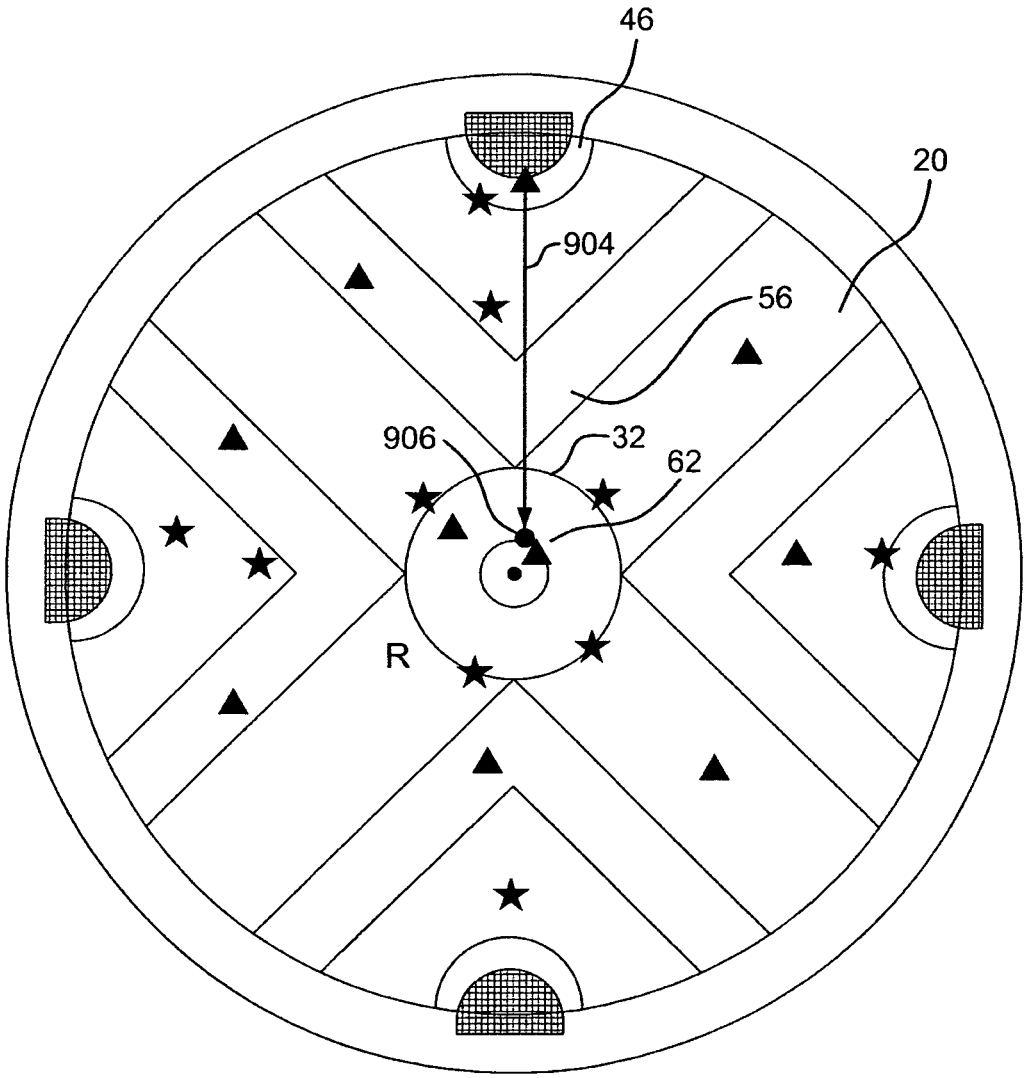
FIG. 75 shows an alternative embodiment of a team clearing a ball into a second ring area.

Referring now to FIG. 75, a defensive player from Team B in goal zone 46 throws 904 ball 310 to a teammate inside second ring 32 to complete clearance of ball 310. The teammate receiving ball 310 is in cross zone 62 and may receive ball 310 by hand or foot and opts to catch ball 310.

Figure 76:
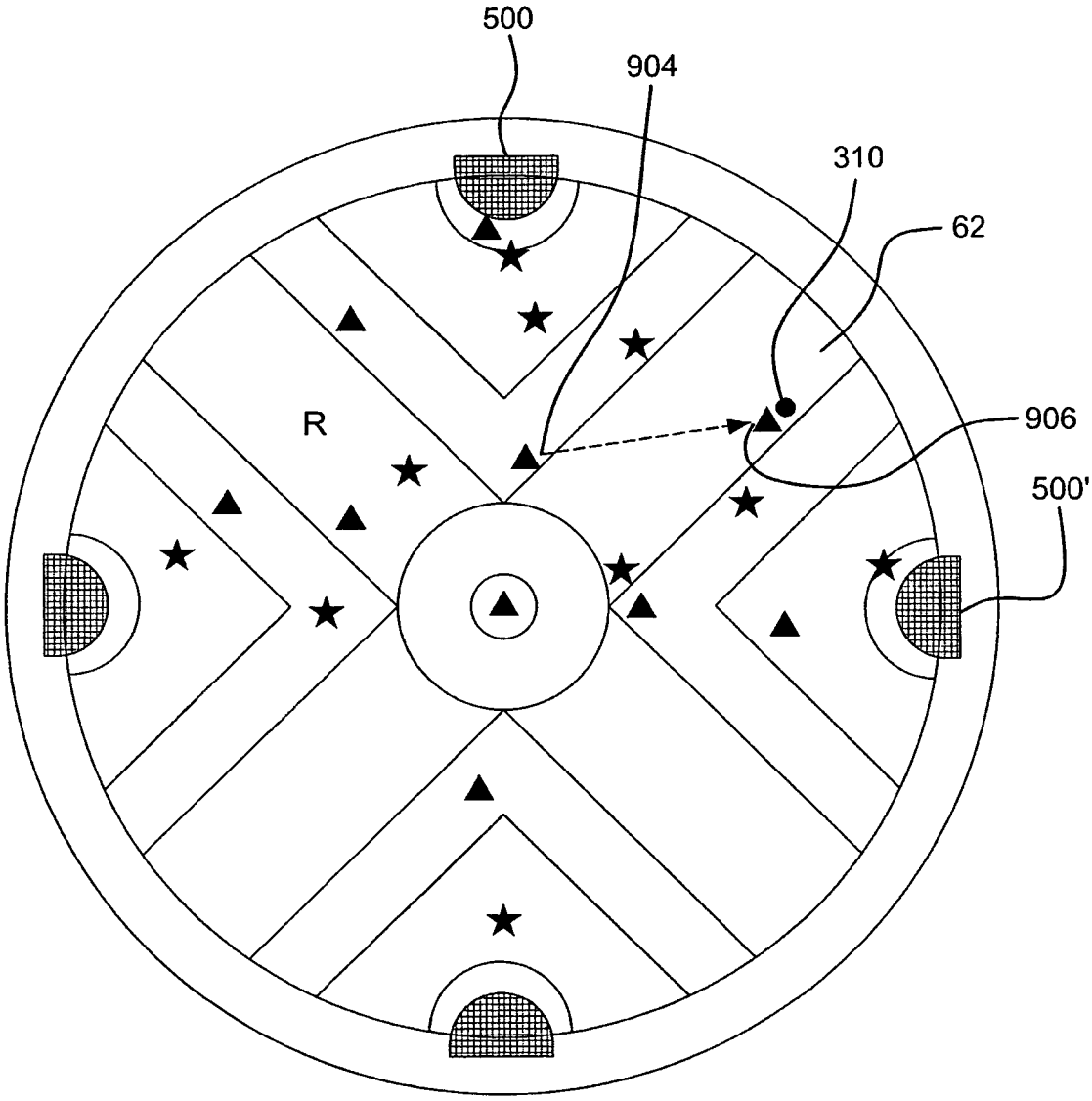
FIG. 76 shows an alternative embodiment of a team player passing a ball to another team player.

Referring now to FIG. 76, the player from Team B on offense decides that there are too many defensive players from Team A defending near goal 500 so he turns for more scoring options. The player from Team B sees an open teammate cutting through cross zone 62 towards distant goal 500' and throws 904 ball 310 to the open teammate. The open teammate catches 906 ball 310 and turns to goal 500' to attempt to shoot or pass ball 310.

Figure 77A:
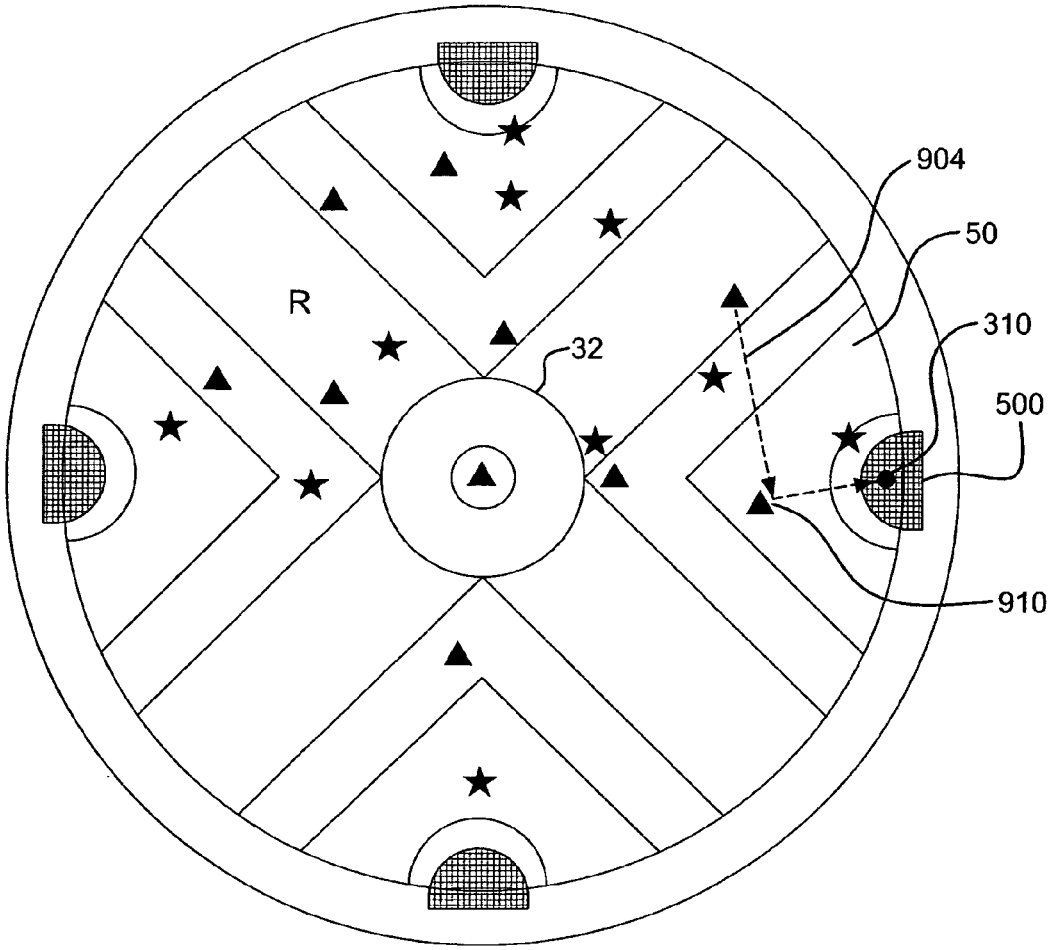
FIGS. 77*a* and 77*b* show an alternative embodiment of a team's pass, shot, and score of a ball in a goal.
Figure 77B:
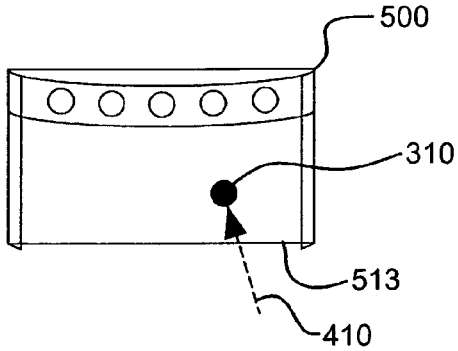

Referring now to FIG. 77*a*, a player from Team B, on offense, throws 904 ball 310 low so that the receiving player on Team B may play ball 310 with his feet. The receiving player kicks 910 ball 310 at goal 500 and scores, as shown in FIG. 77*b*. Referee R signals the score. Team A must then clear ball inside second ring 32 before going on offense. Team B may not challenge the clear following the score and must evacuate the area in second ring 32.

Figure 78:
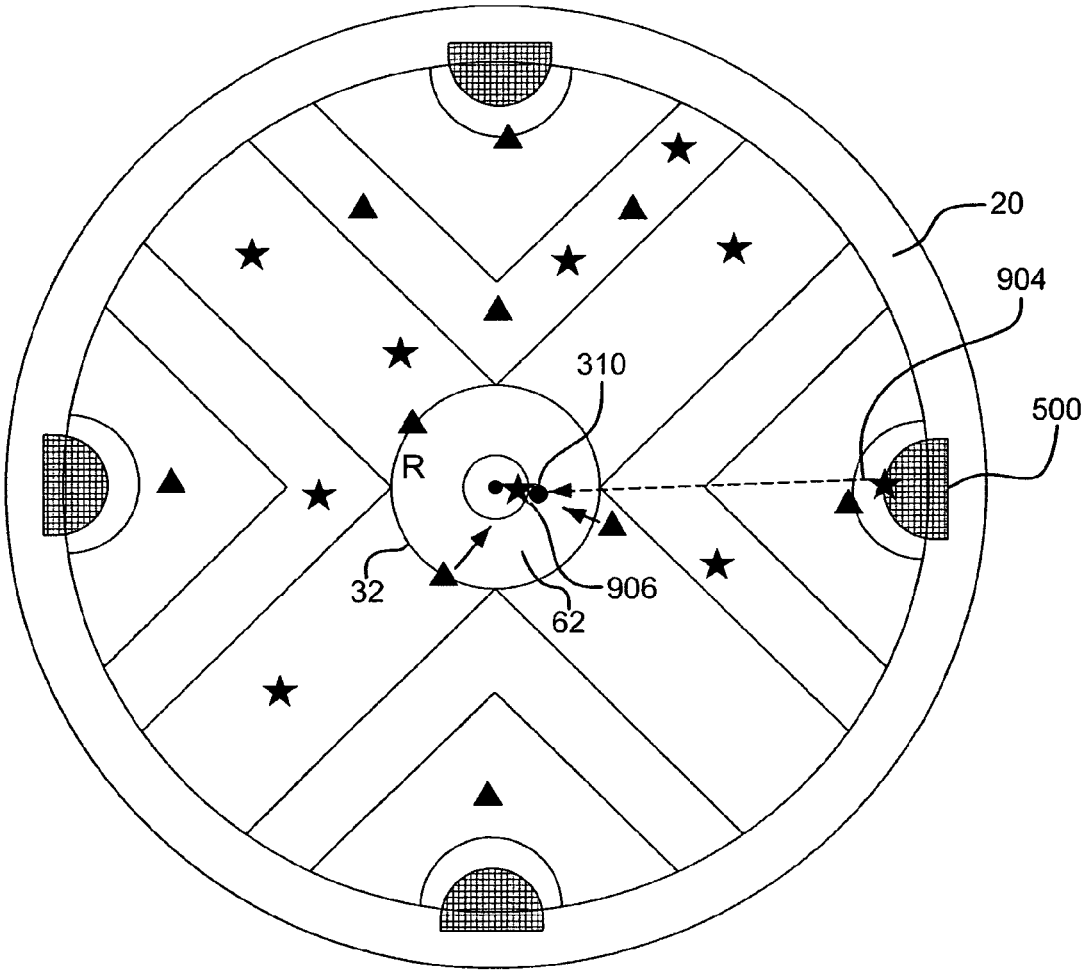
FIG. 78 shows an alternative embodiment of a free clear of a ball to another team play within second ring area.

Referring now to FIG. 78, a player from Team A collects ball 310 from goal 500. All players tactically reposition themselves on playing surface 20. The player throws 904 ball 310 from goal 500 to a teammate inside second ring 32 and in cross zone 62 to complete a free clear. Team B immediately presses on defense.

Figure 79:
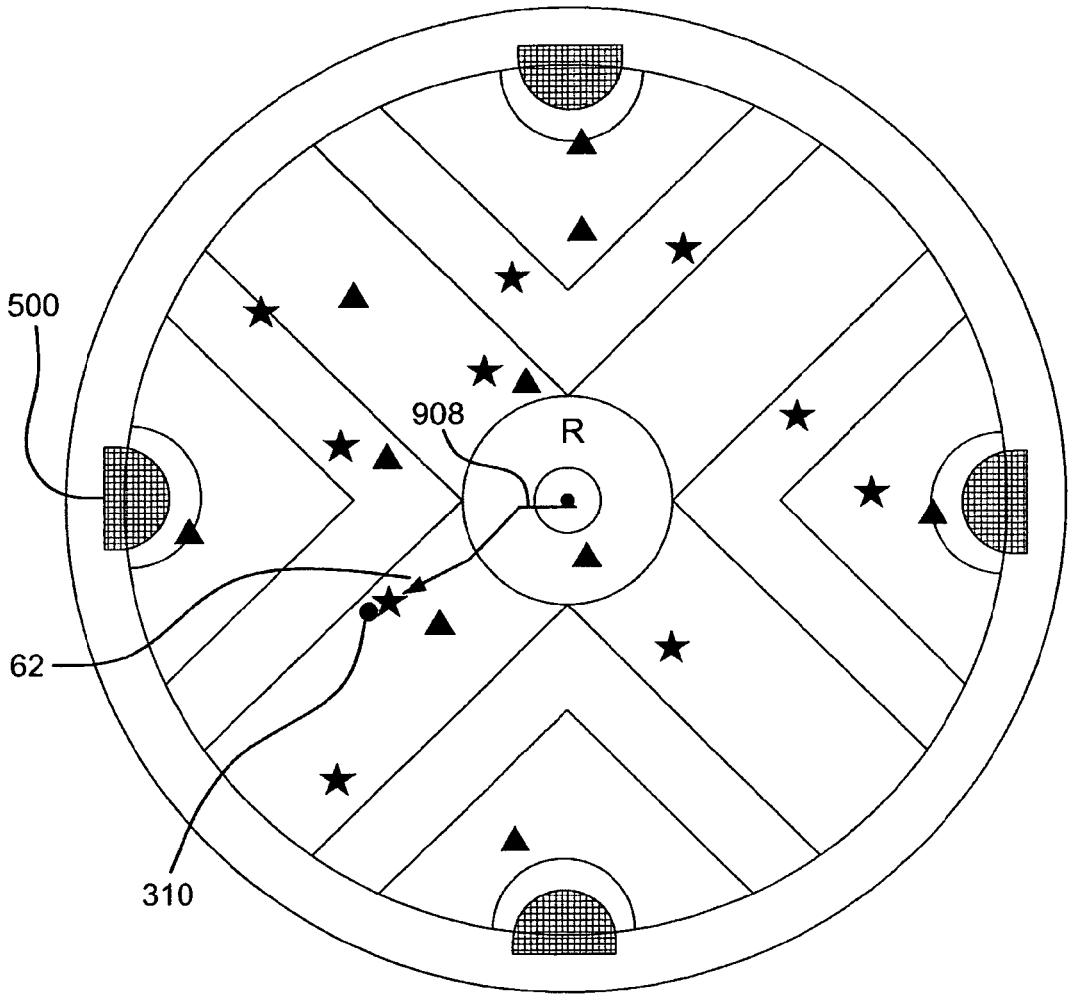
FIG. 79 shows an alternative embodiment of advancing a ball by dribbling.

Referring now to FIG. 79, a player from Team A with ball 310 dribbles 908 ball 310 with his feet and drives toward goal 500, away from Team B defensive pressure and into an open area in cross zone 62. Other Team A players move into attacking positions near goal 500. Team B moves to cover and defend.

Figure 80:
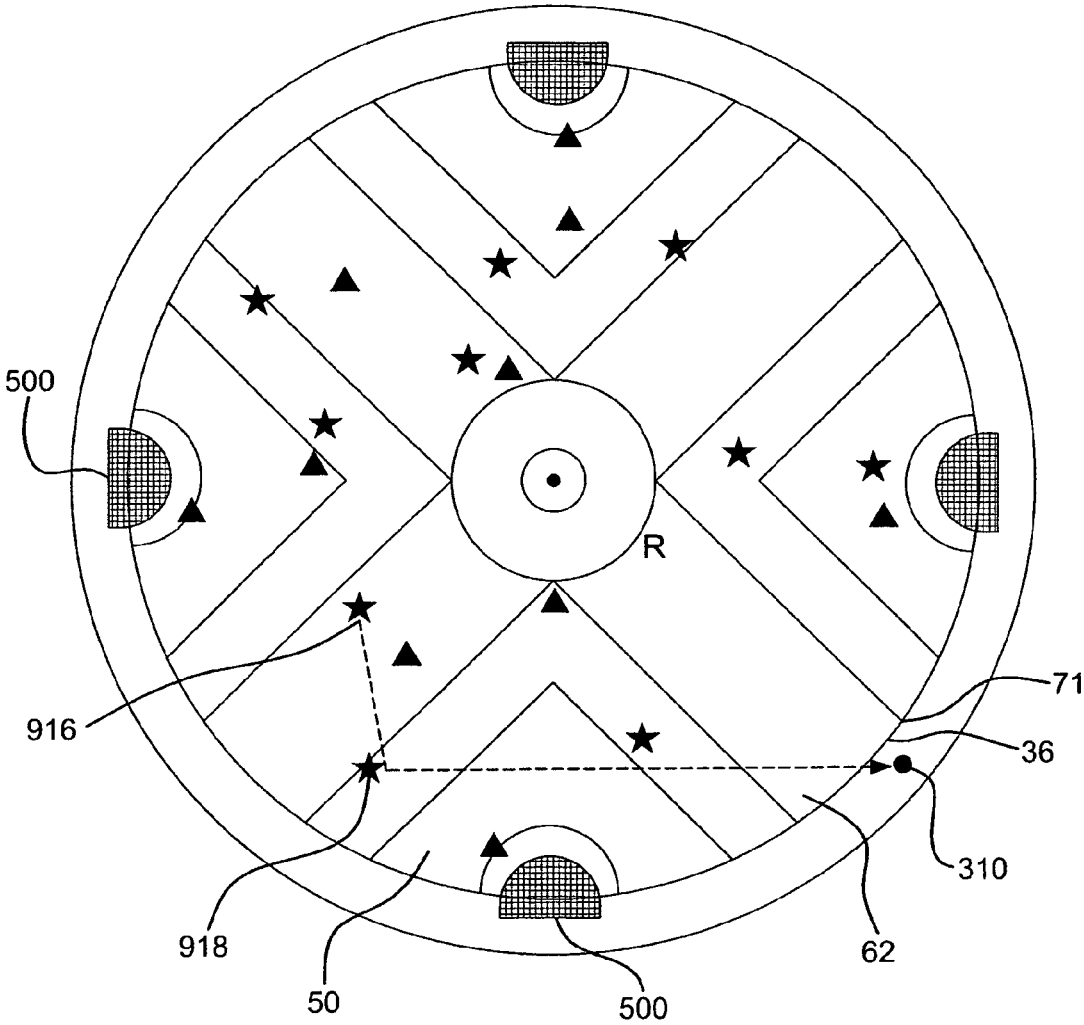
FIG. 80 shows an alternative embodiment of two passes between players of the same team that results in an out-of-bounds.

Referring now to FIG. 80, a player from Team A decides to shift the attack and passes 916 ball 310 to a teammate closer to another goal 500. The pass is low and too far ahead of the receiving teammate to play ball 310 cleanly and kick/deflects 918 ball 310 to another teammate moving toward wedge zone 50. The pass misses its mark and goes out-of-bounds from cross zone 62. Referee R signals out-of-bounds, triggering a change of possession. Team B is awarded a throw-in by Referee R. The throw-in is spotted at flex zone corner point 71 near to where ball 310 passed over boundary ring 36.

Referring now to FIG. 81, a player from Team B retrieves ball 310 and proceeds to nearest flex zone corner point 71 where ball 310 passes over boundary ring 36 and sets up for a throw-in. Team B is now on offense and does not need to clear ball 310 since the turnover occurred on an out-of-bounds. Team B may not score directly from throw-in. Team A players must remain distance Q, which may be about 2 yards, away from flex zone corner point 71.

Referring now to FIG. 82, a player from Team B takes a throw-in and directs ball 310 to teammate in flex zone 56 on the far side of goal 500. The playing receiving 914 ball 310 traps ball 310 and then kicks 910 ball 310 toward goal 500. The shot misses and ball 310 passes out-of-bounds from wedge zone 50. Referee R signals an out-of-bounds. This triggers a change of possession, and Team A is awarded a throw-in. The throw-in is spotted at the nearest wedge zone corner point 73 where ball 310 passed over boundary ring 36.

Referring now to FIG. 83, a player from Team A prepares to take a throw-in at wedge zone corner point 73 where ball 310 passed over boundary ring 36. Team A does not need to clear ball 310 since the turn over occurred on an out-of-bounds. Team A may not score directly from the throw-in. Team B must remain a minimum distance T, which may be 2 yards, from the point at which the throw-in is taken.

Referring now to FIG. 84, a player from Team A takes the throw-in and throws 904 ball 310 to nearby teammate in cross zone 62. The Team A player catches 906 ball 310 and throws 904 ball 310 to another teammate in flex zone 56 near goal 500. The Team A player in flex zone 56 catches 906 ball 310. Team B players move to challenge and defend.

Figure 85A:
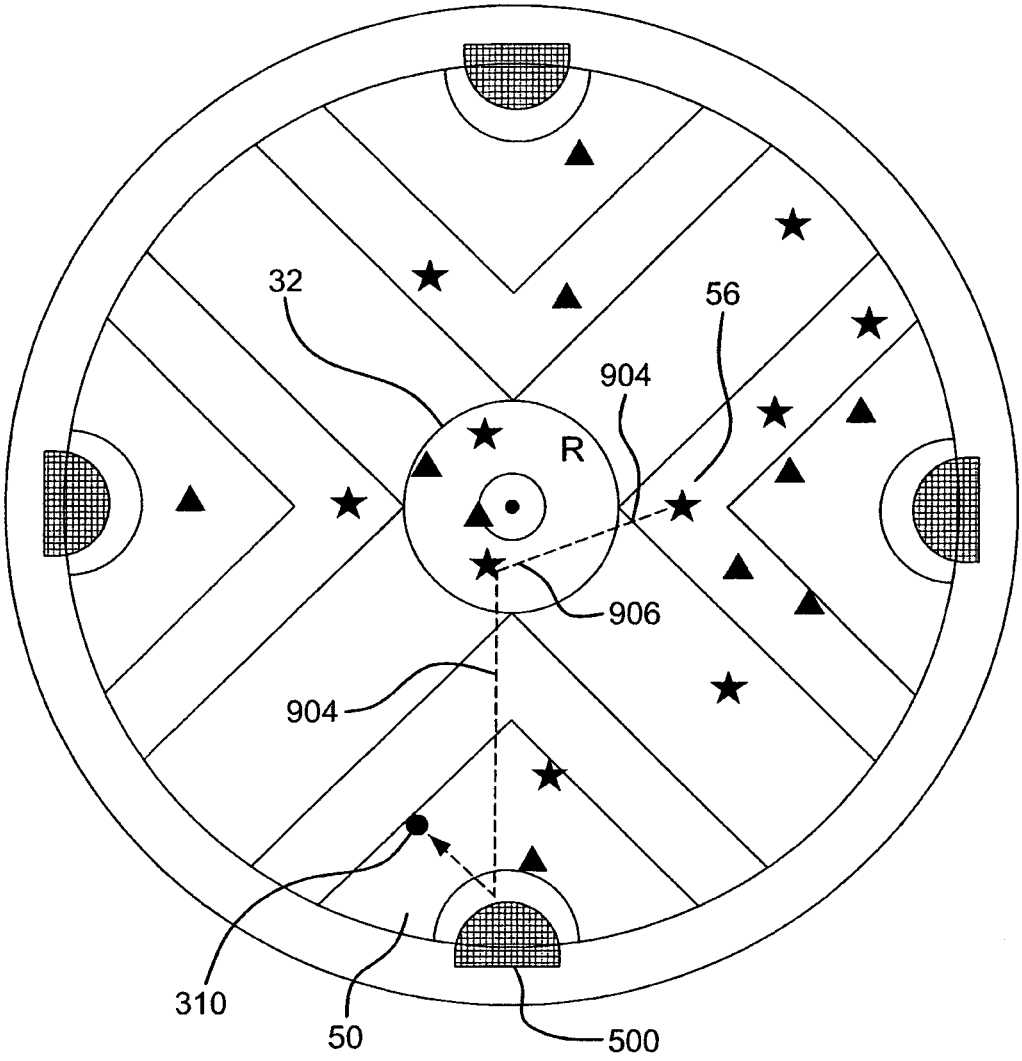
FIGS. 85*a* and 85*b* show an alternative embodiment of a pass, a shot, and a rebound of a ball off of a Crown of a goal.
Figure 85B:
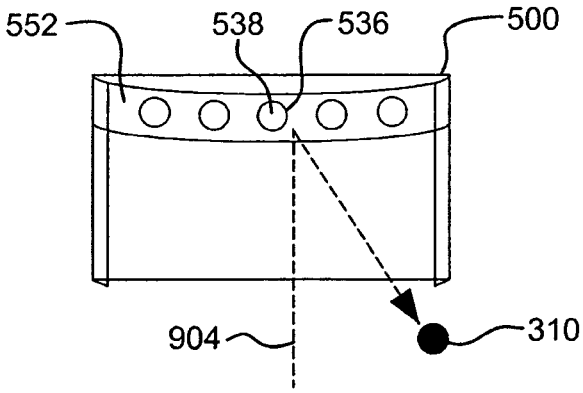

Referring now to FIG. 85*a*, a player from Team A in flex zone 56 throws 904 ball 310 to an open teammate in second ring 32 that may have an option for a long shot or a drive toward another goal 500. The Team A player catches 906 ball 310, takes a dribble, and then throws 904 ball 310 at goal 500 attempting to score through circular open ring 536. A Team B player moves to block the shot and cannot reach it. The shot is off target, and ball 310 rebounds of off Crown 552, as shown in FIG. 85*b*, and rolls into wedge zone 50. Nearby Team A and Team B players race to retrieve the loose ball 310.

Figure 86:
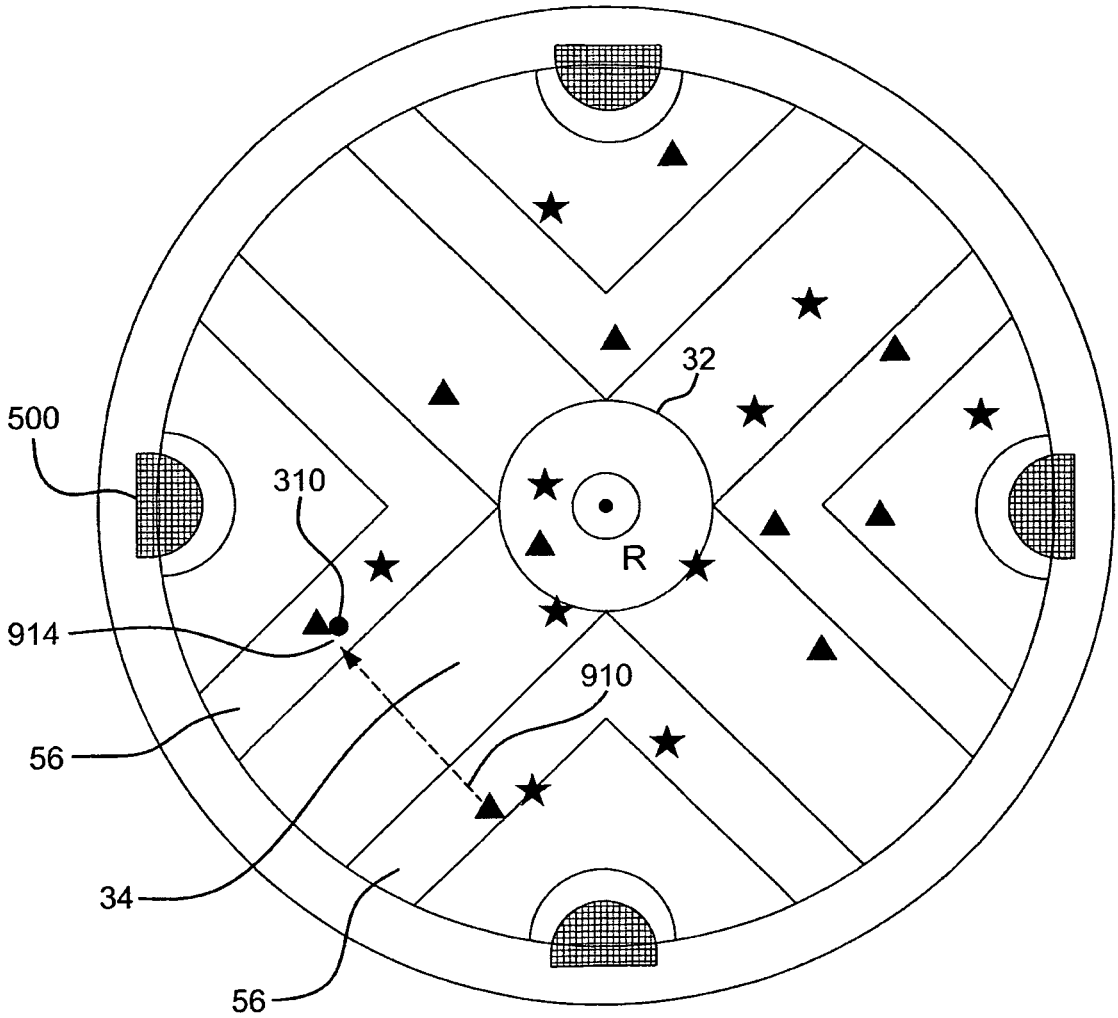
FIG. 86 shows an alternative embodiment of a recovery and a pass of a ball.

Referring now to FIG. 86, a player from Team B reaches ball 310 and plays ball 310 with his foot in flex zone 56. Team B is now in control of ball 310, but must clear ball 310 to inside second ring 32 to complete a change of possession. The Team B player with ball 310 is pressed by a player from Team A, who attempts to steal ball 310. The player from Team B kicks 910 ball 310 to a teammate inside an adjacent flex zone 56. The near goal 500 is open, but Team B must clear ball 310 before shooting. The player from Team B receiving ball 310 receives 914 ball 310 with his foot and scans from a teammate inside second ring 32.

Figure 87:
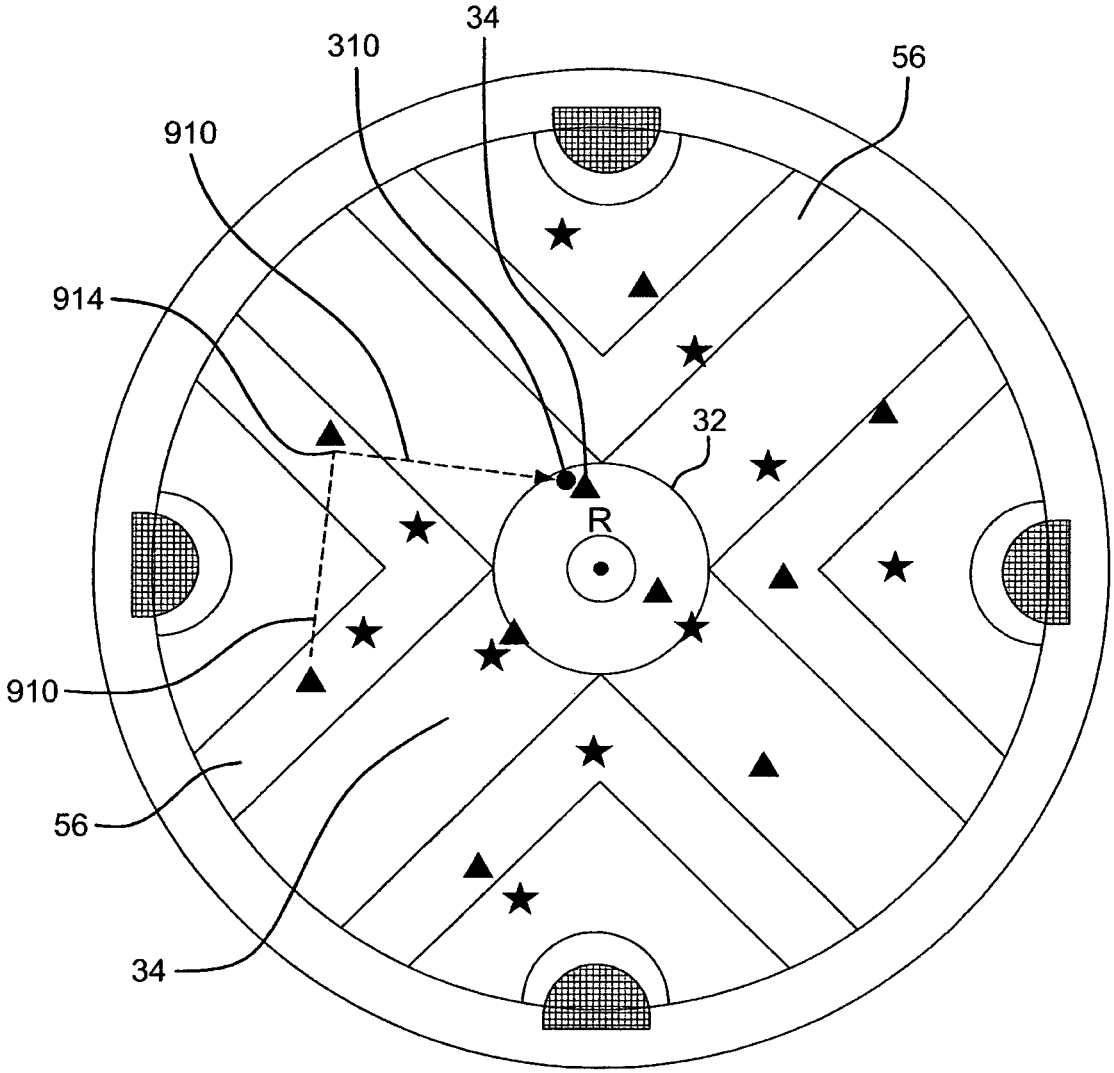
FIG. 87 shows an alternative embodiment of a pass and a second ring clearance of a ball.

Referring now to FIG. 87, a player from Team B with ball 310 inside flex zone 56 is facing defensive pressure and kicks 910 ball 310 to an open teammate also in flex zone 56. The player from Team B receives 914 ball 310 with his foot and kicks 910 ball 310 to an open teammate inside second ring 32, completing the clear.

Figure 88A:
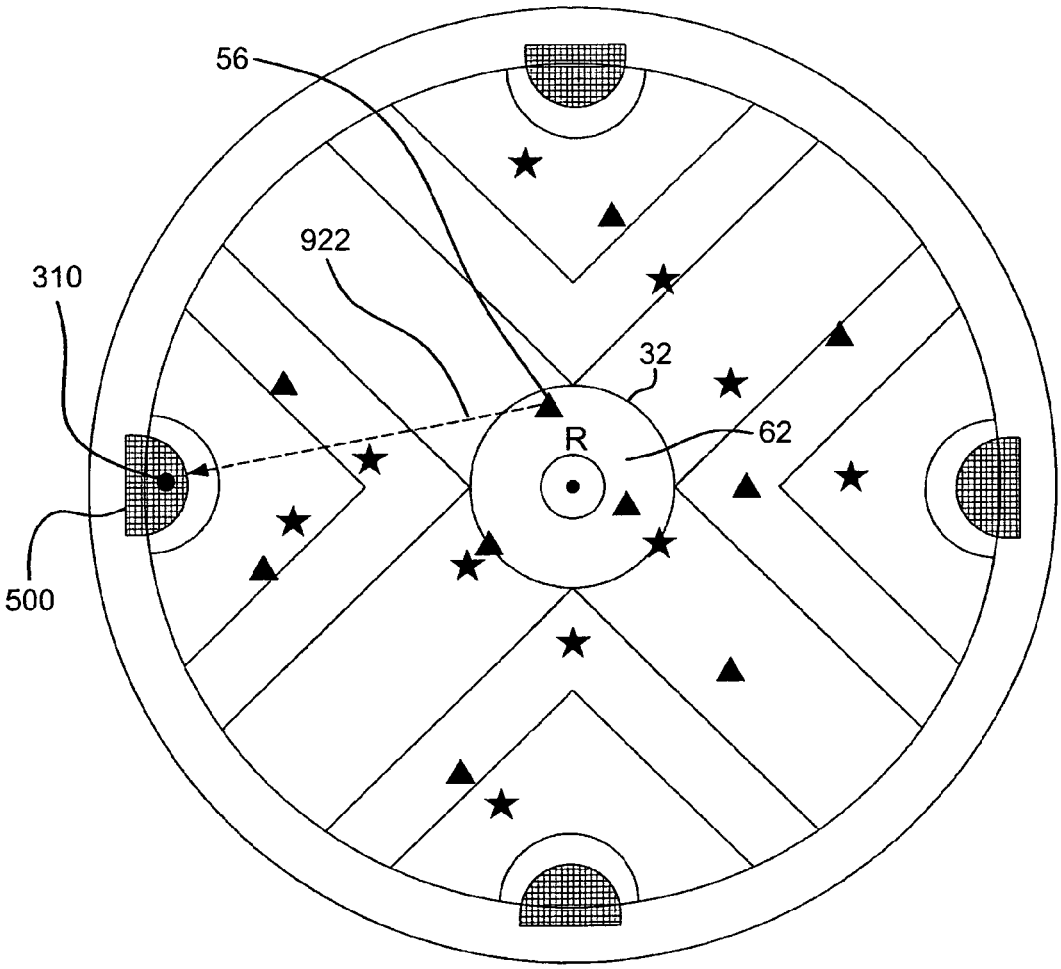
FIGS. 88*a* and 88*b* show an alternative embodiment of a distant shot and a score of a ball in a goal.
Figure 88B:
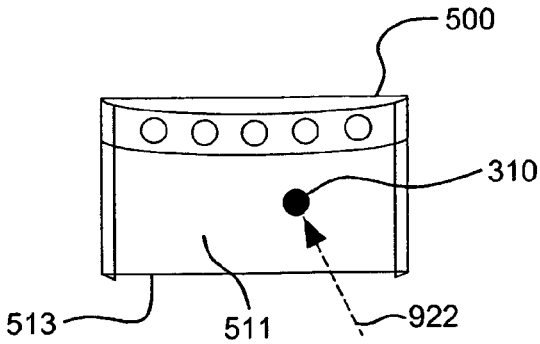

Referring now to FIG. 88*a*, a player from Team B receiving ball 310 inside second ring 32 takes a kick-shot 922 at open goal 500. The shot passes into chamber 511, as shown in FIG. 88*b*. Referee R signals the score. The score triggers a free clear and a change of possession. Team A must clear ball 310 inside second ring 32 before advancing ball 310 on offense. Team B may not challenge the clear attempt following the score. Team B must also evacuate from inside second ring 32.

Figure 89:
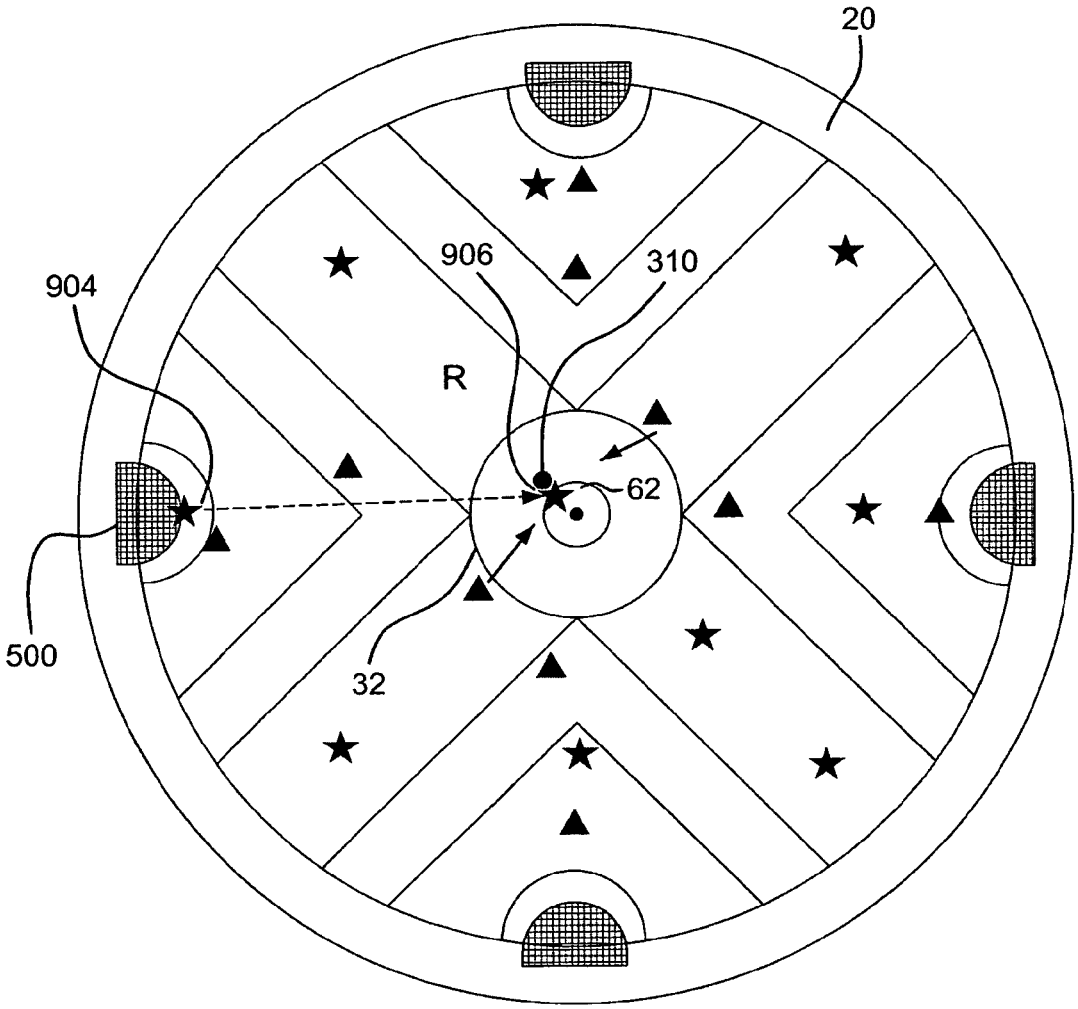
FIG. 89 shows an alternative embodiment of a second ring clearance of a ball.

Referring now to FIG. 89, a player from Team A collects ball 310 from goal 500. Players from both teams reposition themselves on playing surface 20. The player throws 904 ball 310 to a teammate on Team A, who catches 906 ball 310 inside second ring 32 in cross zone 62. Team B immediately presses on defense.

Figure 90:
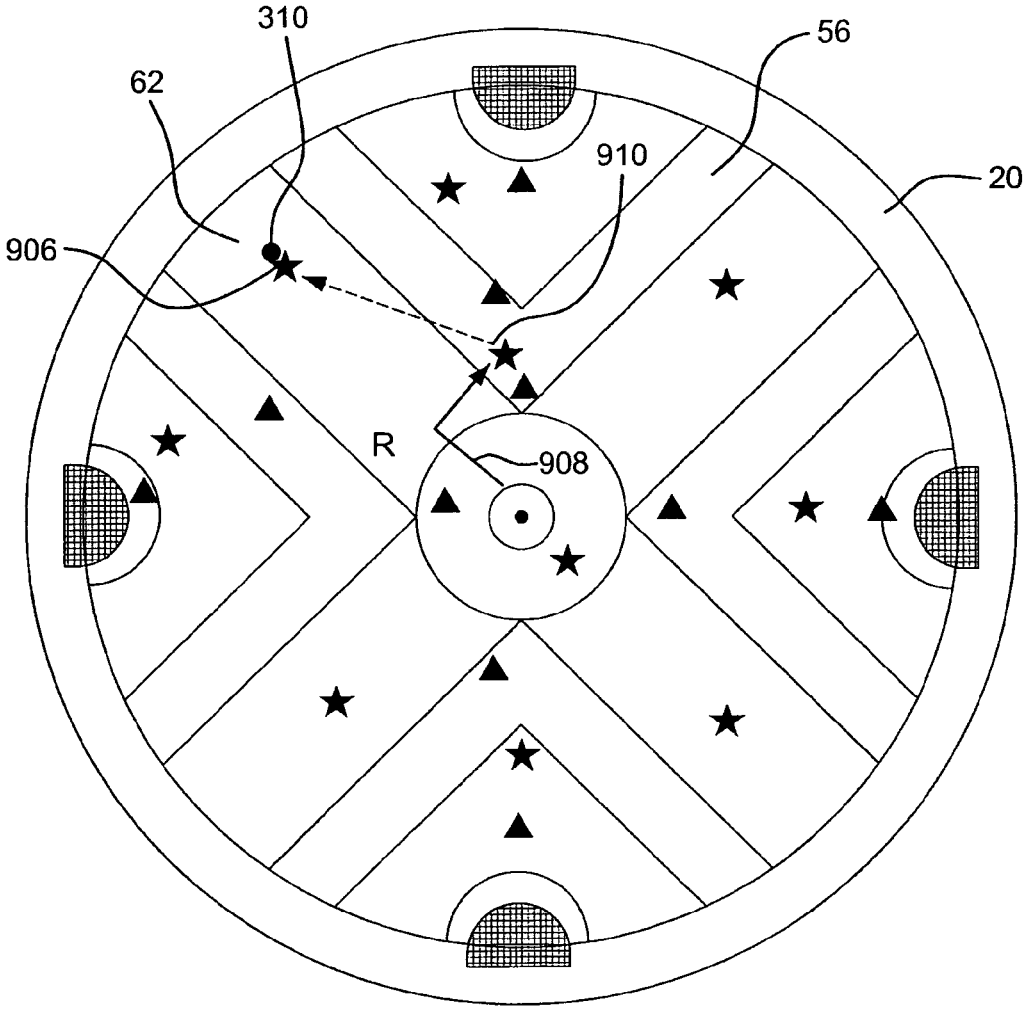
FIG. 90 shows an embodiment of a dribble and a pass of a ball.

Referring now to FIG. 90, a player from Team A dribbles 908 ball 310 into flex zone 56, where he transitions ball 310 from his hands to his feet and kicks 910 ball 310 to teammate in cross zone 62. The Team A player in cross zone 62 catches 906 ball 310 and surveys playing surface 20 for players.

Figure 91:
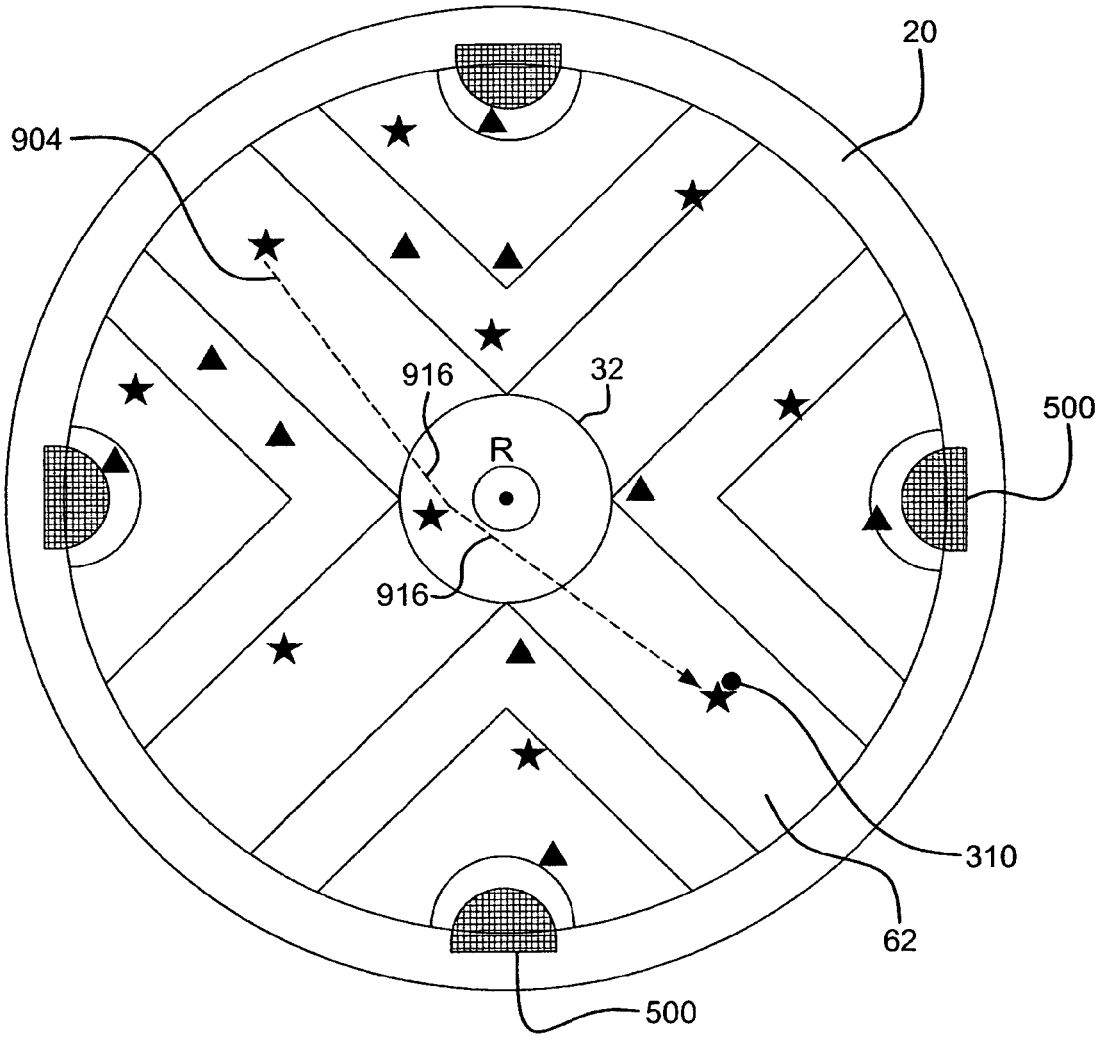
FIG. 91 shows an alternative embodiment of two sequential passes of a ball between team members.

Referring now to FIG. 91, a player from Team A with ball 310 throws 904 ball 310 to a teammate inside second ring 32. The teammate swings passes 916 ball 310 to another teammate in cross zone 62 on the opposite side of playing surface 20.

Figure 92A:
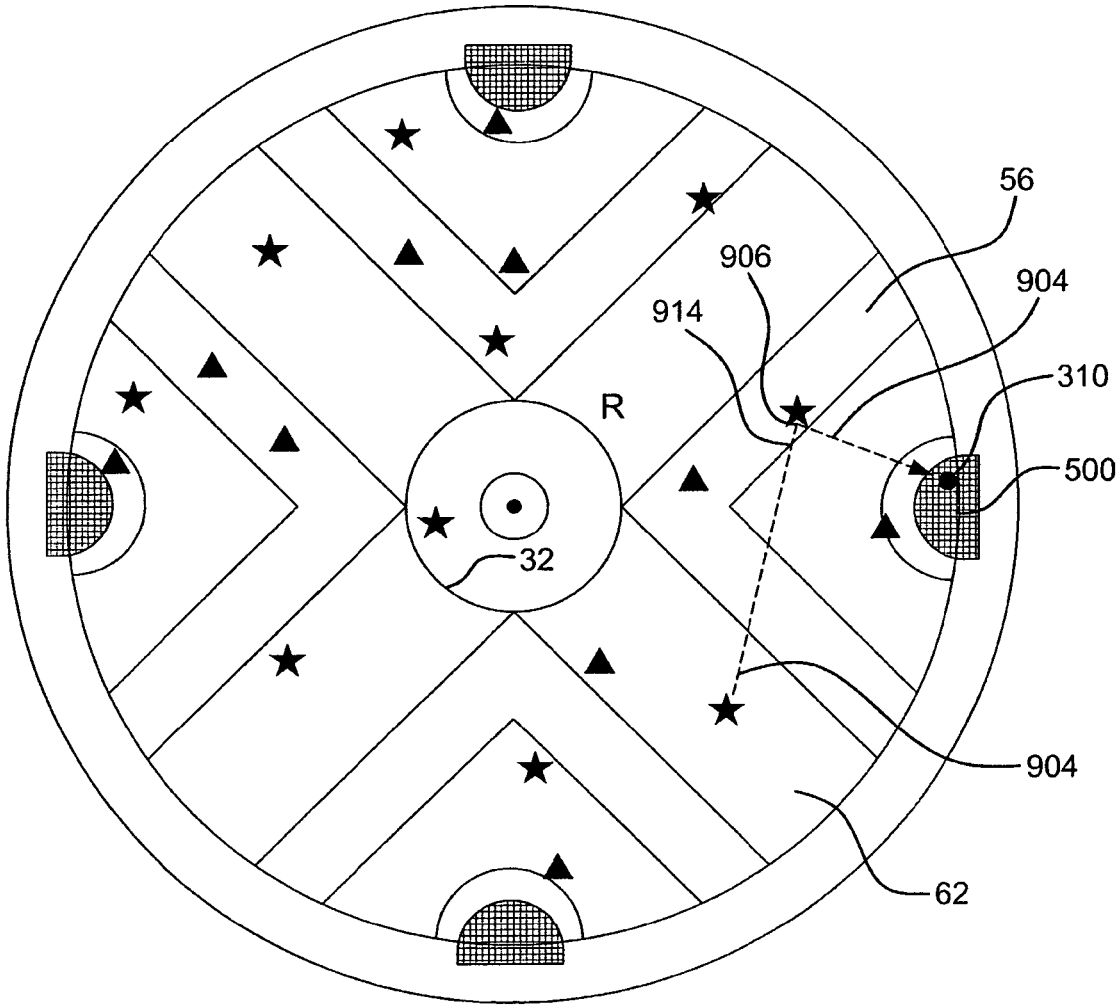
FIGS. 92*a* and 92*b* show an alternative embodiment of a pass, a shot, and a score with a ball through an opening of a circular ring structure of a goal.
Figure 92B:
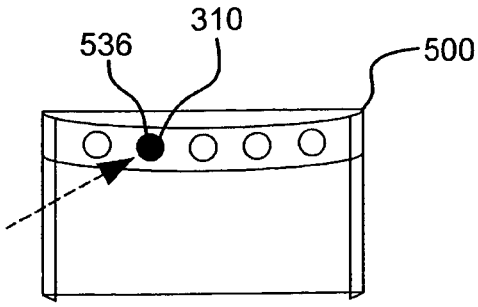

Referring now to FIG. 92*a*, a player from Team A with ball 310 in cross zone 62 throws 904 ball 310 to an open teammate in the opposite side of flex zone 56. The Team A player receiving 914 ball 310 catches 906 ball 310 and then throws 904 ball 310 at goal 500. A Team B player defending goal 500 does not have time to move and block the shot. The shot is on target and passes through opening 536 of circular open ring 538 for a score as shown in FIG. 92*b*. Referee R signals a score. The score triggers a change of possession. Team B must clear ball 310 inside second ring 32 before scoring. Team A may not challenge the clear attempt following a score. Team A must also evacuate from within second ring 32.

Figure 93:
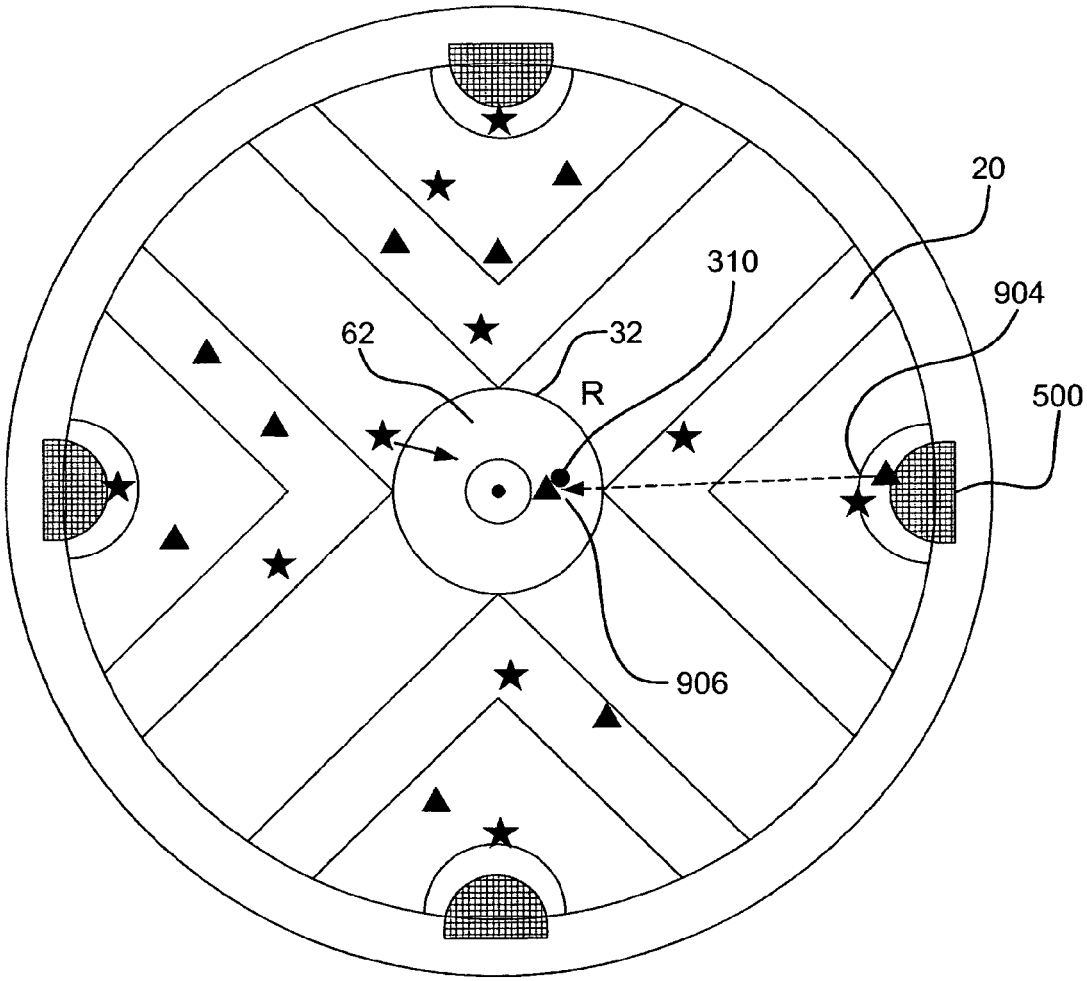
FIG. 93 shows an alternative embodiment of second ring clearance of a ball.

Referring now to FIG. 93, a player from Team B collects ball 310 from goal 500. Players from both teams tactically reposition themselves on playing surface 20. The player throws 904 ball 310 to a teammate, who catches 906 ball 310 inside second ring 32 in cross zone 62 to complete a free clear. Team A presses on defense.

Figure 94:
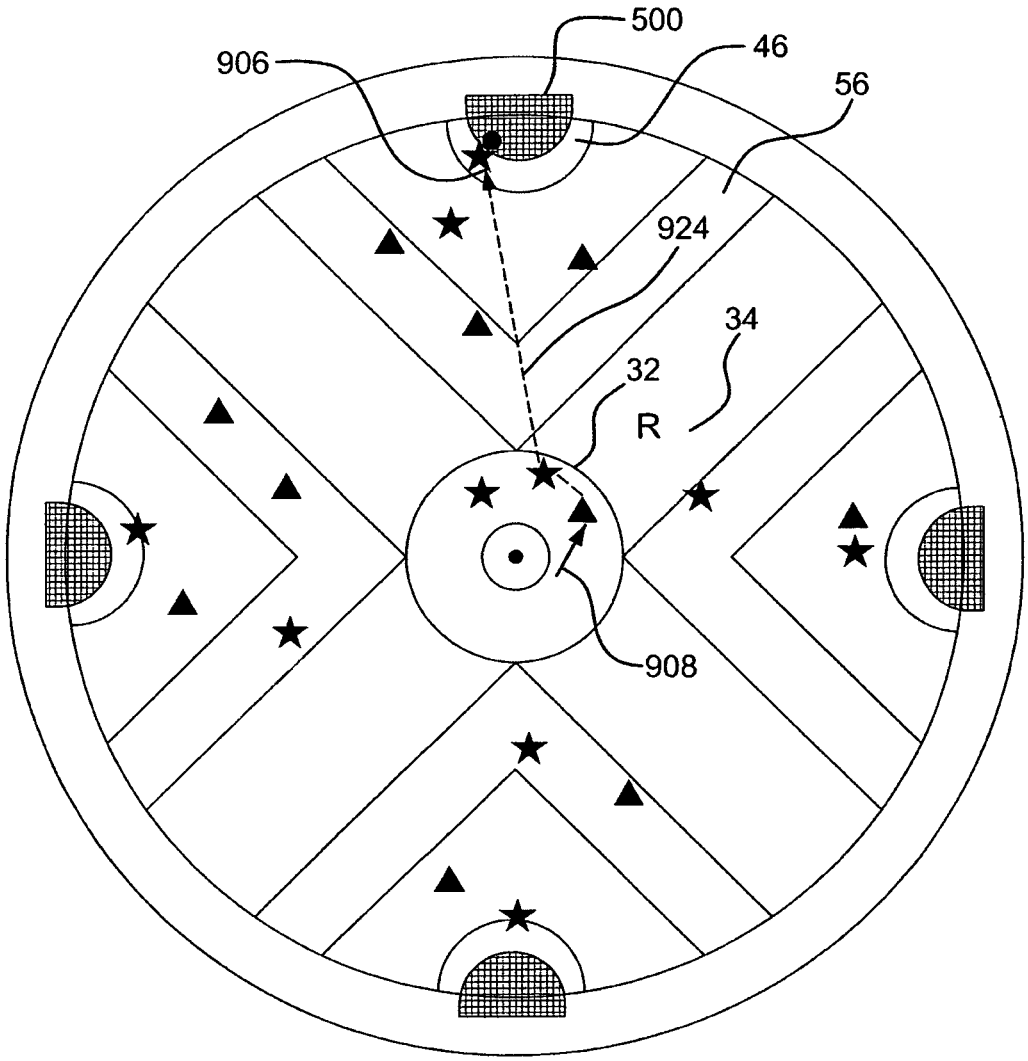
FIG. 94 shows an alternative embodiment of a dribble, a turnover, a kick, a dunk, and a score with a ball in a goal.

Referring now to FIG. 94, a player from Team B with ball 310 dribbles 908 ball 310 in the direction of goal 500 and three teammates. The player mishandles ball 310 and ball 310 bounces away from the player to a defending Team A player. The Team A player inside second ring 32 shoots 924 ball 310 at goal 500. The shot is wide left and high. Another Team A player in the goal zone 46 jumps, catches 906 ball 310, and dunks ball 310 through opening 536 of circular open ring 538. Referee R signals the score.

Figure 95:
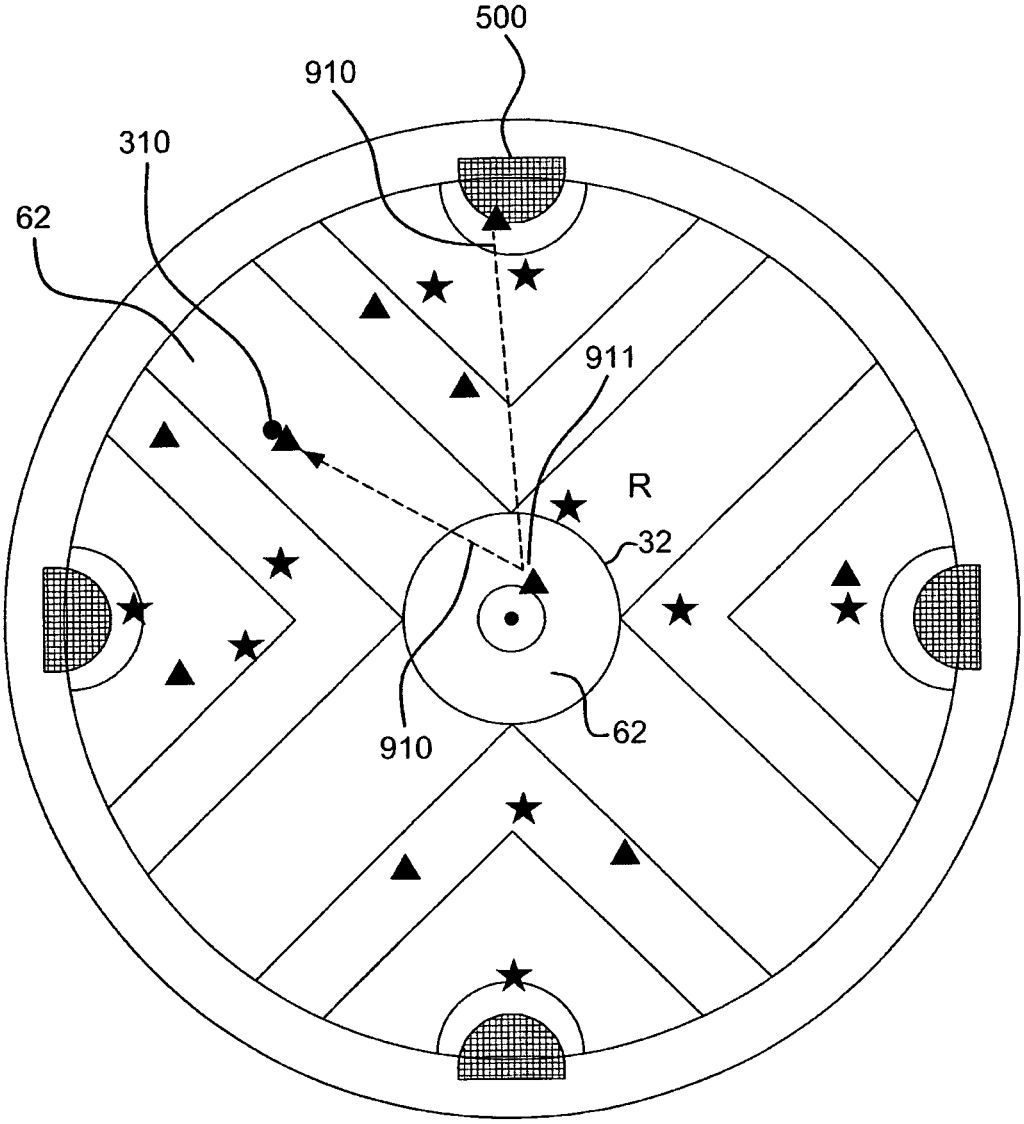
FIG. 95 shows an alternative embodiment of a second ring clearance and a pass of a ball.

Referring now to FIG. 95, a player from Team B collects ball 310 from goal 500. Players from both teams tactically reposition themselves on playing surface 20. The Team B payer kicks 910 ball 310 from goal 500 to a teammate who traps 911 ball 310 with his foot inside second ring 32 in cross zone 62 to complete a free clear. Team B is now on offense. The Team B player kicks 910 ball 310 to another teammate in cross zone 62.

Figure 96:
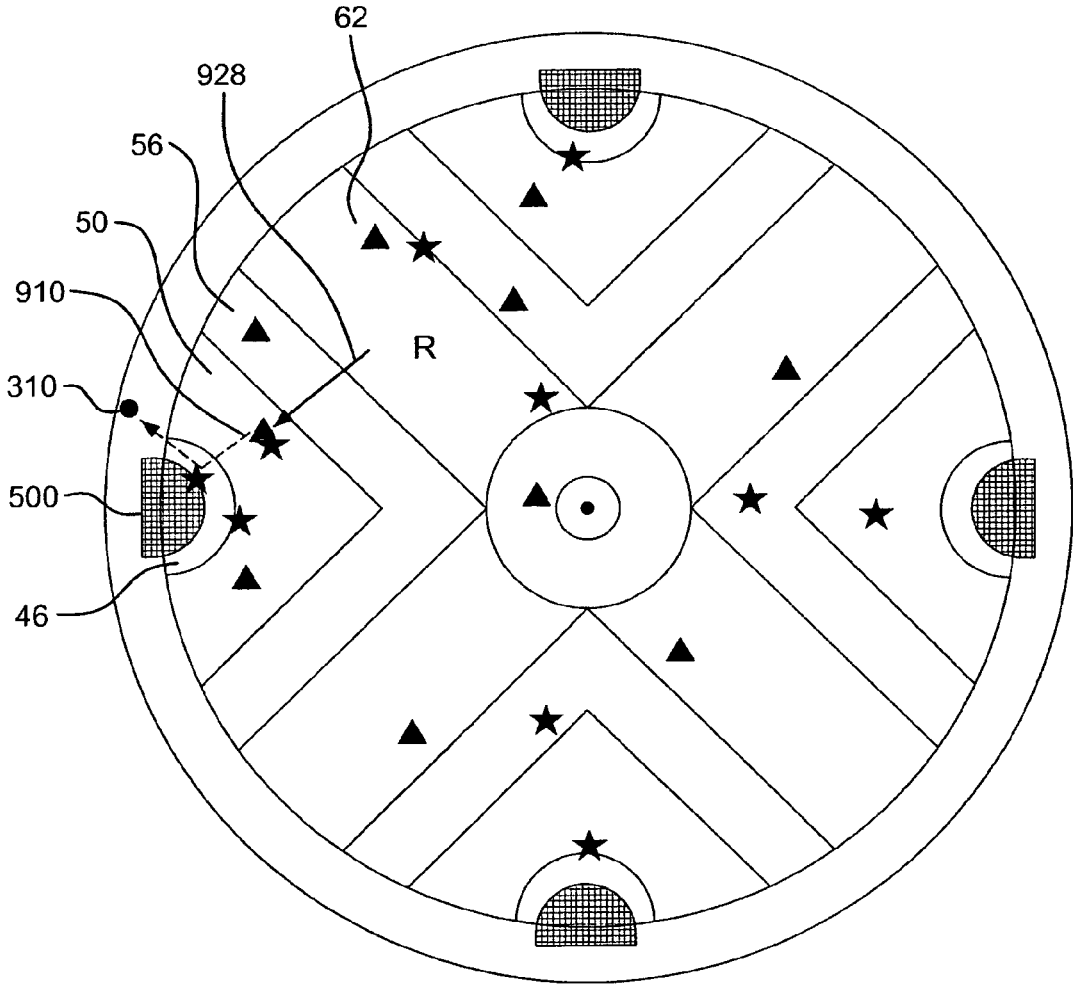
FIG. 96 shows an alternative embodiment of a dribble, a transition, a shot, and a foul.

Referring now to FIG. 96, a player from Team B flips ball 310 from cross zone 62 over flex zone to wedge zone 50. The player from Team B plays ball 310 with his feet driving into wedge zone 50. Team A players react—one takes a defensive position in goal zone 46, another challenges driving player from Team B knocking him down as he kicks 910 ball 310 at goal 500. Referee R signals a foul on the player from Team A. The Team B player in goal zone 46 deflects shot wide and ball 310 goes out-of-bounds.

Figure 101:
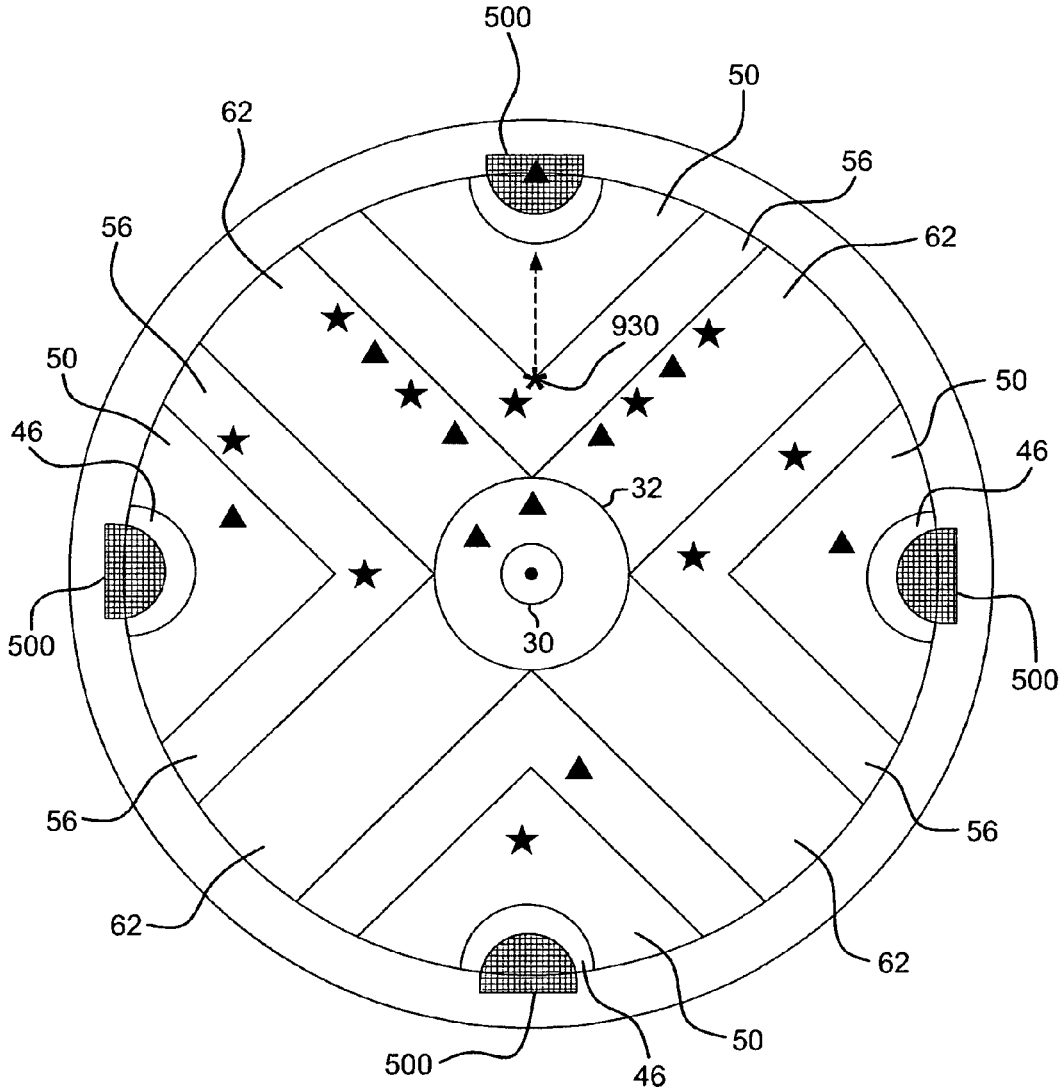
FIG. 101 shows an embodiment of a penalty kick.

Referring now to FIG. 101, Referee R awards fouled Team B player with a penalty shot from wedge zone point closest to the spot of the foul. Referee R places ball 310 on wedge zone point. Non-participating players must position themselves outside of flex zone 50. Team A player defender begins on goal spot and comes out to defend as Team B player makes his approach on ball 310. The Team B player kicks 930 penalty shot and scores ball 310 in chamber of goal 500. Referee R signals the score.

Figure 97:
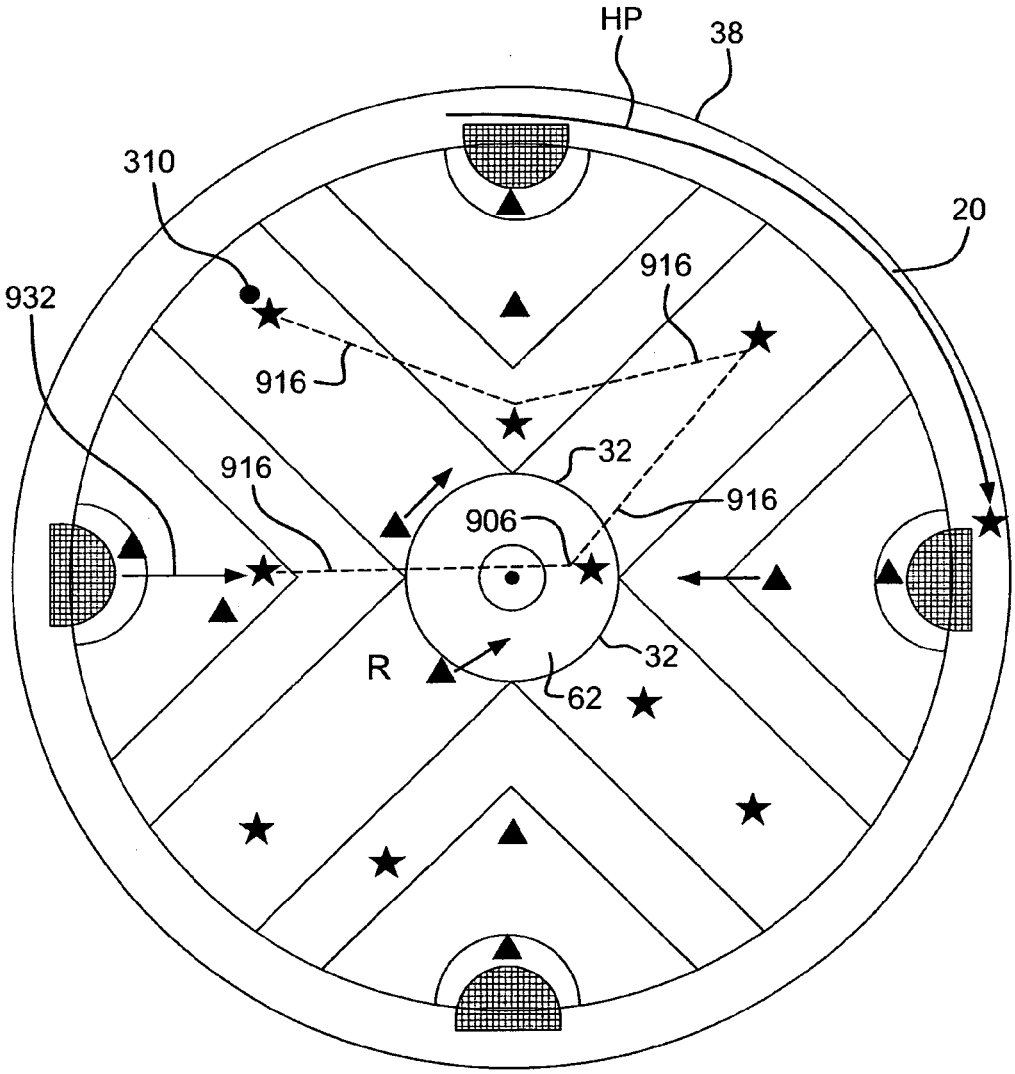
FIG. 97 shows an alternative embodiment of a second ring clearance and a sequence of passes of a ball.

Referring now to FIG. 97, the previous score on the penalty kick triggers a change of possession. Team A must clear ball 310 before attempting to shoot ball 310. Team B must evacuate from within second ring 32. A player from Team A collects ball 310 from goal 500 and passes 916 ball 310 to a teammate inside of second ring 32 in cross zone 62 to complete the free clear. Team B presses Team A player on defense. Team B passes 916 ball 310 around from player to player looking for a goal scoring opportunity.

Referring now to FIG. 98, alternative embodiments of throw-ins for a ball going out-of bounds from cross zone 62 are shown. Ball 310 would be placed at the nearest flex zone corner point 71 from a throw-in.

Referring now to FIG. 99, alternative embodiments of throw-ins for a ball going out-of-bounds from a goal zone, wedge zone, or flex zone are shown. Ball 310 would be placed at the nearest wedge zone corner point 73 from a throw-in.

The disclosure herein is directed to certain features of the elements and methods of the invention disclosed as well as others that will be apparent to those skilled in the art in light of the disclosure herein. Thus, it is intended that the present invention covers all such modifications and variations of this invention and the equivalents thereof.

I claim:

1. A method for at least two teams to play a game with a ball, the method comprising, starting the game by placing a ball in play on a playing surface comprising a plurality of zones relative to a goal, wherein each of the plurality of zones have distinct rules for handling the ball, wherein the playing surface has at least two goals each having two distinctly defined scoring zones comprising at least one substantially vertically configured open ring having an opening wherein said open ring is positioned between two horizontally configured support posts and an arced rectangular-shaped opening positioned below the two horizontally-configured support posts;

contacting the ball within at least one of the plurality of zones using the distinct rules for handling the ball;

scoring the ball by passing it through a scoring zone of the goal;

calculating points based on passage of the ball through a scoring zone of the goal;

recording the points scored during the game using scoreboard equipment; and keeping time for the game using clock equipment.

2. The method of claim 1, wherein contacting the ball comprises any one or more of the players passing, receiving, controlling, redirecting, or shooting the ball.

3. The method of claim 2, wherein contacting the ball may occur in any one of the plurality of zones.

4. The method of claim 2, wherein the plurality of zones related to a goal comprise, a cross zone, a flex zone, a wedge zone, and a goal zone.

5. The method of claim 4, wherein the distinct rules for handling the ball in the cross zone comprise playing the ball with any body part of a player.

6. The method of claim 4, wherein the distinct rules for handling the ball in the flex zone comprise playing the ball with any body part of a player.

7. The method of claim 4, wherein the distinct rules for handling the ball in the wedge zone comprise playing the ball with any body part of a player except arms and hands.

8. The method of claim 4, wherein the distinct rules for handling the ball in the goal zone comprise playing the ball with any body part of a player.

9. The method of claim 1, the method further comprising the step of awarding points comprising assigning different points for any one of throwing the ball through an opening of an open ring, kicking the ball through an opening of an open ring, throwing ball through the arced rectangularly-shaped opening, and kicking ball through the arced rectangularly-shaped opening.

10. The method of claim 9, wherein the awarding of points depends on a location of a shot of a ball in relation to a near goal or a distant goal.

11. The method of claim 9, the method comprising a further step of stopping play for a ball traveling outside of a peripheral boundary of the playing surface or for a foul.

12. The method of claim 11, the method comprising the further step of restarting play by a throw-in or a kick-in.

13. The method of claim 1, wherein the teams comprise a base number of players on the playing surface.

14. The method of claim 13, wherein the base number of players is 10.

15. The method of claim 9, the method comprising the further step of completing play of the game in at least one timed period.

16. The method of claim 15, wherein the at least one timed period comprises a range of about 20 minutes to about 30 minutes.

17. The method of claim 15, wherein three timed periods are provided.

18. The method claim 15, wherein the method comprises the further step of awarding a win to the team having the greatest number of points at an end of a game.

* * * * *